US012660880B2

(12) United States Patent
Lyden

(10) Patent No.: US 12,660,880 B2
(45) **Date of Patent: *Jun. 23, 2026**

(54) ARTICLE OF FOOTWEAR, METHOD OF MAKING THE SAME, AND METHOD OF CONDUCTING RETAIL AND INTERNET BUSINESS

(71) Applicant: Robert Lyden, Ashland, OR (US)

(72) Inventor: Robert Lyden, Ashland, OR (US)

(73) Assignee: Robert Lyden, St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/605,495

(22) Filed: Mar. 14, 2024

(65) Prior Publication Data

US 2024/0215678 A1 Jul. 4, 2024

Related U.S. Application Data

(63) Continuation-in-part of application No. 17/530,172, filed on Nov. 18, 2021, now Pat. No. 12,178,288, which is a continuation-in-part of application No. 16/820,254, filed on Mar. 16, 2020, now Pat. No. 11,399,591.

(51) Int. Cl.

| | |
|---|---|
| ***A43B 13/14*** | (2006.01) |
| ***A43B 1/00*** | (2006.01) |
| ***A43B 3/24*** | (2006.01) |
| ***A43B 9/00*** | (2006.01) |
| ***A43B 13/18*** | (2006.01) |
| ***A43B 13/36*** | (2006.01) |
| ***A43B 23/22*** | (2006.01) |
| ***A43D 86/00*** | (2006.01) |

(52) U.S. Cl.
CPC ..... *A43B 9/00* (2013.01); *A43B 13/146* (2013.01); *A43B 13/18* (2013.01); *A43B 13/36* (2013.01); *A43D 86/00* (2013.01)

(58) Field of Classification Search
None
See application file for complete search history.

(56) References Cited

U.S. PATENT DOCUMENTS

| | | | |
|---|---|---|---|
| 357,062 | A | 2/1887 | Buch |
| 968,020 | A | 8/1910 | Yandoli |

(Continued)

FOREIGN PATENT DOCUMENTS

| | | | |
|---|---|---|---|
| EP | 0 593 394 | A1 | 4/1994 |
| EP | 0 890 321 | A2 | 1/1999 |

(Continued)

OTHER PUBLICATIONS

Non-Final Rejection mailed Jul. 22, 2024 from corresponding U.S. Appl. No. 17/530,172, filed Nov. 18, 2021.

(Continued)

*Primary Examiner* — Jila M Mohandesi
(74) *Attorney, Agent, or Firm* — Westman, Champlin & Koehler, P.A.

(57) ABSTRACT

The present disclosure relates to a custom article of footwear, a method of making the same, and a method of conducting retail and Internet business. In particular, the components of the custom article of footwear can be selected from a range of alternative options, and the selected components can be easily removed, replaced, and recycled.

20 Claims, 166 Drawing Sheets

(56) References Cited

U.S. PATENT DOCUMENTS 997,657 A 7/1911 Drake
1,088,328 A 2/1914 Cucinotta
1,107,894 A 8/1914 Cain
1,113,266 A 10/1914 Waechter
1,127,456 A 2/1915 Kurz
1,219,507 A 3/1917 Teare
1,352,865 A 9/1920 Arent
1,370,212 A 3/1921 Peter
1,625,048 A 4/1927 Nock
1,741,340 A 12/1929 Scholl
1,889,716 A 11/1932 Walker
2,102,368 A 12/1937 Martel
2,144,563 A 1/1939 Davis
2,183,277 A 12/1939 Heilhecker
2,200,080 A 5/1940 Jacob
2,220,534 A 11/1940 McLean
2,333,373 A 11/1943 Grey
2,391,064 A 12/1945 Stokes
2,444,865 A 7/1948 Warrington
2,447,603 A 8/1948 Snyder
2,456,102 A 12/1948 Joseph
2,508,318 A 5/1950 George
2,530,226 A 11/1950 Gaston
2,552,943 A 5/1951 Edgaras
2,588,061 A 3/1952 Karel
2,640,283 A 6/1953 Joses
2,687,528 A 8/1954 Paul
2,771,691 A 11/1956 Luchs
2,790,975 A 5/1957 Gunning
2,873,540 A 2/1959 Ramey
3,012,340 A 12/1961 Reinhart
3,085,410 A 4/1963 Loizillon
3,102,271 A 9/1963 Wilkerson
3,274,709 A 9/1966 Lipinski
3,333,353 A 8/1967 Arnau
3,373,510 A 3/1968 Ralph et al.
3,538,628 A * 11/1970 Arthur, Jr. ..... A43B 3/0078 36/15
3,653,151 A 4/1972 Laurent
3,796,067 A 3/1974 East
3,818,617 A 6/1974 Dassler et al.
3,846,919 A * 11/1974 Milotic ..... A43B 13/28 36/100
3,878,626 A 4/1975 Isman
3,906,646 A 9/1975 Milotic
3,982,336 A 9/1976 Herro
4,103,440 A 8/1978 Lawrence
4,107,857 A 8/1978 Devlin
4,132,016 A 1/1979 Vaccari
4,183,156 A 1/1980 Rudy
4,194,249 A 3/1980 Thorneburg
4,253,317 A 3/1981 Howard et al.
4,255,949 A 3/1981 Thorneburg
4,262,434 A 4/1981 Michelotti
4,263,793 A 4/1981 Safrit et al.
4,267,650 A 5/1981 Bauer
4,267,728 A 5/1981 Manley et al.
4,277,959 A 7/1981 Thorneburg
4,279,083 A 7/1981 Dilg
4,300,294 A 11/1981 Riecken
4,314,413 A 2/1982 Dassler
4,317,294 A * 3/1982 Goodyear ..... A43B 13/36 36/36 B
4,340,626 A 7/1982 Rudy
4,341,096 A 7/1982 Safrit et al.
4,351,120 A 9/1982 Dalebout
4,373,361 A 2/1983 Thorneburg
4,377,042 A 3/1983 Bauer
4,420,894 A * 12/1983 Glassman ..... A43B 13/36 36/12
4,429,474 A 2/1984 Metro
4,486,964 A 12/1984 Rudy
4,492,046 A 1/1985 Kosova
4,506,460 A 3/1985 Rudy
4,520,635 A 6/1985 Shields et al.
4,535,554 A 8/1985 De Obaldia B.
4,538,368 A 9/1985 Mugford
4,566,206 A 1/1986 Weber
4,574,206 A 3/1986 Todokoro et al.
4,598,376 A 7/1986 Burton et al.
4,604,807 A 8/1986 Bock et al.
4,606,139 A * 8/1986 Silver ..... A43B 13/36 36/15
4,615,188 A 10/1986 Hursh et al.
4,638,575 A 1/1987 Illustrato
4,651,354 A 3/1987 Petrey
4,674,206 A 6/1987 Lyden
4,732,015 A 3/1988 Abrams et al.
4,736,203 A 4/1988 Sidlauskas
4,747,220 A 5/1988 Autry et al.
4,771,554 A 9/1988 Hannemann
4,800,657 A 1/1989 Brown
4,807,372 A 2/1989 McCall
4,813,436 A 3/1989 Au
4,825,563 A 5/1989 Strongwater
4,850,122 A 7/1989 Schwab, Jr.
4,854,057 A 8/1989 Misevich et al.
4,869,001 A 9/1989 Brown
4,878,300 A 11/1989 Bogaty
4,887,369 A 12/1989 Bailey et al.
4,898,007 A 2/1990 Dahlgren
4,942,677 A 7/1990 Flemming et al.
5,042,175 A 8/1991 Ronen et al.
5,052,130 A 10/1991 Barry et al.
5,060,401 A 10/1991 Whatley
5,063,603 A 11/1991 Burt
5,083,385 A 1/1992 Halford
5,101,580 A 4/1992 Lyden
5,123,169 A 6/1992 White et al.
5,128,880 A 7/1992 White
5,138,776 A 8/1992 Levin
5,159,767 A 11/1992 Allen
5,164,793 A 11/1992 Wolfersberger et al.
5,187,883 A 2/1993 Penney
5,195,030 A 3/1993 White
5,203,095 A 4/1993 Allen
5,203,793 A 4/1993 Lyden
5,206,804 A 4/1993 Thies et al.
5,216,594 A 6/1993 White et al.
5,224,278 A 7/1993 Jeon
5,230,333 A 7/1993 Yates et al.
5,231,723 A 8/1993 White et al.
5,237,520 A 8/1993 White
5,279,051 A 1/1994 Whatley
D347,106 S 5/1994 Sell et al.
D347,315 S 5/1994 Sell et al.
5,307,522 A 5/1994 Thorneburg et al.
5,311,357 A 5/1994 Summer et al.
5,317,822 A * 6/1994 Johnson ..... A43B 13/36 36/15
5,335,517 A 8/1994 Thorneburg et al.
5,337,492 A 8/1994 Anderie et al.
5,339,252 A 8/1994 White et al.
5,339,544 A 8/1994 Caberlotto
5,343,637 A 9/1994 Schindler
5,343,639 A 9/1994 Kilgore et al.
5,351,303 A 9/1994 Willmore
5,353,523 A 10/1994 Kilgore et al.
5,367,790 A 11/1994 Gamow et al.
5,367,791 A 11/1994 Gross et al.
5,381,608 A 1/1995 Claveria
5,384,973 A 1/1995 Lyden
5,396,718 A 3/1995 Schuler et al.
5,410,821 A 5/1995 Hilgendorf
5,425,184 A 6/1995 Lyden et al.
5,435,959 A 7/1995 Williamson et al.
5,437,110 A 8/1995 Goldston et al.
5,461,800 A 10/1995 Luthi et al.
5,469,638 A 11/1995 Crawford, III
5,483,601 A 1/1996 Faulkner
5,500,802 A 3/1996 Morris et al.
5,511,324 A 4/1996 Smith
D370,116 S 5/1996 Passke et al.
5,517,769 A 5/1996 Zhao

(56) References Cited

U.S. PATENT DOCUMENTS 5,528,842 A 6/1996 Ricci et al.
5,533,280 A 7/1996 Halliday
5,542,198 A 8/1996 Famolare
5,544,431 A 8/1996 Dixon
D374,341 S 10/1996 Passke et al.
D374,553 S 10/1996 Throneburg et al.
5,560,226 A 10/1996 Thorneburg
5,580,507 A 12/1996 Williamson et al.
5,595,004 A 1/1997 Lyden et al.
5,595,005 A 1/1997 Thorneburg et al.
5,596,819 A 1/1997 Goldston et al.
5,603,232 A 2/1997 Thorneburg
5,604,997 A 2/1997 Dieter
5,615,497 A 4/1997 Meschan
5,625,964 A 5/1997 Lyden et al.
5,628,129 A 5/1997 Kilgore et al.
5,632,057 A 5/1997 Lyden
5,636,456 A 6/1997 Allen
5,644,857 A 7/1997 Ouellette et al.
5,647,145 A 7/1997 Russell et al.
5,649,374 A 7/1997 Chou
5,657,558 A 8/1997 Pohu
5,661,915 A 9/1997 Smith
5,678,327 A 10/1997 Halberstadt
5,692,319 A 12/1997 Parker et al.
5,701,686 A 12/1997 Herr et al.
5,706,589 A 1/1998 Marc
5,709,954 A 1/1998 Lyden et al.
5,724,753 A 3/1998 Thorneburg et al.
5,729,912 A 3/1998 Gutkowski et al.
5,729,916 A 3/1998 Vorobiev et al.
5,729,918 A 3/1998 Smets
5,761,831 A 6/1998 Cho
5,771,495 A 6/1998 Turner et al.
5,784,721 A 7/1998 Huff
5,785,909 A 7/1998 Chang et al.
5,786,057 A 7/1998 Lyden et al.
5,791,163 A 8/1998 Thorneburg
5,799,417 A 9/1998 Burke et al.
5,813,146 A 9/1998 Gutkowski et al.
5,822,886 A 10/1998 Luthi et al.
5,822,888 A 10/1998 Terry
5,823,352 A 10/1998 Mena et al.
5,826,350 A 10/1998 Wallerstein
5,829,057 A 11/1998 Gunn
5,831,610 A 11/1998 Tonelli et al.
5,832,629 A 11/1998 Wen
5,832,636 A 11/1998 Lyden et al.
D401,758 S 12/1998 Huff
D403,149 S 12/1998 Fincher
5,843,268 A 12/1998 Lyden et al.
5,860,226 A 1/1999 Graham et al.
5,875,567 A 3/1999 Bayley
5,881,413 A 3/1999 Throneburg et al.
5,885,500 A 3/1999 Tawney et al.
5,896,608 A 4/1999 Whatley
5,896,679 A 4/1999 Baldwin
5,897,622 A 4/1999 Blinn et al.
5,906,872 A 5/1999 Lyden et al.
5,909,719 A 6/1999 Throneburg et al.
5,921,004 A 7/1999 Lyden
5,930,769 A 7/1999 Rosengard
5,937,544 A 8/1999 Russell
5,940,994 A 8/1999 Allen
5,946,731 A 9/1999 Finlay et al.
5,974,695 A 11/1999 Slepian et al.
5,983,200 A 11/1999 Slotznick
5,983,201 A 11/1999 Fay
5,987,780 A 11/1999 Lyden et al.
5,991,950 A 11/1999 Schenkel
6,006,449 A 12/1999 Orlowski et al.
6,021,527 A 2/2000 Lessard
6,023,857 A * 2/2000 Vizy ..... A43B 13/36
36/28
6,023,859 A 2/2000 Burke et al.
6,024,712 A 2/2000 Iglesias et al.
6,029,374 A 2/2000 Herr et al.
6,055,746 A 5/2000 Lyden et al.
6,122,937 A 9/2000 Roell
6,138,281 A 10/2000 Chiaruttini
6,139,929 A 10/2000 Hayton et al.
6,145,221 A 11/2000 Hockerson
6,151,805 A 11/2000 Savoie
D434,548 S 12/2000 Gallegos
6,154,983 A 12/2000 Austin et al.
6,195,915 B1 3/2001 Russell
6,195,916 B1 3/2001 Meschan
6,206,750 B1 3/2001 Barad et al.
6,216,365 B1 4/2001 Cohen
6,230,525 B1 5/2001 Dunlap
6,233,847 B1 5/2001 Brown
6,237,251 B1 5/2001 Litchfield et al.
6,247,182 B1 6/2001 Tasbas
6,247,249 B1 6/2001 Lindqvist
6,256,824 B1 7/2001 Austin et al.
6,282,814 B1 9/2001 Krafsur et al.
6,286,151 B1 9/2001 Lambertz
6,292,951 B1 9/2001 Kalde
6,295,679 B1 10/2001 Chenevert
6,299,962 B1 10/2001 Davis et al.
6,306,483 B1 10/2001 Bessey et al.
6,308,438 B1 10/2001 Throneburg et al.
D450,437 S 11/2001 Simpson et al.
6,314,584 B1 11/2001 Errera
6,324,772 B1 12/2001 Meschan
6,324,874 B2 12/2001 Fujimoto
6,327,795 B1 12/2001 Russell
6,330,757 B1 12/2001 Russell
6,332,281 B1 12/2001 Savoie
6,334,222 B1 1/2002 Sun
6,336,227 B1 1/2002 Liput et al.
6,341,432 B1 1/2002 Muller
6,349,486 B1 2/2002 Lin
6,354,114 B1 3/2002 Sghiatti
6,393,620 B2 5/2002 Hatch et al.
6,393,731 B1 5/2002 Moua et al.
6,416,610 B1 7/2002 Matis et al.
D461,045 S 8/2002 Warren
D462,830 S 9/2002 Greene
6,446,267 B1 9/2002 Shah
6,449,878 B1 9/2002 Lyden
6,451,144 B2 9/2002 Williamson et al.
6,457,261 B1 10/2002 Crary
6,457,332 B1 10/2002 Schiavello
6,487,796 B1 12/2002 Avar et al.
6,533,885 B2 3/2003 Davis et al.
D472,696 S 4/2003 Magro
6,546,648 B2 4/2003 Dixon
D474,332 S 5/2003 Turner et al.
6,557,271 B1 5/2003 Weaver, III
6,568,102 B1 5/2003 Healy et al.
6,598,320 B2 7/2003 Turner et al.
6,601,042 B1 7/2003 Lyden
6,618,960 B2 9/2003 Brown
6,622,401 B2 9/2003 Carroll, III
D483,936 S 12/2003 Fullum
6,665,957 B2 12/2003 Levert et al.
6,684,532 B2 2/2004 Greene et al.
6,694,642 B2 2/2004 Turner
6,711,834 B1 3/2004 Kita
6,722,058 B2 4/2004 Lucas et al.
6,749,187 B2 6/2004 Yang
6,751,891 B2 6/2004 Lombardino
6,767,611 B2 7/2004 Hayashi et al.
6,807,753 B2 10/2004 Steszyn et al.
6,829,848 B2 12/2004 Gallegos
6,842,999 B2 1/2005 Russell
6,851,204 B2 2/2005 Aveni et al.
6,860,034 B2 3/2005 Schmid
6,865,824 B2 3/2005 Levert et al.
6,879,945 B1 4/2005 Cook
6,880,267 B2 4/2005 Smaldone et al.
6,886,274 B2 5/2005 Krafsur et al.
6,898,870 B1 5/2005 Rohde

(56) References Cited

U.S. PATENT DOCUMENTS

| | | | | |
|---|---|---|---|---|
| D507,094 | S | 7/2005 | Lyden | |
| 6,915,596 | B2 | 7/2005 | Grove et al. | |
| 6,920,705 | B2 | 7/2005 | Lucas et al. | |
| 6,925,732 | B1 | 8/2005 | Clarke | |
| 6,928,756 | B1 | 8/2005 | Haynes | |
| 6,931,766 | B2 | 8/2005 | Greene | |
| 6,939,502 | B2 | 9/2005 | Lyden | |
| 6,944,972 | B2 | 9/2005 | Schmid | |
| 6,948,262 | B2 | 9/2005 | Kerrigan | |
| 6,948,264 | B1 | 9/2005 | Lyden | |
| 6,964,119 | B2 | 11/2005 | Weaver, III | |
| 6,964,120 | B2 | 11/2005 | Cartier et al. | |
| 6,968,636 | B2 | 11/2005 | Aveni et al. | |
| 6,976,322 | B1 | 12/2005 | Walker | |
| 6,983,553 | B2 | 1/2006 | Lussier et al. | |
| 6,986,269 | B2 | 1/2006 | Dua | |
| 7,013,581 | B2 | 3/2006 | Greene et al. | |
| 7,013,583 | B2 | 3/2006 | Greene et al. | |
| 7,016,867 | B2 | 3/2006 | Lyden | |
| 7,076,890 | B2 | 7/2006 | Grove et al. | |
| 7,082,698 | B2 | 8/2006 | Smaldone et al. | |
| 7,089,152 | B2 | 8/2006 | Oda et al. | |
| 7,100,308 | B2 | 9/2006 | Aveni | |
| 7,100,309 | B2 | 9/2006 | Smith et al. | |
| 7,107,235 | B2 | 9/2006 | Lyden | |
| 7,114,269 | B2 | 10/2006 | Meschan | |
| 7,140,129 | B2 | 11/2006 | Newson et al. | |
| 7,175,187 | B2 | 2/2007 | Lyden | |
| 7,406,781 | B2 | 8/2008 | Scholz | |
| 7,464,944 | B2 | 12/2008 | Lyden | |
| 7,730,637 | B2 | 6/2010 | Scholz | |
| 7,752,775 | B2 | 7/2010 | Lyden | |
| 7,770,306 | B2 | 8/2010 | Lyden | |
| 7,810,257 | B2 * | 10/2010 | Candrian | A43B 7/1495 36/15 |
| 8,209,883 | B2 | 7/2012 | Lyden | |
| 8,341,856 | B2 | 1/2013 | Smith et al. | |
| 8,544,189 | B2 | 10/2013 | Chaney et al. | |
| 8,567,096 | B2 | 10/2013 | Scholz | |
| 8,653,151 | B2 | 2/2014 | Skaja et al. | |
| 8,959,797 | B2 | 2/2015 | Lyden | |
| 9,074,061 | B2 | 7/2015 | Yu | |
| 9,114,580 | B2 | 8/2015 | Skaja et al. | |
| 9,259,050 | B2 | 2/2016 | Smith et al. | |
| 9,357,813 | B2 | 6/2016 | Lyden | |
| 9,364,046 | B2 | 6/2016 | Adams et al. | |
| 9,486,036 | B1 * | 11/2016 | Douglas | A43B 23/0245 |
| 9,545,132 | B2 | 1/2017 | Hatfield et al. | |
| 9,565,899 | B2 | 2/2017 | Adams et al. | |
| 9,635,904 | B2 | 5/2017 | Wakeland et al. | |
| 9,655,404 | B2 | 5/2017 | Wakeland et al. | |
| 9,681,704 | B2 | 6/2017 | Podhajny et al. | |
| 9,775,404 | B2 | 10/2017 | Lyden | |
| 9,939,803 | B2 | 4/2018 | Regan | |
| 9,955,748 | B2 | 5/2018 | Grove et al. | |
| 9,968,156 | B2 | 5/2018 | Huffman et al. | |
| 9,986,781 | B2 | 6/2018 | Dua et al. | |
| 10,013,711 | B2 | 7/2018 | Gooch et al. | |
| 10,028,552 | B2 | 7/2018 | Manz et al. | |
| 10,092,063 | B2 | 10/2018 | Waatti | |
| 10,130,142 | B2 | 11/2018 | Meir | |
| 10,136,703 | B2 | 11/2018 | Gooch et al. | |
| 10,143,265 | B2 | 12/2018 | Lucas et al. | |
| 10,149,514 | B2 | 12/2018 | Adams et al. | |
| 10,172,414 | B2 | 1/2019 | Hayes et al. | |
| 10,182,617 | B2 | 1/2019 | Craig | |
| 10,231,503 | B2 | 3/2019 | Greene et al. | |
| 10,294,592 | B2 | 5/2019 | Uesato | |
| 10,351,979 | B2 | 7/2019 | Dua et al. | |
| 10,364,517 | B2 | 7/2019 | Dua et al. | |
| 10,378,130 | B2 | 8/2019 | Dua et al. | |
| 10,383,388 | B2 | 8/2019 | Podhajny | |
| 10,435,825 | B2 | 10/2019 | MacGilbert et al. | |
| 10,458,052 | B2 | 10/2019 | Adami et al. | |
| 10,463,103 | B2 | 11/2019 | Hayes et al. | |
| 10,512,296 | B2 | 12/2019 | Droege et al. | |
| 10,531,700 | B2 | 1/2020 | Johnson | |
| 10,548,364 | B2 | 2/2020 | Podhajny | |
| 11,090,863 | B2 | 8/2021 | Constantinou et al. | |
| 11,399,591 | B2 * | 8/2022 | Lyden | A43B 3/244 |
| 12,178,288 | B2 | 12/2024 | Lyden | |
| 2004/0024645 | A1 | 2/2004 | Potter et al. | |
| 2004/0040180 | A1 | 3/2004 | Rennex et al. | |
| 2005/0071242 | A1 | 3/2005 | Allen et al. | |
| 2005/0166422 | A1 | 8/2005 | Schaeffer et al. | |
| 2005/0193592 | A1 | 9/2005 | Dua et al. | |
| 2005/0268491 | A1 | 12/2005 | McDonald et al. | |
| 2006/0010715 | A1 | 1/2006 | Tseng et al. | |
| 2006/0048413 | A1 | 3/2006 | Sokolowski et al. | |
| 2006/0059713 | A1 | 3/2006 | Stockbridge et al. | |
| 2006/0059715 | A1 | 3/2006 | Aveni | |
| 2006/0101671 | A1 | 5/2006 | Berend et al. | |
| 2006/0112592 | A1 | 6/2006 | Leedy et al. | |
| 2006/0129416 | A1 | 6/2006 | Shum | |
| 2006/0130359 | A1 | 6/2006 | Dua et al. | |
| 2006/0130365 | A1 | 6/2006 | Sokolowski et al. | |
| 2006/0213082 | A1 | 9/2006 | Meschan | |
| 2006/0213088 | A1 | 9/2006 | Grove et al. | |
| 2006/0276095 | A1 | 12/2006 | Dua et al. | |
| 2006/0283050 | A1 | 12/2006 | Carnes et al. | |
| 2007/0011920 | A1 | 1/2007 | DiBenedetto et al. | |
| 2007/0022627 | A1 | 2/2007 | Sokolowski et al. | |
| 2007/0043630 | A1 * | 2/2007 | Lyden | G06Q 30/0613 705/26.5 |
| 2014/0257719 | A1 | 9/2014 | Figiel | |
| 2014/0310984 | A1 | 10/2014 | Tamm et al. | |
| 2014/0310986 | A1 | 10/2014 | Tamm et al. | |
| 2022/0071338 | A1 | 3/2022 | Lyden | |

FOREIGN PATENT DOCUMENTS

| | | | |
|---|---|---|---|
| EP | 1 025 770 | A2 | 8/2000 |
| EP | 1 033 087 | A1 | 9/2000 |
| EP | 1 048 233 | A2 | 11/2000 |
| EP | 1 240 838 | A1 | 9/2002 |
| FR | 472735 | A | 12/1914 |
| IT | 633409 | B | 2/1962 |
| WO | 90/05345 | A1 | 5/1990 |
| WO | 94/20020 | A1 | 9/1994 |
| WO | 96/21366 | A1 | 7/1996 |
| WO | 97/46127 | A1 | 12/1997 |
| WO | 98/07341 | A2 | 2/1998 |
| WO | 98/18386 | A1 | 5/1998 |
| WO | 02/13641 | A1 | 2/2002 |
| WO | 02/23641 | A1 | 3/2002 |

OTHER PUBLICATIONS

Notice of Allowance and Fee(s) Due mailed Aug. 27, 2024 from corresponding U.S. Appl. No. 17/530,172, filed Nov. 18, 2021.

Non-Final Rejection from corresponding U.S. Appl. No. 16/820,254 mailed Feb. 28, 2022.

Final Rejection from corresponding U.S. Appl. No. 16/820,254 mailed May 23, 2022.

Notice of Allowance and Fee(s) Due from corresponding U.S. Appl. No. 16/820,254 mailed Jun. 7, 2022.

* cited by examiner

PRIOR ART

ARTICLE OF FOOTWEAR, METHOD OF MAKING THE SAME, AND METHOD OF CONDUCTING RETAIL AND INTERNET BUSINESS

CROSS-REFERENCE TO RELATED APPLICATION

This Application is a Continuation-In-Part of U.S. patent application Ser. No. 17/530,172 entitled Article of Footwear, Method of Making The Same, and Method of Conducting Retail and Internet Business filed Nov. 18, 2021 and published as U.S. 20220071338 on Mar. 10, 2022, which was a Continuation-In-Part of U.S. patent application Ser. No. 16/820,254 entitled Article of Footwear, Method of Making the Same, And Method of Conducting Retail and Internet Business filed Mar. 16, 2020 which was granted as U.S. Pat. No. 11,399,591 on Aug. 2, 2022. The contents of the applications cited in the CROSS REFERENCE TO RELATED APPLICATIONS section is incorporated by reference in its entirety.

FIELD

The invention relates to customized articles of footwear including removable and replaceable components, methods of making the same, and methods of conducting retail and Internet business.

BACKGROUND

The present disclosure teaches customized articles of footwear including removable and replaceable components, methods of making the same, and methods of conducting retail and Internet business.

Conventional articles of footwear cannot be substantially customized for use by an individual wearer. In this regard, the structure, and both the physical and mechanical properties, and performance characteristics of men's shoes in the running category are often fixed and selected to well serve the average 160 pound individual. However, the body weight or mass, walking or running speed, and characteristic running technique of different individuals having the same footwear size can vary greatly. As a result, the stiffness in compression of the foam material or other means for cushioning which is used in the soles of athletic shoes can be too soft for individuals who employ more forceful movements or have greater body mass than an average wearer. Alternatively, the stiffness provided by the soles of conventional athletic shoes can be too great for individuals who weigh significantly less than an average wearer. As a result, persons having characteristics deviating significantly from the norm or average individual can possibly experience less than ideal cushioning and/or stability. Accordingly, conventional articles of athletic footwear cannot provide optimal performance characteristics for many individual wearers.

Further, conventional athletic footwear often include an outsole made of a thermoset rubber material that is cemented by an adhesive to a midsole made of an ethylene vinyl acetate or polyurethane foam material which in turn is also cemented with an adhesive to a textile upper constructed using over two dozen parts which are held together by stitching. Because of the time, expense and difficulty associated with renewing any portion of conventional articles of footwear most of them are simply discarded at the end of their service life. The service life of an article of footwear can be relatively short when a wearer frequently engages in an athletic activity such as distance running, or tennis. In tennis, portions of a sole can be substantially abraded within a few hours, and when running a conventional foam midsole can take a compression set within one hundred miles of use. The resulting deformation of the midsole can degrade both cushioning and stability, and then possibly contribute to the origin of athletic injuries. Accordingly, many competitive distance runners who routinely cover over 50 miles in a week's time will discard their athletic footwear after logging three hundred miles in order to avoid possible injury.

While the service life of conventional athletic footwear is relatively short, the price of athletic footwear has steadily increased over the last three decades, and some current models have retail prices over one hundred and fifty dollars. Nevertheless, most athletic footwear and other casual shoes continue to be disposable commodities and relatively few are being recycled. Accordingly, both the manufacture and disposal of conventional athletic footwear is relatively inefficient and environmentally unfriendly. In contrast, the present disclosure teaches a customizable article of footwear, a method of making the same which enables recycling, and also a method of conducting retail and Internet business.

SUMMARY

An aspect of the present disclosure is an article of footwear including an upper having an anterior side, a posterior side, a length between the anterior side and the posterior side, a medial side, a lateral side, a superior side, an inferior side, an exterior side, an interior side, a lasting margin, and a plurality of openings on the inferior side of the upper. The article of footwear further includes a lasting plate having a top side, a bottom side, a front side, a back side, an edge disposed near the lasting margin within the interior side and extending substantially between the anterior side and the posterior side of the upper. The lasting plate further includes a plurality of hooks extending from the bottom side. In this regard, the plurality of hooks include at least three hooks each having a free end which extend towards the front side of the lasting plate, and at least one hook having a free end which extends towards the back side of the lasting plate. The lasting plate has a shape in a relaxed state and is configured to flex under force and subsequently recover its shape when the force is removed. The article of footwear further includes a sole including a plurality of receptacles, and a portion of the plurality of hooks extend through the plurality openings on the inferior side of the upper, and the plurality of hooks are mechanically coupled with the sole with the plurality of receptacles thereby removably securing the upper, the lasting plate, and the sole.

The lasting plate can include an anterior portion, a posterior portion, and a flexible elastomeric portion disposed between and connecting the anterior portion with the posterior portion. The elastomeric portion can also extend on a portion of at least the top side of the lasting plate. The elastomeric portion can also extend on at least a portion of the bottom side of the lasting plate. The elastomeric portion can include a resilient joint disposed across the width of the lasting plate. The anterior portion and posterior portion of the lasting plate can each include a recess on the top side near the elastomeric portion. The anterior portion and posterior portion of the lasting plate can each also include a recess on the bottom side near the elastomeric portion. Alternatively, the lasting plate can include an anterior portion, a posterior portion, and a flexible thermoplastic middle portion which can be made with a different thermoplastic material having a lower flexural modulus than the material used to make the anterior portion and posterior portion of the lasting plate. Alternatively, the thickness of a thermoplastic material which is used to make the lasting plate can be reduced in the middle portion to provide greater flexibility.

Alternatively, the lasting plate can be configured to serve as a superior spring element and exhibit a high flexural modulus and a spring to dampening ratio of over 90 percent. The lasting plate can include a plurality of flex notches including at least a first flex notch configured to be disposed beneath and below between 60-65 percent of the length of the insole on the lateral side and a second transverse flex notch configured to be disposed between 80-85 percent of the length of the insole on the medial side.

The lasting plate can include an integral insole which extends substantially between the front side and back side of the lasting plate. Alternatively, an insole can be made and provided as a separate component and be disposed on the top side and surface of the lasting plate. Alternatively, an insole can be made and provided as a separate component and extend on the interior side of the upper substantially between its anterior side and posterior side.

Further, the at least three hooks each having a free end which extend towards the front side of the lasting plate can include a first hook disposed near the front side of the lasting plate in a location configured to be disposed anterior of the metatarsal-phalangeal joints of the second and a third toes and posterior of the distal phalanges of the second and third toes of a wearer's foot, and include a second hook configured to be disposed posterior of the metatarsal-phalangeal joint of the big or first toe of the wearer's foot, and include a third hook configured to be disposed posterior of the metatarsal-phalangeal joint of the fifth or little toe of the wearer's foot, and the at least one hook comprising a free end which extends towards the back side of the lasting plate is configured to be disposed posterior of the weight bearing center of the wearer's heel. The free ends of the hooks can have a rounded, squared, or semi-octagonal configuration.

The lasting plate can further include a plurality of projections which extend downwards from the bottom side and near the edge for manipulating the configuration and width of the upper. The plurality of projections can each include a head portion which can include an annular, conical, or pointed configuration. The plurality of projections can include a short stem portion and a head portion, or alternatively only a head portion. In this regard, the upper can include a second plurality of openings on its inferior side, and the plurality of projections can be configured to be removably secured to the upper by engagement with the second plurality of openings. The second plurality of openings can include a plurality of sets of openings, and each set can include at least two openings proximate to one another, and the plurality of projections are configured to be engaged with at least one opening of each set of the plurality of sets. The plurality of sets can be disposed on each of the medial side and the lateral side of the upper on its inferior side near the lasting margin, and the plurality of sets can be spaced along the length of the upper.

An aspect of the present is an article of footwear including an upper, an anterior side, a posterior side, a length between the anterior side and the posterior side of the upper, a medial side, a lateral side, a superior side, an inferior side, an exterior side, an interior side, a lasting margin, a plurality of slits on the inferior side, and an upper opening on the inferior side of the upper; a lasting plate including a top side, a bottom side, a front side, a back side, an edge disposed near the lasting margin within the interior side and extending substantially between the anterior side and the posterior side of the upper, the lasting plate including a plurality of hooks extending from its bottom side, the plurality of hooks including a first hook having an J or L shape and a free end which extends towards the front side of the lasting plate and disposed near the front side and a second hook disposed near the back side having a J or L shape and free end which extends towards the back side of the lasting plate; the lasting plate further including a plurality of hooks disposed between the first hook comprising an J or L shape and the second hook comprising a J or L shape, and extend from the lasting plate at different angles; the lasting plate having a shape in a relaxed state and configured to flex under force and subsequently recover its shape when the force is removed; the lasting plate including a lasting plate recess having a lasting plate opening; a sole including a plurality of receptacles and also a sole recess including a sole opening; a removably attachable fastener disposed in the lasting plate recess and extends through the lasting plate opening in the lasting plate and the upper opening in the inferior side of the upper and into a portion of the sole opening in the sole and coupled to the sole, and a least a portion of the first hook having a J or L shape, the second hook having a J or L shape, and the plurality of hooks disposed therebetween extend through the plurality of slits on the inferior side of the upper, and the first hook having a J or L shape, the second hook having a J or L shape, and the plurality of hooks disposed therebetween are mechanically coupled with the plurality of receptacles thereby removably securing the upper, the lasting plate, and the sole.

An aspect of the present disclosure is an article of footwear including: an upper, an anterior side, a posterior side, a length between the anterior side and the posterior side, a medial side, a lateral side, a superior side, an inferior side, an exterior side, an interior side, a lasting margin, a plurality of slits on the inferior side, and at an upper opening on the inferior side; a lasting plate having a top side, a bottom side, a front side, a back side, an edge disposed near the lasting margin within the interior side and extending substantially between the anterior side and the posterior side of the upper, the lasting plate including a plurality of hooks extending from the bottom side, the plurality of hooks including a first plurality of hooks each having a free end which extends towards the front side of the lasting plate, and a second plurality of hooks each having a free end which extends towards the back side of the lasting plate; the lasting plate having a shape in a relaxed state and configured to flex under force and subsequently recover the shape when the force is removed; the lasting plate including a lasting plate recess including a lasting plate opening; a sole including a sole insert including a plurality of receptacles and also a sole recess including a sole opening; a removably attachable fastener disposed in the lasting plate recess in the lasting plate and at least partially extends through the lasting plate opening in the lasting plate and the upper opening on the inferior side of the upper and the sole opening in the sole and coupled to the sole, and a least a portion of the plurality of hooks extend through the plurality of slits on the inferior side of the upper, and the plurality of hooks are mechanically coupled with the plurality of receptacles thereby removably securing the upper, the lasting plate, and the sole.

An aspect of the present disclosure is an article of footwear including: an upper having an anterior side, a posterior side, a length between the anterior side and the posterior side, a medial side, a lateral side, a superior side, an inferior side, an exterior side, an interior side, a lasting margin, a plurality of slits on the inferior side, and an upper opening on the inferior side; a two-part lasting plate including an anterior lasting plate portion and a posterior lasting plate portion; the anterior lasting plate portion including a plurality of hooks extending from the anterior lasting plate bottom side, each of the plurality of hooks having a free end which extends towards the anterior side; the posterior lasting plate portion including a plurality of hooks extending from a posterior lasting plate bottom side, each of the plurality of hooks having a free end which extends toward the posterior side; the lasting plate including a lasting plate recess including a lasting plate opening; a sole including a plurality of receptacles and also a sole recess including a sole opening; a removably attachable fastener disposed in the lasting plate recess and at least a portion of the fastener extends through the lasting plate opening in the lasting plate and the upper opening on the inferior side of the upper and into a portion of the sole opening in the sole and coupled to the sole, and at least a portion of the plurality of hooks extend through the plurality of slits on the inferior side of the upper, and the plurality of hooks are mechanically coupled with the plurality of receptacles thereby removably securing the upper, the lasting plate, and the sole.

An aspect of the present disclosure is an article of footwear including: an upper, an anterior side, a posterior side, a length between the anterior side and the posterior side of the upper, a medial side, a lateral side, a superior side, an inferior side, an exterior side, an interior side, a lasting margin, a plurality of slits on the inferior side, and an upper opening on the inferior side; a lasting plate having a top side, a bottom side, a front side, a back side, an edge disposed near the lasting margin within the interior side and extending substantially between the anterior side and the posterior side of the upper, the lasting plate including a plurality of hooks extending from the bottom side, the plurality of hooks each having a free end which extends towards the front side of the lasting plate; the lasting plate including a projection extending from the bottom side including a lasting plate opening; a sole including a plurality of receptacles, a void space, and a sole opening; the projection on the lasting plate extending through the upper opening on the inferior side of the upper into the void space in the sole and a removable pin disposed in the sole opening and in the lasting plate opening in the projection and coupled to the projection and the sole, at least a portion of the plurality of hooks extend through the plurality of slits on the inferior side of the upper, and the plurality of hooks are mechanically coupled with the plurality of receptacles thereby removably securing the upper, the lasting plate, and the sole.

An aspect of the present disclosure is an article of footwear including: an upper, an anterior side, a posterior side, a length between the anterior side and the posterior side, a medial side, a lateral side, a superior side, an inferior side, an exterior side, an interior side, a lasting margin, a plurality of slits on the inferior side, and an upper opening on the inferior side; a lasting plate including a top side, a bottom side, a front side, a back side, an edge disposed near the lasting margin within the interior side and extending substantially between the anterior side and the posterior side of the upper, the lasting plate including a plurality of hooks extending from the bottom side, the plurality of hooks including a first hook having a free end which extends towards the front side of the lasting plate disposed near the front side and a second hook disposed near the back side having a free end which extends towards the back side of the lasting plate; the lasting plate including a first pivot point P1 proximate the first hook and a second pivot point P2 proximate the second hook; the lasting plate further including a plurality of arcuate hooks each being disposed at different distances from the first pivot point P1 proximate the first hook, and/or the second pivot point P2 proximate the second hook, and each of the plurality of arcuate hooks having an arcuate configuration defined by an arc generated from a radius extending from one of the first pivot point P1 or the second pivot point P2 to the position of each arcuate hook on the lasting plate; the lasting plate having a shape in a relaxed state and configured to flex under force and subsequently recover the shape when the force is removed; the lasting plate including a lasting plate recess including a lasting plate opening; a sole including a plurality of receptacles and also a sole recess including a sole opening; a removably attachable fastener disposed in the lasting plate recess and extends through the lasting plate opening in the lasting plate and the upper opening on the inferior side of the upper and into a portion of the sole opening in the sole and coupled to the sole, and a least a portion of the first hook, the second hook, and the plurality of arcuate hooks extend through the plurality of slits on the inferior side of the upper, and the first hook, the second hook, and the plurality of arcuate hooks are mechanically coupled with the plurality of the receptacles in the sole thereby removably securing the upper, the lasting plate, and the sole.

An aspect of the present disclosure is an article of footwear including: an upper, an anterior side, a posterior side, a length between the anterior side and the posterior side, a medial side, a lateral side, a superior side, an inferior side, an exterior side, an interior side, a lasting margin, a plurality of slits on the inferior side, and a plurality of upper openings on the inferior side; a lasting plate including a top side, a bottom side, a front side, a back side, an edge disposed near the lasting margin within the interior side and extending substantially between the anterior side and the posterior side of the upper, the lasting plate including a plurality of hooks extending from the bottom side, the plurality of hooks including a first hook having a free end which extends towards the front side of the lasting plate and a second hook having a free end which extends towards the back side of the lasting plate; the lasting plate including a plurality of lasting plate recesses including a plurality of lasting plate openings; the lasting plate having a shape in a relaxed state and configured to flex under force and subsequently recover the shape when the force is removed; a sole including a plurality of sole receptacles and also a plurality of sole recesses including sole openings; a plurality of removably attachable fasteners disposed in the plurality of the lasting plate recesses and at least a portion of the fasteners extend through the lasting plate openings in the lasting plate and the upper openings on the inferior side of the upper and into a portion of the sole openings in the sole and coupled to the sole, and a least a portion of the plurality of hooks extend through the plurality of slits on the inferior side of the upper, and the plurality of hooks are mechanically coupled with the plurality of receptacles thereby removably securing the upper, the lasting plate, and the sole.

An aspect of the present disclosure is an article of footwear including: an upper having an inferior side including a first substantially smooth surface having a low, medium or high surface energy; a sole having a superior side having a second substantially smooth surface having a low, medium or high surface energy; and, a double-sided pressure sensitive adhesive tape disposed between the first substantially smooth surface and the second substantially smooth surface and coupling together the upper and the sole.

The upper can be made of a knitted textile material. The upper can include a tongue. The tongue can be knitted or otherwise formed as an integral part of the upper. Alternatively, the upper can be without a tongue. At least some of the openings in the upper can include a reinforcement structure near the edge of the openings. The upper can include a channel which extends about a portion of the medial side, lateral side, and posterior side for being coupled with a portion of the sole. Alternatively, the upper can include a channel that extends about the medial side, lateral side, posterior side, and anterior side which for being coupled with a portion of the sole. The channel can be configured to be disposed near the lasting margin of the upper. Alternatively, a channel can be configured to couple with a portion of an external heel counter, and also a portion of the sole.

The sole can include a fluid-filled bladder. The sole can include an integral heel counter. The sole can include at least one longitudinal groove extending beneath and substantially between the anterior side and the posterior side of the upper of the article of footwear, and also at least two transverse grooves in a portion of the sole configured to support the forefoot area of a wearer's foot. The sole can include a sidewall frame extending about at least a portion of the edge on its top side. The sole can include a plurality of individual female receptacles which are coupled to the sole. The sole can include a plurality of female receptacles which are joined together by strips. The sole can include an integral toe cap. The toe cap can have a straight, curved, or reverse wingtip configuration. At least a portion of the sole can be removably secured in a channel disposed on the exterior side of the upper.

The article of footwear can include a heel counter. In this regard, the upper can include a heel counter. The heel counter can be disposed on the interior side of the shoe upper, or alternatively on the exterior side of the shoe upper. Alternatively, the lasting plate can include a heel counter.

The upper can include a closure mechanism selected from the group of closure mechanisms consisting of: laces, straps, openings, eyelets, and lace loops. A closure mechanism including a strap can be configured to be removably secured to the lasting plate. In this regard, a strap can be disposed on the interior side of the upper and a portion of the strap can extend through at least one slit in the upper. Alternatively, a strap can be removably secured on the exterior side of the upper between the upper and the sole. Alternatively, the article of footwear can include a strap which is an integral part of the upper. Alternatively, a closure mechanism can include a draw cord which repeatedly crosses over the superior side and between the medial and lateral sides of the upper. Alternatively, another means for closure is a resilient textile material configured to impart compression in the shoe upper and help to secure a wearer's foot.

Another aspect of the present disclosure is a method of making a custom article of footwear. In this regard, the method includes: selecting an upper from a plurality of alternative uppers each having a plurality of openings on an inferior side; selecting a lasting plate including an integral insole from a plurality of alternative lasting plates including integral insoles each including at least three fasteners including a hook having a free end facing the front side of the lasting plate and at least one fastener including a hook having a free end facing the back side of the lasting plate; selecting a sole from a plurality of alternative soles each including a plurality of receptacles; inserting the selected lasting plate including an integral insole into the selected upper and causing the at least three fasteners each including a hook having a free end facing the front side of the lasting plate to pass through some of the plurality of openings in the upper; inserting the at least three fasteners each including a free end facing the front side of the lasting plate into three of the plurality of receptacles of the selected sole; and, flexing the lasting plate and inserting the at least one fastener including a hook having a free end facing the back side of the lasting plate through one of the plurality of openings in the upper and into one of the plurality of receptacles in the sole; whereby the plurality of hooks are mechanically coupled with the sole with the plurality of receptacles thereby removably securing the selected upper, the selected lasting plate including an integral insole, and the selected sole.

Another aspect of the present disclosure is an alternative method of making a custom article of footwear. In this regard, the method includes: selecting an upper from a plurality of alternative uppers each having a plurality of openings on an inferior side; selecting a lasting plate from a plurality of alternative lasting plates each including at least three fasteners including a hook having a free end facing the front side of the lasting plate and at least one fastener including a hook having a free end facing the back side of the lasting plate; selecting a sole from a plurality of alternative soles each including a plurality of receptacles; selecting an insole from a plurality of alternative insoles; inserting the selected lasting plate into the selected upper and causing the at least three fasteners each including a hook having a free end facing the front side of the lasting plate to pass through some of the plurality of openings in the upper and into three of the plurality of receptacles of the selected sole; flexing the lasting plate and inserting the at least one fastener including a hook having a free end facing the back side of the lasting plate through one of the plurality of openings in the upper and into one of the plurality of receptacles in the sole; whereby the plurality of hooks are mechanically coupled with the sole with the plurality of receptacles thereby removably securing the selected upper, the selected lasting plate, and the selected sole; and, inserting the selected insole into the upper.

The present disclosure teaches a method of making an article of footwear. The method can include the steps of selecting a first footwear component from a plurality of uppers, selecting a second footwear component from a plurality of lasting plates including an insole, and selecting a third footwear component from a plurality of soles, and removably securing the first, second and third footwear components to make an article of footwear.

The present disclosure teaches a method of making an article of footwear. The method can include the steps of providing a plurality of footwear components and a plurality of variations of a plurality of the footwear components, a plurality of the footwear components including means for fastening, selecting from the plurality of footwear components sufficient footwear components for making the article of footwear including at least an upper, a lasting plate, and a sole which can be removably secured together in functional relation by the means for fastening, providing the selected sufficient footwear components to a physical location at which the article of footwear can be made, and removably securing a plurality of the selected sufficient footwear components in functional relation with the means for fastening and completing the assembly for making the article of footwear.

The means for fastening can include mating male and female parts which can be coupled, whereby a plurality of selected footwear components are removable and replaceable.

The means for cushioning can include an elastomeric material such as a foam material and/or a fluid-filled bladder.

The step of securing a plurality of the selected sufficient footwear components in functional relation with means for fastening can be completed in less than five minutes, and sometimes even less than one minute.

The step of providing a plurality of footwear components and a plurality of variations of a plurality of the footwear components can include providing alternative footwear product categories, alternative footwear models, alternative footwear skus, alternative footwear colors, alternative footwear materials, alternative footwear components, alternative footwear options using images generated using a computer database, alternative footwear options using at least one actual footwear component, and alternative footwear options using an adaptable article of footwear.

The step of selecting from the plurality of footwear components sufficient footwear components for making the article of footwear can include providing a capability to a customer or individual wearer selected from the group including providing a data input capability, providing a search capability, providing a selection capability, providing a purchase capability.

The step of providing the selected sufficient footwear components to a physical location at which the article of footwear can be made can include providing means for delivery of the selected sufficient footwear components to a company headquarters, a retail store, a sales office, a service center, a medical office, a factory, a vending machine, a warehouse and distribution center, or a private residence. The means for delivery can include U.S. Mail, or courier services including but not limited to FEDEX®, UPS®, Amazon Prime®, and the like.

The present disclosure teaches a method of making an article of footwear having an upper, a lasting plate, and a sole which can be removably secured together. The method can include the steps of providing a plurality of footwear components, and a plurality of variations of a plurality of the footwear components, a plurality of the footwear components including means for fastening, selecting from the plurality of footwear components at least one footwear component for use in making the article of footwear, and providing the at least one footwear component to an address selected by an individual, whereby a plurality of footwear components comprising sufficient footwear components for making the article of footwear including the selected at least one footwear component are secured in functional relation with the means for fastening and the assembly for making the article of footwear is completed.

The present disclosure teaches a method of conducting business including making and selling an article of footwear. The method can include the steps of providing a plurality of footwear components, and a plurality of variations of a plurality of the footwear components, a plurality of the footwear components including means for fastening, selecting from the plurality of footwear components sufficient footwear components for making the article of footwear including an upper, a lasting plate, and a sole, providing the sufficient footwear components to a physical location at which the article of footwear can be made, securing a plurality of the sufficient footwear components in functional relation with the means for fastening and completing the assembly for making the article of footwear, and providing the article of footwear to a customer.

The present disclosure teaches a method of conducting business with the use of a vending device or machine and making and selling an article of footwear including at least an upper, a lasting plate, and a sole which can be removably secured together. The method includes the steps of providing a plurality of footwear components for making an article of footwear, and a plurality of variations of a plurality of the footwear components in a vending device or machine, a plurality of the footwear components including means for fastening, and selecting from the plurality of footwear components using the vending device or machine at least one footwear component for use in making the article of footwear and providing the at least one footwear component from the vending device or machine to a physical location, whereby a plurality of footwear components comprising sufficient footwear components for making the article of footwear including the at least one footwear component are removably secured with the means for fastening and the assembly for making the article of footwear is completed.

Definitions

In the present disclosure, the words, terms, or phrases anterior side, medial side, lateral side and posterior side will be used to indicate or make reference to portions of a footwear last, upper, insole, sole, and an article of footwear. The anterior side corresponds to what is sometimes called the front side, and the posterior side corresponds to what is sometimes called the back side.

When making reference to sides on an article of footwear or a sub-component thereof which has a curved surface, it can be readily understood and is hereby defined that a side can possibly refer to a single point, or alternatively to a curve or plane formed by three or more points, that is, a side does not have to be flat or planar. Further, the words front, back, top, and bottom will be used describe different sides, surfaces, or portions of various other footwear components such as a lasting plate and/or superior spring element. In this regard, it can be readily understood that different footwear components can each have their own front, back, top, and bottom sides and associated surfaces or portions, and the meaning of these descriptive words and phrases can be understood in view of their context.

The word or term longitudinal will be used to describe an orientation generally consistent with the length of an upper, lasting plate, insole, or sole of an article of footwear, and in particular, with respect to the orientation of flex grooves, openings, or other footwear structures disclosed herein.

The term transverse will be used to describe an orientation generally consistent with the width of an upper, lasting plate, insole or sole of an article of footwear, and in particular, with respect to the orientation of flex grooves, openings, or other footwear structures.

In this disclosure, the term or phrase rearfoot area will be used to refer to a portion of a wearer's foot, an article of footwear or sub-component thereof which is configured to underlie or be disposed about a portion of the calcaneus bone and/or heel, and the term or phrase midfoot area will be used to refer to a portion of a wearer's foot, an article of footwear, or subcomponent thereof which is configured to underlie or be disposed about a portion of the navicular, cuboid, outer, middle, and inner cuneiform, and the proximal end and shafts of the metatarsal bones.

The term or phrase ball of a wearer's foot will refer to a portion of a wearer's foot, an article of footwear, or sub-component thereof which is configured to underlie or be disposed about a portion of the distal heads of the five metatarsal bones, and also the proximal ends of the proximal phalanges.

In this disclosure, the term or phrase forefoot area will be used to refer to a portion of a wearer's foot, an article of footwear or sub-component thereof which is configured to underlie or be disposed about a portion of the phalanges and toes. In this regard, the position of the medial metatarsal-phalangeal joint is normally approximately located at about 69% of foot length, and the lateral metatarsal-phalangeal joint is normally approximately found at about 63% of foot length, that is, when measured from the back of a last for a typical size 9 men's article of footwear. Given a last length of 283 mm, the medial metatarsal-phalangeal joint is then located at about 195 mm, and the lateral metatarsal phalangeal joint at about 178 mm from the back or posterior side of the last. Accordingly, in this disclosure it can be readily understood that the term or phrase forefoot area can be used to indicate a portion of a wearer's foot, article of footwear, or sub-component thereof which is configured to be disposed anterior of a line drawn between 69% of foot length on the medial side which is approximately 195 mm, and 63% of foot length on the lateral side which is approximately 178 mm from the back or posterior side of a last for a typical size 9 men's article of footwear. Further, in this disclosure the term or phrase forefoot area will also be used to indicate a portion of an article of footwear or a sub-component thereof which is configured to underlie or be disposed about the metatarsal heads of a wearer's foot and/or the ball of the foot as defined herein.

In this disclosure, a surface is hereby defined as being substantially smooth when its typical surface roughness is such as to not exceed a range of variation which is in the range including and between the smoothness of the surface of typical window glass, and a surface having peaks and valleys and/or other irregularities which do not typically exceed variations in height or depth greater than 1.75 mm which is 0.06889764 inches. This definition can be relevant to the joining of opposing surfaces such as the inferior side of a shoe upper to the superior side of a sole footwear component using pressure sensitive double-sided adhesive tape.

In this disclosure, a material having an extremely low surface energy is hereby defined as a material which exhibits a water contact angle of equal to or greater than 92 degrees and is therefore hydrophobic, a material having a low surface energy is defined and as a material which exhibits a water contact angle between 80-92 degrees, a material having a moderate surface energy is defined as a material which exhibits a water contact angle between 70-80 degrees, and a material having a high surface energy is defined as a material which exhibits a water contact angle between 30-70 degrees. These definitions with regards to surface energy can be relevant to the subject of adhesion and bonding.

BRIEF DESCRIPTION OF THE DRAWINGS

FIG. 120 is a top view of an alternative embodiment of a sole including a plastic or elastomeric insert which includes a plurality of female receptacles.

FIG. 121 is a top view of an alternative embodiment of a sole including a frame extending upwards about the top edge of the sole.

FIG. 122 is a top view of an alternative embodiment of a lasting plate having a middle portion which is more flexible relative to the anterior portion and posterior portion.

FIG. 123 is a medial side view of an embodiment of a shoe having a sole including a fluid-filled bladder disposed between the posterior side of the article of footwear and a flex groove in the sole.

FIG. 124 is a medial side view of an embodiment of a shoe having a sole including at least one fluid-filled bladder including a frame extending upwards from the top edge of the sole.

FIG. 125 is a medial side view of an embodiment of a shoe having a first sole portion including at least one fluid-filled bladder, and also an inferior spring element including a removeable and replaceable second sole portion.

FIG. 126 is a medial side view of an embodiment of a shoe having a first sole portion including an elastomeric foam material, and a second sole portion including an inferior spring element including a removable and replaceable fluid-filled bladder.

FIG. 127 is a medial side view of a sole having an anterior sole portion and a posterior sole portion which are coupled together with a bridge plate.

FIG. 128 is a lateral side view of a boot including an upper, lasting plate and/or superior spring element, and sole.

FIG. 129 is an exploded lateral side view of an embodiment of an article of footwear including an upper, a lasting plate including an insole, and a sole.

FIG. 130 is a lateral side view of two embodiments of casual articles of footwear each including an upper, a lasting plate including an insole, and a sole.

FIG. 131 is a top view of a lasting plate including an anterior portion, a flexible middle portion, a posterior portion, and including a plurality of hooks.

Figure 131:
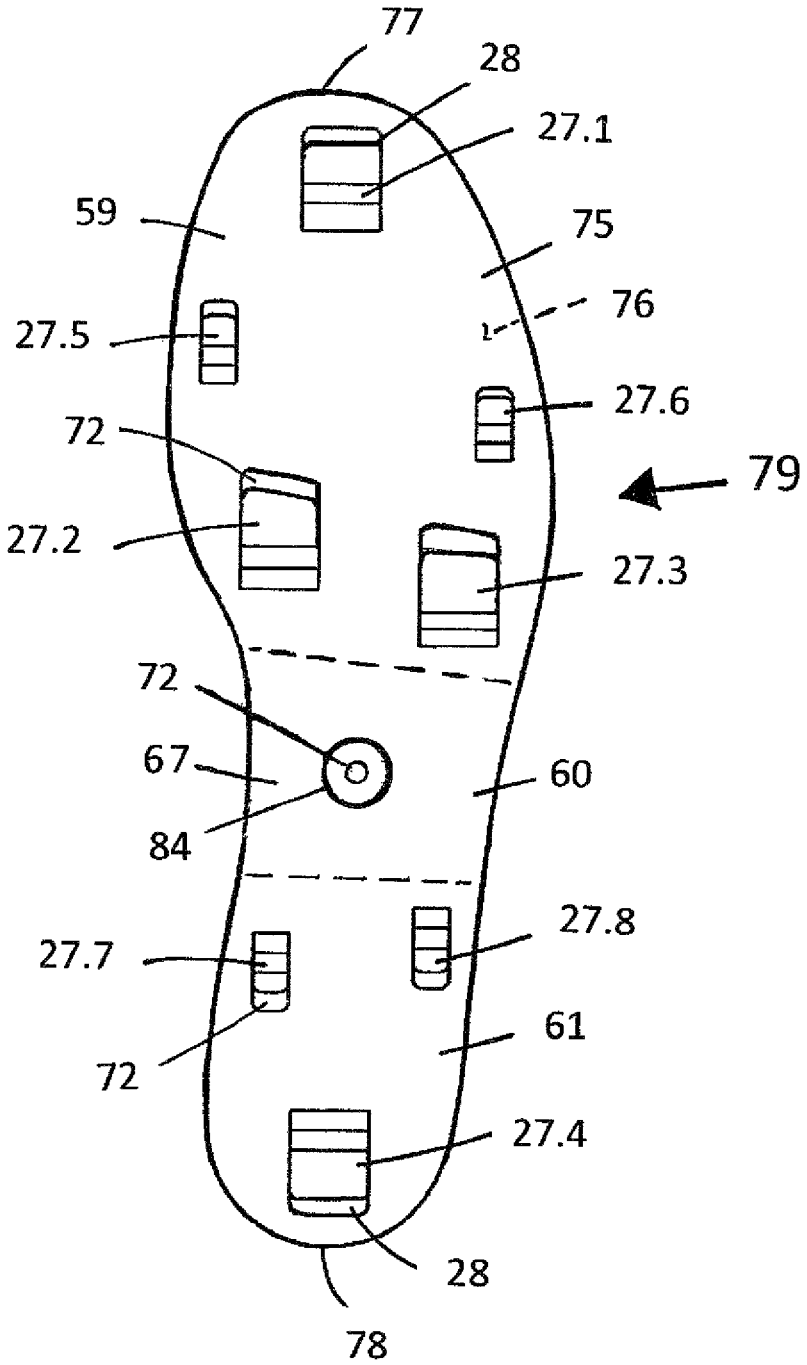
Figure 132:
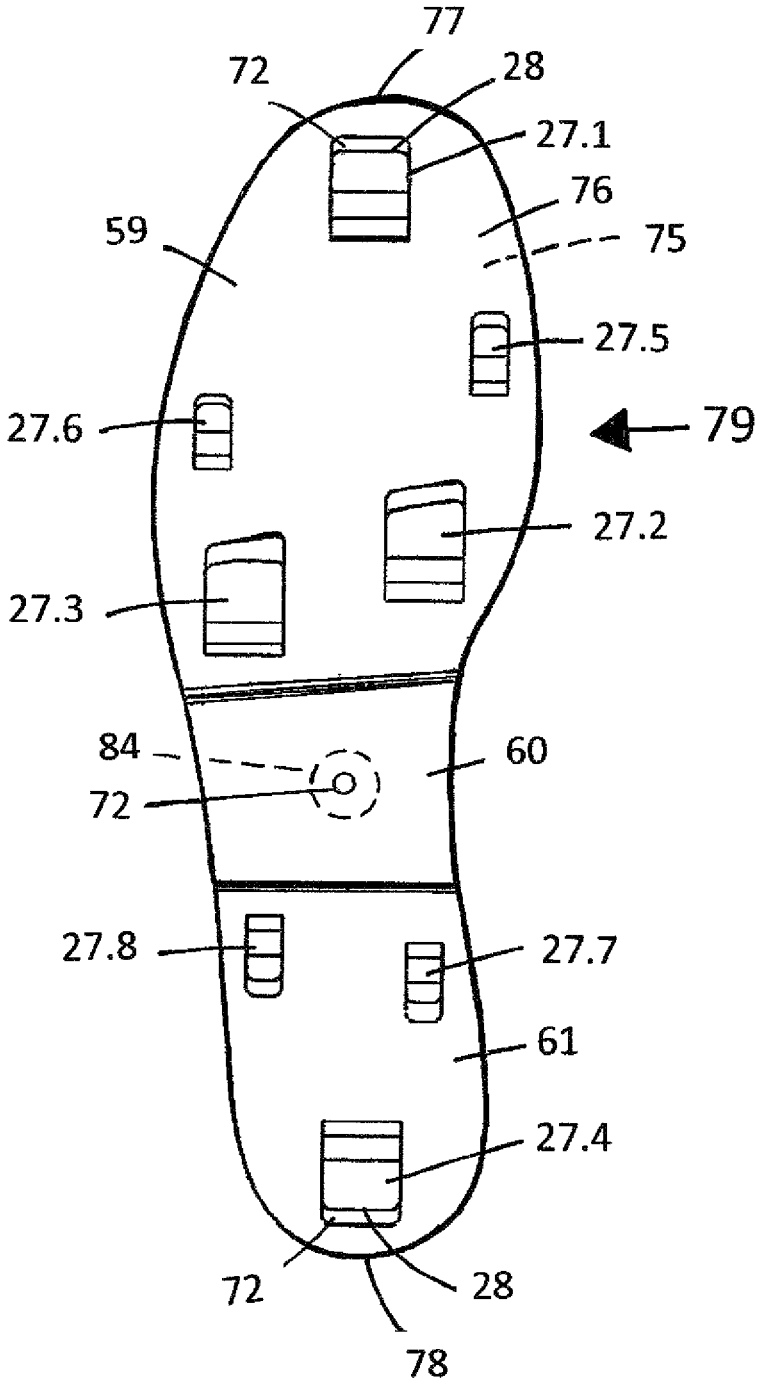

FIG. 132 is a bottom view of the lasting plate shown in FIG. 131.

Figure 133:
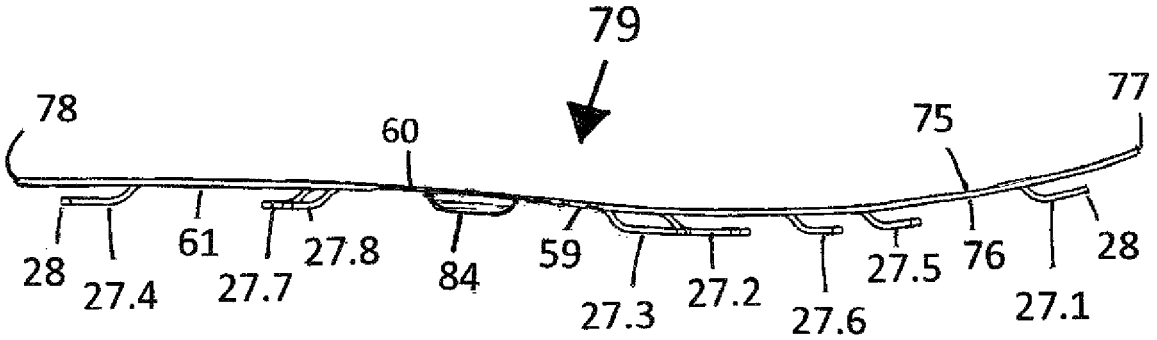

FIG. 133 is a side view of the lasting plate shown in FIGS. 131 and 132.

Figure 134:
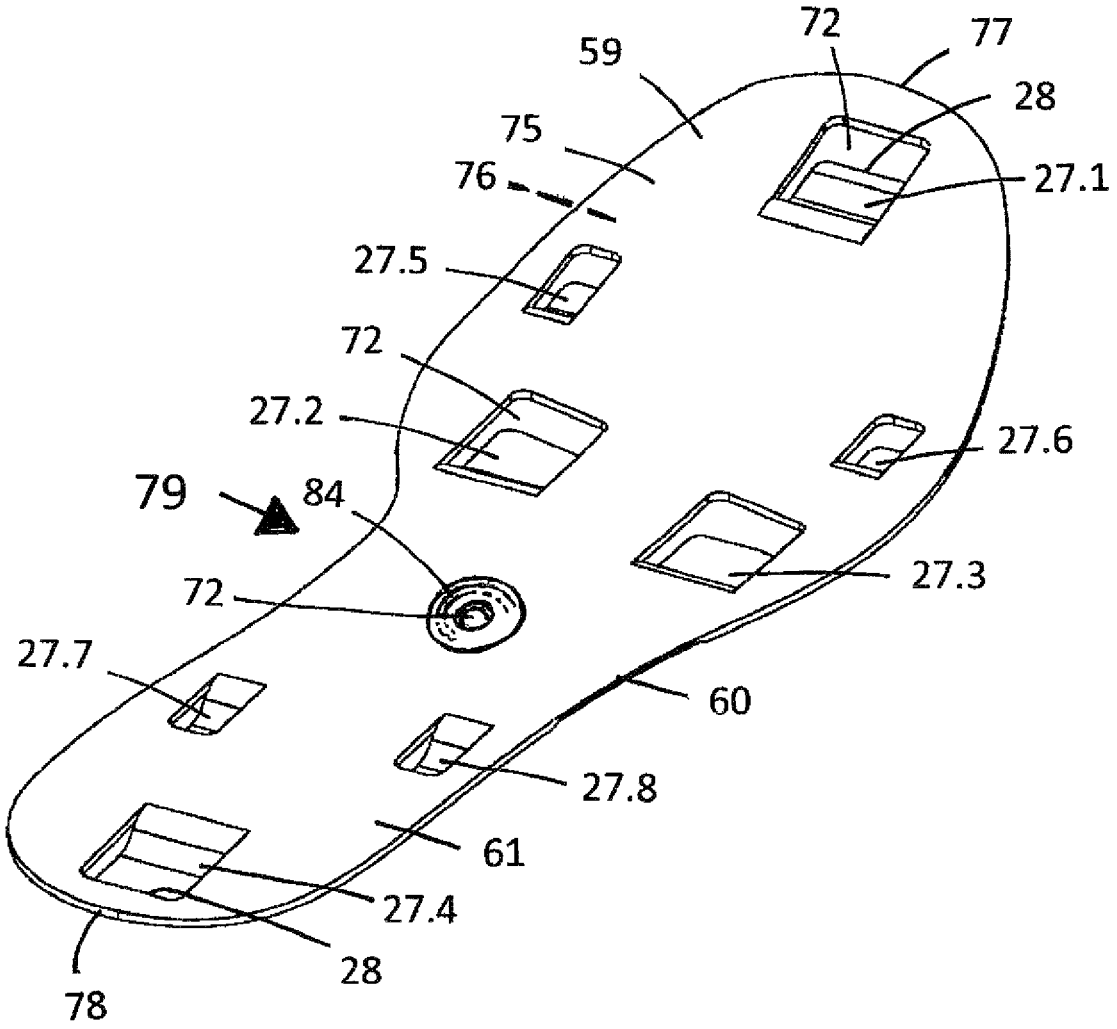

FIG. 134 is a perspective view of the lasting plate shown in FIGS. 131, 132, and 133.

Figure 135:
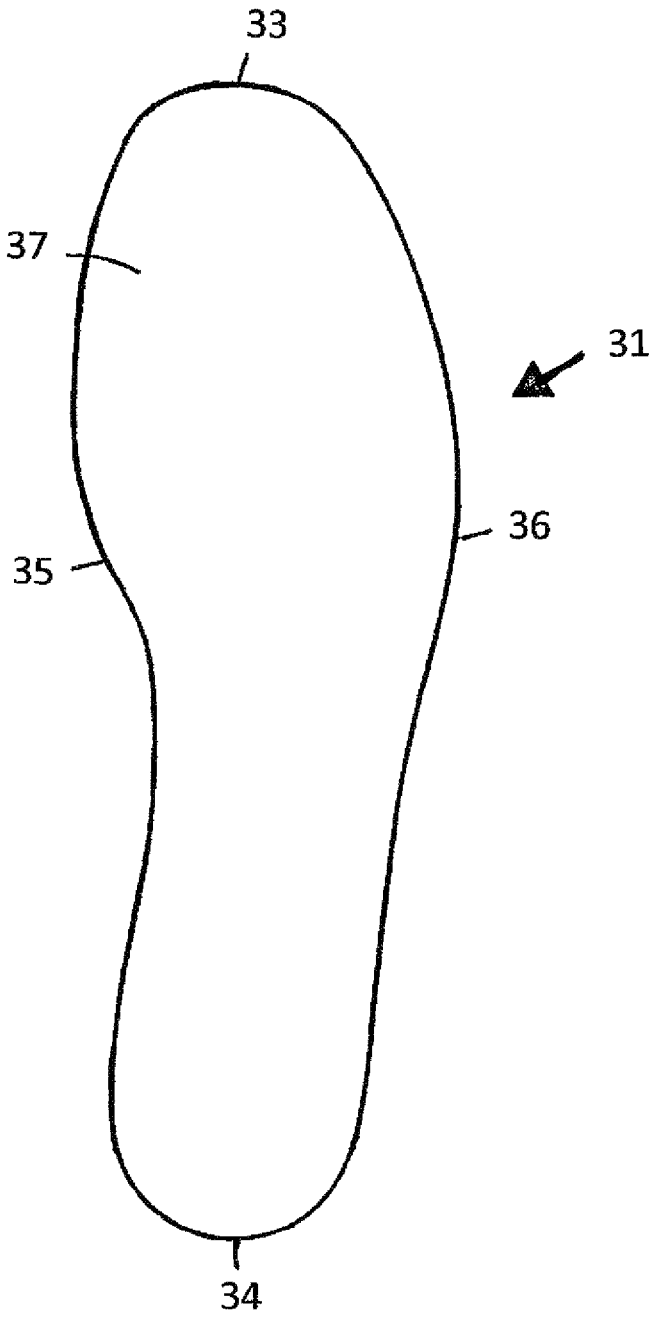

FIG. 135 is a top view of an insole.

Figure 136:
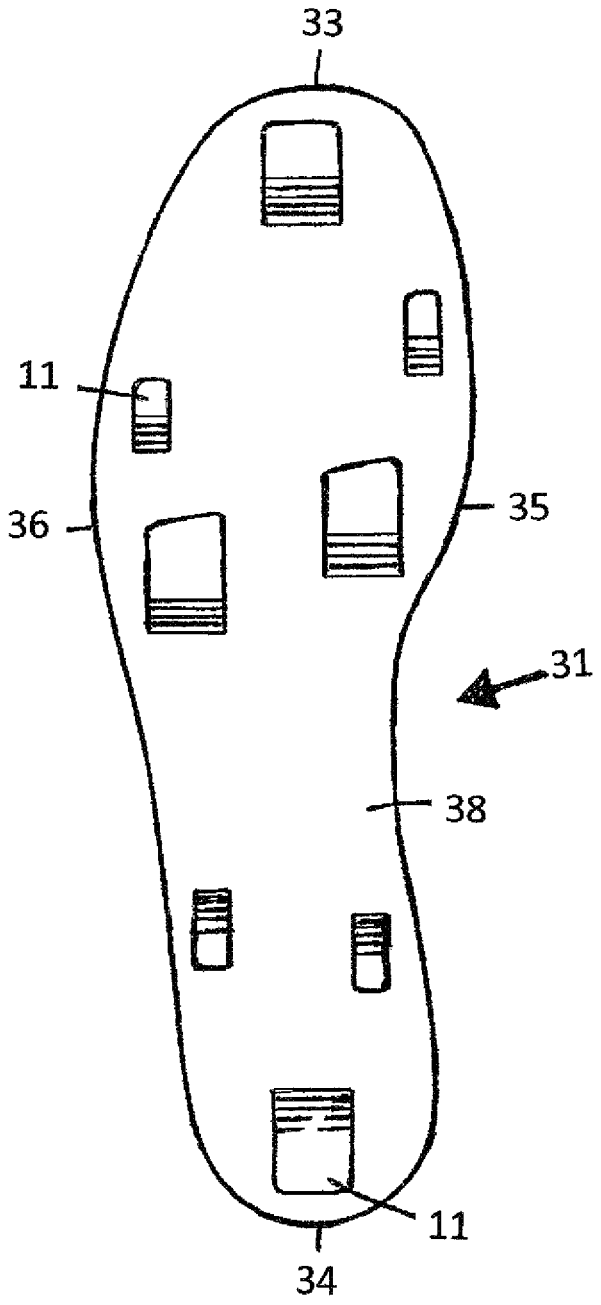

FIG. 136 is a bottom view of the insole shown in FIG. 135.

Figure 137:
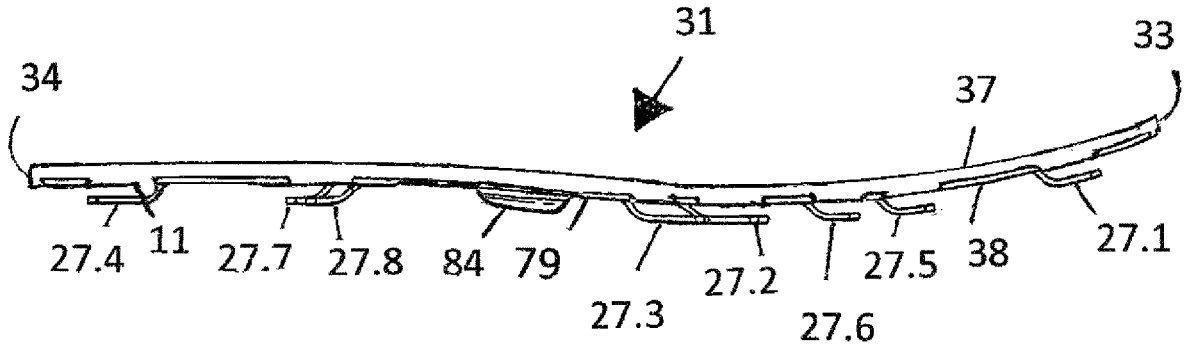

FIG. 137 is a side view of the insole shown in FIGS. 135 and 136 disposed on the lasting plate shown in FIG. 131.

Figure 138:
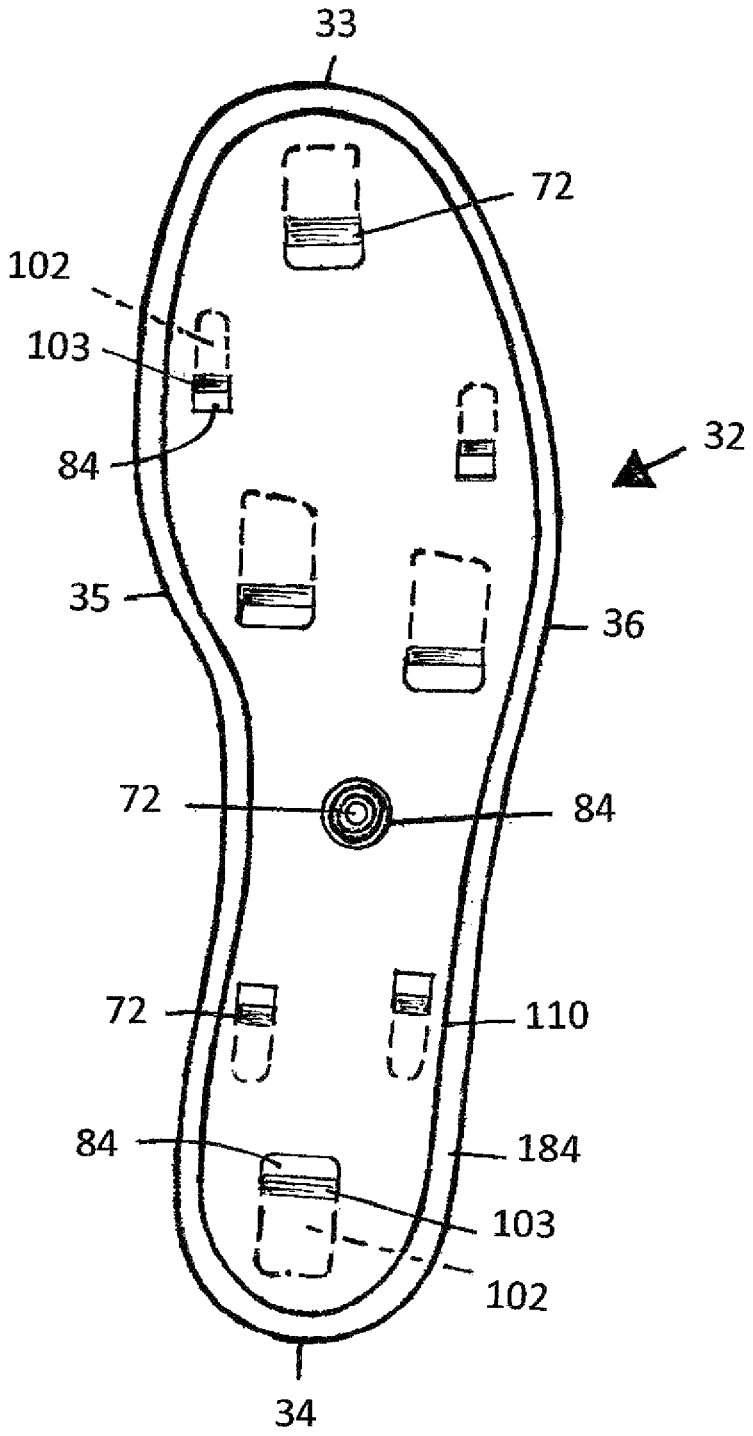

FIG. 138 is a top view of a sole including an elevated top edge, a sidewall, and a plurality of female receptacles.

Figure 139:
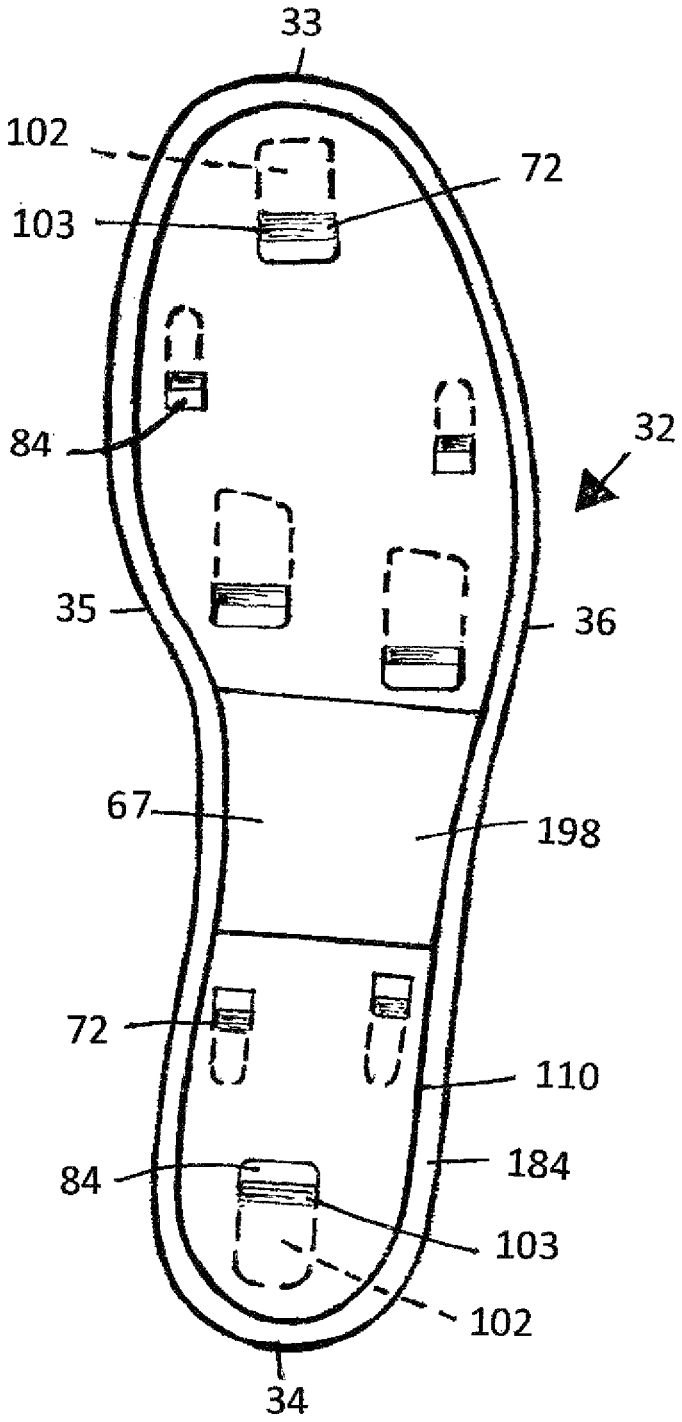

FIG. 139 is a top view of a sole generally similar to the one shown in FIG. 138 including a pressure sensitive adhesive.

Figure 140:
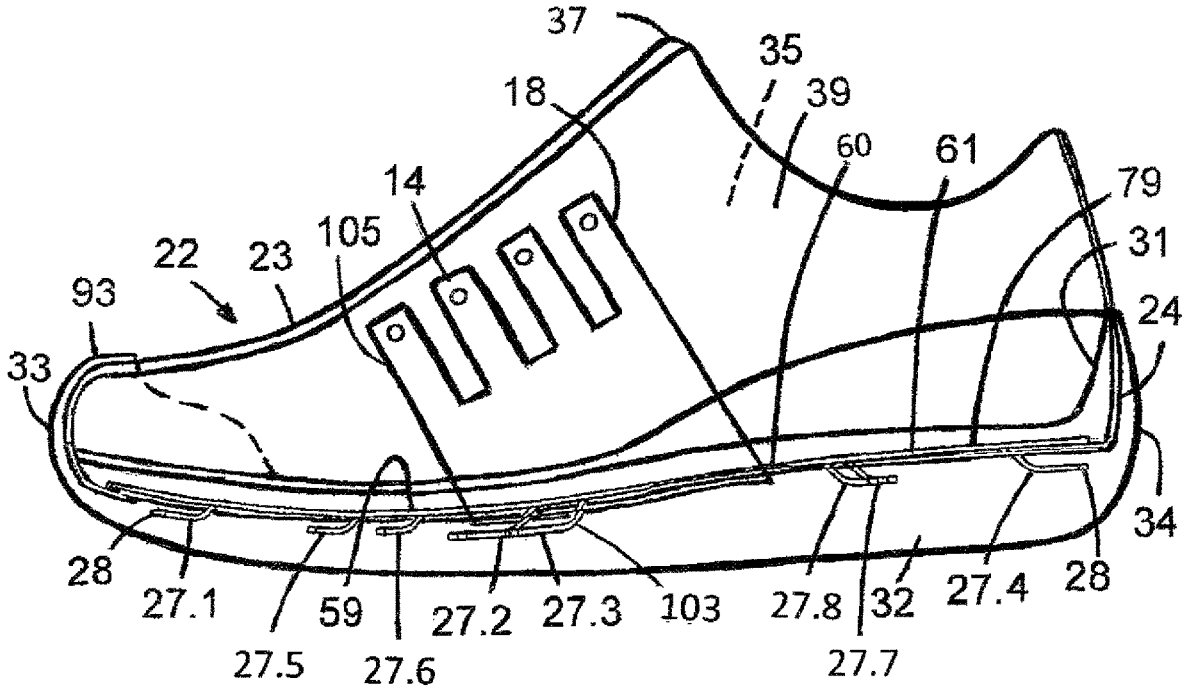

FIG. 140 is a side x-ray and/or parts broken away view of an article of footwear including the lasting plate shown in FIGS. 131, 132, 133, 134, and a sole generally similar to the one shown in FIGS. 138 and 139.

Figure 141:
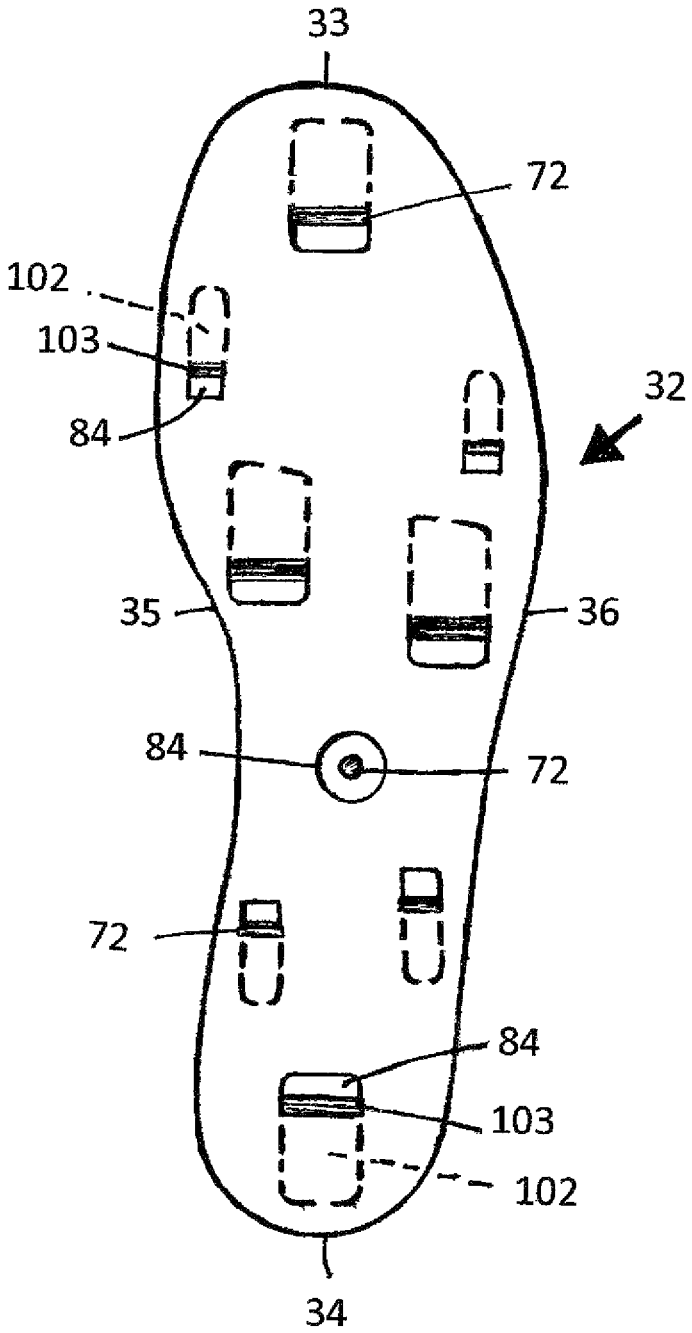

FIG. 141 is a top view of an alternative sole including a plurality of female receptacles.

Figure 142:
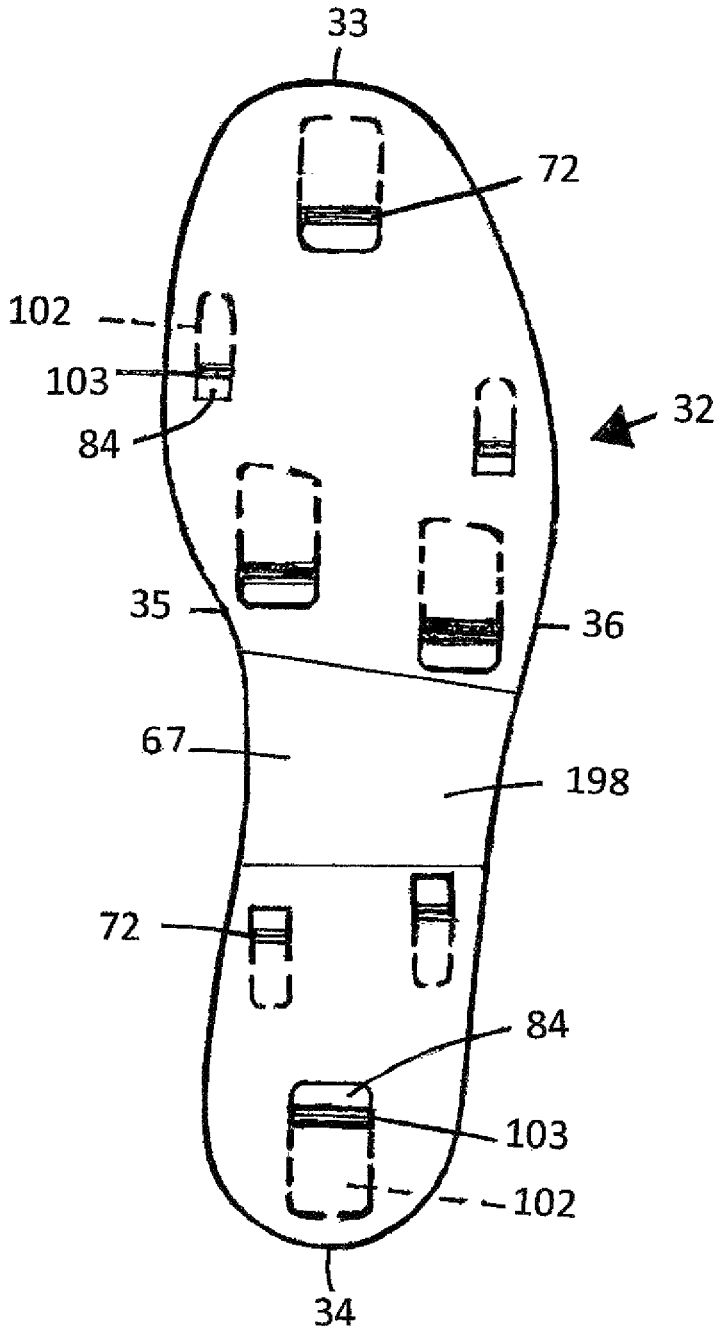

FIG. 142 is a top view of a sole generally similar to the one shown in FIG. 141 including a pressure sensitive adhesive disposed in the midfoot area.

Figure 143:
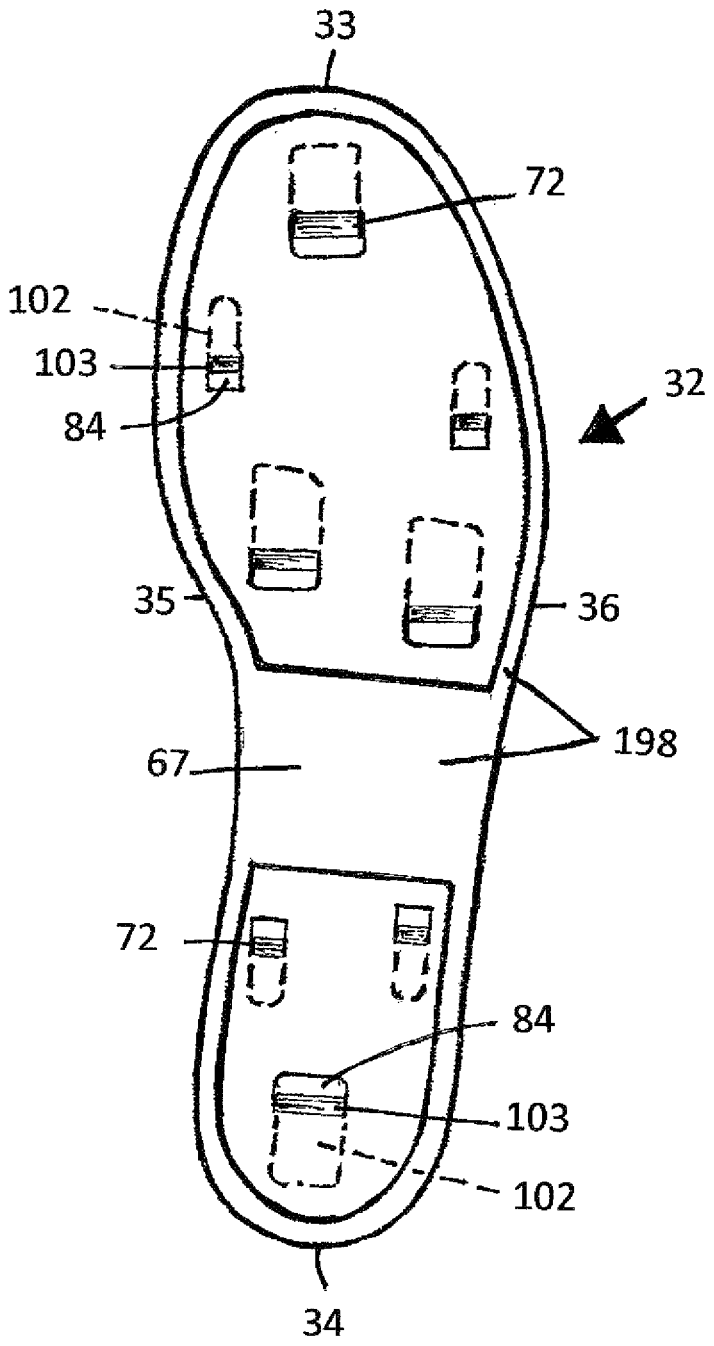

FIG. 143 is a top view of a sole generally similar to the one shown in FIG. 142 including a pressure sensitive adhesive disposed in the midfoot area and also about the perimeter of the sole.

Figure 144:
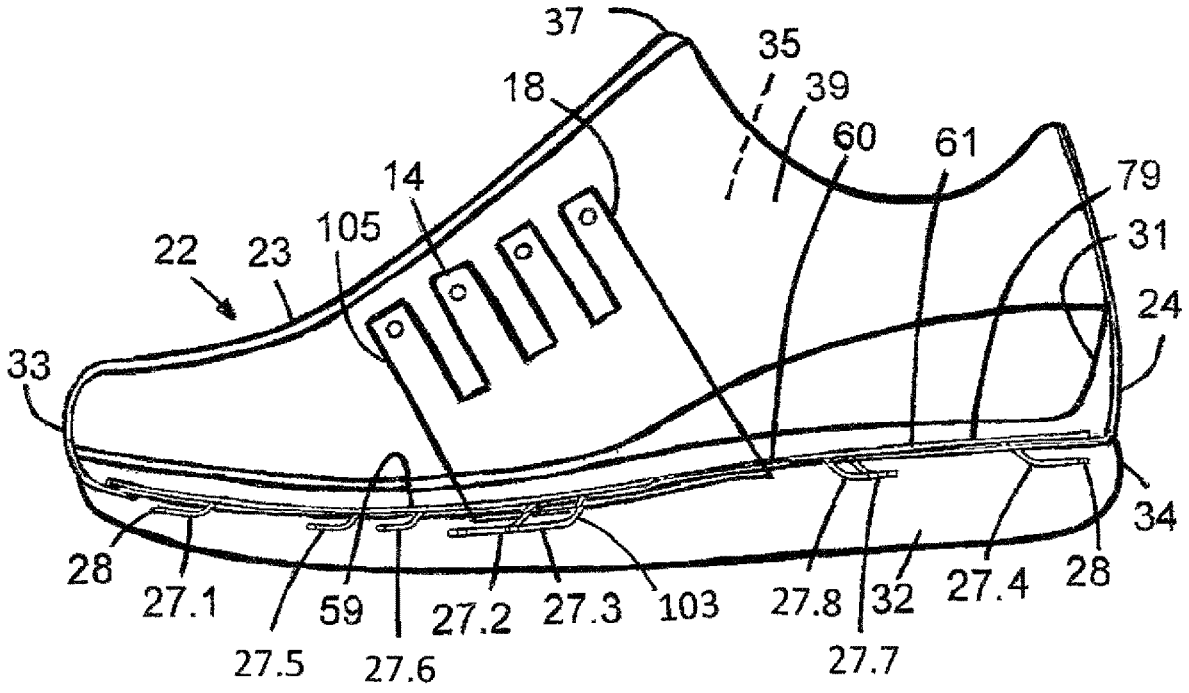

FIG. 144 is a side x-ray and/or parts broken away view of an article of footwear including the lasting plate shown in FIGS. 131, 132, 133, 134, and a sole generally similar to the one shown in FIGS. 141 and 143.

Figure 145:
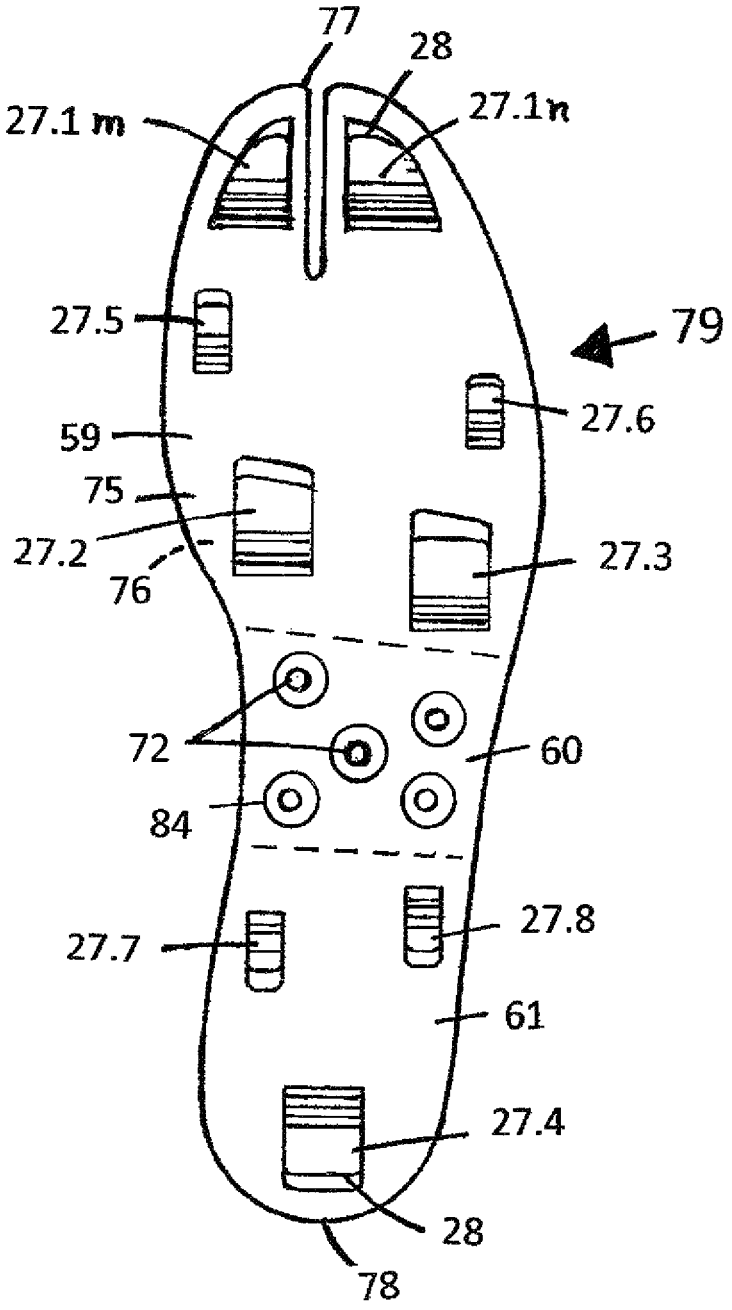

FIG. 145 is a top view of an alternative lasting plate including an anterior portion, a flexible middle portion including a plurality of openings, a posterior portion, and a plurality hooks.

Figure 146:
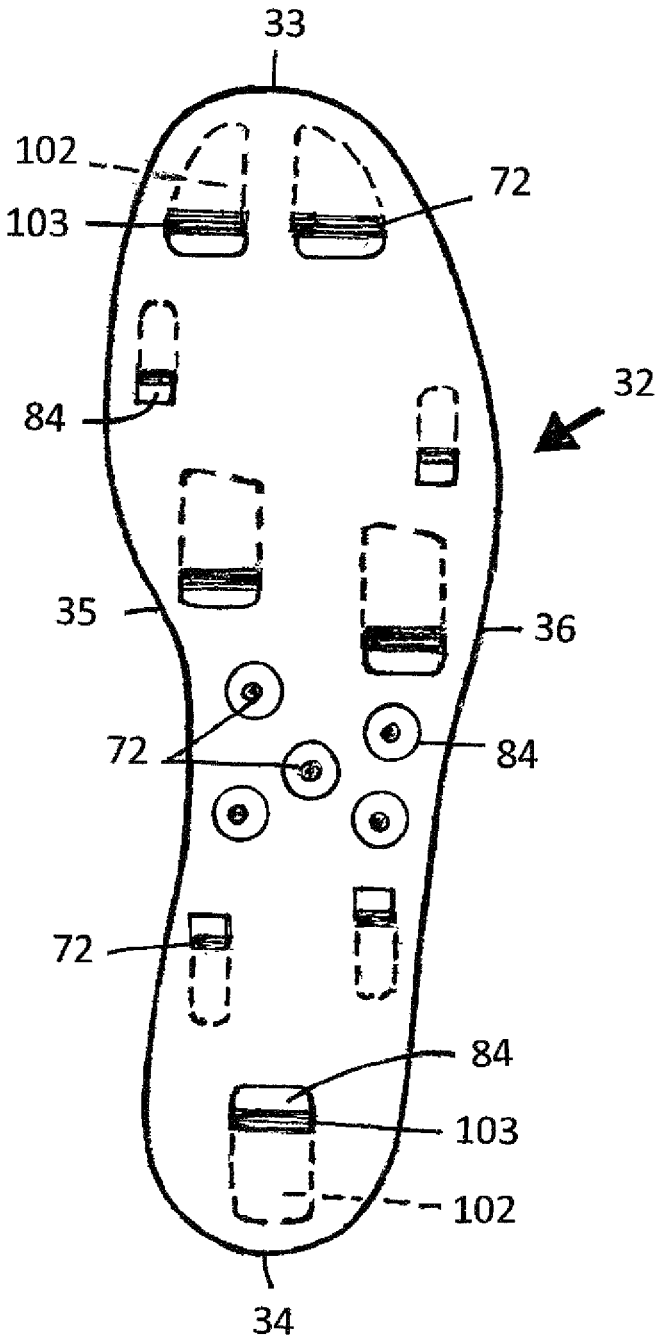

FIG. 146 is a top view of a sole including a plurality of female receptacles and a plurality of openings in the midfoot area.

Figure 147:
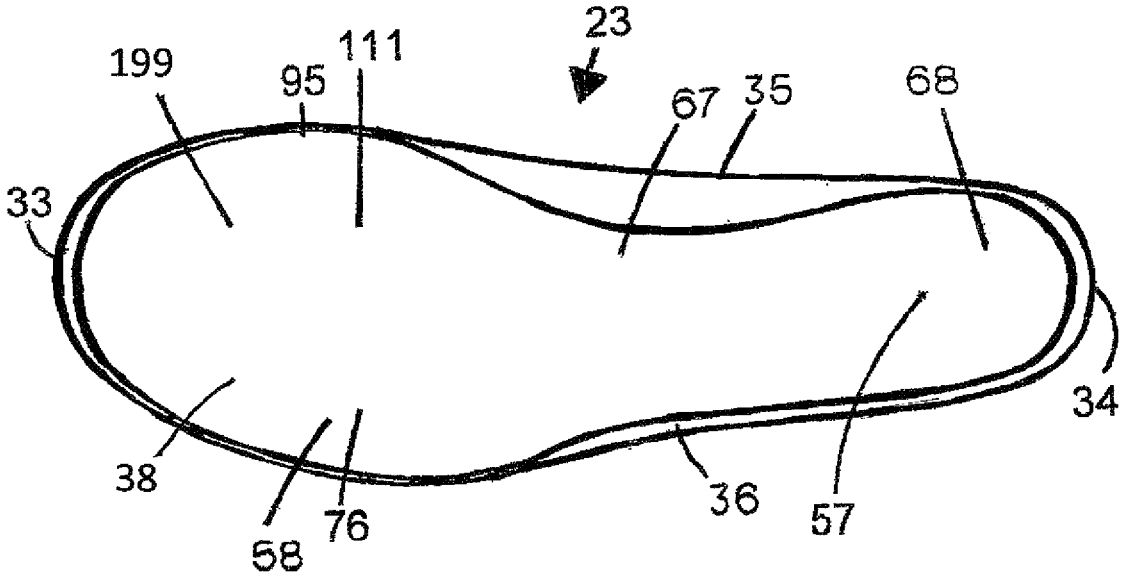

FIG. 147 is a bottom view of an alternative shoe upper including a bottom or inferior side including a smooth surface.

Figure 148:
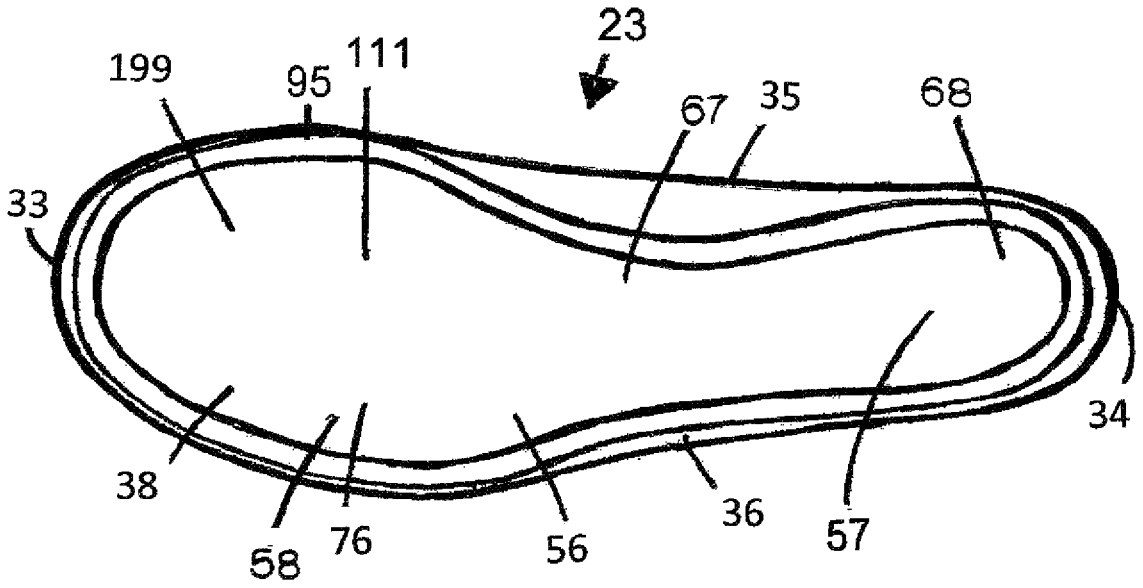

FIG. 148 is a bottom view of an alternative shoe upper including a bottom or inferior side including a T-shock including a smooth surface.

Figure 149:
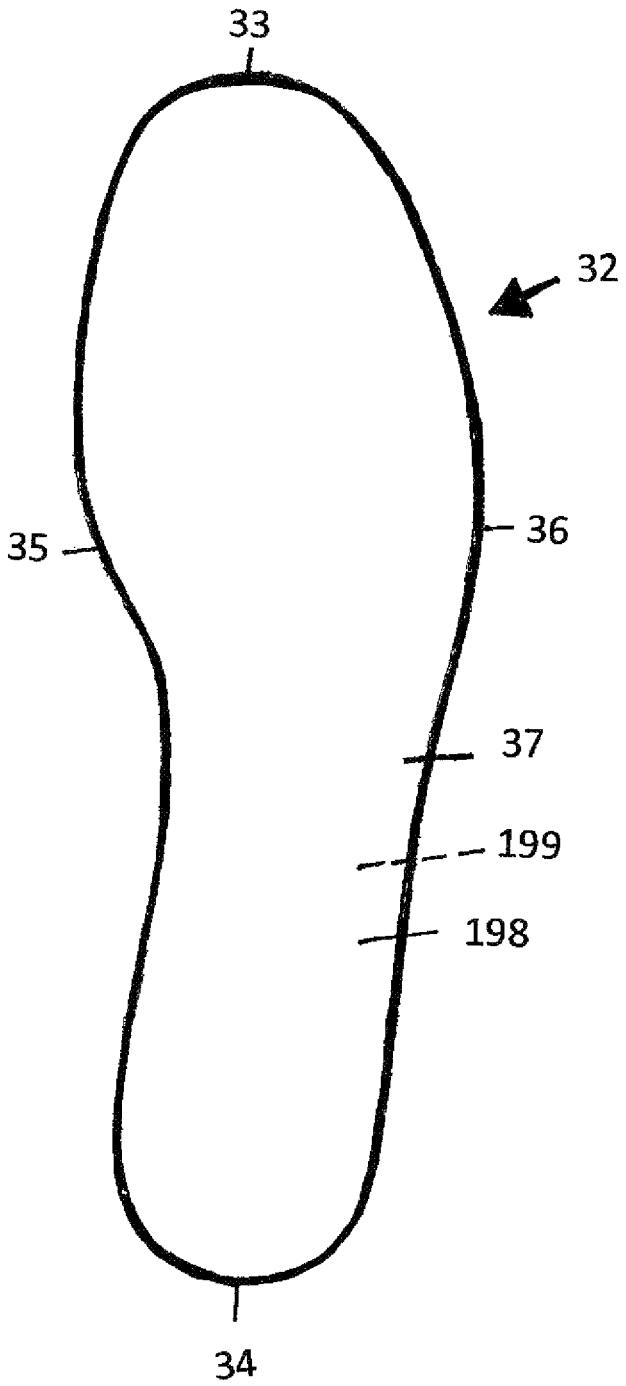

FIG. 149 is a top view of an alternative sole including a pressure sensitive adhesive.

Figure 150:
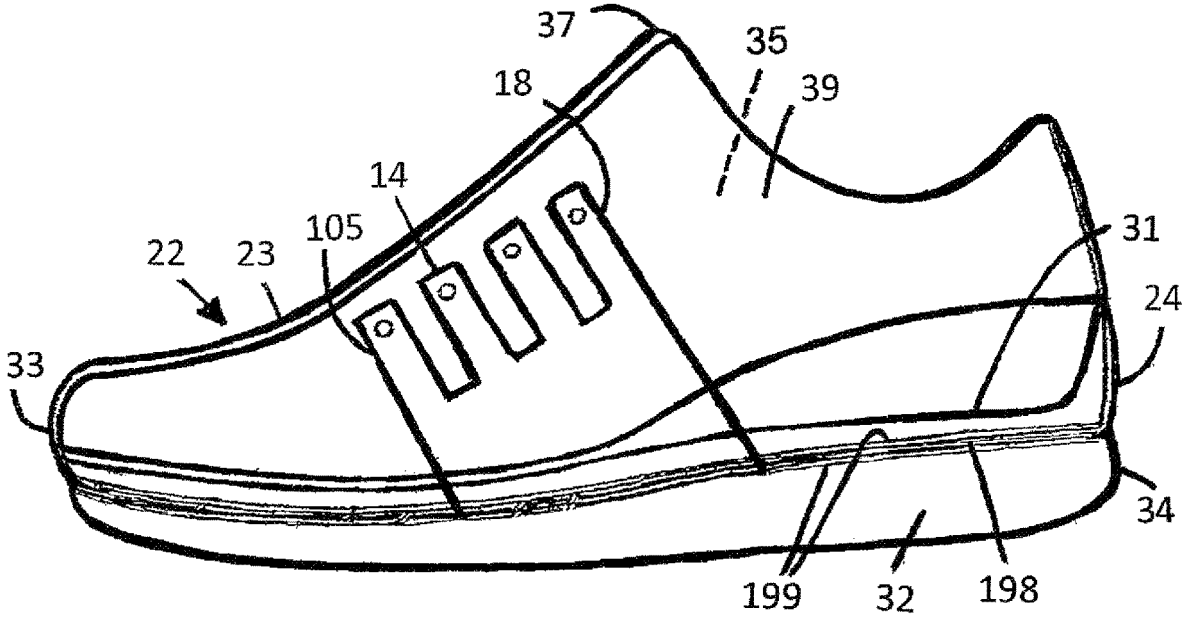

FIG. 150 is a side x-ray and/or parts broken away view of an article of footwear including a sole generally similar to the one shown in FIG. 149.

Figure 151:
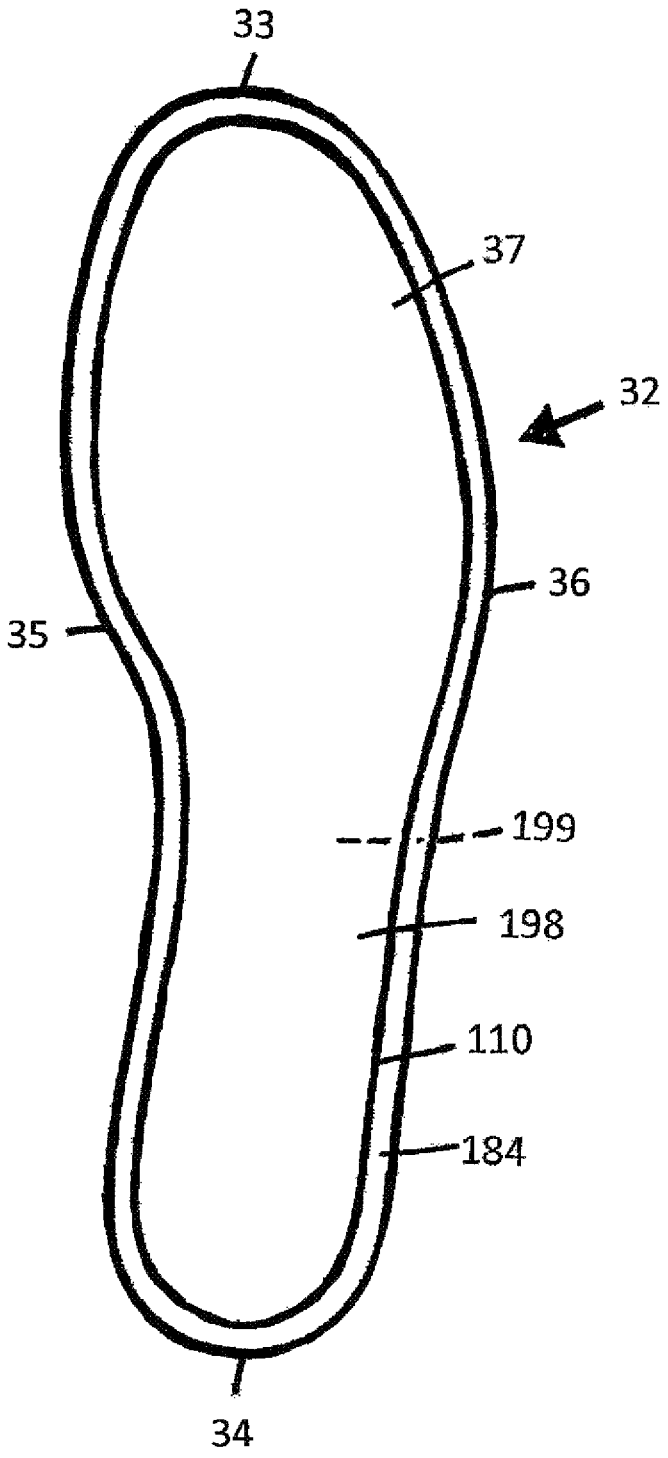

FIG. 151 is a top view of an alternative sole including a pressure sensitive adhesive, a top edge, and a sidewall.

Figure 152:
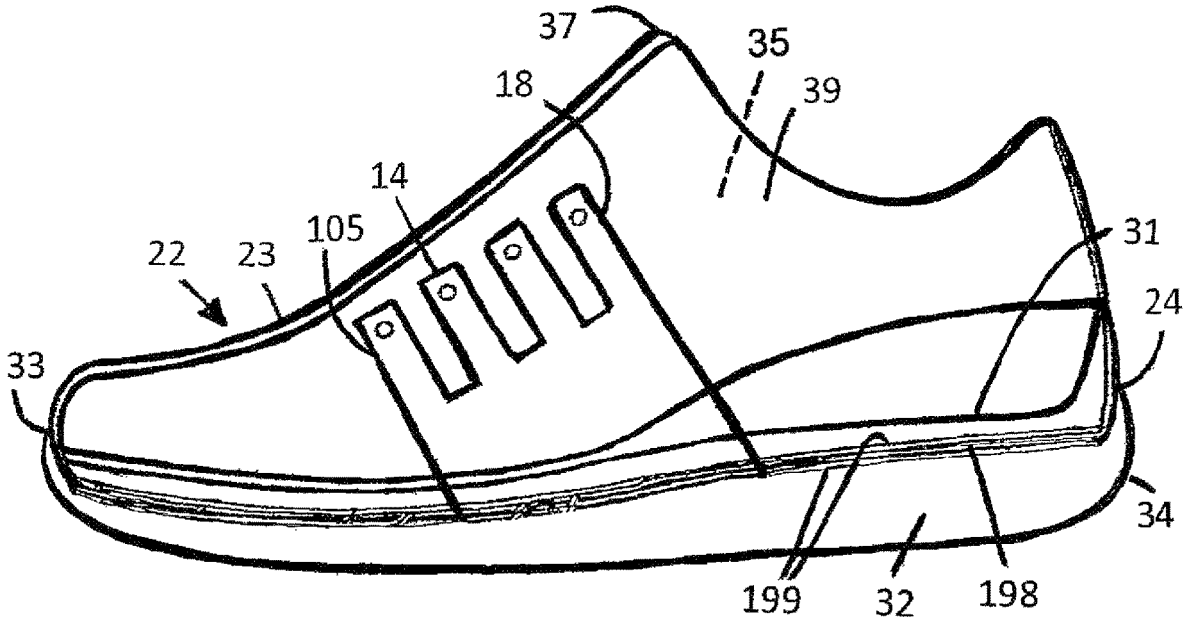

FIG. 152 is a side x-ray and/or parts broken away view of an article of footwear including a sole generally similar to the one shown in FIG. 151.

Figure 153:
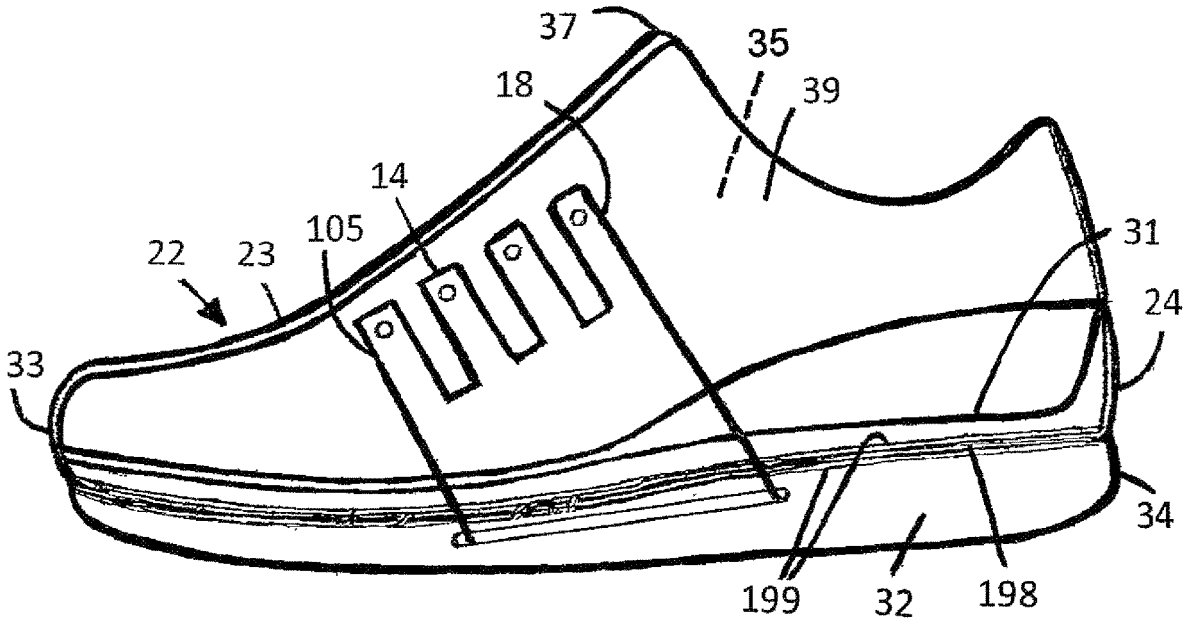

FIG. 153 is a side x-ray and/or parts broken away view of an article of footwear including an alternative sole generally similar to the one shown in FIG. 151 further including an opening for receiving a strap.

Figure 154:
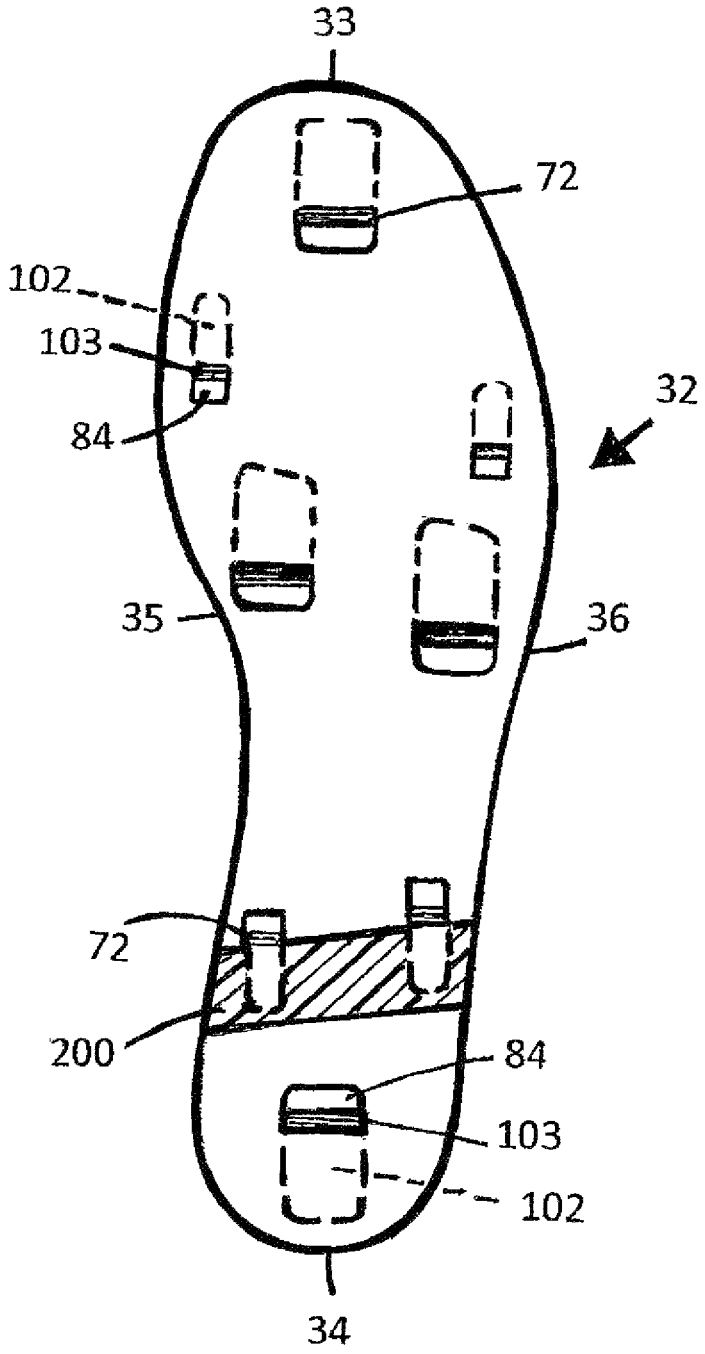

FIG. 154 is a top view of an alternative sole generally similar to the one shown in FIG. 141 further including a female receptacle reinforcement.

Figure 155:
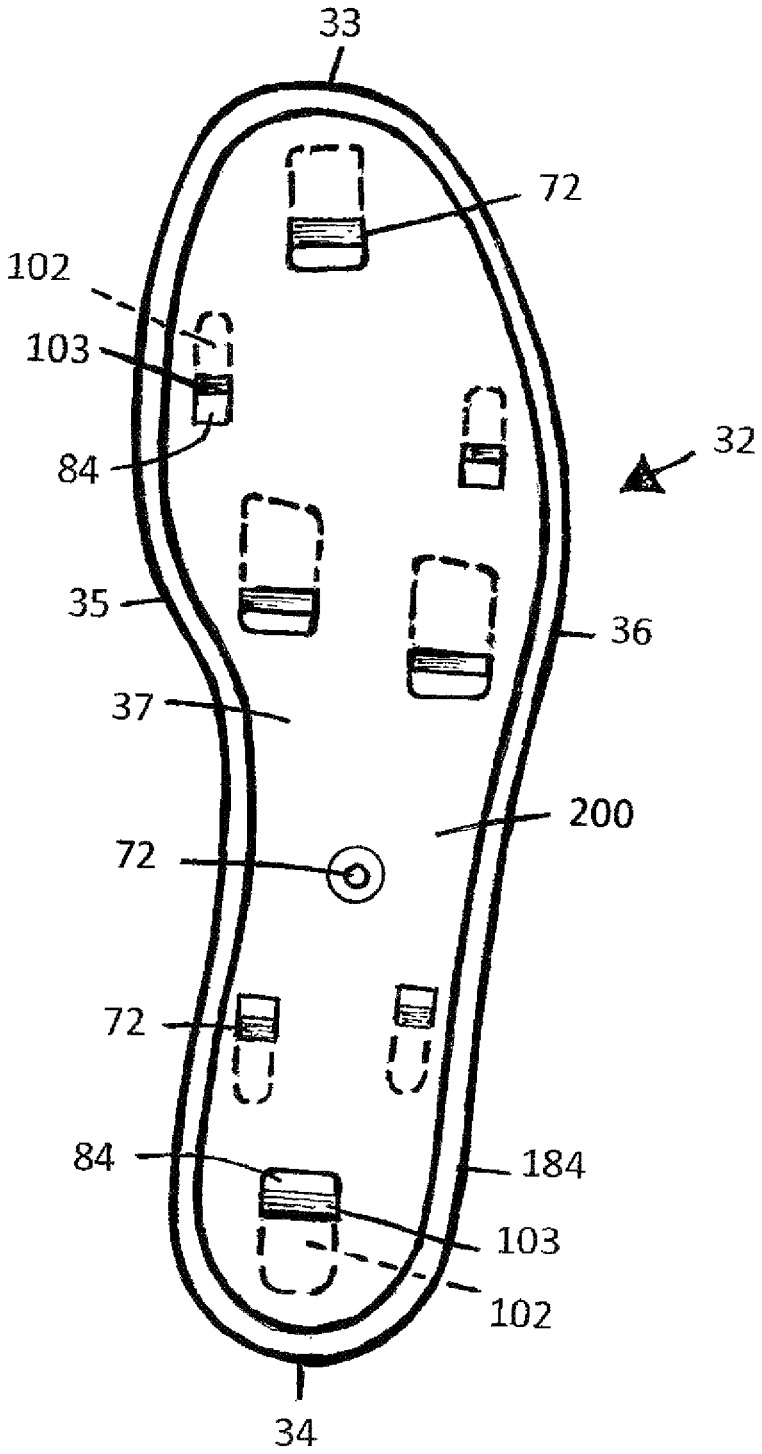

FIG. 155 is a top view of an alternative sole generally similar to the one shown in FIG. 141 further including an alternative female receptacle reinforcement.

Figure 156:
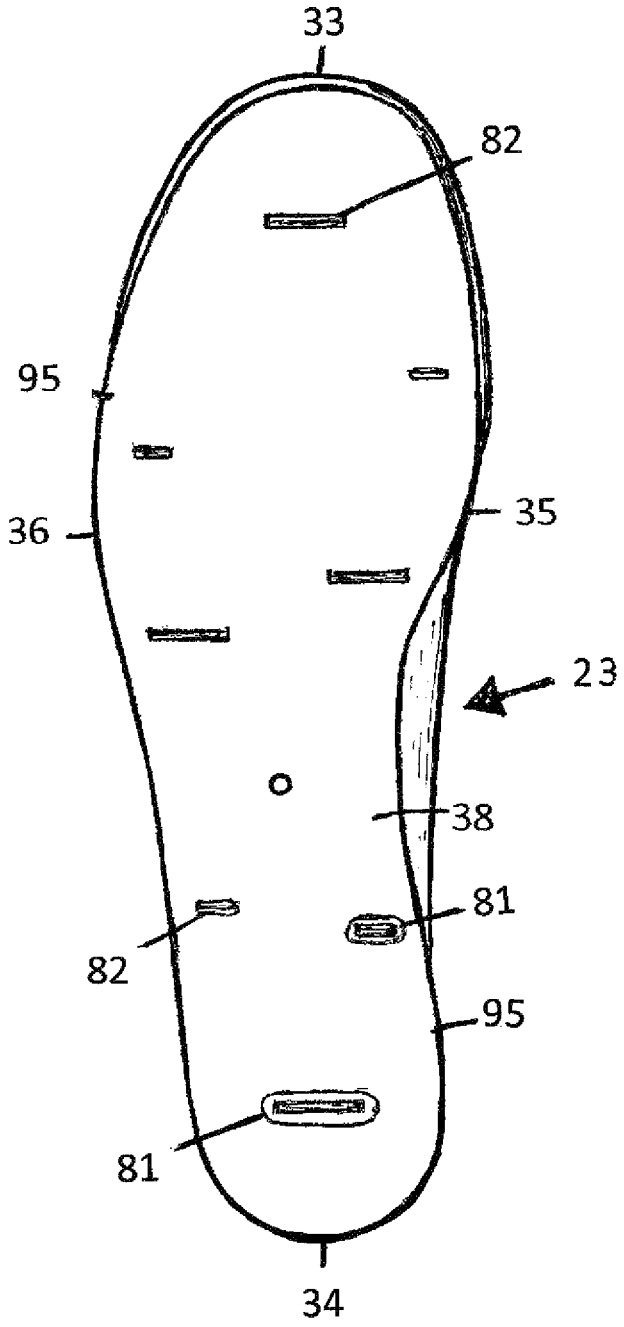

FIG. 156 is a bottom view of a shoe upper including a plurality of slits.

Figure 157:
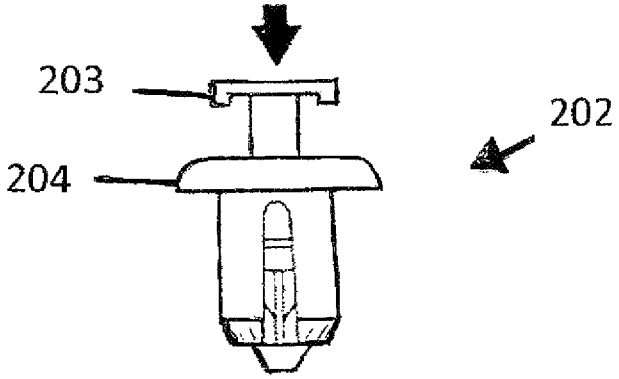

FIG. 157 is a side view of a prior art push-fastener in the open position.

Figure 158:
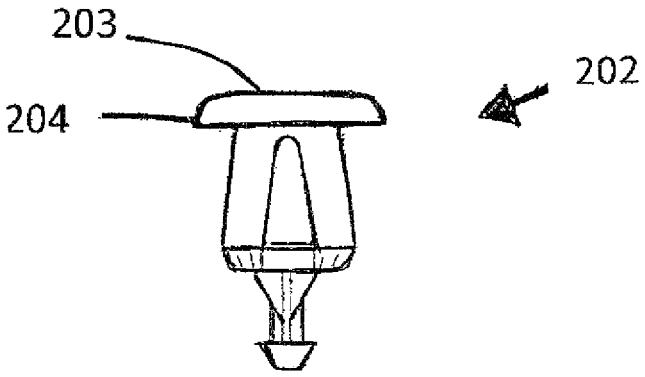
PRIOR ART FIG. 158

FIG. 158 is a side view of the prior art push-fastener in the closed position.

Figure 159:
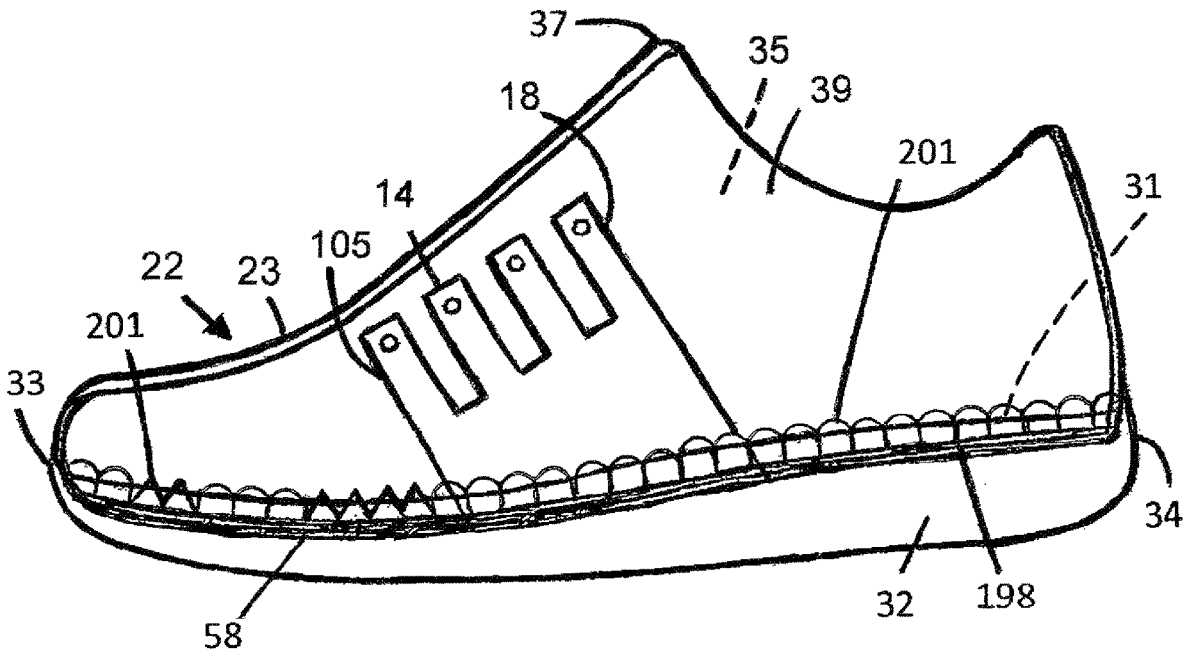

FIG. 159 is a side x-ray and/or parts broken away view of an article of footwear including a sole generally similar to the one shown in FIG. 151 further including a top edge including a plurality of notches having U and V shapes.

Figure 160:
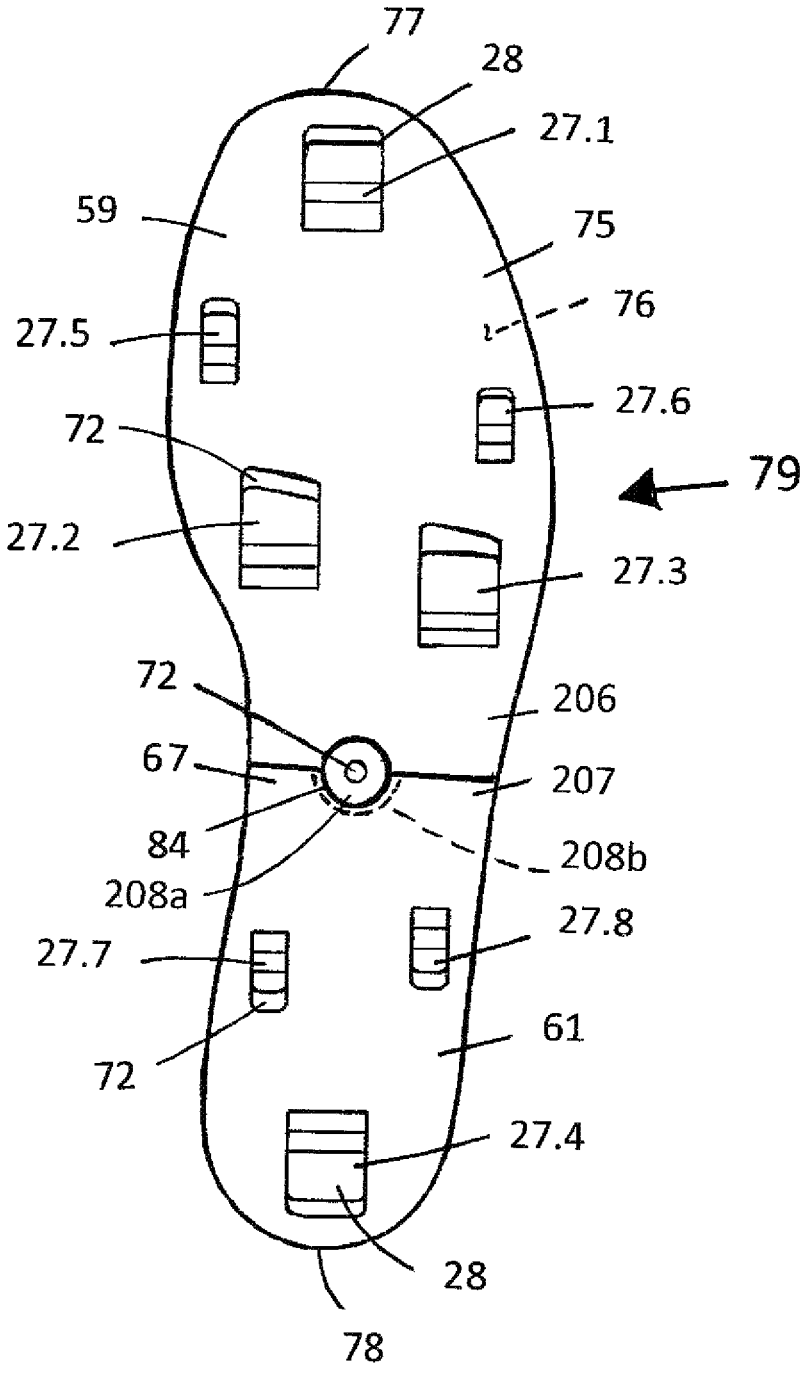

FIG. 160 is a top view of an alternative two-part lasting plate including an anterior component and a posterior component.

Figure 161:
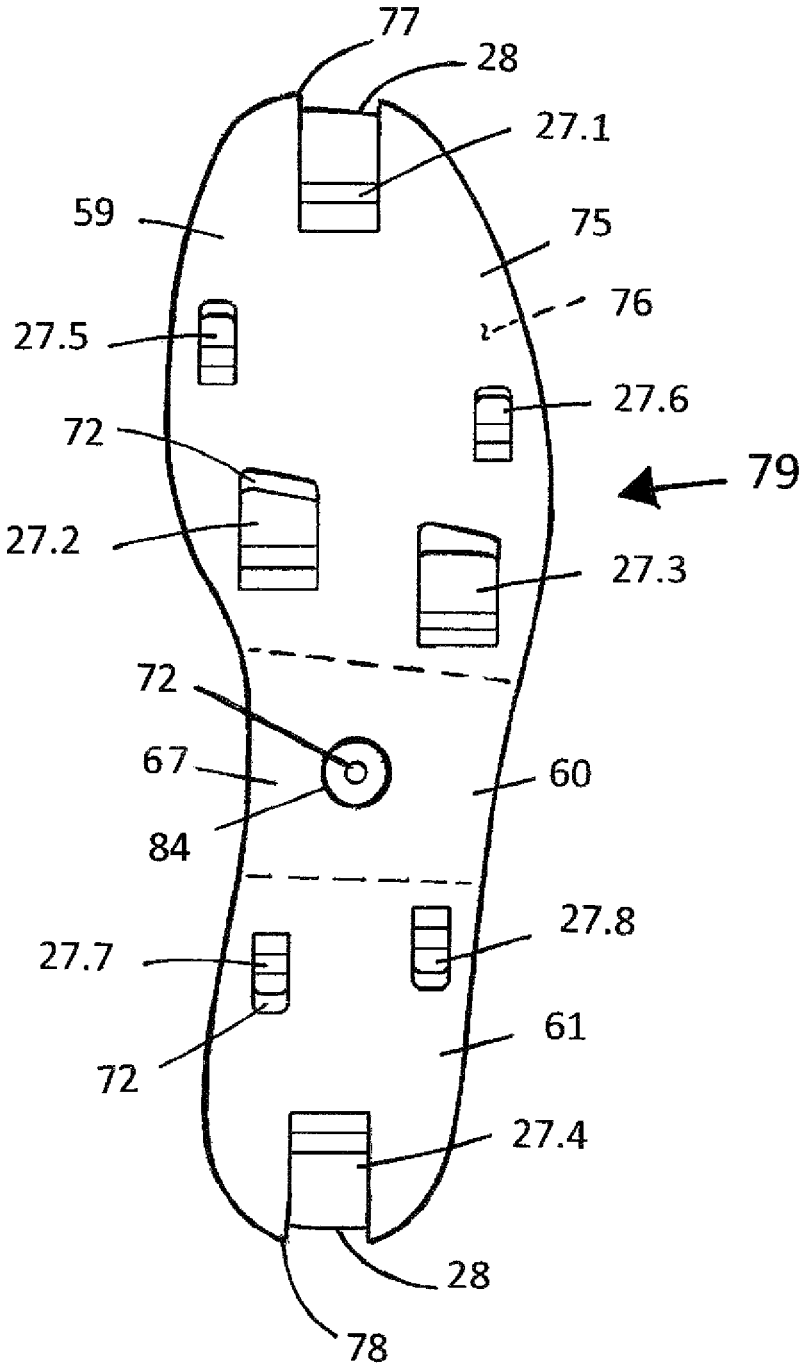

FIG. 161 is a top view of an alternative lasting plate which is discontinuous near the front side and back side and also includes larger hooks 27.1 and 27.4 relative to the lasting plate shown in FIG. 131.

Figure 162:
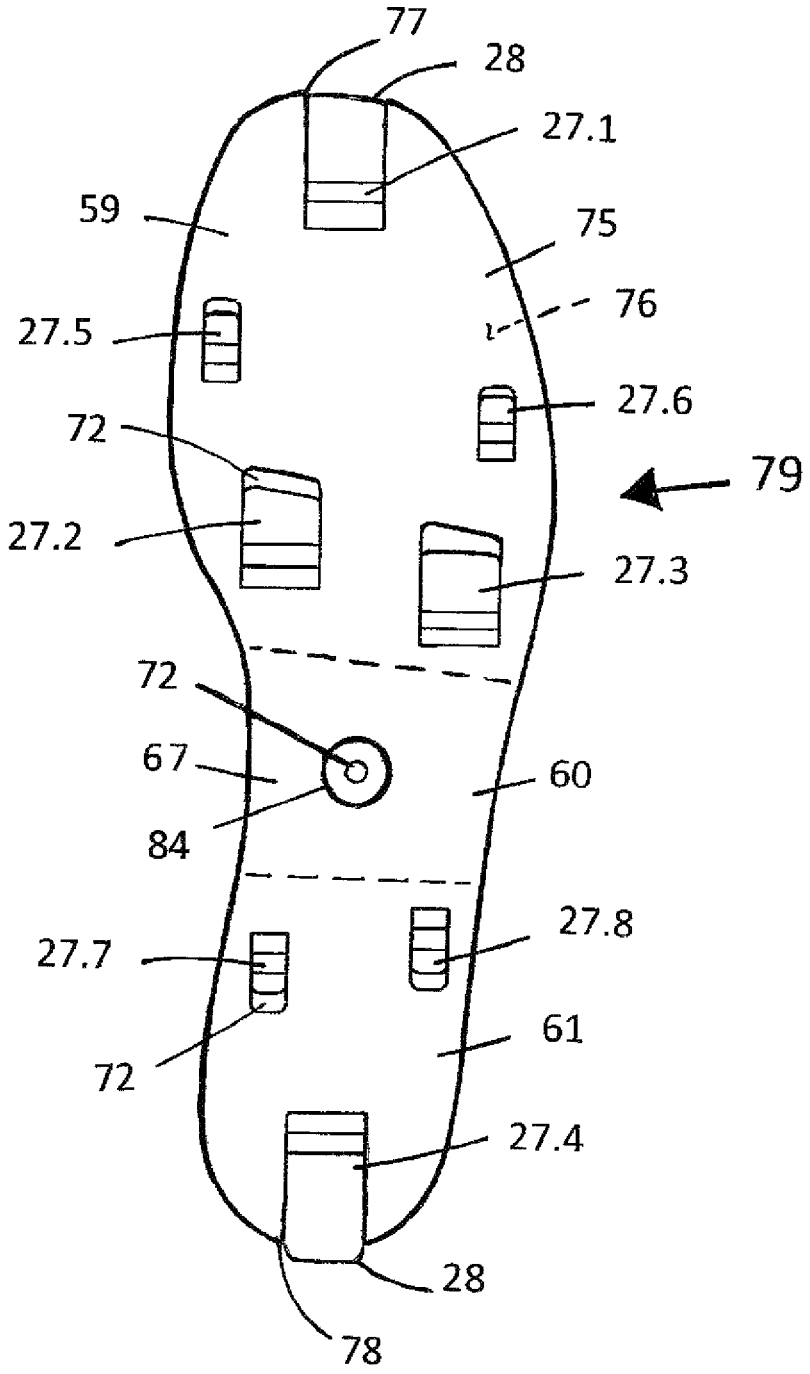

FIG. 162 is a top view of an alternative lasting plate generally similar to the one shown in FIG. 161 which is also discontinuous near the front side and back side, but which includes larger hooks 27.1 and 27.4 relative to the lasting plate shown in FIG. 161.

Figure 163:
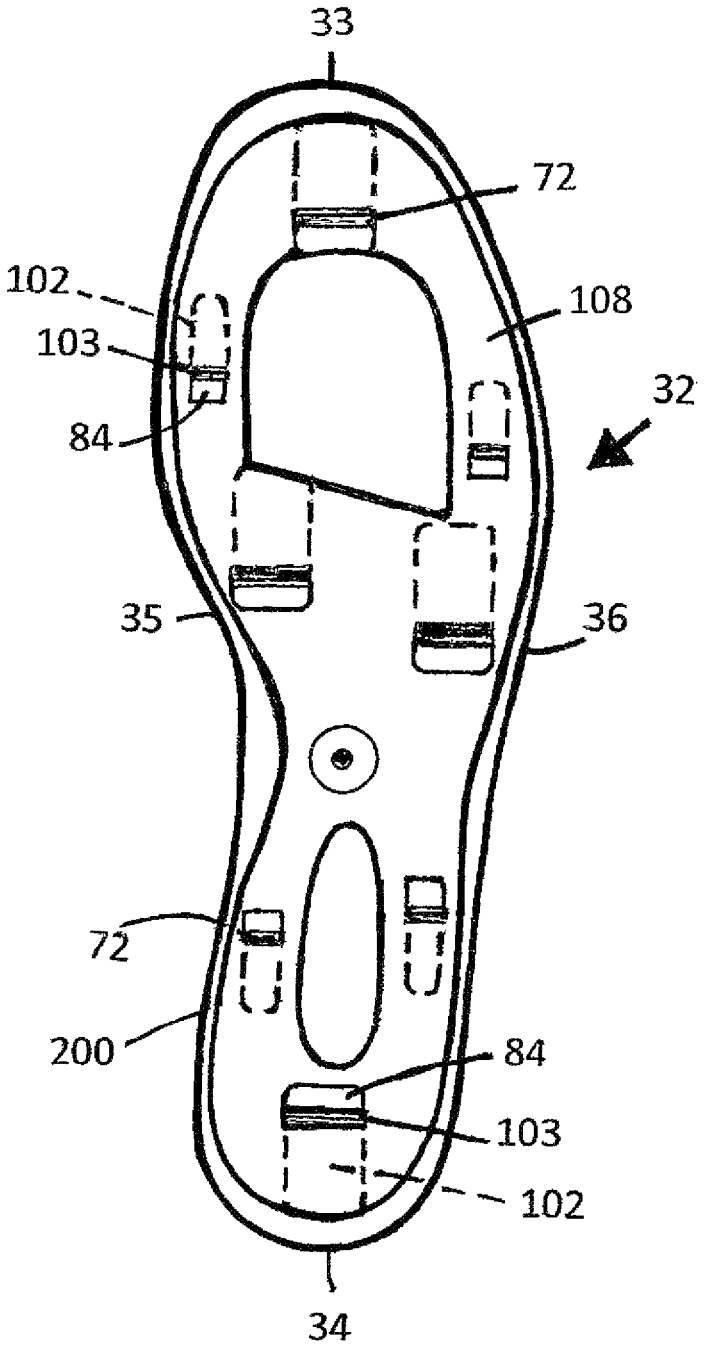

FIG. 163 is a top view of an alternative female receptacle insert including a plurality of female receptacles disposed in sole for receiving a plurality of hooks of a lasting plate.

Figure 164:
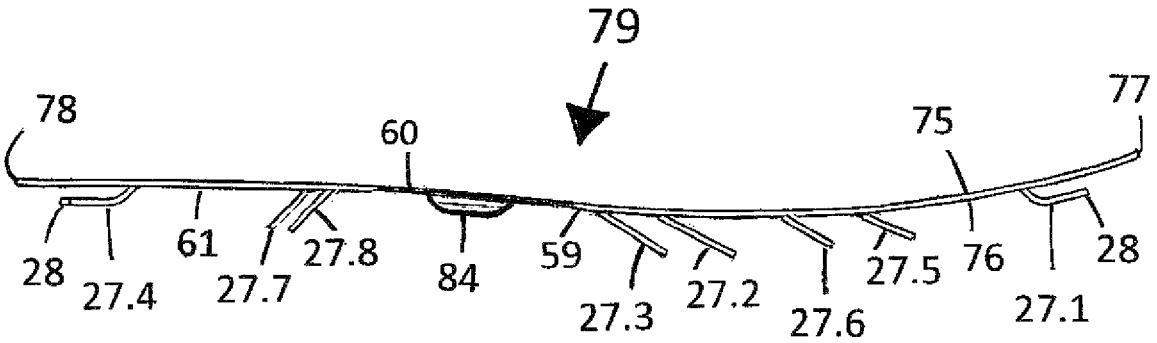

FIG. 164 is a side view of an alternative lasting plate including a plurality of hooks projecting from the bottom side at different angles.

Figure 165:
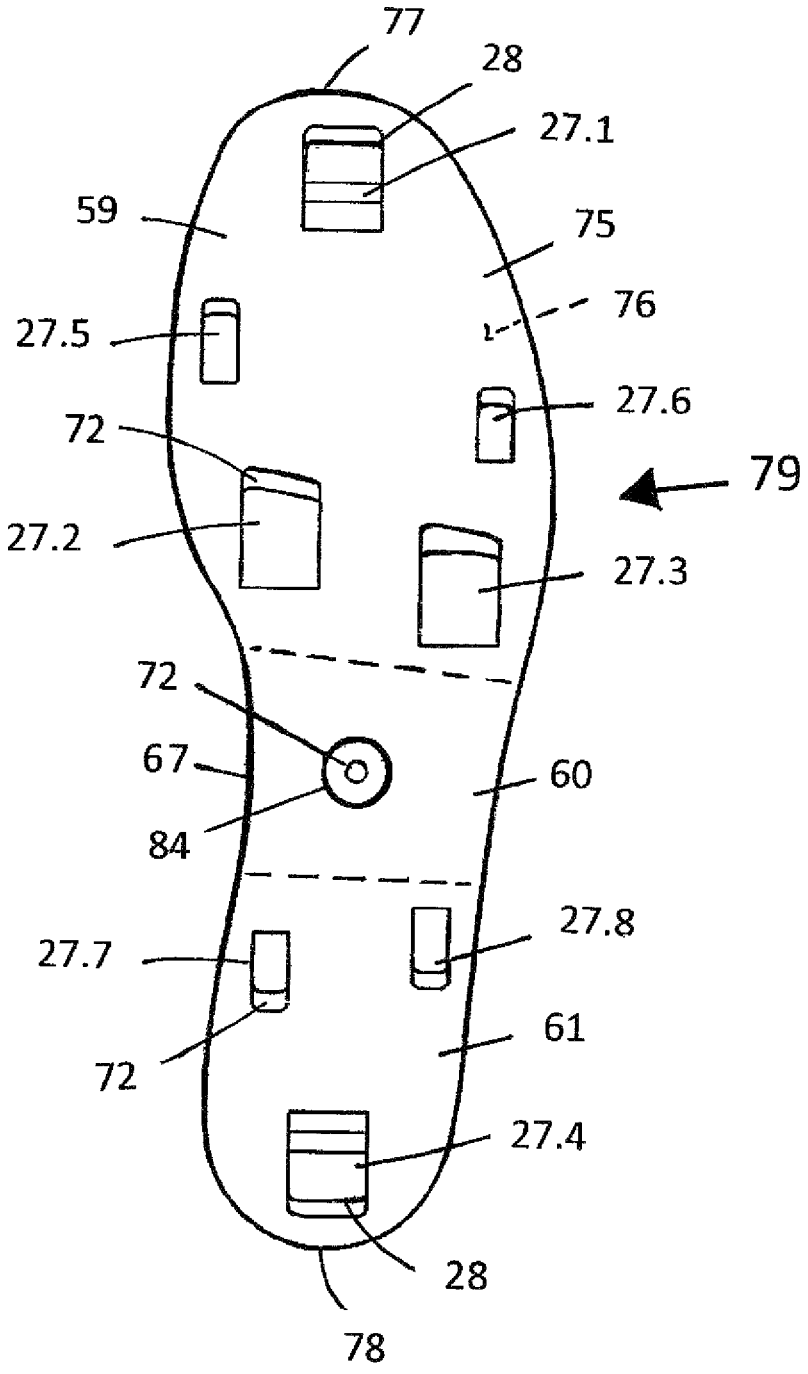

FIG. 165 is a top view of the alternative lasting plate shown in FIG. 164.

Figure 166:
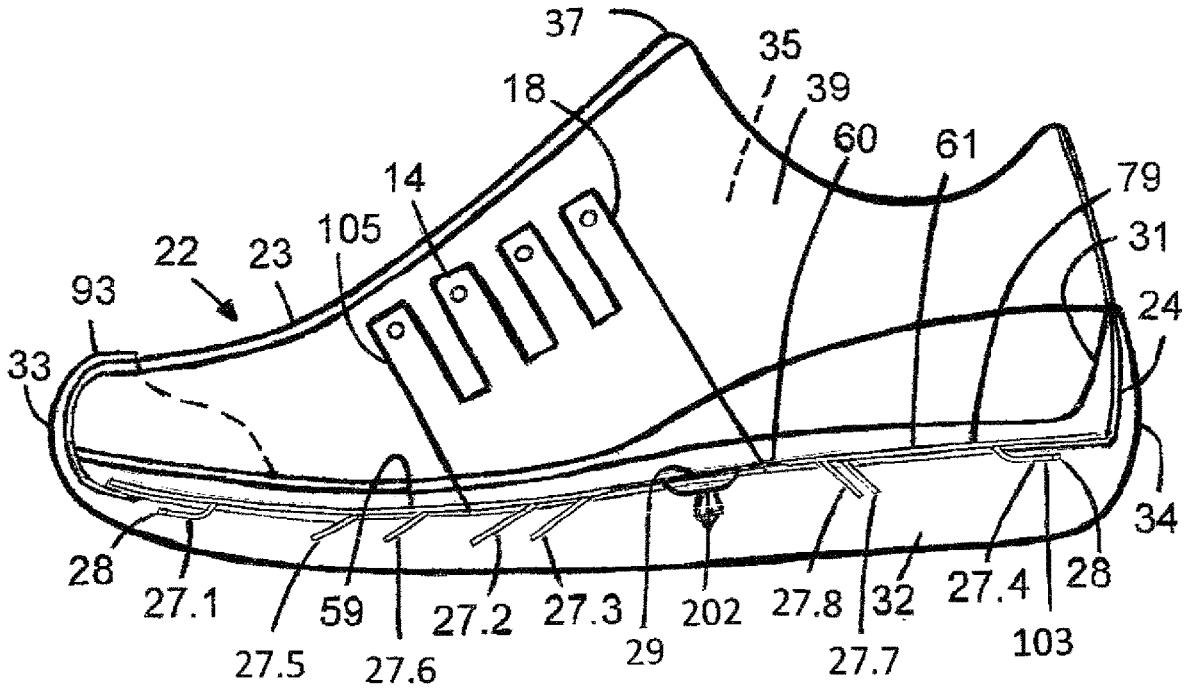

FIG. 166 is a side cross-sectional or x-ray view of an article of footwear including the lasting plate shown in FIGS. 164 and 165.

Figure 167:
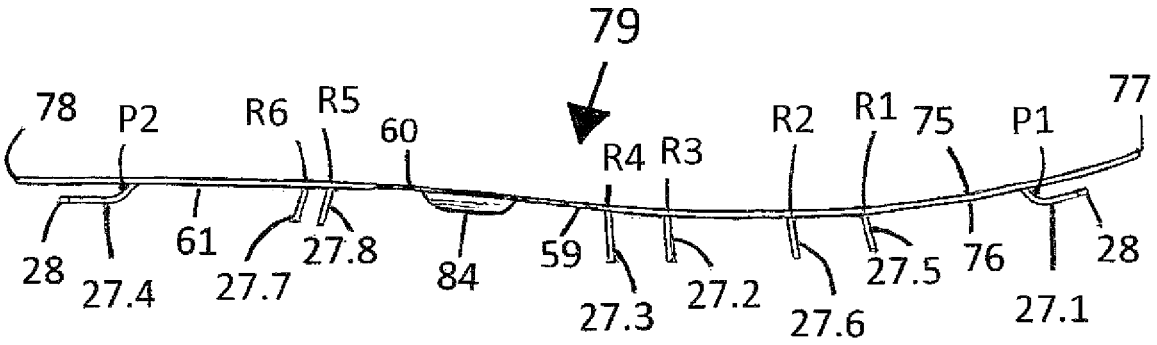

FIG. 167 is a side view of an alternative lasting plate including a plurality of hooks projecting from the bottom side at different angles.

Figure 168:
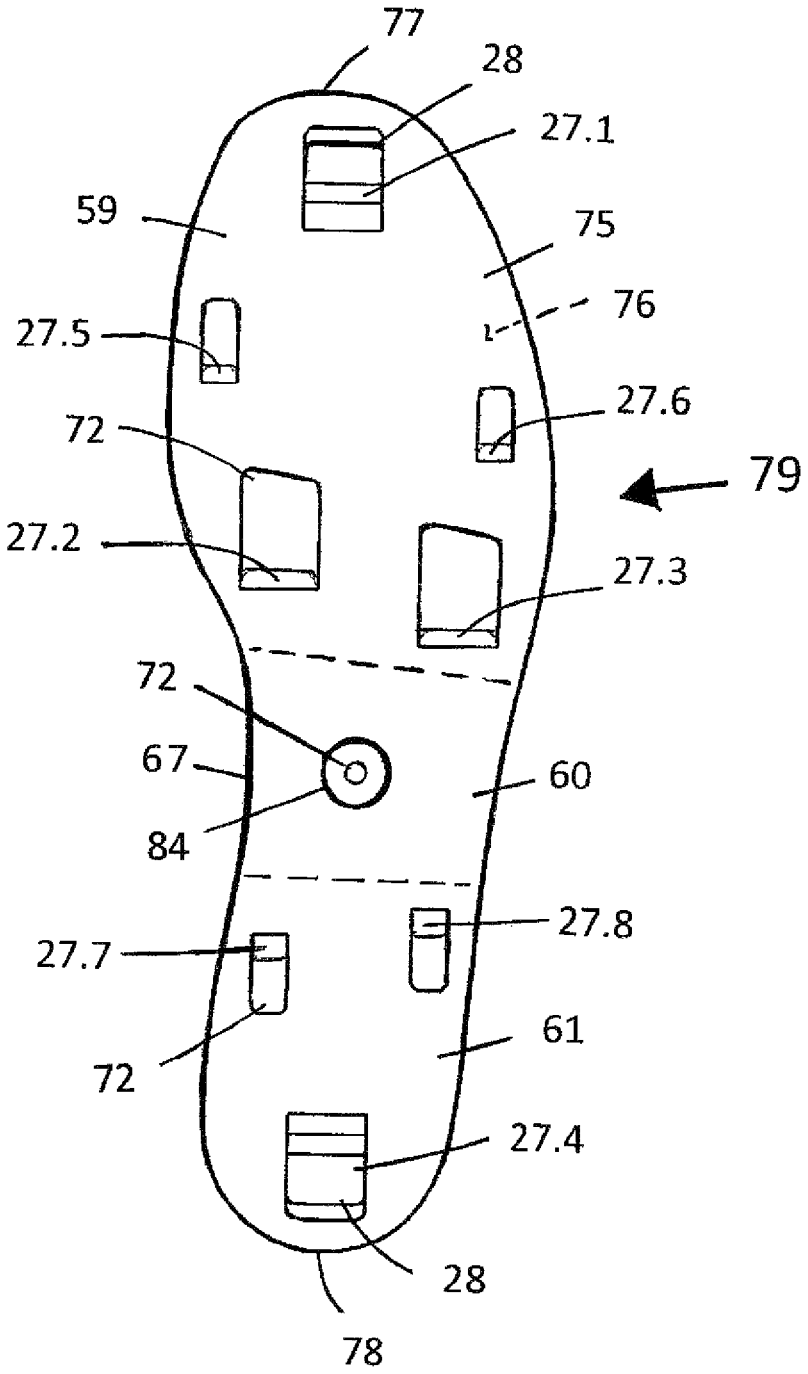

FIG. 168 is a top view of the alternative lasting plate shown in FIG. 167.

Figure 169:
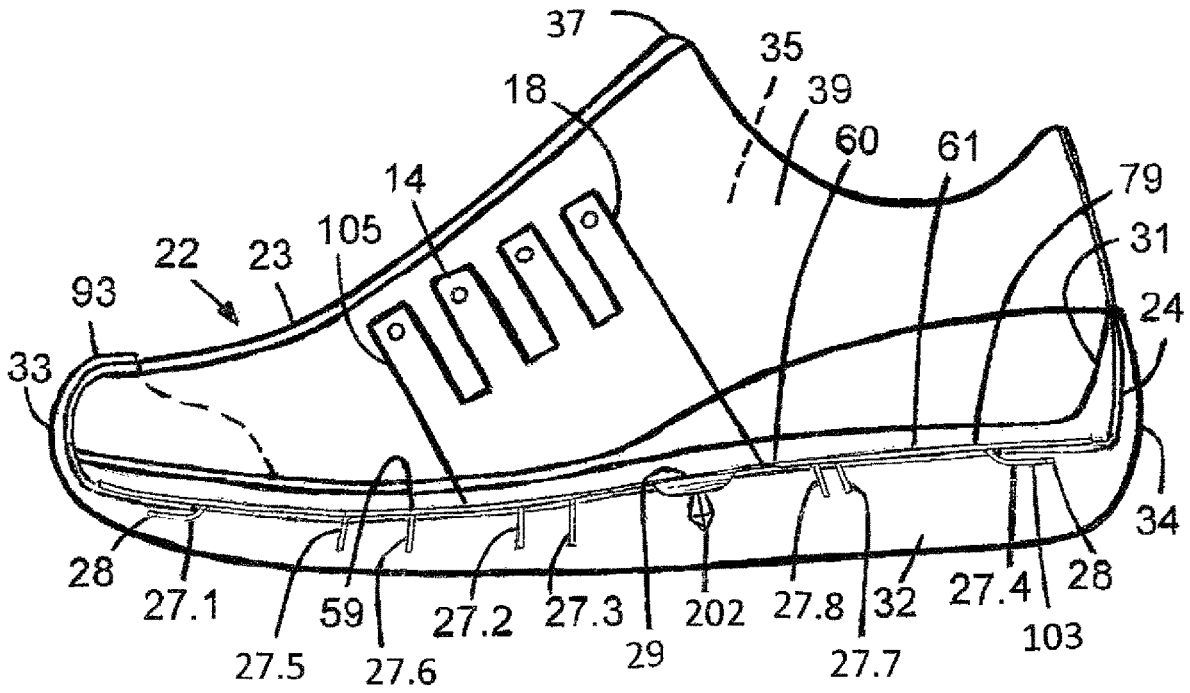

FIG. 169 is a side view of an article of footwear including the lasting plate shown in FIGS. 167 and 168.

Figure 170:
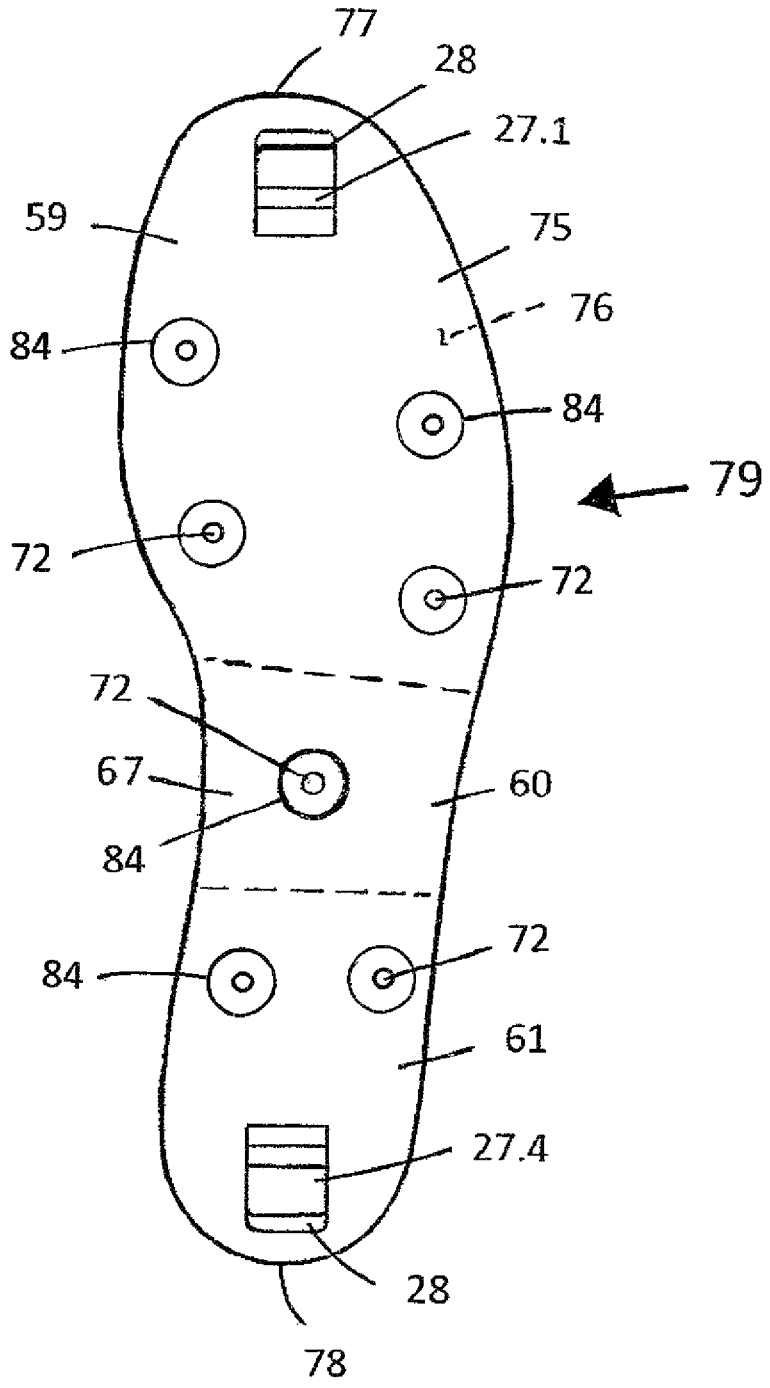

FIG. 170 is a top view of an alternative lasting plate including two hooks and also a plurality of recesses which include openings for receiving mechanical fasteners.

Figure 171:
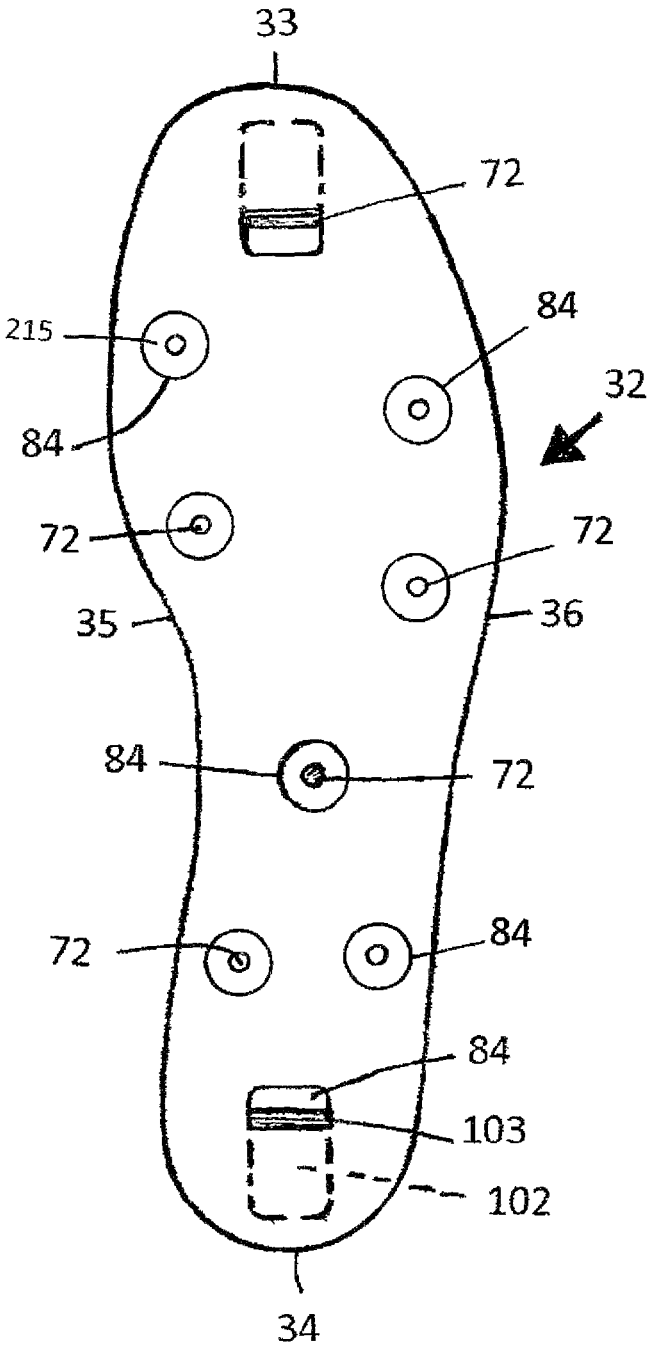

FIG. 171 is a top view of an alternative sole for possible use with the lasting plate shown in FIG. 170 which includes two female receptacles and also a plurality of recesses including openings for receiving mechanical fasteners.

Figure 172:
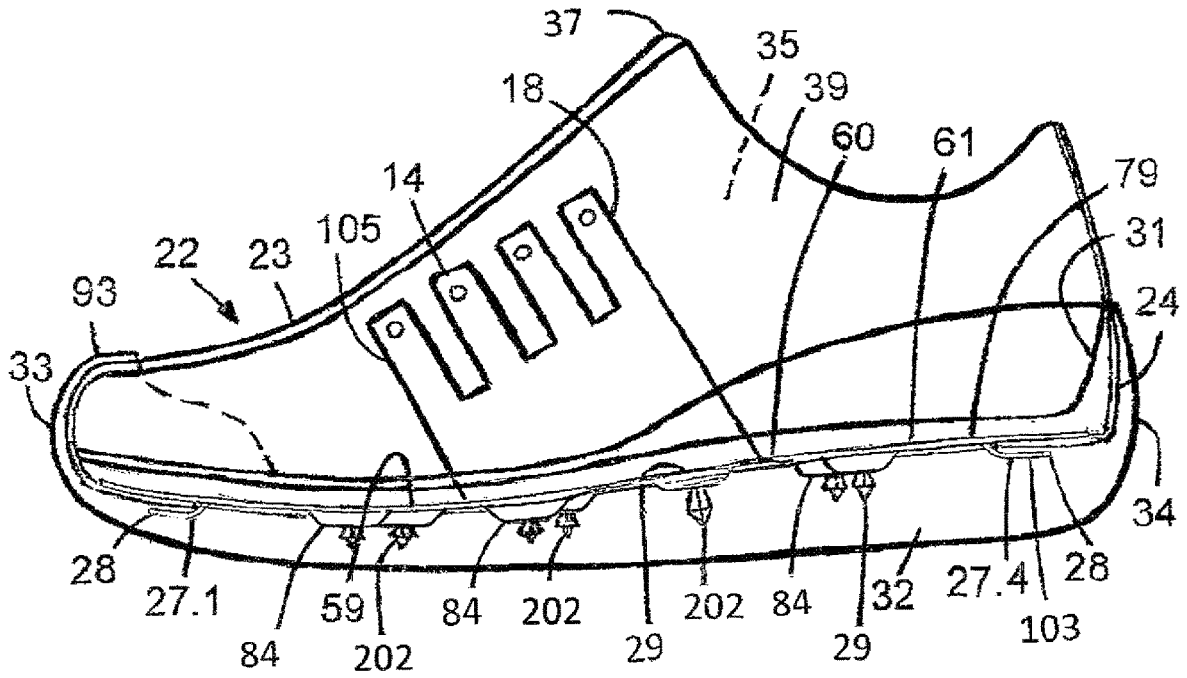

FIG. 172 is a side x-ray and/or parts broken away view of an article of footwear which includes the lasting plate shown in FIG. 170 and sole shown in FIG. 171.

Figure 173:
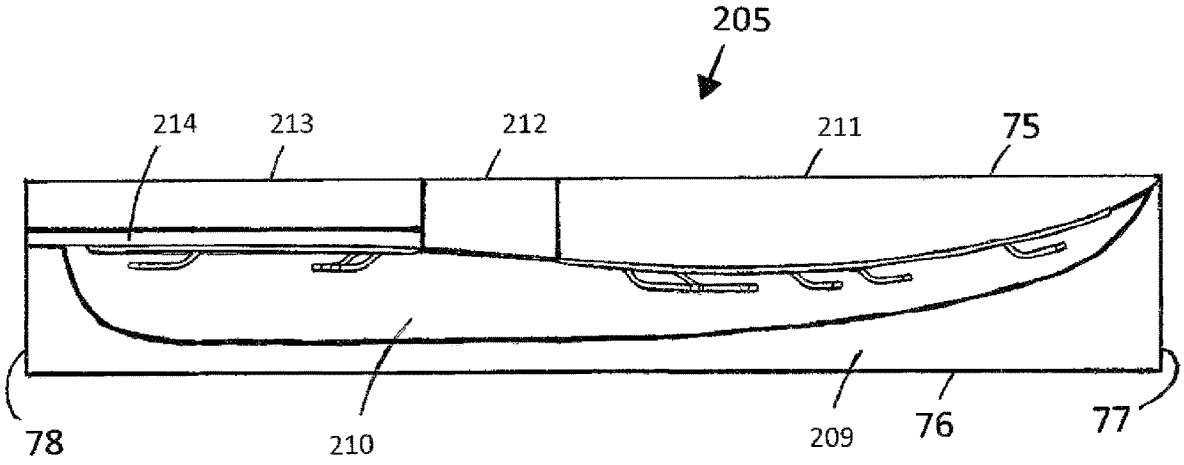

FIG. 173 is a side x-ray and/or parts broken away view of a mold for making a sole generally similar to the one shown in FIG. 144.

Figure 174:
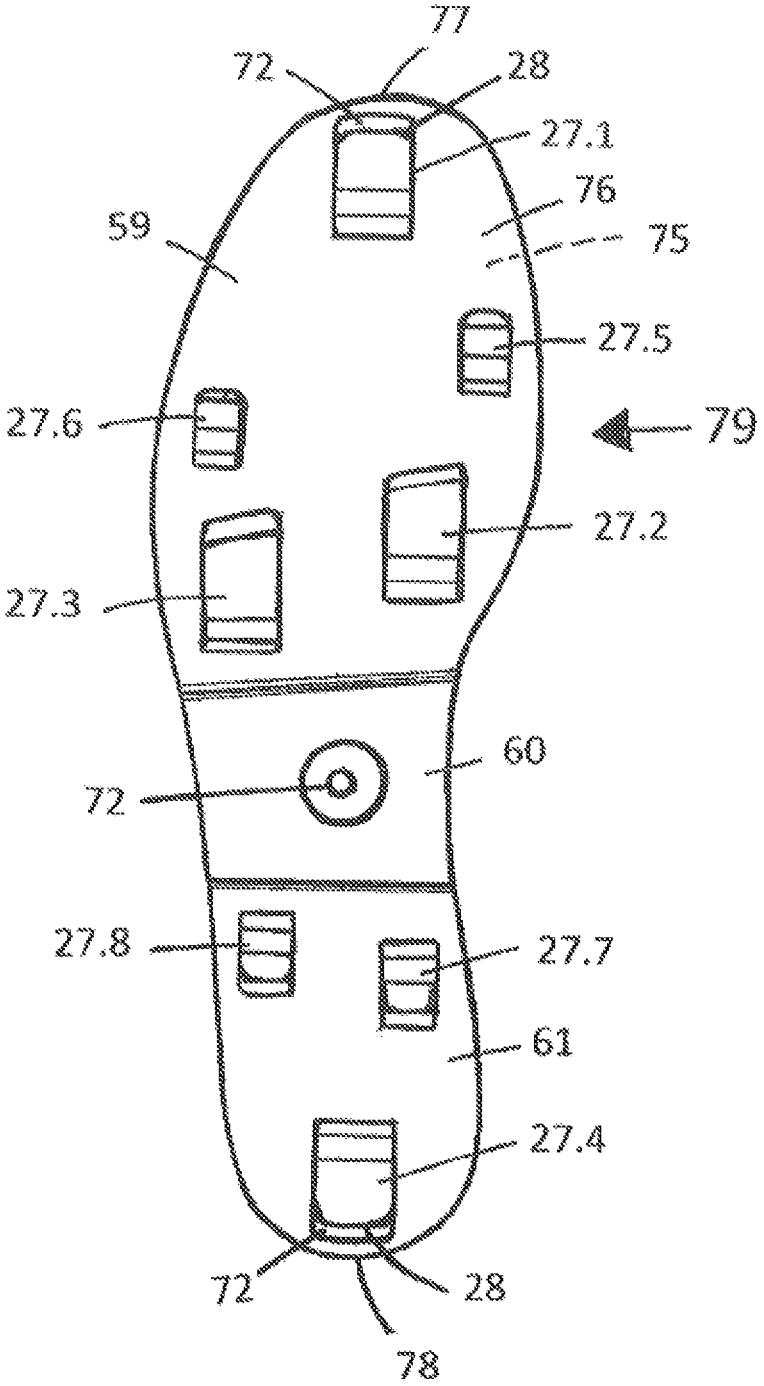

FIG. 174 is a top view of an alternative lasting plate generally similar to the one shown in FIG. 132, which includes longer and/or wider hooks.

Figure 175:
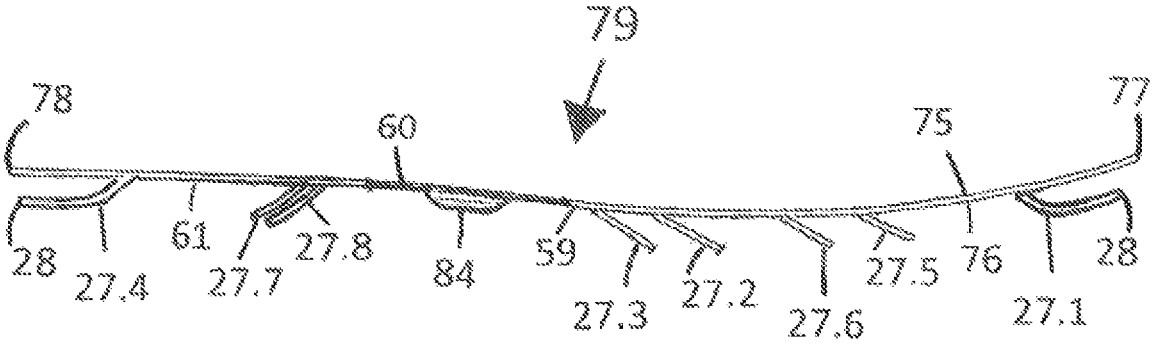

FIG. 175 is a side view of an alternative lasting plate generally similar to the one shown in FIG. 174.

Figure 176:
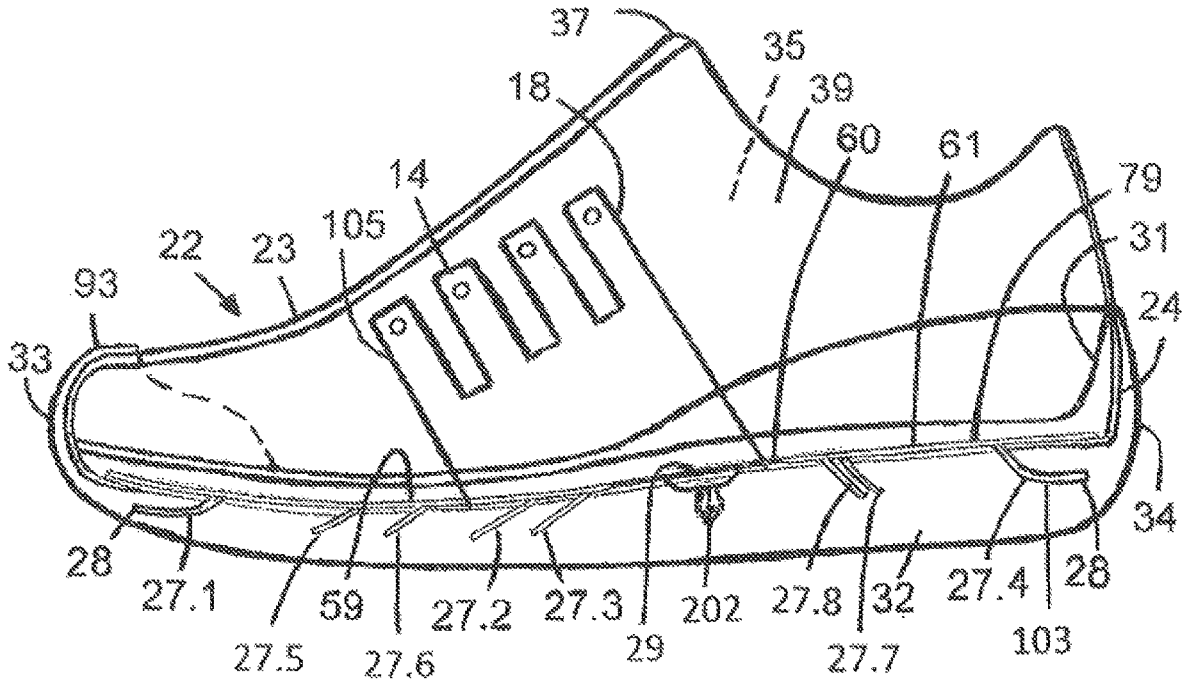

FIG. 176 is a side view of an alternative article of footwear including an alternative lasting plate generally similar to the ones shown in FIGS. 174-175.

Figure 177:
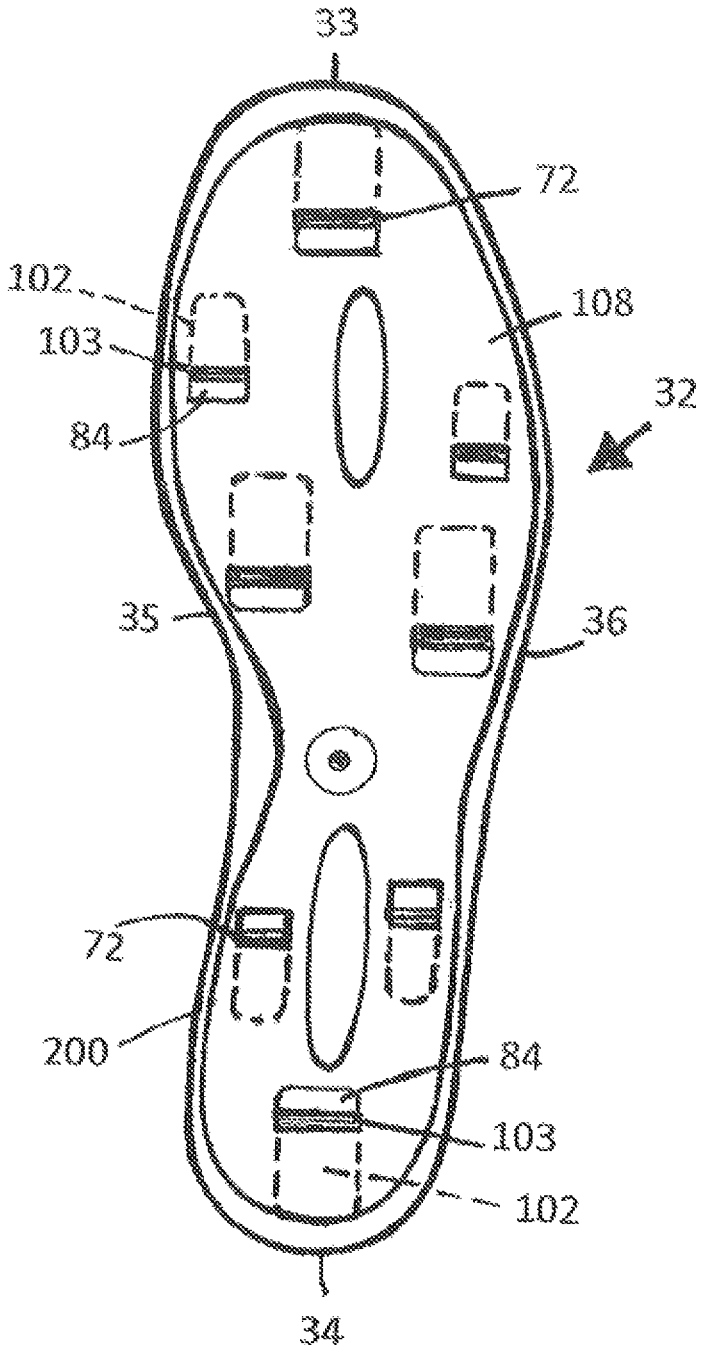

FIG. 177 is a top view of an alternative sole including a sole insert which includes a plurality of female receptacles.

Figure 178:
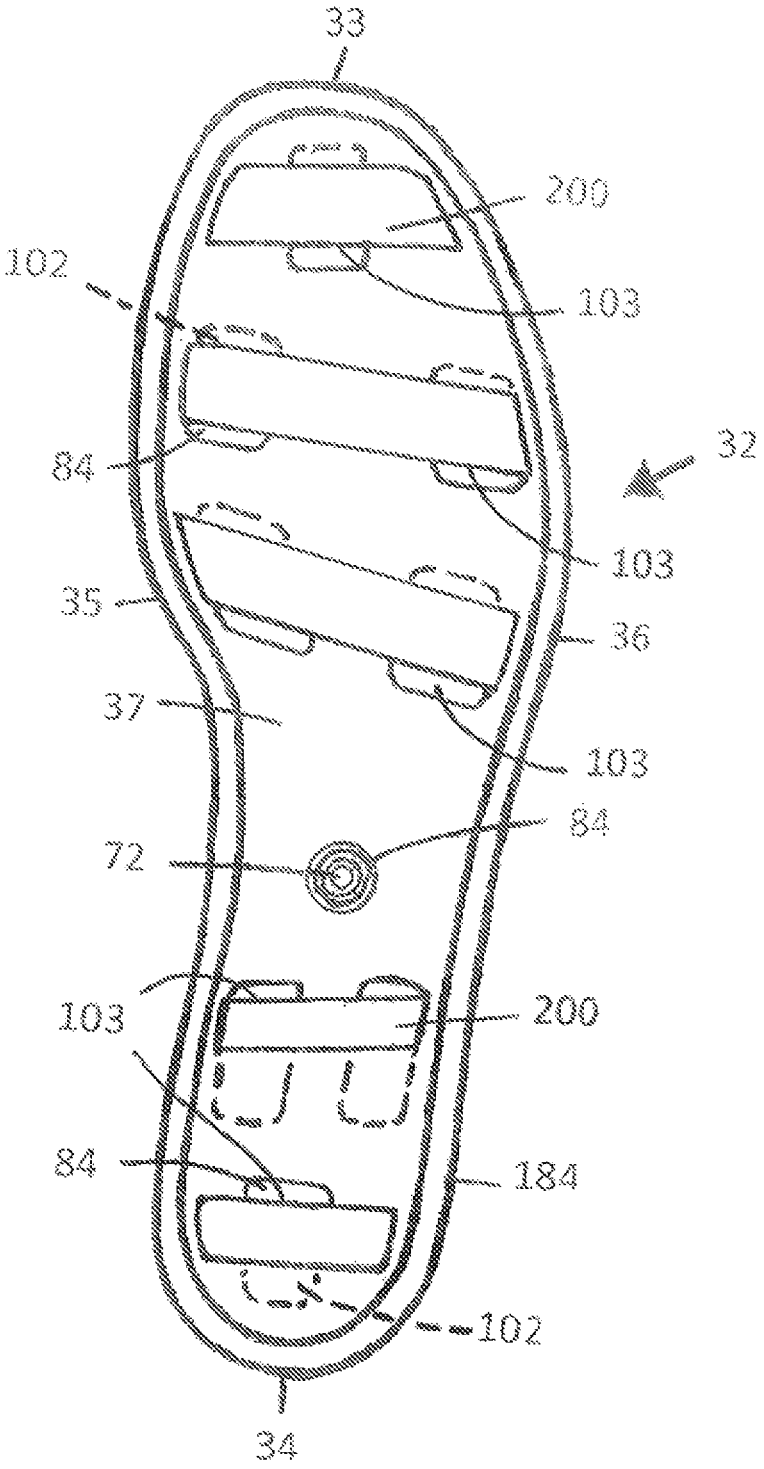

FIG. 178 is a top view of an alternative sole including a plurality of female reinforcements and female receptacles.

Figure 179:
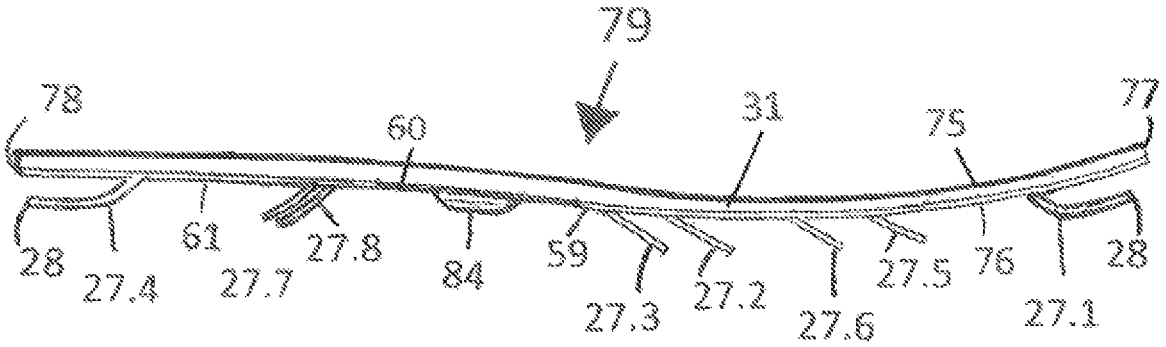

FIG. 179 is a side view of an alternative lasting plate generally similar to the one shown in FIG. 175, and also showing the inclusion of an insole.

Figure 180:
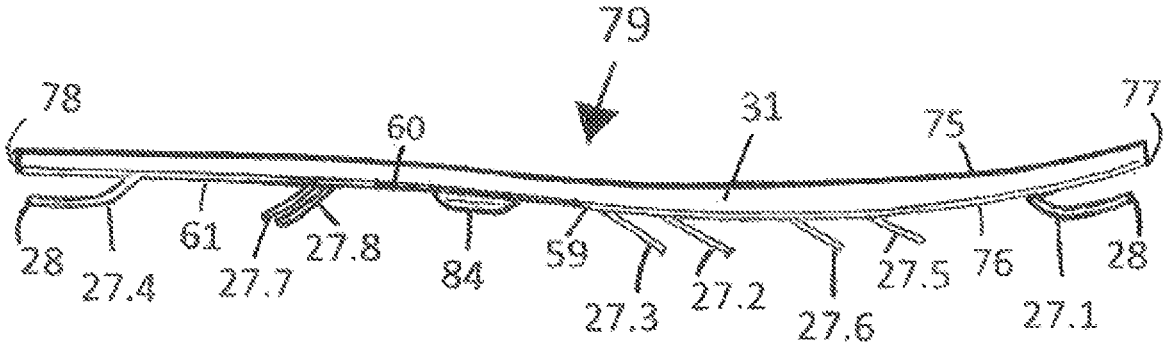

FIG. 180 is a side view of an alternative lasting plate generally similar to the one shown in FIG. 179, showing the inclusion of an alternative insole which has greater thickness proximate to hook 27.6.

Figure 181:
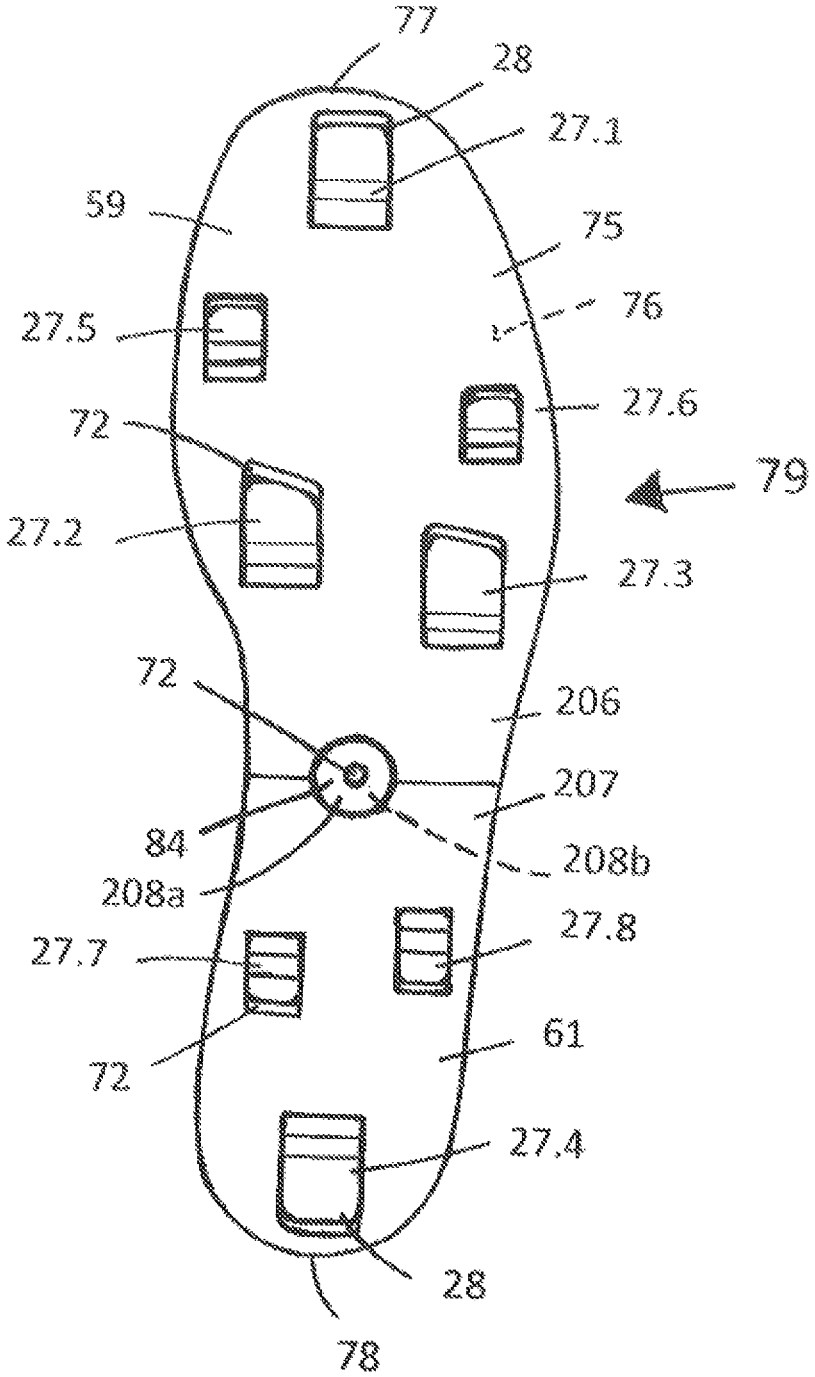

FIG. 181 is a top view of an alternative lasting plate including two separate components, namely, an anterior portion and a posterior portion generally similar to the one shown in FIG. 160, and which includes longer and/or wider hooks.

Figure 182:
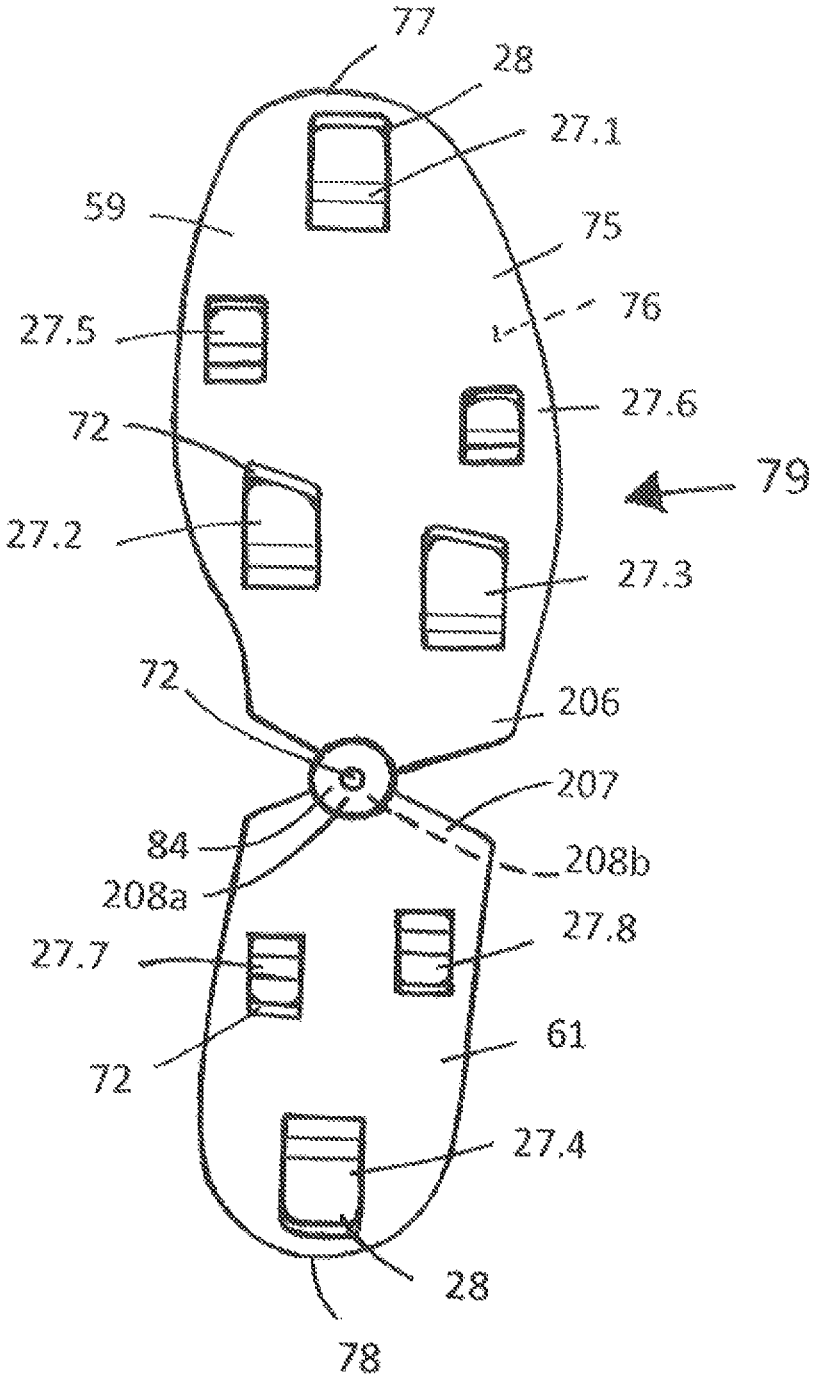

FIG. 182 is a top view of an alternative lasting plate including two separate components generally similar to the one shown in FIG. 181, which includes a different configuration where the anterior portion and posterior portion overlap.

Figure 183:
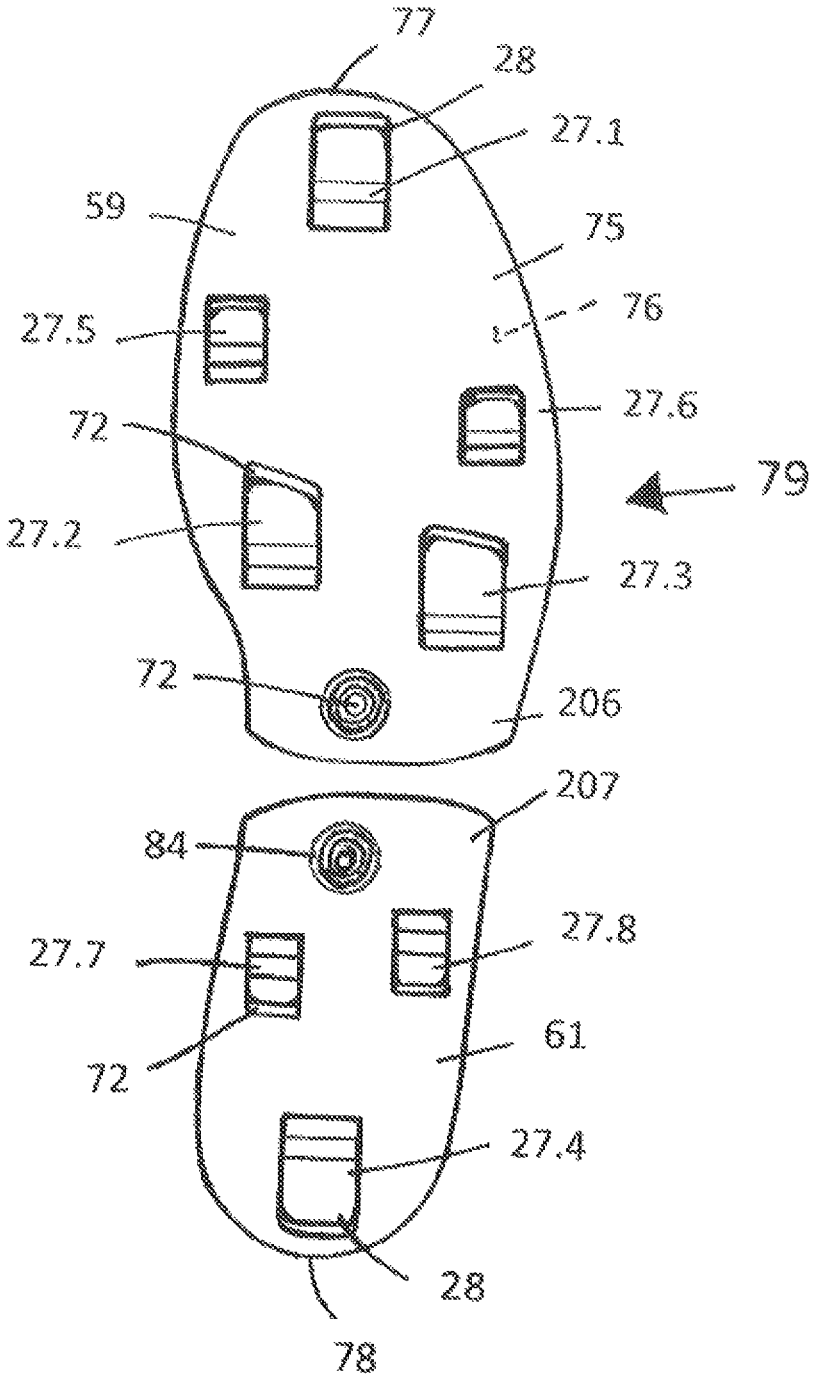

FIG. 183 is a top view of an alternative lasting plate including two separate components generally similar to the one shown in FIG. 181, but having an anterior portion and a posterior portion which do not overlap.

Figure 184:
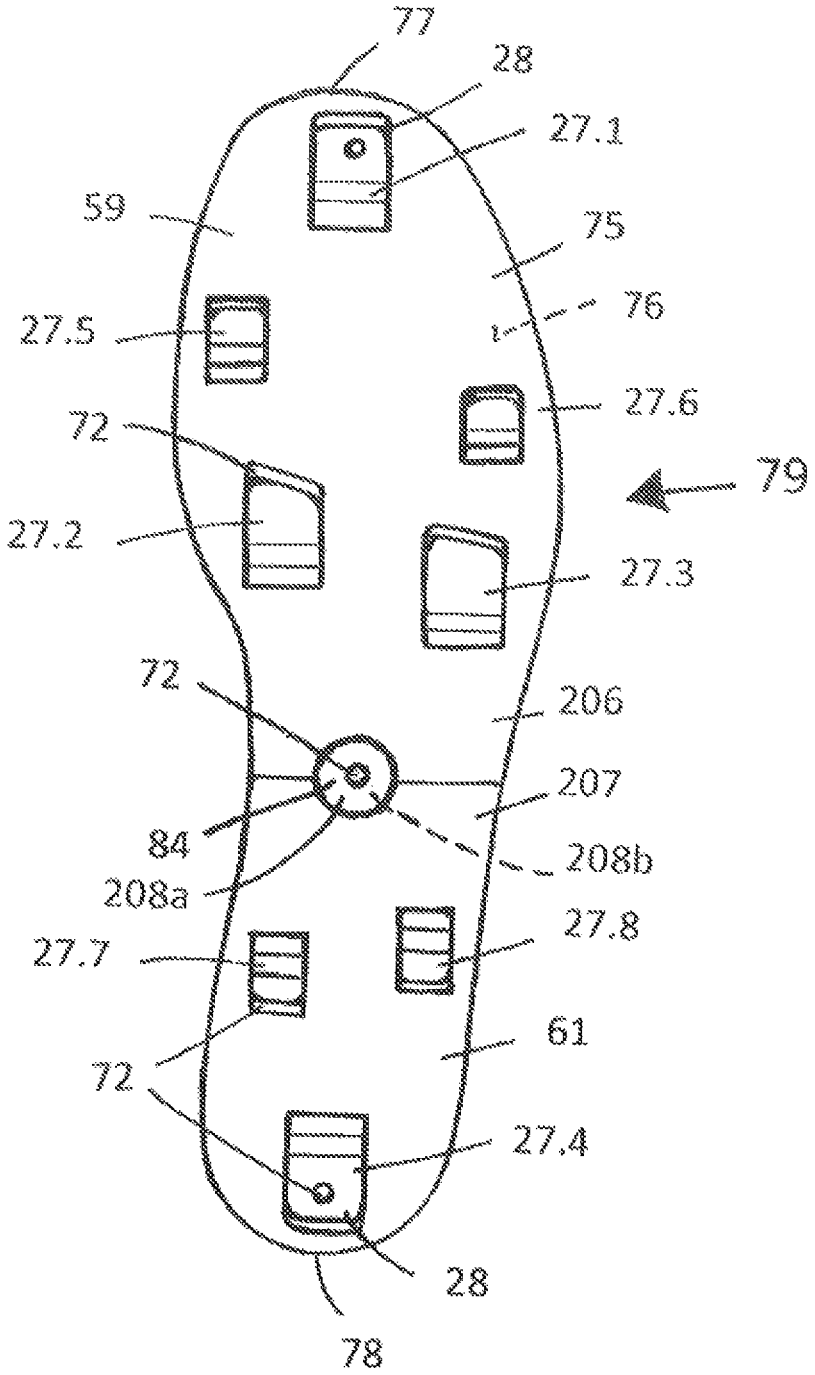

FIG. 184 is a top view of an alternative lasting plate including two separate components generally similar to the one shown in FIG. 181, which includes openings in hooks 27.1 and 27.4 for receiving fasteners.

Figure 185:
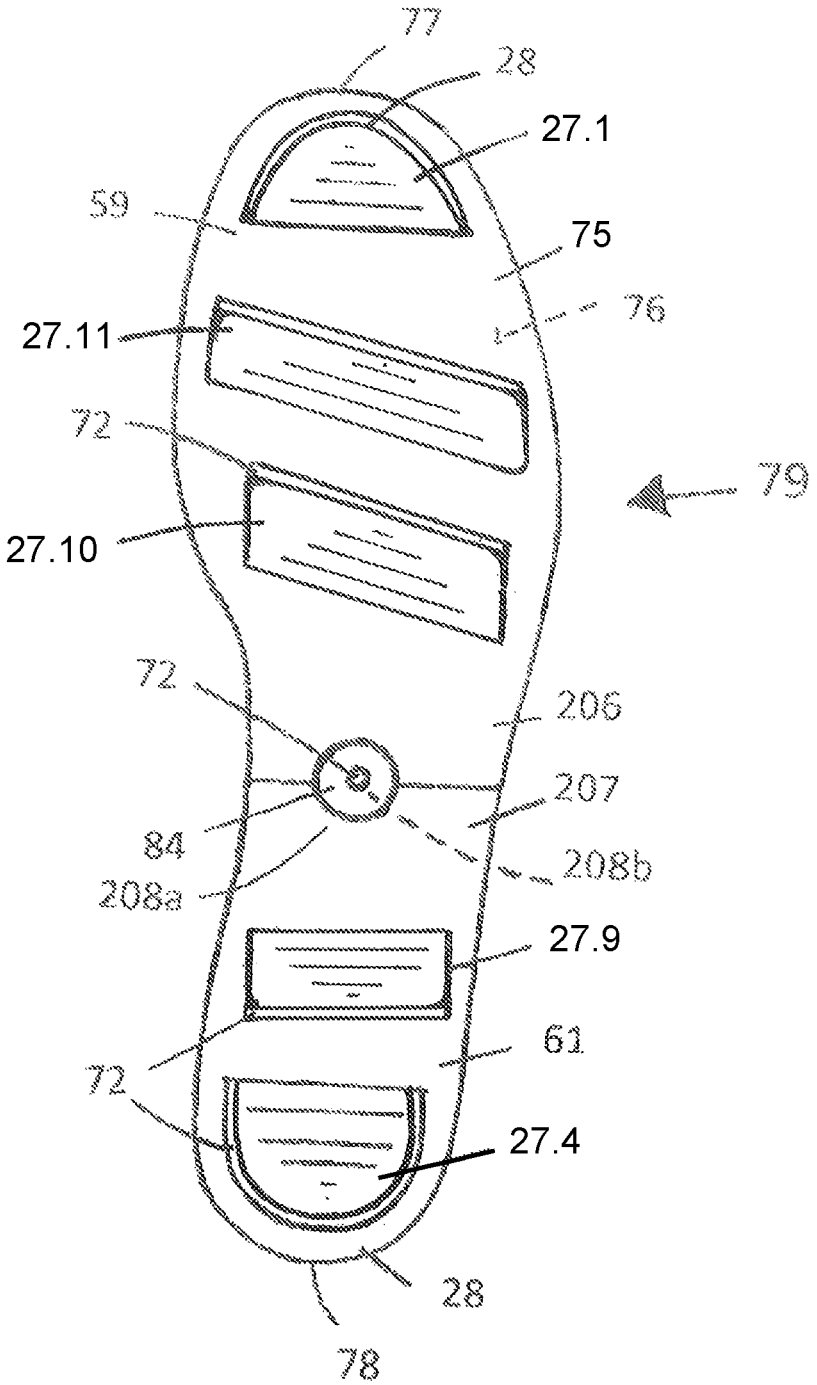

FIG. 185 is a top view of an alternative lasting plate generally similar to the one shown in FIG. 181, but which has larger and wider hooks 27.1 and 27.4 and instead of having individual hooks 21.7 and 27.8 includes a single hook 27.9, and instead of having individual hooks 27.1 and 27.3 includes a single hook 27.10, and instead of having individual hooks 27.5 and 27.6 includes a single hook 27.11.

Figure 186:
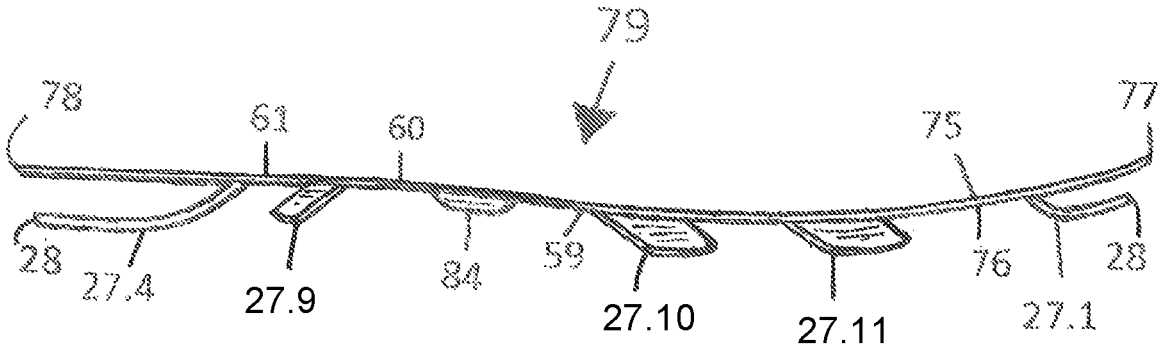

FIG. 186 is a side view of the alternative lasting plate shown in FIG. 185.

Figure 187:
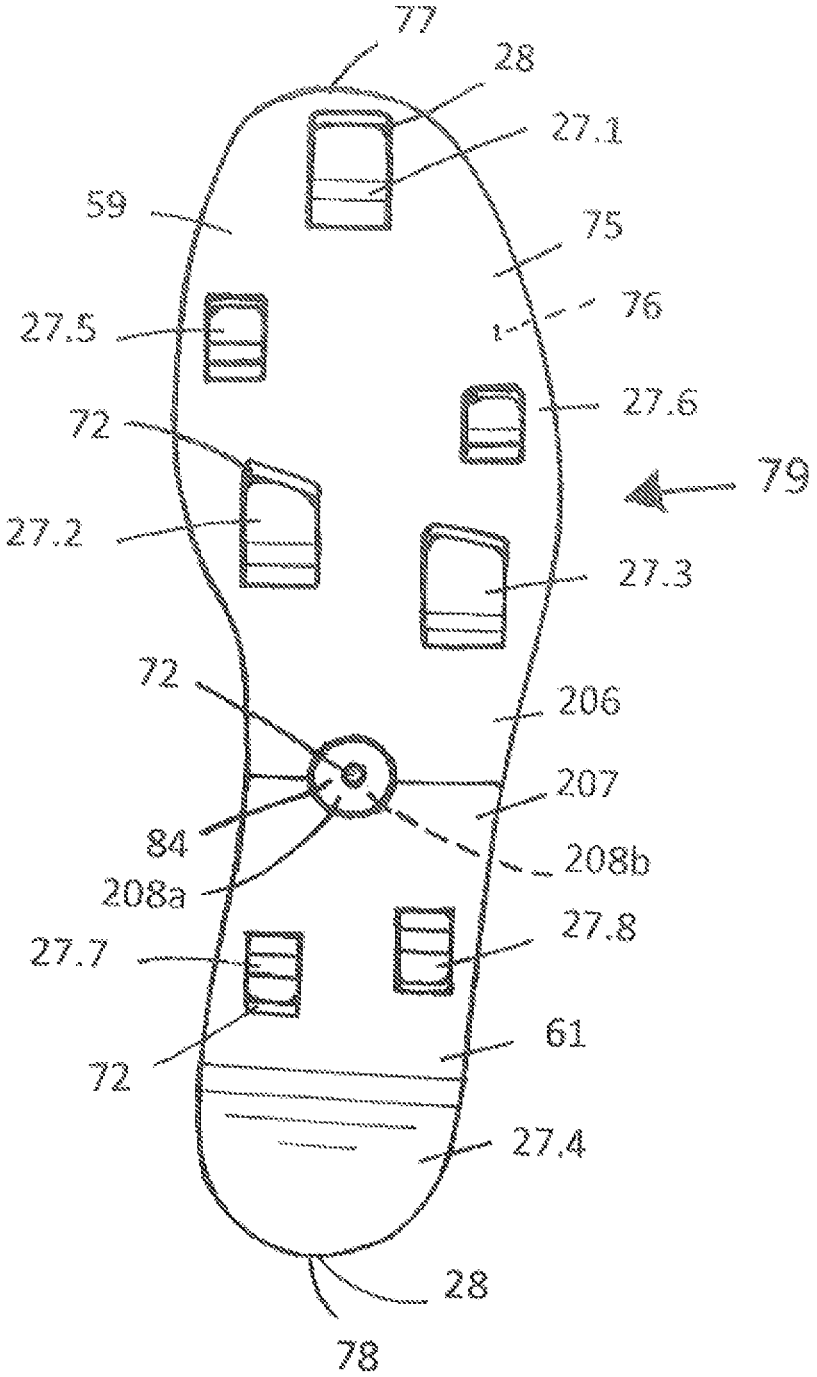

FIG. 187 is a top view of an alternative lasting plate generally similar to the one shown in FIG. 181, which has a larger and wider hook 27.4 which spans entirely across a posterior portion of the alternative lasting plate.

Figure 188:
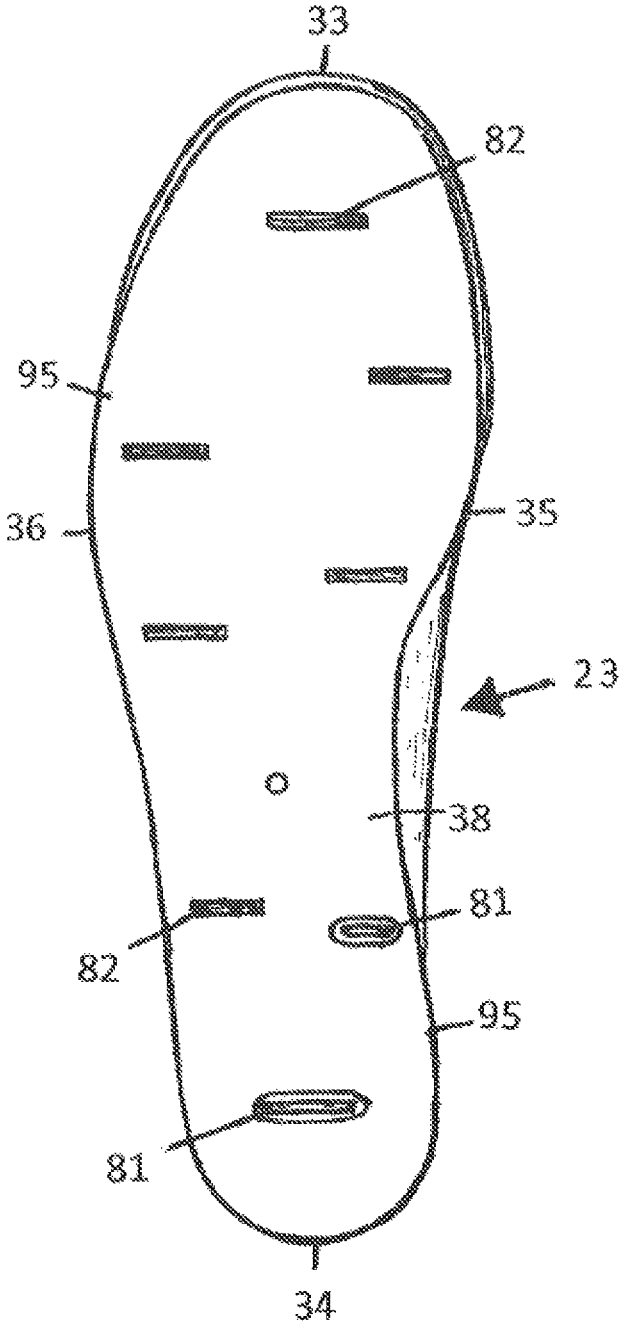

FIG. 188 is a bottom view of an alternative upper including a plurality of slits for receiving and permitting a plurality of hooks of a lasting plate to pass therethrough.

Figure 130:
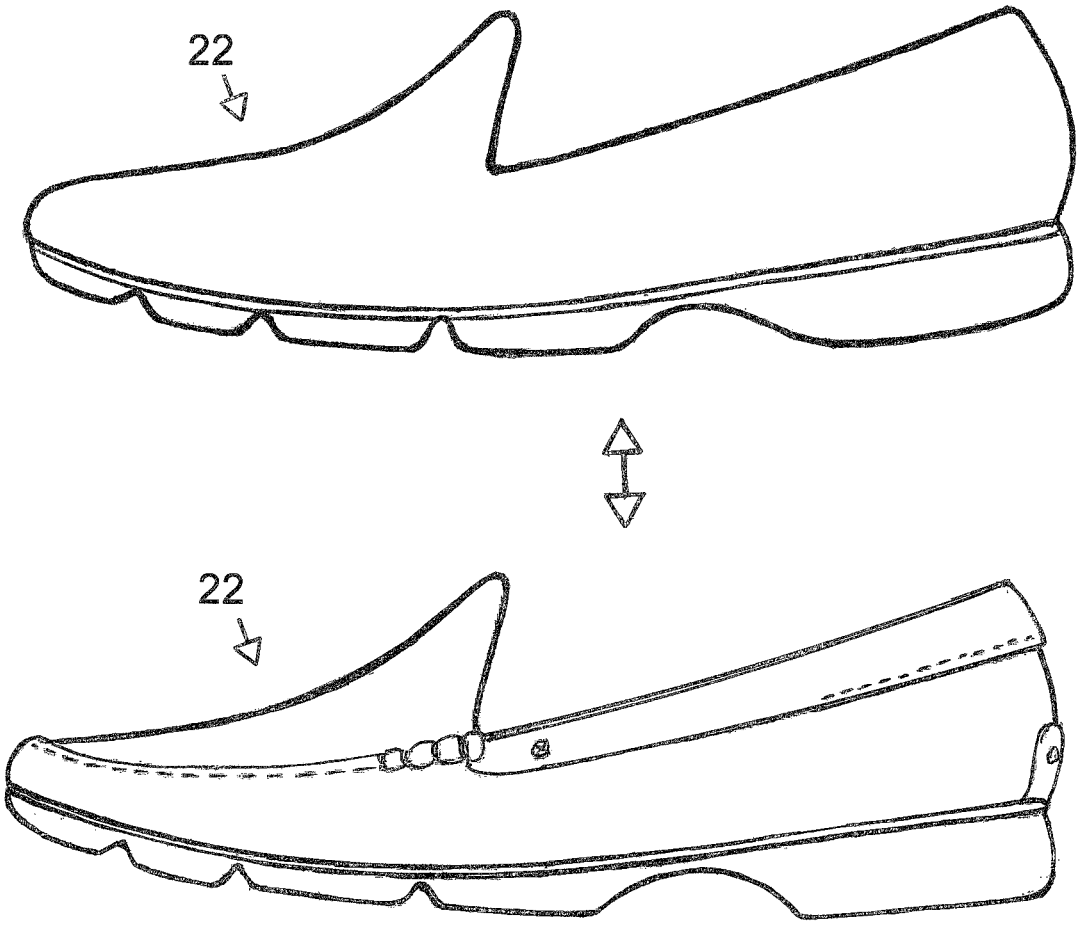
Figure 189:
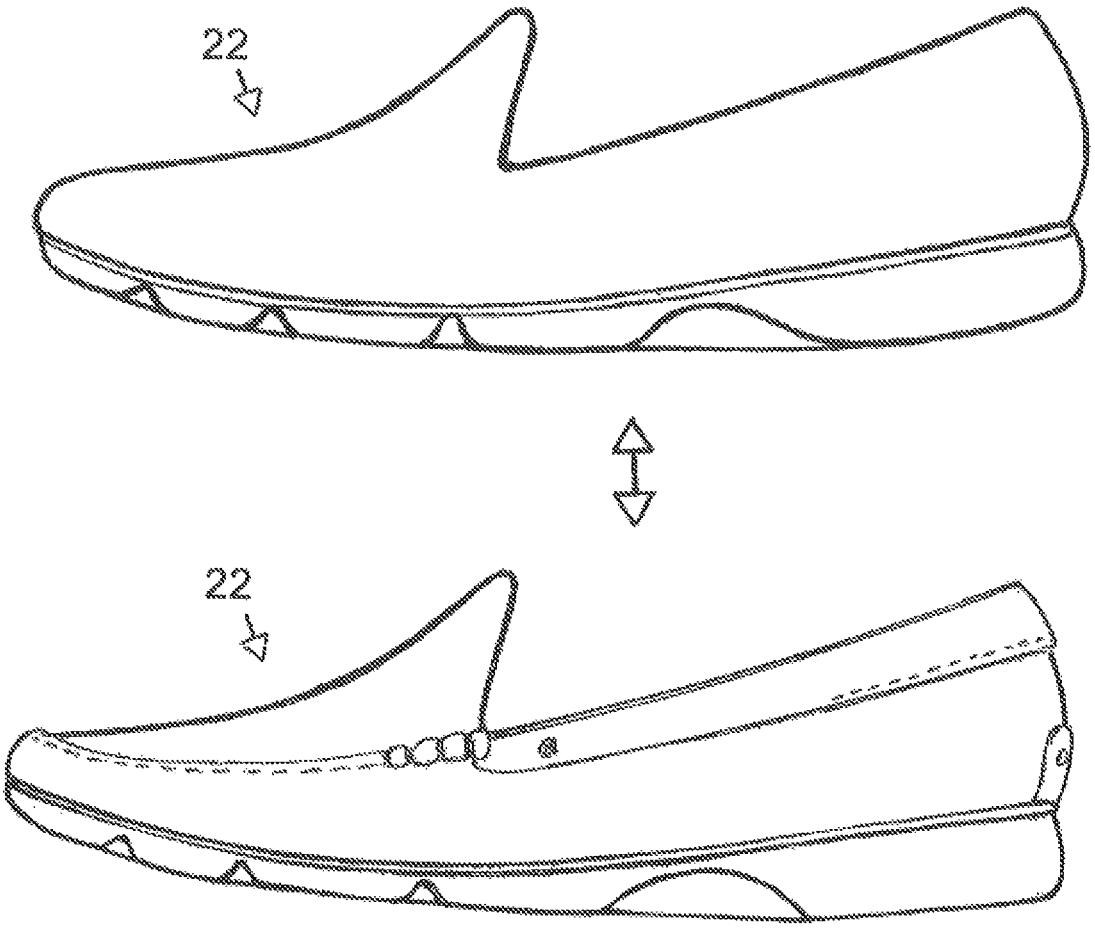

FIG. 189 is a side view of two alternative articles of footwear which are generally similar to those shown in FIG. 130.

DETAILED DESCRIPTION OF ILLUSTRATIVE EMBODIMENTS

The present disclosure teaches an article of footwear 22 which can include an upper 23, a lasting plate 79, an insole 31, and a sole 32, and each of these components can be selected from a range of alternative options and be easily removed and replaced as desired. Alternatively, the insole 31 and lasting plate 79 can be made or provided as a single component, and it is then possible to make a custom article of footwear 22 by selecting and assembling only three footwear sub-component parts. Further, the configuration and width of the upper 23 of the article of footwear 22 can be manipulated and adjusted in order to provide a custom fit for an individual wearer. Accordingly, the article of footwear 22 can be customized in order to provide a desired fit and structure, but also physical and mechanical properties, and related performance characteristics. Moreover, the present disclosure teaches a method of making an article of footwear, and also a method of doing both retail and Internet business including making and selling a custom article of footwear.

For example, the product category and style of a footwear upper 23, and also its color, material composition, physical and mechanical properties, configuration and fit can be selected by a customer and/or individual wearer. In this regard, a shoe or boot upper 23 can be made in whole or part of a woven material, a non-woven material, a knitted material such as a two or three-dimensional knit material, a textile material made of natural fibers such as cotton or hemp, wool, leather, suede leather, synthetic leather, a thermoplastic material, a thermoplastic elastomer, and/or rubber.

A potential customer or individual wearer can be provided with many different alternative uppers to choose from at a point of purchase in a retail store, and/or when using a vending device which includes inventory, and/or by using a cell phone, tablet, or computer in order to communicate with an online website on the Internet to select a desired footwear upper 23 component, and any other needed or desired footwear components for making an article of footwear 22. In this regard, a plurality of different options and alternate embodiments of various footwear components can be provided for possible selection by a customer or individual wearer. For example, different alternative embodiments of an upper 23, a lasting plate 79, an insole 31, a draw cord 106, a strap 18, a heel counter 24, a fastener 29 including a male portion 85 and female portion 86, laces 21, an inferior spring element 50, a fluid-filled bladder 115, a retaining pin 63, a sole 32, and also other footwear components can be provided for possible selection to make an article of footwear 22.

The anatomical features, configuration, and dimensions of a given individual's foot and any other special needs, requirements, or preferences can be communicated and/or recorded by observation and measurement in a retail setting, or alternately be communicated by an individual or wearer in their own home or when at different remote site, and the provided data can be used to generate information and intelligence relating to various possible options and making selections for a making a custom article of footwear. In this regard, measuring devices or other means for determining, rendering, recording, or reproducing an individual's foot length size, foot width size, foot shape, arch characteristics, conformation and other information could include rulers, measuring tapes, Brannock devices, two or three dimensional scanners, three dimensional printers, pressure sensors, infrared thermography, stereolithography, cameras, photographs, video, television, photocopies, FAX, e-mail, impressions, tracings, phones, tablets, texts, computers and computer screens, software, data storage and retrieval systems, templates, molds, models, and patterns, and one or more of these devices and related methods can be used to help make selections relating to an individual's needs and desires when making an article of footwear 22.

The lasting plate 79 can be made of a thermoplastic material such as nylon, ethylene, propylene, or a thermoplastic elastomer such as Santoprene®. Alternatively, when a high mechanical efficiency and spring to dampening ratio greater than 90 percent is desired, the lasting plate 79 can be made of a fiber composite material such as thermoplastic or thermoset carbon fiber composite, carbon nanofiber compositive, a hemp fiber composite, fiberglass, or a metal such as a spring grade titanium. In this regard, the material composition, thickness, and stiffness of the lasting plate can be selected to provide desired performance characteristics. For example, the spring to dampening ratio of the elastomeric foam materials used in conventional articles of footwear is commonly in the range between 40-60 percent, whereas an article of footwear 22 including a lasting plate 79 made of carbon fiber compositive or spring grade titanium can provide a higher spring to dampening ratio exceeding 90 percent and this can possibly contribute to mechanical efficiency and running economy. In this regard, a lasting plate 79 that underlies the forefoot area which can store energy during the latter portion of the stance phase and early portion of the propulsive phase of the running cycle and then release this energy during the latter portion of the propulsive phase can provide improved running economy. It is believed that the improvement in running performance can approximate one second over four hundred meters when running at four minutes/mile pace. When an efficient lasting plate 79 is used in a hiking or military boot the amount of effort and energy expended when carrying a 100 pound backpack can also be reduced. The lasting plate 79 can be made in different configurations to provide different options and possible selections for wearers having flat feet, normal arches, or high arches so as to provide individuals with comfort, conformance, support, and stability. Moreover, the lasting plate 79 can also include an integral heel counter 24, and/or 74, and/or toc counter 100.

An insole 31 can be made as a separate component and include a bottom portion including a thermoplastic or thermoset material for providing a conforming structure and support for individuals having low arches or flat feet, medium arches, or high arches. An insole 31 can also have a middle portion or cushioning layer including a foam material such as ethylene vinyl acetate or polyurethane, memory foam, neoprene, thermoplastic elastomer, rubber, or cork, and also a top portion or cover layer including a textile having natural fibers such as cotton, hemp, wool, or leather, suede, and/or other natural or synthetic leathers and textiles for providing a comfortable surface for contact with a wearer's foot. Alternatively, an insole 31 can be made to include only a cushioning layer including a foam material and cover layer for making contact with a wearer's foot. Alternatively, an insole 31 can be made as a single cover layer for making contact with a wearer's foot. Alternatively, at least a portion of a lasting plate 79 and/or insole 31 can be molded to a desired shape and conformance with the use of heat, or by using a chemical reaction with the use of a curable polymer, and/or a light cure polymer, e.g., as disclosed in U.S. Pat. Nos. 6,939,502, 5,632,057, 5,203,793, 5,101,580, 4,674,206, all of these patents hereby being incorporated by reference herein. Alternatively, an insole 31 can be made as an integral part of a lasting plate 79. Alternatively, an insole 31 can be made as a component which can mechanically mate and be easily removably coupled with a lasting plate 79. The following U.S. patents are assigned to Superfect Worldwide, Inc. which is a manufacturer of quality insoles for use in footwear include U.S. Pat. Nos. 4,869,001, 6,233,847, 6,618,960, 6,976,322, 8,341,856, 9,259,050, 9,635,904, 9,655,404, 10,013,711, 10,136,703, 10,172,414, 10,463,103, and all of these patents are hereby incorporated by reference herein.

Further, an article of footwear can include an insole which can be removed and replaced by a different footwear component selected from the group of footwear components including an inner liner, an inner liner adapted for use in cold weather, an inner liner adapted for use in hot and humid weather, a slipper, a different shoe or boot such as an aquatic boot or a rock climbing shoe which can be inserted and fit within the article of footwear, whereby the effective size and function provided by the article of footwear can be varied and customized as desired.

The article of footwear can include means for closure including a closure mechanism, e.g., laces, draw cords, straps, buckles, hook and pile 121, and/or an upper 23 providing a compression fit, and in various combinations and permutations. In this regard, the laces 21, or draw cords 106, and/or straps 18 can be removably secured to a portion of the upper 23. Straps 18 can be disposed on the interior side 39 of the upper 23 and be removably secured to the lasting plate 79. Alternatively, straps 18 can be disposed on the exterior side 40 of the upper 23 and be removably secured to the lasting plate 79. Alternatively, straps 18 can be made or configured as an integral portion of the upper 32.

The article of footwear 22 can also include a removable and replaceable heel counter 24. For example, the lasting plate 79 can include an integral heel counter 24, and/or side counter 74, and/or toe counter 100. Alternatively, a heel counter 24 can be made and provided as a separate footwear component and be configured to be disposed on the interior side 39 of the upper 23. Alternatively, a heel counter 24 can be configured to be disposed on the exterior side 40 of the upper 23.

The sole 32 can be also be selected and replaced as desired in order to optimize desired performance characteristics for a specific activity and given different environmental conditions. In this regard, the ability to easily remove, renew, and recycle the sole 32 portion of an article of footwear 22 can render the use of softer materials having enhanced shock and vibration dampening characteristics, but perhaps less robust wear properties viable from a practical standpoint. Further, the sole portion of a custom article of footwear can be selected from a variety of options with regards to configuration, materials, and function. For example, a wide variety of different soles can be made available for selection and use in articles of footwear configured for many different product categories and having different material compositions and tread patterns, including but not limited to casual and dress shoes, walking, running, aerobics, basketball, tennis, volleyball, cross-training, baseball, football, golf, soccer, cycling, sandals, hiking and military boots. In this regard, many different sole options can be provided within a single product category, e.g., a sole that is suitable for running on streets, another sole that is suitable for running on trails, and yet another sole that provides maximum cushioning can be made and provided for selection and use by an individual wearer for a running shoe. A sole can be compression or injection molded using thermoplastic foam materials such as ethylene vinyl acetate, thermoplastic elastomers such Kraton®, thermoplastic rubber, natural or synthetic rubber, and/or polyurethane materials. Other soles 32 which are resistant to slipping in wet conditions and/or extreme temperatures including ice and snow, or exposure to oil, or resistant to fire, or are otherwise specially designed and which include chemical formulations and materials that are advantageous for specialized use can be made available for selection and use by customers and individual wearers.

A footwear manufacturer can prepare an adequate and ready supply of various footwear components for use in making custom articles of footwear which can then be made on demand or alternatively be pre-stocked. Given the information and selections made by a customer and/or individual wearer, an employee, automated robotic system of a footwear manufacturer, or an individual wearer can assemble and make a customized article of footwear within five minutes. In fact, it is possible to assemble a custom article of footwear in less than one minute using a lasting plate 79 including means for fastening such as a plurality of male hooks 27 and a flexible middle portion 60 between its front side 77 and back side 78 which can be flexed, but then return to its original shape. This operation can be accomplished at the point of purchase or service center which can be located in a retail store, medical facility, or a remote manufacturing environment. Accordingly, a customer or individual wearer can be provided with a custom article of footwear within a few minutes. Alternatively, if and when an individual wearer's data is communicated from a remote location to the website or business address of a footwear company which makes the article of footwear and practices the method of making an article of footwear disclosed herein and/or is transmitted to a manufacturing or assembly center, a custom article of footwear can be made and possibly delivered to an individual's home or other designated address by same day or overnight service, as desired. Alternatively, a vending machine device can be used by a customer to select and obtain various footwear components for making, renewing, or customizing an article of footwear. Moreover, an individual wearer can select and purchase individual components for making, changing, or renewing parts of a customizable article of footwear, and then assemble and complete the manufacturing process by themselves.

Figure 1:
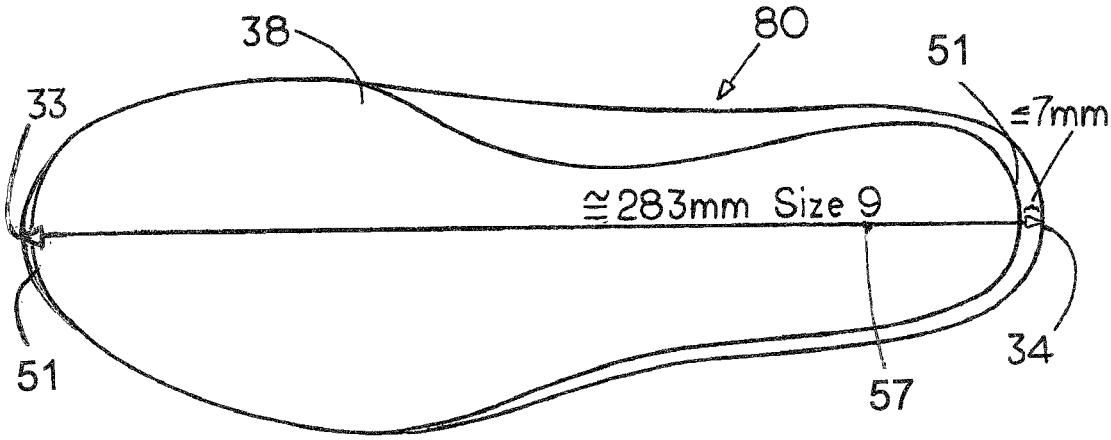
FIG. 1 is a bottom side view of an embodiment of a last for an article of footwear.

FIG. 1 is a bottom view showing the inferior side 38 of an illustrative men's size 9 footwear last 80 which is generally similar to those used by many companies in the athletic footwear industry. As shown, the last measures approximately 283 mm from the front or anterior side 33 to the back or posterior side 34. However, note that the bottom net 51 of this particular last 80 is about 2 mm posterior of the anterior side 33 of the last 80, and also about 7 mm anterior of the posterior side 34 of the last 80. The position of the weight bearing center of the heel 57 is indicated as being approximately 45 mm anterior of the posterior side 34 of the last 80. The foregoing example and other drawings of a footwear last are merely illustrative and not intended to limit the last configuration to any particular type and shape.

Figure 2:
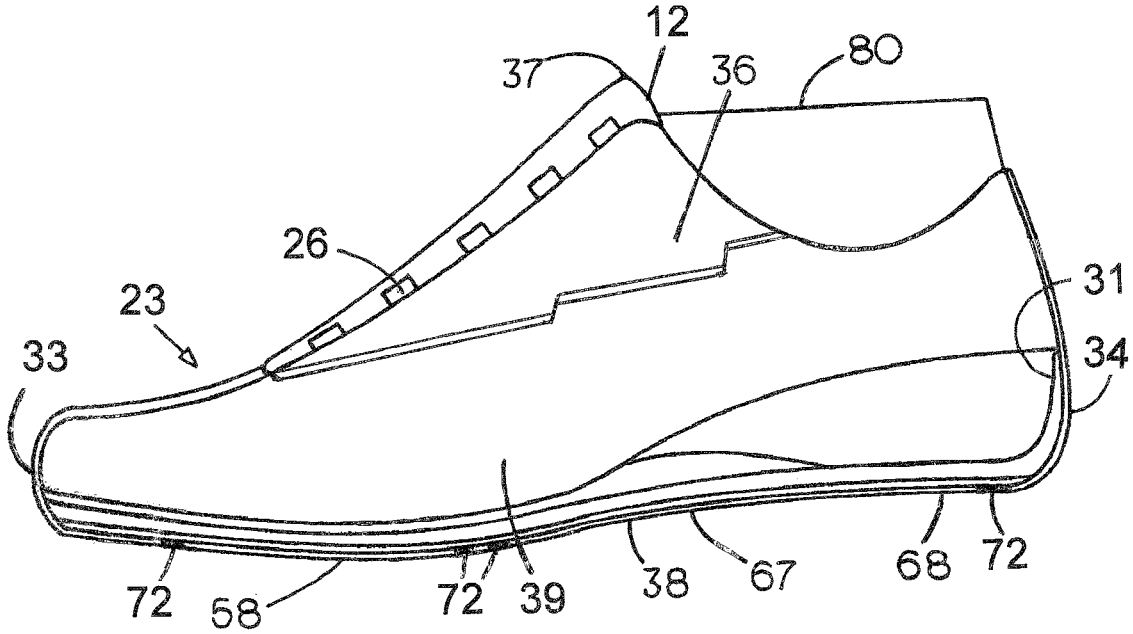
FIG. 2 is a lateral side and partial cross-sectional view showing an embodiment of a shoe upper including lace loops for retaining laces and having an insole and a lasting plate disposed within the shoe upper, and also showing a portion of the footwear last shown in FIG. 1.

FIG. 2 is a lateral side 36 and partial cross-sectional view showing a shoe upper 23 including a non-integral tongue 12, lace loops 26 for retaining laces 21, a plurality of registered openings 72 on the inferior side 38 which can enable means for fastening, e.g., a plurality of male hooks 27 having free ends 28, a plurality of projections 70, and/or a post 16 shown in other provided drawing figures and discussed herein to extend through the upper 23 which is mounted on a last 80 similar to the one shown in FIG. 1 and for illustrative purposes here is transparent. An insole 31 is also shown disposed within the interior side 39 the shoe upper 23. Many running and walking footwear lasts are configured so as to elevate a wearer's heel relative to the tread point 44 when properly treaded. The tread point 44 in the forefoot area 58 is often disposed near and approximately between the position of the medial metatarsal-phalangeal joint 88 associated with the first or big toe, and the lateral metatarsal-phalangeal joint 89 associated with the fifth or small toc. The position of the medial metatarsal-phalangeal joint 88 is normally approximately located at about 69% of foot length, and the lateral metatarsal-phalangeal joint 89 is normally approximately found at about 63% of foot length, that is, when measured from the back of the last 80. Given a last length of 283 mm, the medial metatarsal-phalangeal joint is then located at about 195 mm, and the lateral metatarsal phalangeal joint at about 178 mm from the back or posterior side 34 of the last 80.

Figure 30:
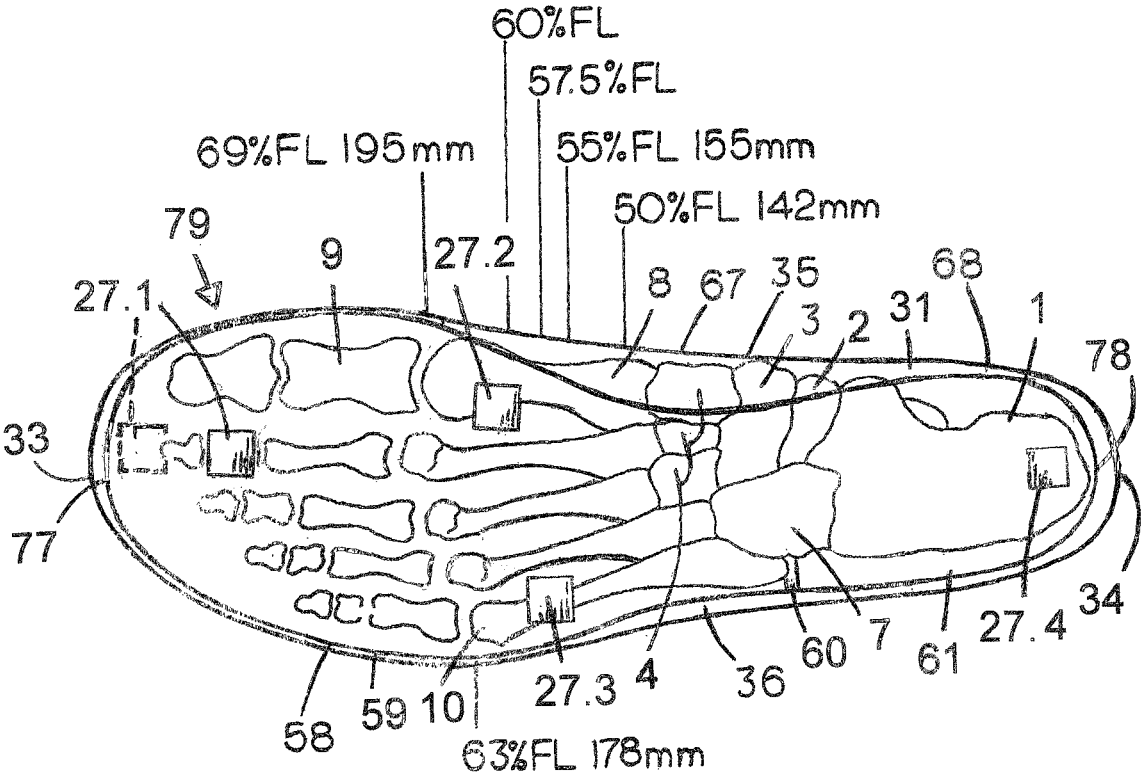
FIG. 30 is a bottom x-ray view of a lasting plate including an insole showing the bones of an average individual's foot.

In this regard, FIG. 30 is a bottom or inferior side view illustration showing the bones of a wearer's foot which includes the calcaneus 1, that is, the heel bone, and the talus 2 which are connected to the tarsus portion of the foot which includes the navicular 3, cuboid 7, and the outer, middle and inner cuneiform bones 4, respectively, which are in turn connected to five metatarsal bones 8 which each have a proximal end, a shaft portion and distal heads 10. The five metatarsal bones 8 are connected to the phalange bones 9 of the foot which are associated with the toes. In this regard, the first or big toe has a proximal and a distal phalange, and all of the other toes have proximal, middle, and distal phalanges. In this disclosure, the term or phrase rearfoot area will be used to refer to a portion of a wearer's foot, an article of footwear or sub-component thereof which is configured to underlie or be disposed about a portion of the calcaneus bone and/or heel, and the term or phrase midfoot area will be used to indicate a portion of a wearer's foot, an article of footwear, or subcomponent thereof which is configured to underlie or be disposed about a portion of the navicular, cuboid, outer, middle, and inner cuneiform, and the proximal end and shafts of the metatarsal bones. The term or phrase ball of a wearer's foot will refer to a portion of a wearer's foot, an article of footwear or subcomponent thereof which is configured to underlie or be disposed about a portion of the distal heads of the five metatarsal bones, and also the proximal ends of the proximal phalanges. In this disclosure, the term or phrase forefoot area will be used to refer to a portion of a wearer's foot, an article of footwear, or sub-component thereof which is configured to underlie or be disposed about a portion of the phalanges and toes. In this regard, the position of the medial metatarsal-phalangeal joint 88 is normally approximately located at about 69% of foot length, and the lateral metatarsal-phalangeal joint 89 is normally approximately found at about 63% of foot length, that is, when measured from the back of the last 80 for a typical size 9 men's article of footwear. Given a last length of 283 mm, the medial metatarsal-phalangeal joint is then located at about 195 mm, and the lateral metatarsal phalangeal joint at about 178 mm from the back or posterior side 34 of the last 80. Accordingly, in this disclosure the term or phrase forefoot area will be used to indicate a portion of a wearer's foot, article of footwear, or sub-component thereof which is configured to be underlie or be disposed anterior of a line drawn between 69% of foot length on the medial side which is approximately 195 mm, and 63% of foot length on the lateral side which is approximately 178 mm from the back or posterior side 34 of a last 80 for a typical size 9 men's article of footwear. Furthermore, in this disclosure the term or phrase forefoot also indicates a portion of a wearer's foot, article of footwear, or sub-component thereof which is configured to underlie or be disposed about the metatarsal heads of a wearer's foot and/or ball of the foot.

The insole 31 can be approximately 3.5-5 mm thick and can be made of EVA, or polyurethane material such as PORON®. The insole 31 can provide conformance and support for the arches in the midfoot area 67 of the shoe 23 beneath the approximate location of the longitudinal and transverse arches of a wearer's foot, but also extend behind and provide a cupped shape about a portion of the wearer's heel in the rearfoot area 68. This can serve to protect the wearer's heel from impact with the heel counter 24. In this regard, the anterior-posterior load or impact to an individual's heel during running can be in the range of 1.25-1.75 body weights and this can contribute to injury, and so cushioning of the wearer's heel can be beneficial. The provided example and drawings of an insole are illustrative and not intended to limit the insole to any particular configuration or dimensions.

Figure 3:
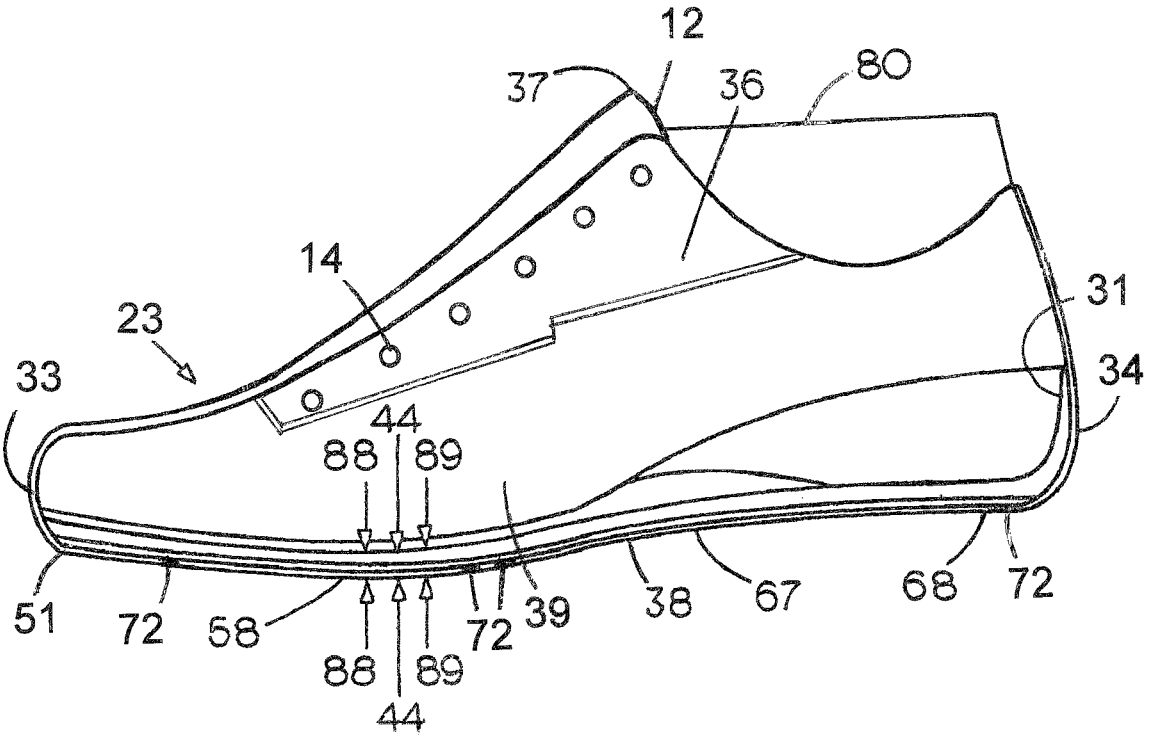
FIG. 3 is a lateral side and partial cross-sectional view showing an embodiment of a shoe upper including eyelets for retaining laces and having an insole and a lasting plate disposed within the shoe upper, and also showing a top portion of the footwear last shown in FIG. 1.

FIG. 3 is a lateral side and partial cross-sectional view showing an embodiment of a shoe upper 23 including an integral tongue 12, a plurality of openings and eyelets 14 for retaining laces 21, and an insole 31 disposed within the interior side 39 of the shoe upper 31. Also shown is a portion of a footwear last 80 generally similar to the one shown in FIG. 1.

Figure 4:
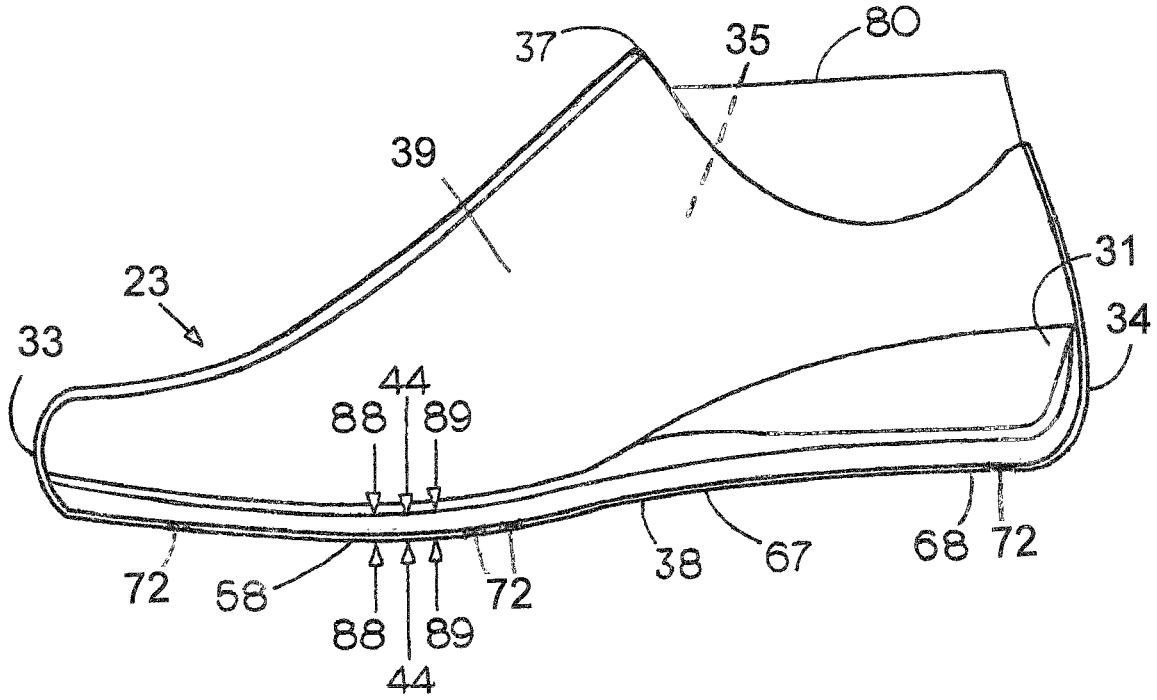
FIG. 4 is a lateral side and cross-sectional view showing an embodiment of a shoe upper having an insole and a lasting plate disposed within the shoe upper, and also showing a top portion of the footwear last shown in FIG. 1.

FIG. 4 is a lateral side cross-sectional view showing an embodiment of a shoe upper 23 including an insole 31 disposed within the interior side 39 of the shoe upper 23. Also shown is a portion of a footwear last 80 generally similar to the one shown in FIG. 1. The shoe upper 23 can be made of a knitted textile material which can be flat knit or three-dimensional knit, and possibly also provide a stretch and/or compression fit and then serve to help retain a wearer's foot and provide both comfort and stability.

Figure 5:
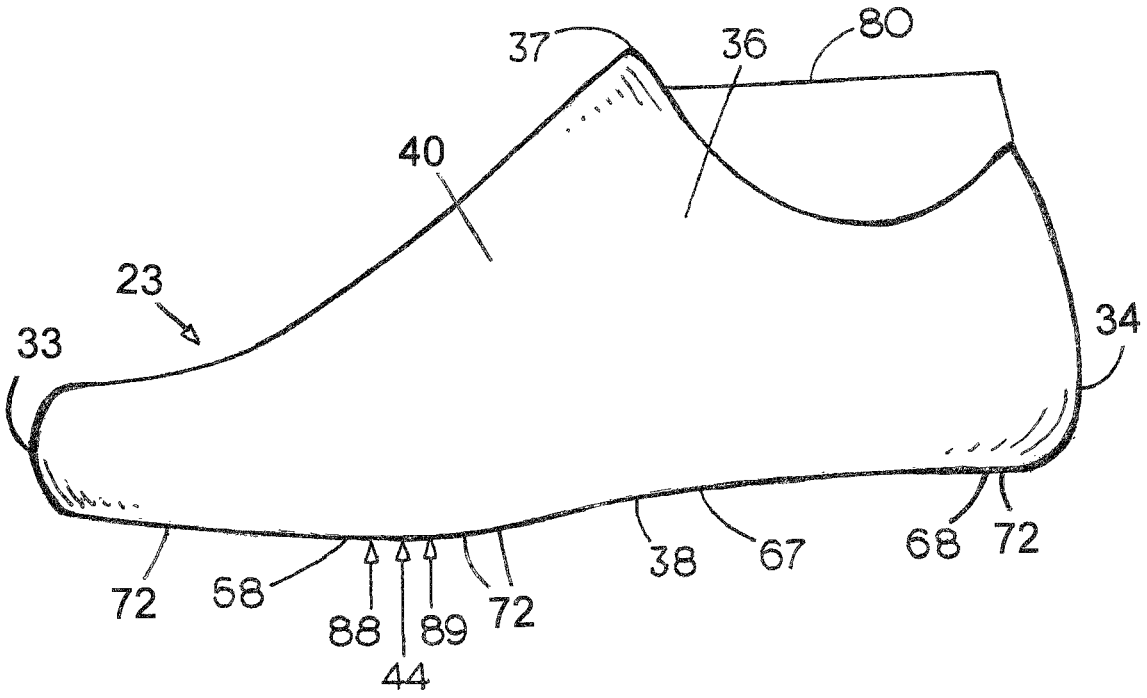
FIG. 5 is a lateral side view showing the exterior side of the embodiment of a shoe upper shown in FIG. 4.

FIG. 5 is a lateral side view showing the exterior side 40 of the embodiment of a shoe upper 23 shown in FIG. 4.

Figure 6:
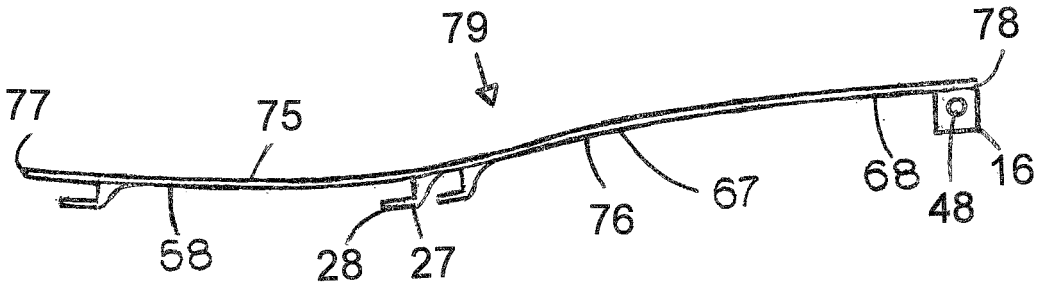
FIG. 6 is a lateral side view of an embodiment of a lasting plate including a plurality of hooks in the forefoot area and the midfoot area, and also a post in the rearfoot area on the bottom side for use in removably securing the lasting plate and shoe upper to a sole.

FIG. 6 is a lateral side view of an embodiment of a lasting plate 79 and including on the bottom side 76 a plurality of male hooks 27 having free ends 28 in the forefoot area 58 and the midfoot area 67, and also a post 16 in the rearfoot area 68 having a transverse post passage 48 for use in removably securing the lasting plate 79 and a shoe upper 23 to a sole 32.

Figure 7:
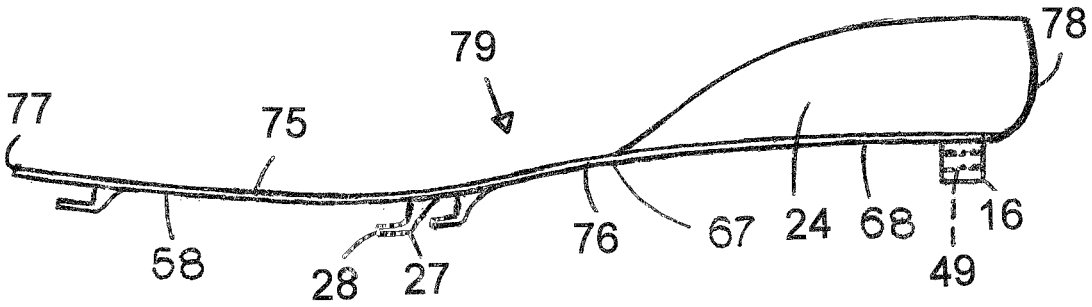
FIG. 7 is a lateral side view of an embodiment of a lasting plate including an integral heel counter in the rearfoot area and including a plurality of hooks in the forefoot area and midfoot area, and also a post in rearfoot area on the bottom side having a longitudinal passage for use in removably securing the lasting plate and shoe upper to a sole.

FIG. 7 is a lateral side view of an embodiment of a lasting plate 79 including an integral heel counter 24 on the top side 75, and including on the bottom side 76 a plurality of hooks 27 having free ends 28 in the forefoot area 58 and midfoot area 67, and also a post 16 in the rearfoot area 68 having a longitudinal post passage 49 for use with a retaining pin 63 for use in removably securing the lasting plate 79 and shoe upper 23 to a sole 32.

Figure 8:
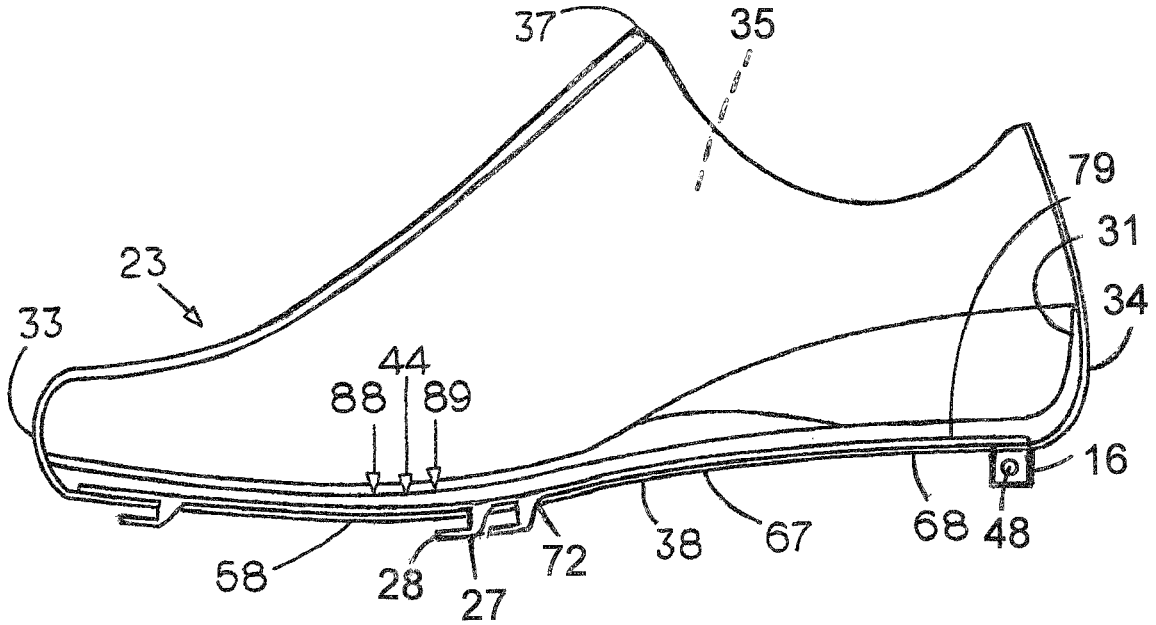
FIG. 8 is a lateral side cross-sectional view of a shoe upper generally similar to that shown in FIGS. 4 and 5 including a plurality of registered openings for receiving the lasting plate shown in FIG. 6.

FIG. 8 is a lateral side cross-sectional view of a shoe upper 23 generally similar to that shown in FIGS. 4 and 5 including a plurality of registered openings 72 for receiving the lasting plate 79 shown in FIG. 6. As shown, the lasting plate 79 can extend substantially between the anterior side 33 and posterior side 34 of the shoe upper 23 and be disposed near, at, or proximate the bottom net 51 and corresponding lasting margin 95 of the shoe upper 23. When made from an injection molded thermoplastic material the thickness of the lasting plate 79 can be in the range between 1-3 mm. When made from a unidirectional carbon fiber composite material or other fiber composite material made of hemp fiber or nanocarbon fiber the thickness of the lasting plate 79 can be in the range between 1.0-1.25 mm. However, it is also possible to make the lasting plate 79 of a less expensive unidirectional fiberglass material such as E or S glass having a thickness between 1.25-2.0 mm. Further, many individuals who only intend to use an article of footwear for easy walking or running at a pace over 7:30 minutes/mile and without carrying a heavy load could possibly not wish or need to use a lasting plate 79 having a high modulus of elasticity and a spring to dampening ratio of over 90 percent. Instead, these individuals could wish to select a lasting plate 79 made of a softer and more flexible thermoplastic material. A lasting plate 79 can spread the loads being placed upon the sole 32 over a greater area which can positively affect the cushioning characteristics, and also serve to increase the exhibited stiffness found at the perimeter of the sole 32 and improve stability. In this regard, there is a discussion of a soft edge phenomenon associated with some athletic footwear provided within U.S. Pat. No. 5,921,004.

Figure 9:
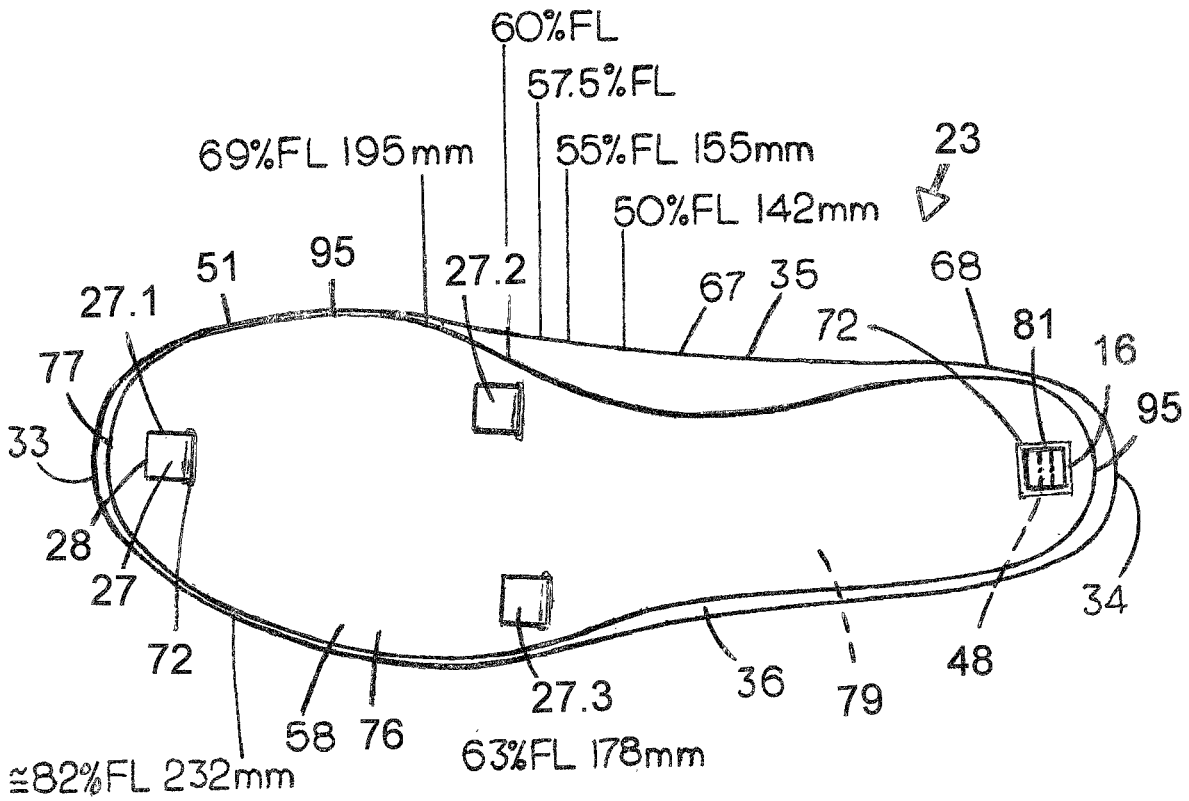
FIG. 9 is a bottom side view of the shoe upper shown in FIG. 8 including the lasting plate shown in FIG. 6.

FIG. 9 is a bottom view of the shoe upper 23 shown in FIG. 4 including the lasting plate 79 shown in FIG. 6. Also indicated on the medial side 35 are positions associated with approximately 50%/142 mm, 55%/155 mm, 57.5%/162.5 mm, and 60%/169 mm of foot length/283 mm. Indicated on the medial side 35 is the position of the metatarsal-phalangeal joint of the big or first toe which normally corresponds with approximately 69% of foot length or 195 mm, and also indicated on the lateral side 36 is the position of the metatarsal-phalangeal joint of the little or fifth toe which normally corresponds with approximately 63% of foot length or 178 mm for a male wearer having a size 9 foot and corresponding shoe last 80 having an overall length of 283 mm. As shown, three male hooks 27 having free ends 28 extend through registered openings 72 in the inferior side 38 of the upper 23. A first male hook 27.1 is disposed near the anterior side 33 of the upper 23. It can be advantageous for the first male hook 27.1 to be located anterior of the metatarsal-phalangeal joints and also posterior of the distal phalanges of the second and third toes because this region of the sole 32 is not normally subject to high pressure and loading. It can also be advantageous for the second male hook 27.2 near the medial side 35 to be disposed posterior of the metatarsal-phalangeal joints of the big or first toe and/or second toe, and for the third male hook 27.3 to be disposed posterior of the metatarsal-phalangeal joints of the little or fifth toe and/or the fourth toe in order to avoid a portion of the sole 32 which is heavily loaded by the ball area of a wearer's foot. In this regard, it can be beneficial for the position of the second male hook 27.2 and third male hook 27.3 to located at least 10 mm behind a line drawn between the position of the first metatarsal-phalangeal joint on the medial side 35 of the shoe upper 23 which approximately corresponds to 69% and 195 mm of foot length, and the fifth metatarsal-phalangeal joint on the lateral side 36 of the shoe upper 23 which approximately corresponds to 63% and 178 mm of foot length for a male wearing having size 9 and a corresponding shoe last 80 having a length of 283 mm. Also shown is a post 16 extending through an opening 72 near the posterior side 34 of the shoe upper 23 and a longitudinal post passage 49 in the post 16 for receiving a retaining pin 63. The openings 72 in the shoe upper 23 for receiving the hooks 27 and/or post 16 can include an edge reinforcement 81. In this regard, the openings 72 in the upper 23 can be configured and made as part of the original design, pattern, and structure of the upper 23, or later be formed or made in the upper 23. For example, when the upper 23 is made using a weaving and/or knitting process, the configuration and location of the openings 72 can be designed and engineered as part of making the upper 23. The edges of the openings can possibly include a reinforcement 81 made by additional weaving, knitting, or stitching. Alternatively, the openings 72 can be cut, or die-punched into a textile material, natural or synthetic leather, or other material used to make the upper 23. In this regard, a combination of cutting or die-punching with the use of heat and pressure can be used to form the openings 72 and simultaneously fuse and make a reinforcement 81 about the edges of the openings 72. Further, some of the footwear components disclosed in the present application could alternatively be at least partially secured in functional relation to one another with the use of stitching, adhesives, the application of heat and/or sonic welding, chemical bonding, fusing, the use of hook and pile, or other mechanical means.

Figure 10:
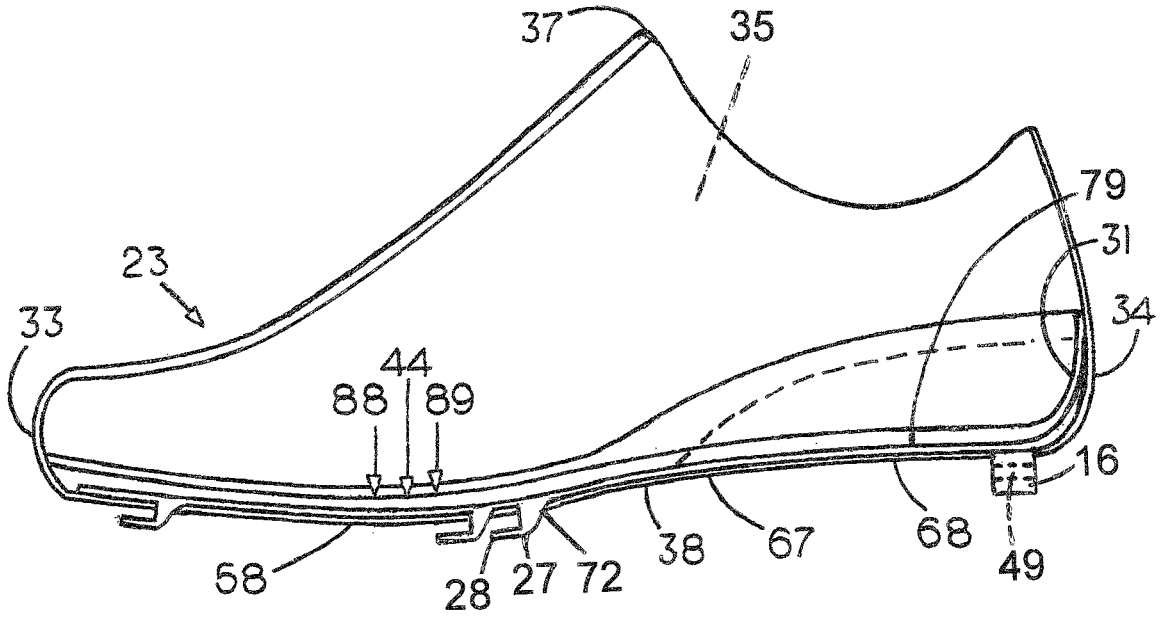
FIG. 10 is a lateral side cross-sectional view of the shoe upper shown in FIG. 8 including the lasting plate shown in FIG. 7.

FIG. 10 is a lateral side cross-sectional view of the shoe upper 23 shown in FIG. 4 including the lasting plate 79 shown in FIG. 7.

Figure 11:
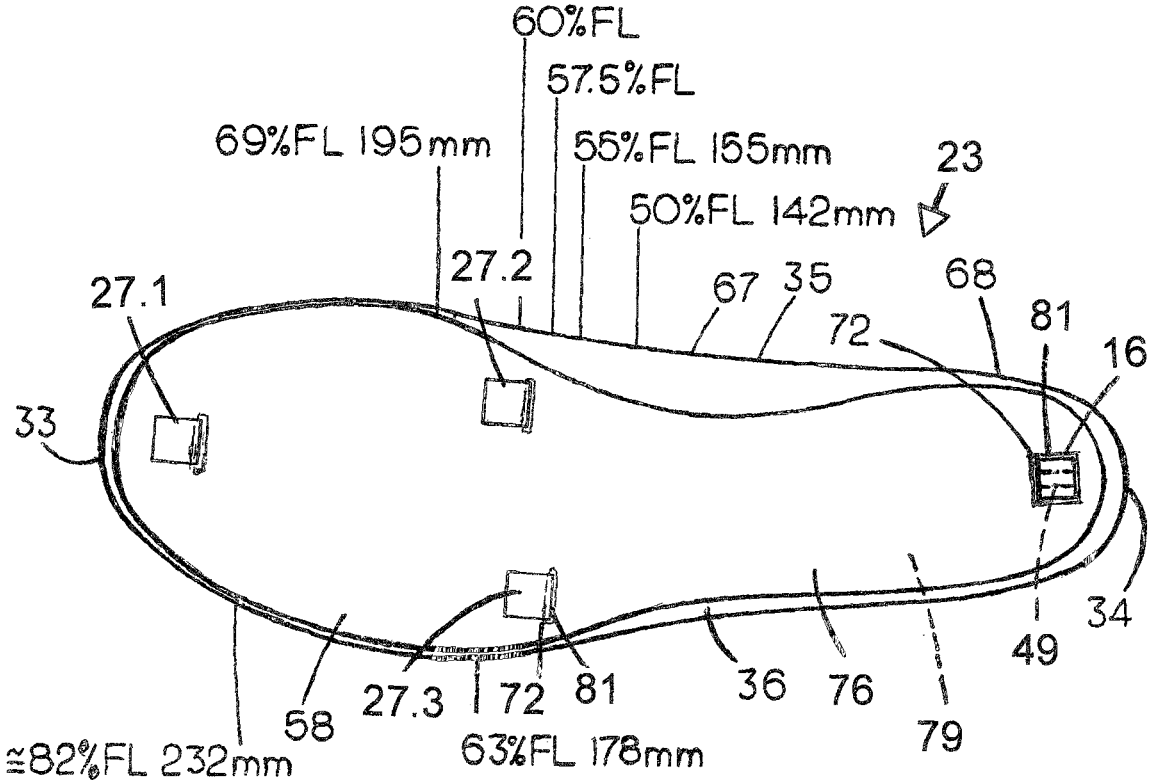
FIG. 11 is an inferior side view of the shoe upper shown in FIG. 8 including the lasting plate shown in FIG. 7.

FIG. 11 is a bottom view of the shoe upper 23 shown in FIG. 4 including the lasting plate 79 shown in FIG. 7.

Figure 12:
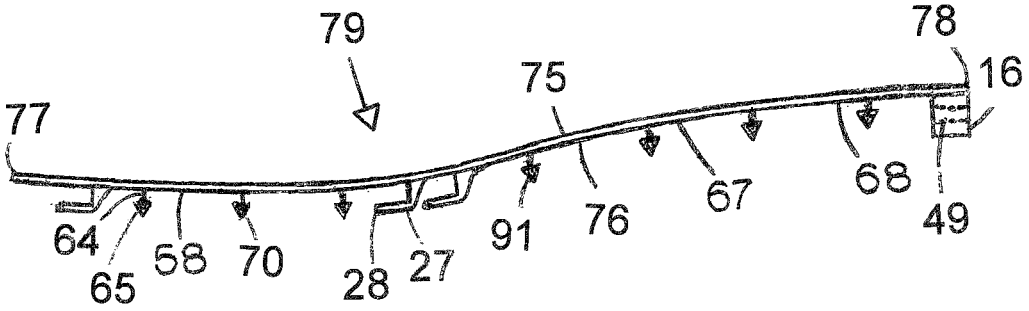
FIG. 12 is a lateral side view of an embodiment of a lasting plate including on the bottom side a plurality of hooks in the forefoot area and midfoot area, a post in the rearfoot area having a longitudinal passage, and a plurality of projections including conical heads for removably securing the lasting plate and/or superior spring element to the shoe upper and sole.

FIG. 12 is a lateral side view of an embodiment of a lasting plate 79 including on its bottom side 76 a plurality of hooks 27 having free ends 28 in the forefoot area 58 and midfoot area 67, a post 16 in the rearfoot area 68 having a longitudinal passage 49, and a plurality of projections 70 including a stem 64 and a head 65, and as shown a conical head 91, for removably securing the lasting plate 79 to a shoe upper 23, and/or a sole 32.

Figure 13:
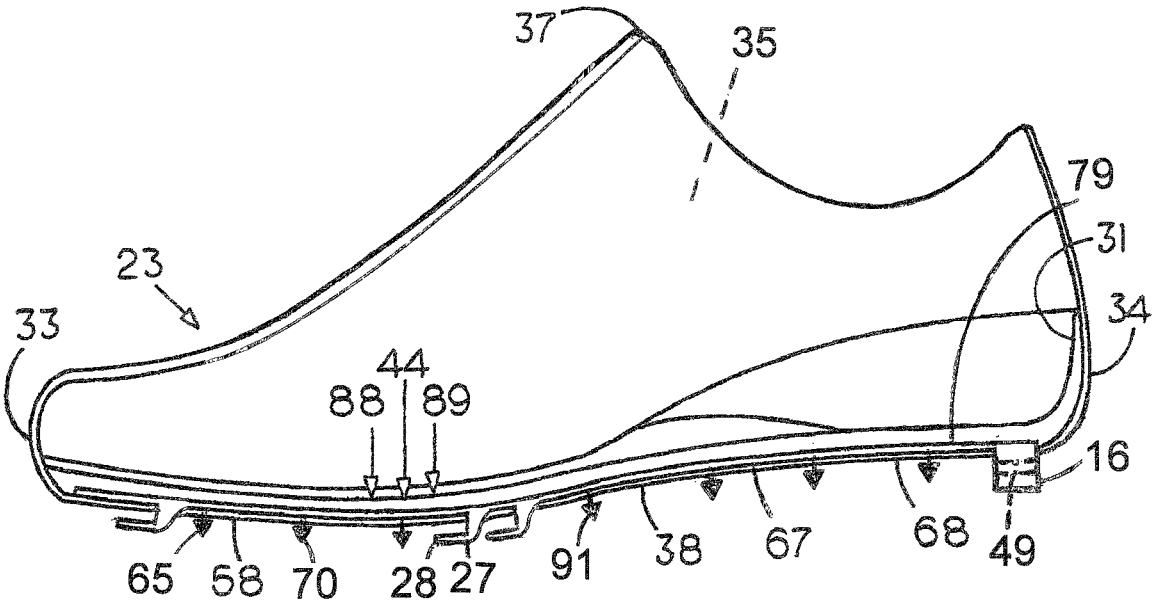
FIG. 13 is a lateral side cross-sectional view of the shoe upper shown in FIG. 8 including the lasting plate shown in FIG. 12.

FIG. 13 is a lateral side cross-sectional view of the shoe upper 23 shown in FIG. 4 including the lasting plate 79 shown in FIG. 12.

Figure 14:
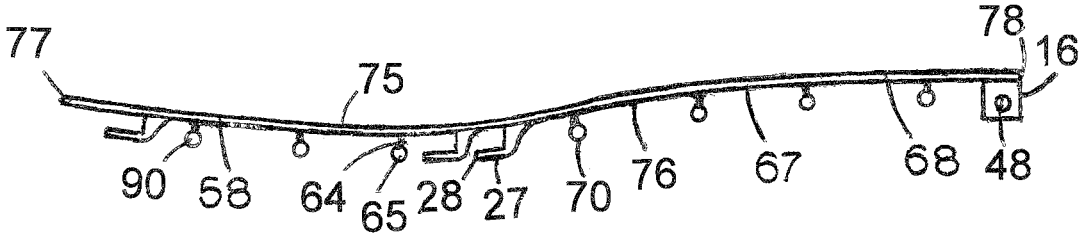
FIG. 14 is a lateral side view of an embodiment of a lasting plate including on its bottom side a plurality of hooks in the forefoot area and midfoot area, and a post in the rearfoot area having a transverse passage, and a plurality of projections including annular heads for removably securing the lasting plate to the shoe upper and sole.

FIG. 14 is a lateral side view of an embodiment of a lasting plate 79 including on its bottom side 76 a plurality of hooks 27 having free ends 28 in the forefoot area 58 and midfoot area 67, and a post 16 in the rearfoot area 68 having a transverse passage 48, and a plurality of projections 70 including a stem 64 and head 65, and as shown an annular head 90 for removably securing the lasting plate 79 to the shoe upper 23, and/or a sole 32.

Figure 15:
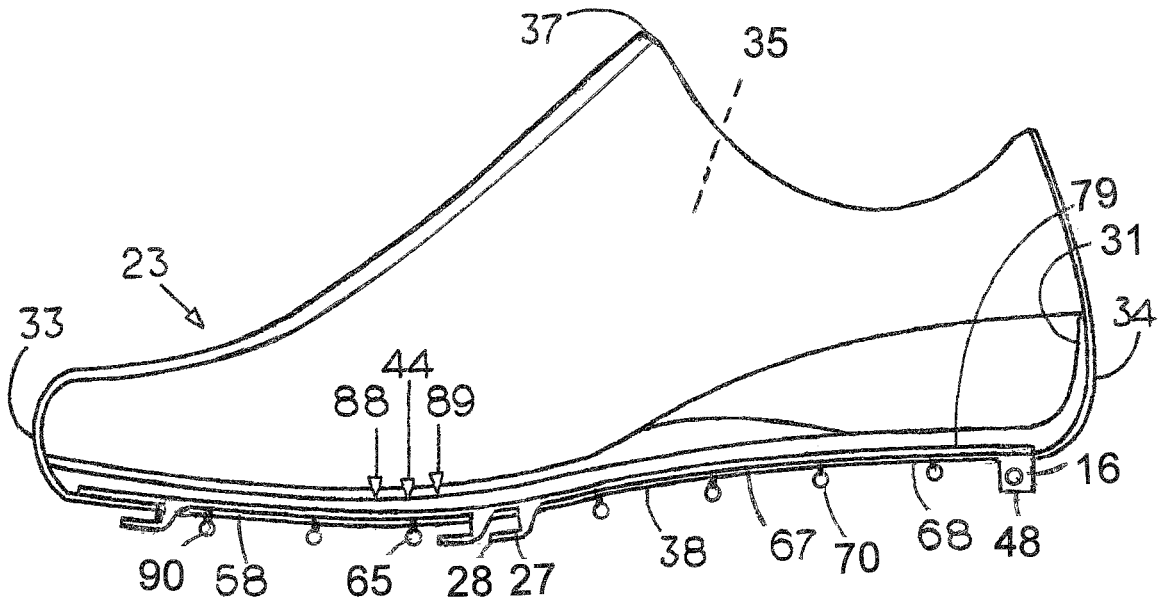
FIG. 15 is a lateral side cross-sectional view of the shoe upper shown in FIG. 8 including the lasting plate shown in FIG. 12.

FIG. 15 is a lateral side cross-sectional view of the shoe upper 23 shown in FIG. 4 including the lasting plate 79 shown in FIG. 14.

Figure 16:
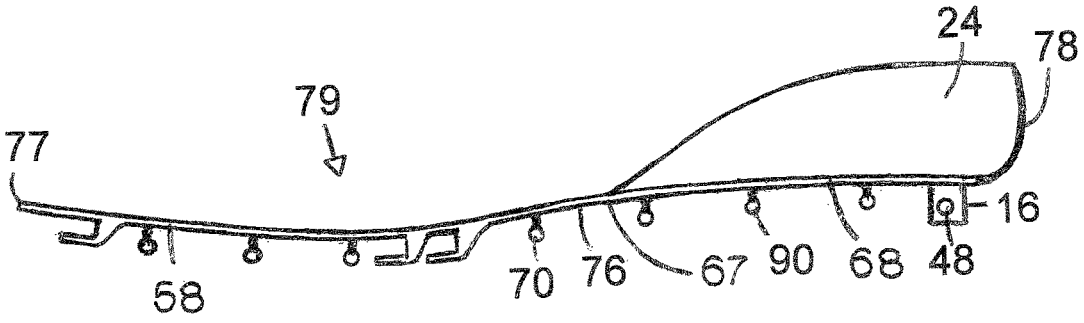
FIG. 16 is a lateral side view of a lasting plate generally similar to that shown in FIG. 12, but further including an integral heel counter.

FIG. 16 is a lateral side view of a lasting plate 79 generally similar to that shown in FIG. 14, but further including an integral heel counter 24.

Figure 17:
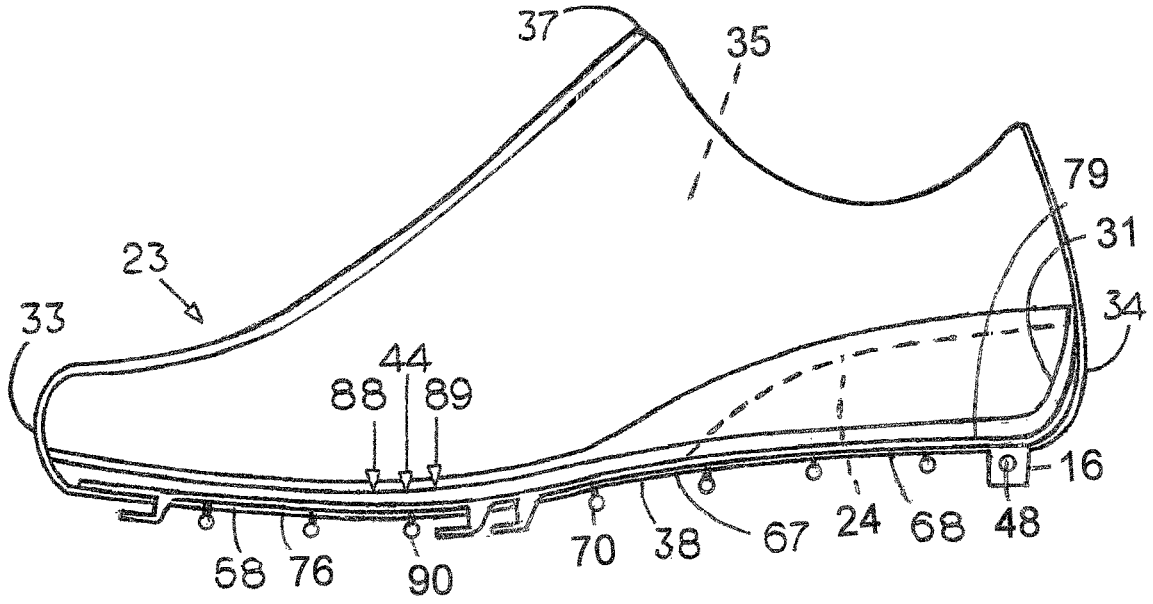
FIG. 17 is a lateral side cross-sectional view of the shoe upper shown in FIG. 8 including the lasting plate shown in FIG. 16.

FIG. 17 is a lateral side cross-sectional view of the shoe upper 23 shown in FIG. 4 including the lasting plate 79 including an integral heel counter 24 shown in FIG. 16.

Figure 18:
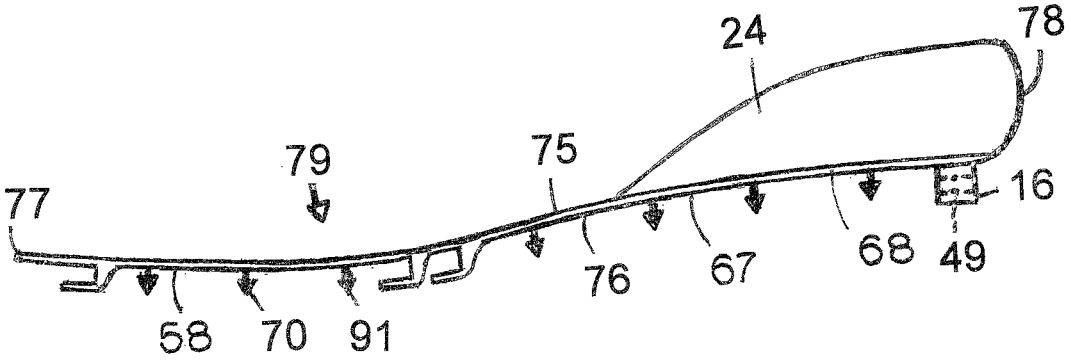
FIG. 18 is a lateral side view of a lasting plate generally similar to that shown in FIG. 14, but further including an integral heel counter.

FIG. 18 is a lateral side view of a lasting plate 79 generally similar to that shown in FIG. 12, but further including an integral heel counter 24.

Figure 19:
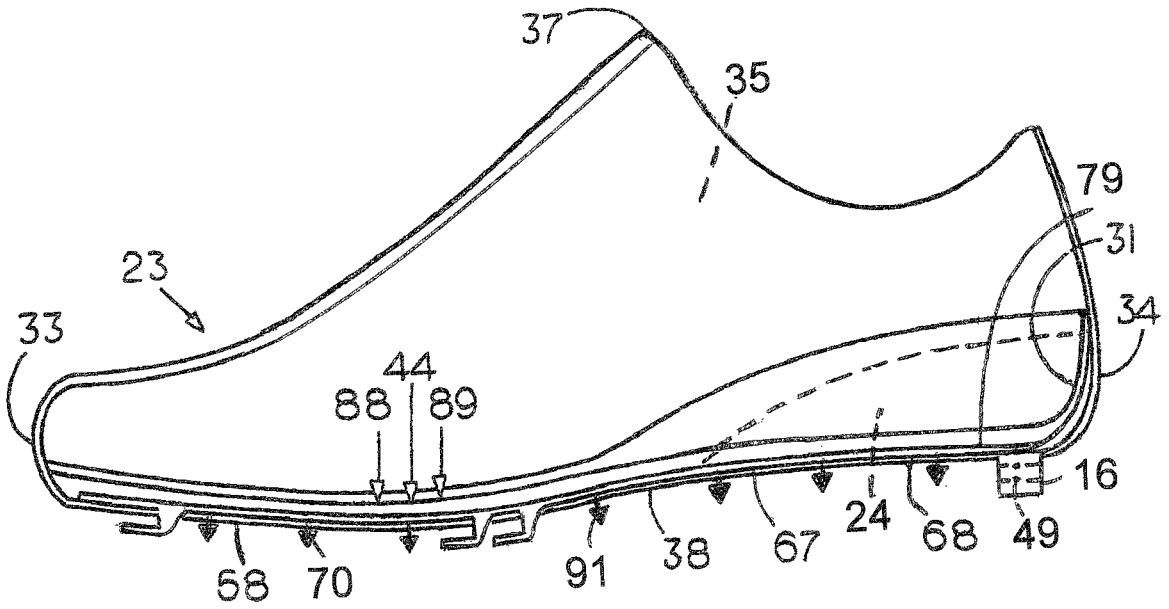
FIG. 19 is a lateral side cross-sectional view of the shoe upper shown in FIG. 8 including the lasting plate shown in FIG. 18.

FIG. 19 is a lateral side cross-sectional view of the shoe upper 23 shown in FIG. 4 including the lasting plate 79 including an integral heel counter 24 shown in FIG. 18.

Figure 20:
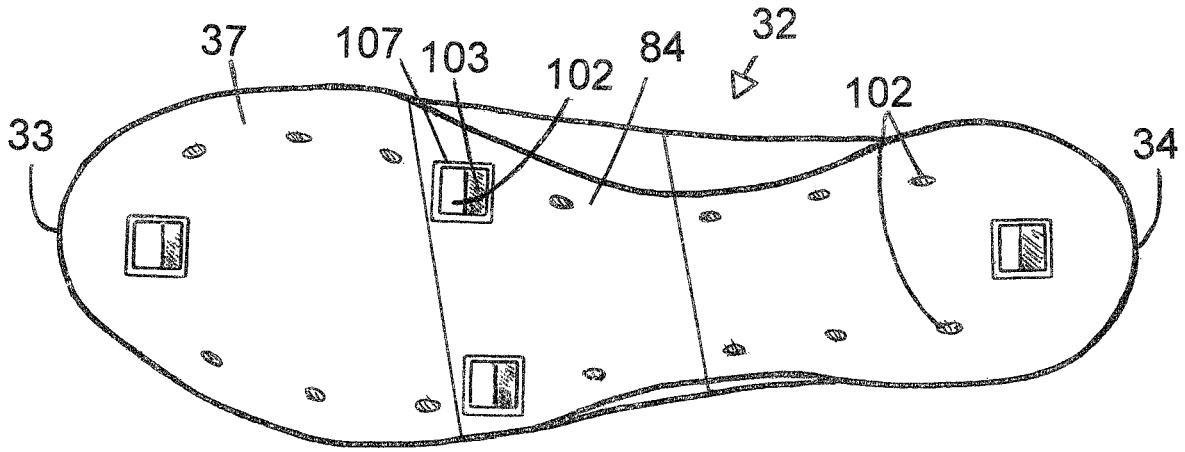
FIG. 20 is a top view of a sole including a plurality of void spaces for receiving a plurality of projections and also a plurality of female receptacles for receiving and coupling with a plurality of male hooks on a lasting plate.

FIG. 20 is a top view of a sole 32 including a plurality of small void spaces 102 for receiving a plurality of projections 70 and also a plurality of female receptacles 103 for receiving and coupling with a plurality of male hooks 27 on a lasting plate 79. In this embodiment, the small void spaces 102 for receiving a plurality of projections 70 only provide space in the sole 32 for the projections 70. As shown is a recess 84 in a portion of the superior side 37 of the sole 32 for accommodating the thickness of a strap 18. In this regard, depth of the recess 84 can be in the range between 1-4 mm. The female receptacles 103 can be made as void spaces in the sole 32, and/or alternatively and as shown as female receptacle inserts 107 made of an elastomeric or thermoplastic material.

Figure 21:
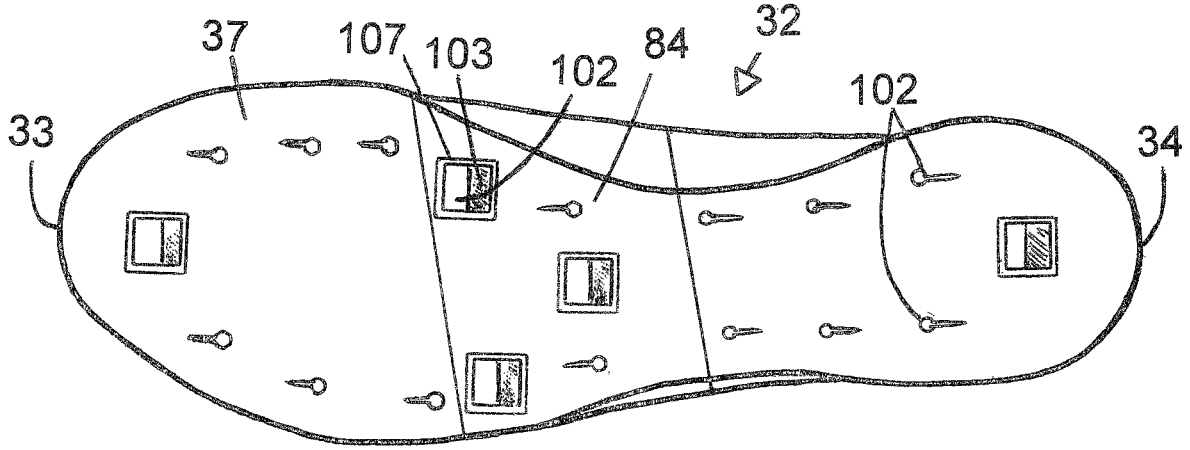
FIG. 21 is a top view of a sole including a plurality of keyed void spaces for receiving a plurality of projections and also a plurality of female receptacles for receiving and coupling with a plurality of male hooks on a lasting plate.

FIG. 21 is a top view of a sole 32 including a plurality of keyed void spaces 102 for receiving a plurality of projections 70 and also a plurality of female receptacles 103 for receiving and coupling with a plurality of male hooks 27 on a lasting plate 79. In this embodiment, the small keyed void spaces 102 for receiving a plurality of projections 70 not only provide space in the sole 32 for the projections 70, but the annular 90, conical 92, or other shaped head 65 portion of the projections 70 can be coupled to the narrow portion of the keyed void spaces 102 and thereby be removably secured to the sole 32. Further, this alternative embodiment of a sole 32 also shows an additional female receptacle 103 for use with a lasting plate 79 having a complementary design, and a recess 84 for accommodating the inclusion of a strap 18.

Figure 22:
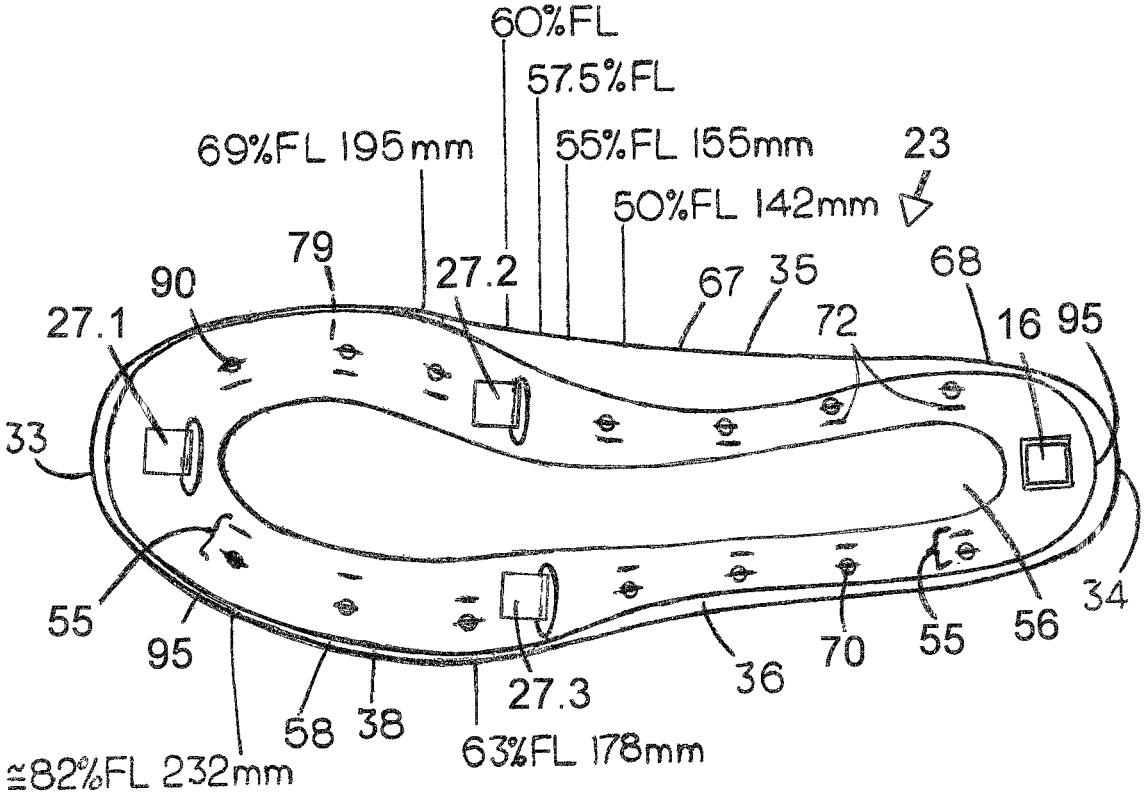
FIG. 22 is a bottom side view of a shoe upper including a t-sock and a plurality of openings for receiving a plurality of hooks in the forefoot area and midfoot area and also a post in the rearfoot area, and also including multiple sets of paired alternative openings on the medial and lateral sides of the shoe upper for selectively adjusting the configuration and width of the upper, and a plurality of other openings for receiving a plurality of annular, conical, or other geometrically shaped projections for removably securing the shoe upper to a lasting plate such as those shown in FIGS. 12, 14, 16 and 18.

FIG. 22 is a bottom view of a shoe upper 23 including a t-sock 56 and a plurality of openings 72 including an edge having a reinforcement 81 for receiving a plurality of male hooks 27.1, 27.2 and 27.3 in the forefoot area 58 and midfoot area 67, and a post 16 in the rearfoot area 68. Further, also shown are multiple sets of paired alternative openings 55 on the medial side 35 and also the lateral side 36 of the shoe upper 23 for receiving a plurality of projections 70 for adjusting the conformance and width of the upper 23. The projections 70 can have annular heads 90 or conical heads 91, or other geometrically shaped projections can be used for removably securing the shoe upper 23 to a lasting plate 79 and adjusting the conformance and width of the upper 23. In this regard, the openings 72 in the upper 23 for the hooks 27.1, 27.2, 27.3, post 16, sets of paired alternative openings 55, eyelets 14, and other openings 72 possibly associated with means for closure and a closure mechanism such as laces 21 and straps 18 can be configured and made as part of the design, pattern, and structure of the upper 23, or later be formed or made in the upper 23. For example, when the upper 23 is made using a weaving and/or knitting process, the configuration and location of the openings 72 can be designed and engineered to make the upper 23. The edges of the openings 72 can possibly include a reinforcement 81 made by additional weaving, knitting, or stitching. Alternatively, the openings 72 can be cut, or die-punched into a textile material, natural or synthetic leather, or other material used to make the upper 23. In this regard, a combination of cutting or die-punching with the use of heat and pressure can be used to form the openings 72 and simultaneously fuse and make a reinforcement 81 about the edges of the openings 72.

Figure 23:
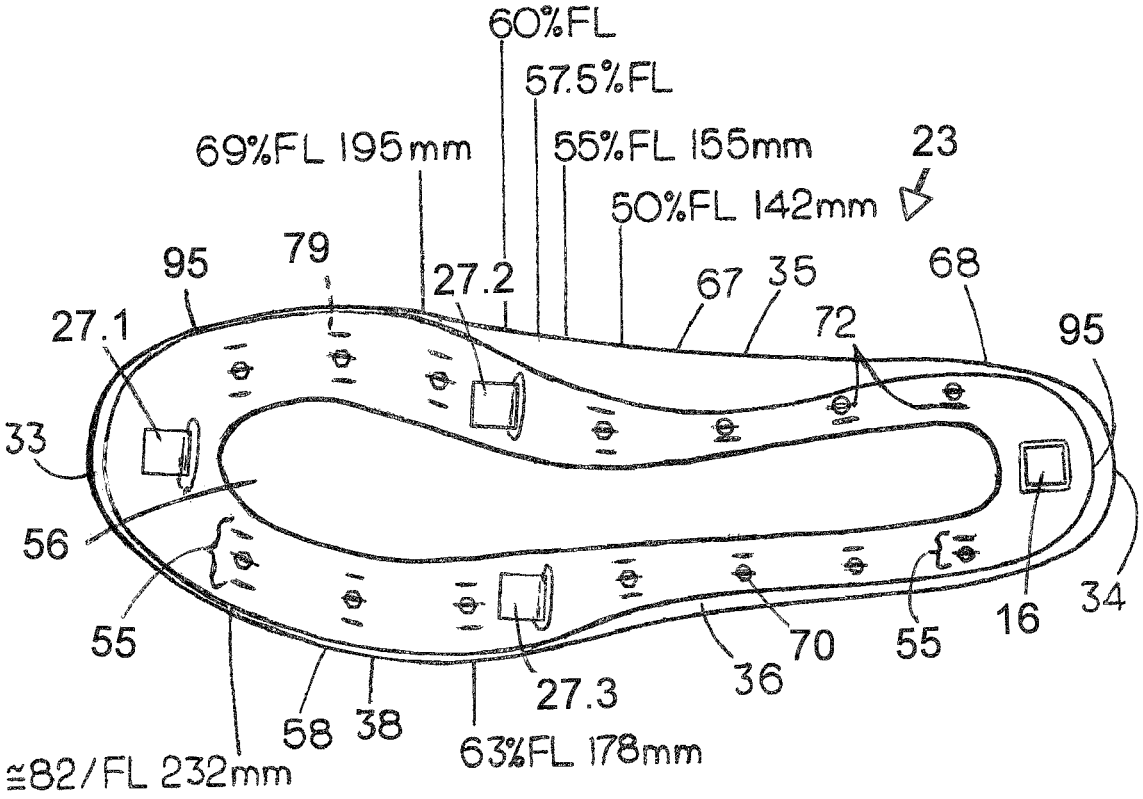
FIG. 23 is bottom side view of a shoe upper including a t-sock and a plurality of openings for receiving a plurality of hooks in the forefoot area and midfoot area and a post in the rearfoot area, and also including multiple sets of three alternative openings on the medial and lateral sides of the shoe upper in the forefoot area and multiple sets of either two or three alternative openings in the midfoot area and/or rearfoot area for selectively adjusting the configuration and width of the upper, and a plurality of other openings for receiving a plurality of annular, conical, or other geometrically shaped projections for removably securing the shoe upper to a lasting plate such as those shown in FIGS. 12, 14, 16 and 18.

FIG. 23 is bottom view of a shoe upper 23 including a t-sock 56 and a plurality of openings 72 for receiving a plurality of hooks 27.1, 27.2, 27.3 in the forefoot area 58 and midfoot area 67 and a post 16 in the rearfoot area 68. Further, also shown are multiple sets of three alternative openings 55 on the medial side 35 and also the lateral side 36 of the shoe upper 23 in the forefoot area 58 and multiple sets of either two or three alternative openings 55 in the midfoot area 67 and rearfoot area 68 for selectively adjusting and customizing the configuration and width of the upper 23. The projections 70 can have annular heads 90 or conical heads 91, or other geometrically shaped projections can be used for removably securing the shoe upper 23 to a lasting plate 79 and adjusting the conformance and width of the upper 23.

Figure 24:
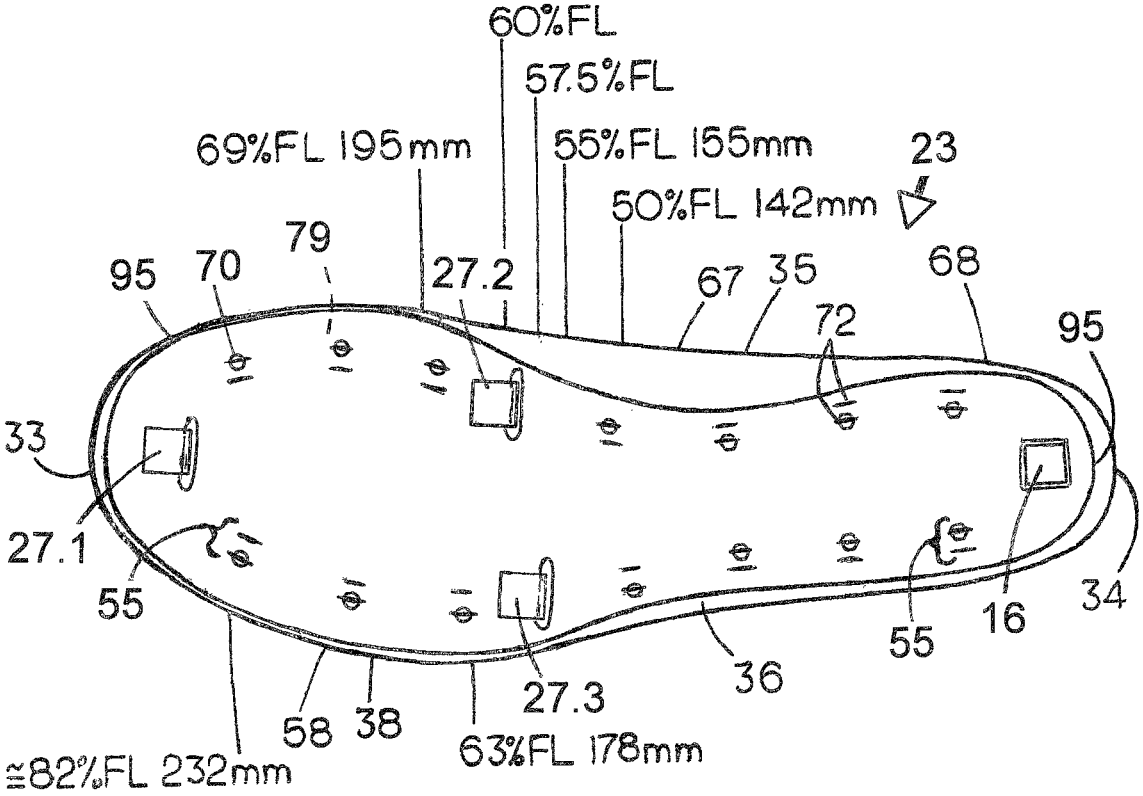
FIG. 24 is a bottom side view of a shoe upper including a plurality of openings for receiving a plurality of hooks in the forefoot area and midfoot area and a post in the rearfoot area, and also including multiple sets of paired alternative openings on the medial and lateral sides of the shoe upper for selectively adjusting the configuration and width of the upper, and also a plurality of other openings for receiving a plurality of annular, conical, or other geometrically shaped projections for removably securing the shoe upper to a lasting plate such as those shown in FIGS. 12, 14, 16 and 18.

FIG. 24 is a bottom view of a shoe upper 23 including a plurality of openings 72 for receiving a plurality of hooks 27.1, 27.2, 27.3 in the forefoot area 58 and midfoot area 67 and a post 16 in the rearfoot area 68. Further, also show are multiple sets of paired alternative openings 55 on the medial side 35 and lateral side 36 of the shoe upper 23 for selectively adjusting and customizing the configuration and width of the upper 23. The projections 70 can have annular heads 90 or conical heads 91, or other geometrically shaped projections can be used for removably securing the shoe upper 23 to a lasting plate 79 and adjusting the conformance and width of the upper 23.

Figure 25:
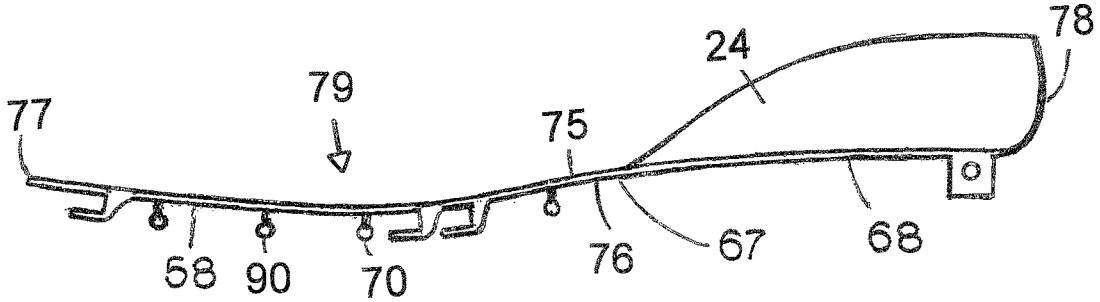
FIG. 25 is a lateral side view of a lasting plate generally similar to those shown in FIGS. 16 and 21, which includes a post that has a transverse passage, but which does not include a plurality of projections having annular heads in the rearfoot area.

FIG. 25 is a lateral side view of a lasting plate 79 generally similar to those shown in FIGS. 16, which includes on the bottom side 76 a plurality of projections 70 having annular heads 90 and a post 16 having a transverse post passage 48, but which does not include a plurality of projections 70 having annular heads 90 in the rearfoot area.

Figure 26:
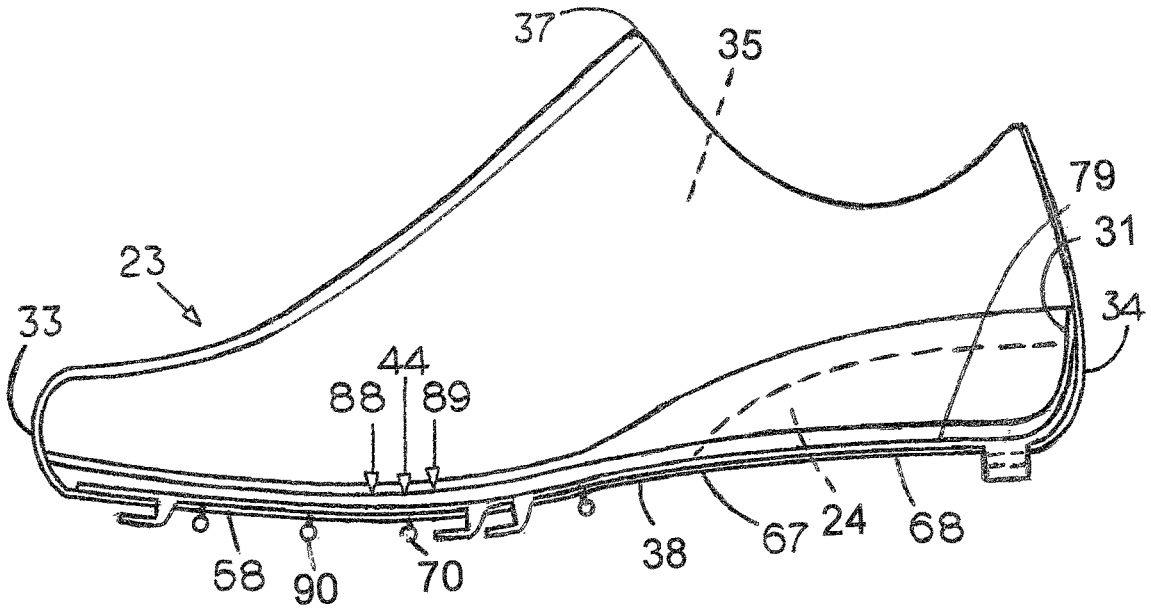
FIG. 26 is a medial side view of an embodiment of an article of footwear generally similar to that shown in FIG. 17, including a lasting plate generally similar to that shown in FIG. 25 which instead includes a post having a longitudinal passage.

FIG. 26 is a medial side cross-sectional view of an embodiment of shoe upper 23 generally similar to that shown in FIG. 4 including a lasting plate 79 generally similar to that shown in FIG. 25, but which instead includes a longitudinal post passage 49.

Figure 27:
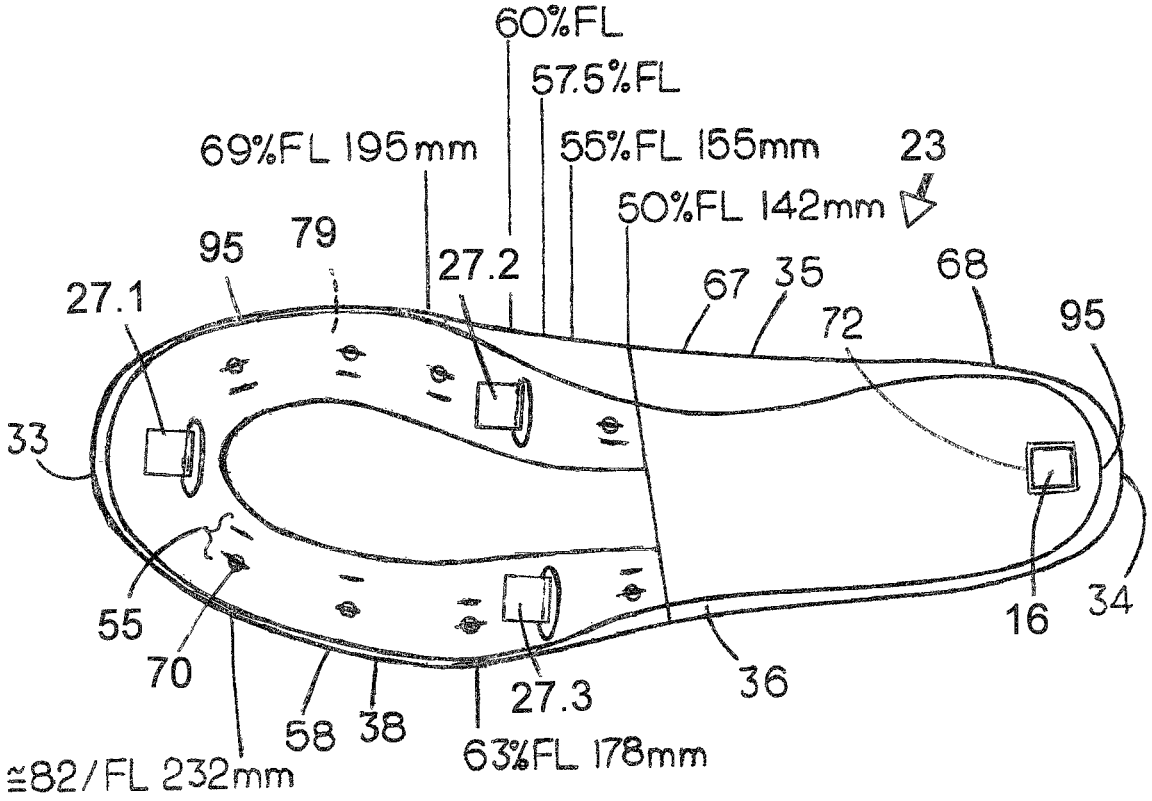
FIG. 27 is an inferior side view of the shoe upper shown in FIG. 26.

FIG. 27 is a bottom view of the shoe upper 23 shown in FIG. 26.

Figure 28:
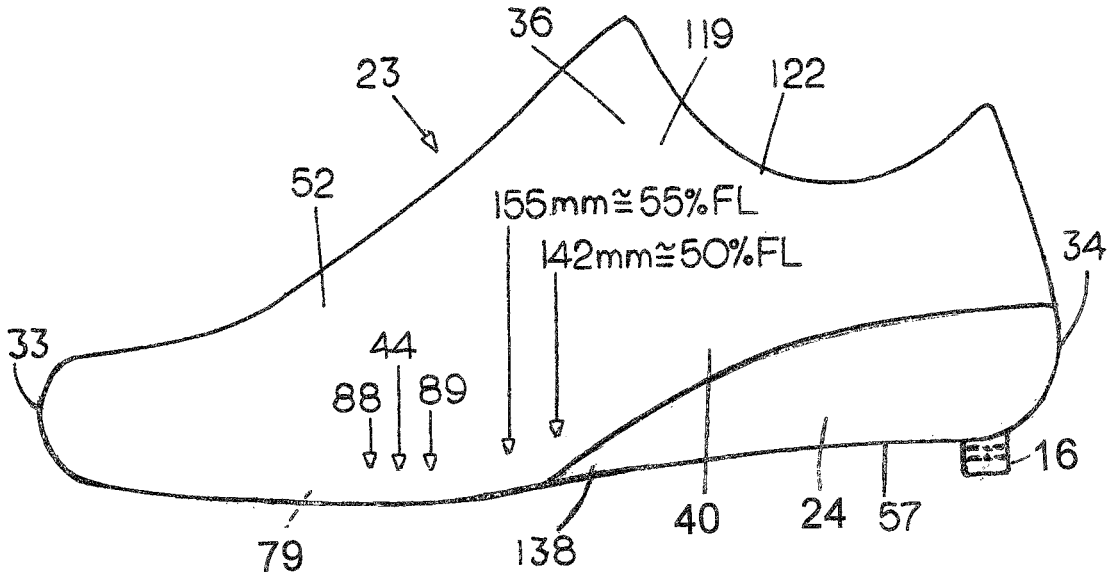
FIG. 28 is a lateral side view of a shoe upper generally similar to that shown in FIG. 8 which includes an internal lasting plate including a post having a longitudinal passage, and an external heel counter.

FIG. 28 is a lateral side view of a shoe upper 23 generally similar to that shown in FIG. 4 which includes a lasting plate 79 on the interior side 39 including a post 16 having a longitudinal post passage 49, and an external heel counter 24 on the exterior side 40 of the shoe upper 23.

Figure 29:
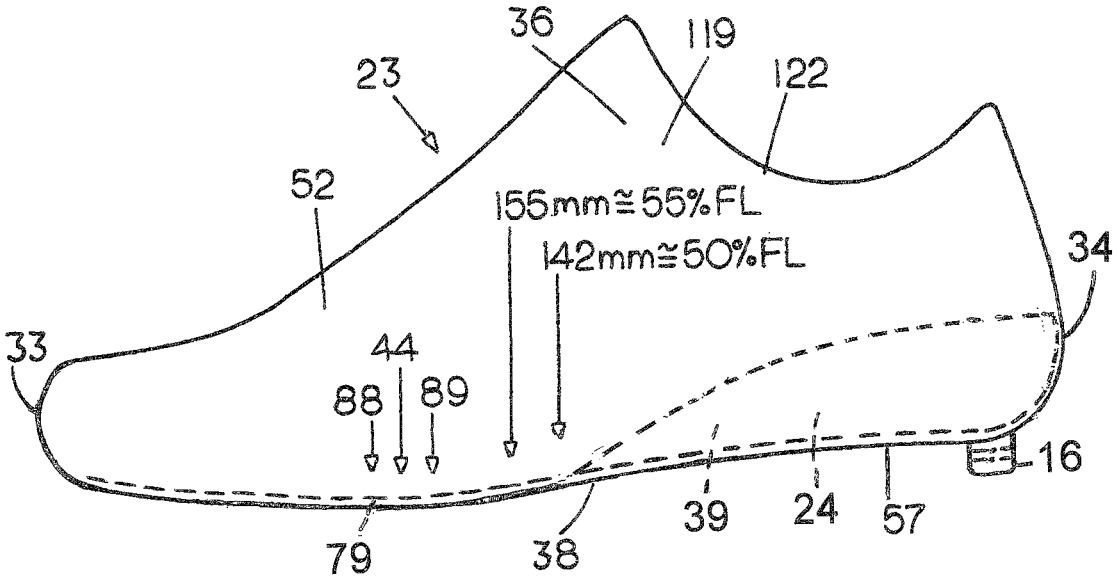
FIG. 29 is a lateral side view of a shoe upper generally similar to that shown in FIG. 8 which includes an internal lasting plate including a post having a longitudinal passage, and also an internal heel counter.

FIG. 29 is a lateral side view of a shoe upper 23 generally similar to that shown in FIG. 4 which includes a lasting plate 79 on the interior side 39 shown with a single dashed phantom line which includes a post 16 having a longitudinal post passage 49 which projects downwards from the inferior side 38 of the shoe upper 23. The lasting plate 79 overlaps an internal heel counter 24 shown with dashed lines which includes a registered opening 72 for mechanically mating with the post 16.

FIG. 30 is a bottom x-ray view of a lasting plate 79 including an insole 31 showing the bones of a normal individual's foot which include the calcaneus 1, talus 2, navicular 3, three cuneiforms 4, cuboid 7, five metatarsals 8, and a plurality of phalanges 9. In this regard, the big or first toe has a proximal and a distal phalange, and the second, third, fourth, and fifth toes have proximal, middle, and distal phalanges. As shown, male hooks 27.2 and 27.3 are disposed rearward or posterior of the position of the metatarsal phalangeal joints. The male hook 27.1 is shown disposed in a position under and between the middle phalange of the second toe, thus between the metatarsal phalangeal joint of the second toe, and the distal phalange of the second toc. In an alternative embodiment of a lasting plate 79, and as shown with dashed phantom lines in FIG. 30, a male hook 27.1 can alternatively be substantially or entirely disposed in front or anterior of the distal phalange of the second toe. This configuration of the location of the hooks 27.1, 27.2, and 27.3 on a lasting plate 79 can permit the area beneath the ball of the foot and also under the distal phalange of the big or first toe which are subjected to high loads to have unimpeded deflection and thereby enhance cushioning.

Figure 31:
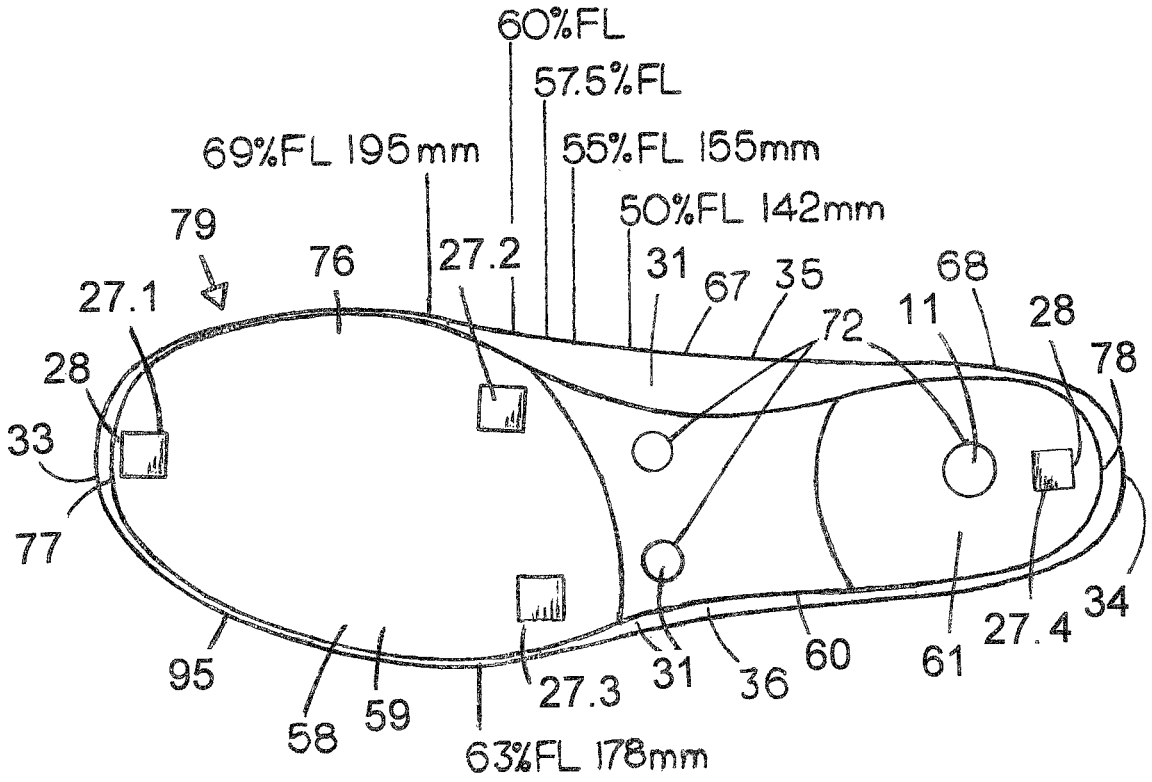
FIG. 31 is a bottom view of a lasting plate including an anterior portion, a flexible middle portion, a posterior portion, and an insole.

FIG. 31 is a bottom view of a lasting plate 79 including an anterior portion 59, a flexible middle portion 60, a posterior portion 61, and an insole 31. In this embodiment, the male hook 27.1 is disposed to a position near the front side 77 of the lasting plate 79, like the one indicated with dashed phantom lines in FIG. 30. As shown in FIG. 31, the insole 31 has three circular protrusions 11 which project downwards from the insole 31 and can mechanically mate and serve to removably couple the insole 31 with three corresponding registered openings 72 in the lasting plate 79. Moreover, the inclusion of one or more openings 72 in the middle portion 59 of a lasting plate 79 can also serve to reduce its exhibited stiffness and resistance to flexion or bending and make it easier to manipulate the lasting plate 79 and insert male hook 27.4 into a mating female receptacle 103 in a sole 32, thus removably secure an upper 23, a lasting plate 79 which can include an insole 31, and a sole 32 to make an article of footwear 22.

Figure 32:
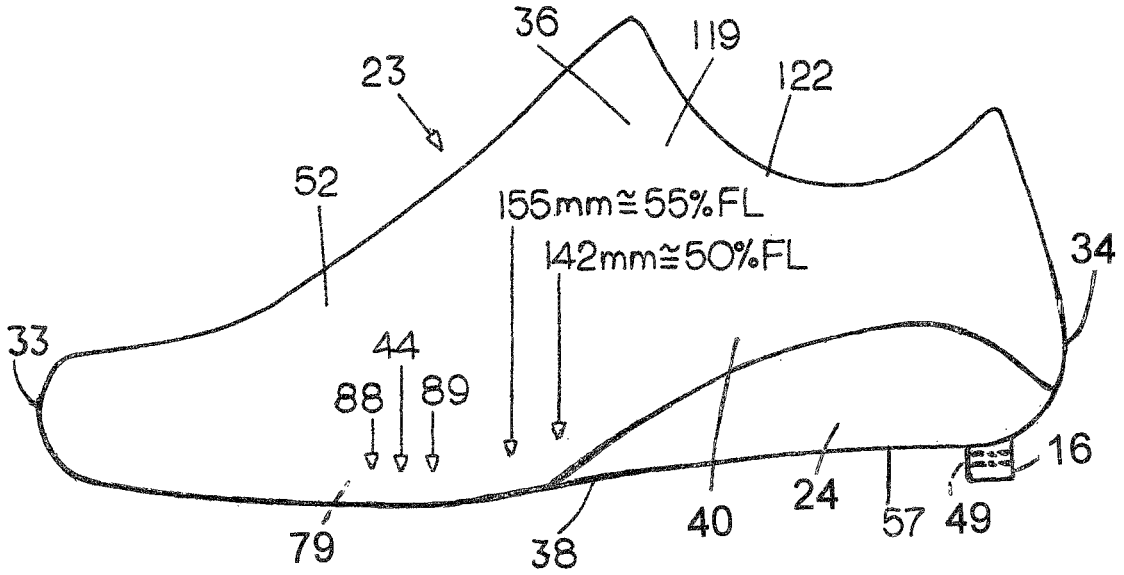
FIG. 32 is a lateral side view of a shoe upper generally similar to that shown in FIG. 8 which includes an internal lasting plate including a post having a longitudinal passage, and an external heel counter having a relatively low profile near the posterior side as also shown in FIG. 44.
Figure 44:
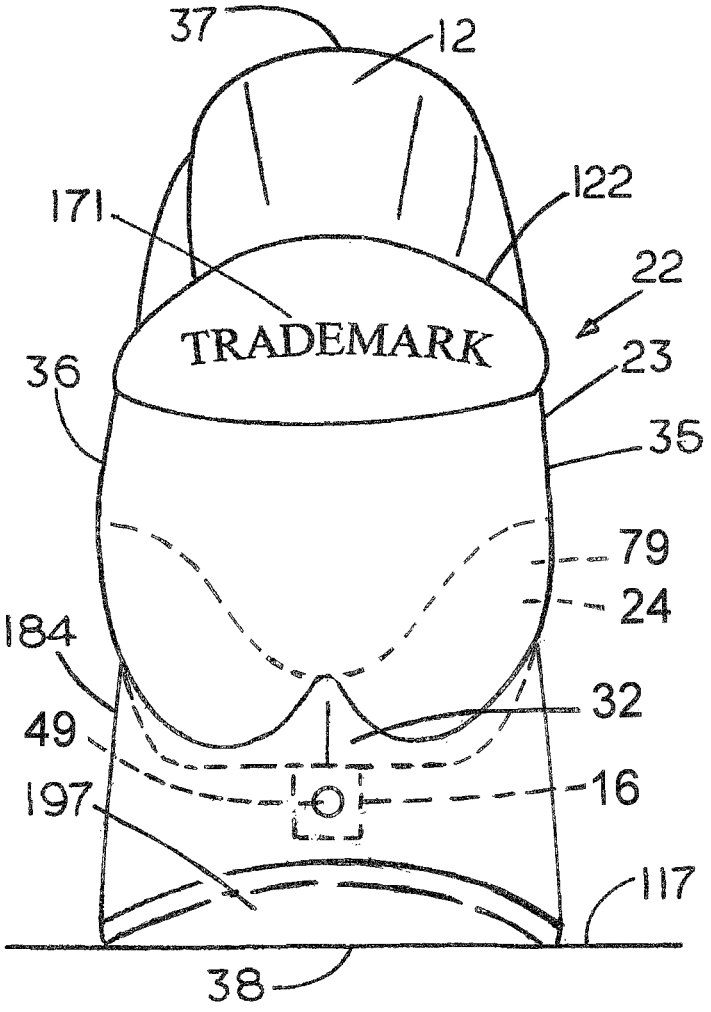
FIG. 44 is a posterior and partial x-ray view of a portion an embodiment of an article of footwear including a shoe upper including a lasting plate including a plurality of hooks and a post having a circular longitudinal passage similar to that shown in FIG. 42, and a sole.

FIG. 32 is a lateral side view of a shoe upper 23 generally similar to that shown in FIG. 4 which includes a lasting plate 79 on the interior side 39 including a post 16 having a longitudinal post passage 49, and an external heel counter 24 including a relatively low vertical profile on the exterior side 40 as also shown in FIG. 44. The heel counter 24 includes a registered opening 72 for mechanically mating with the post 16.

Figure 33:
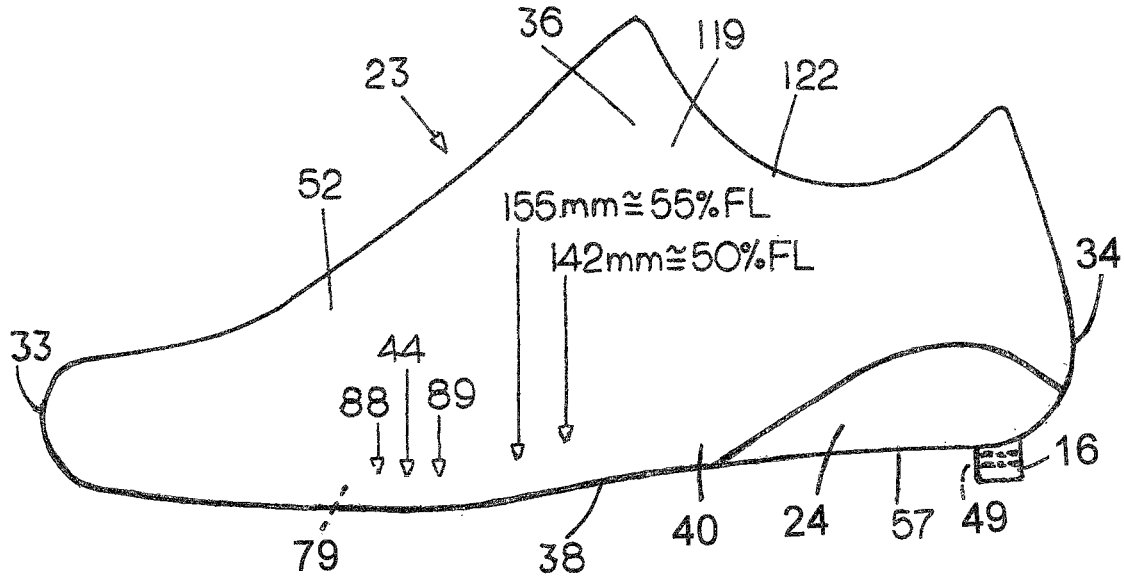
FIG. 33 is a lateral side view of a shoe upper generally similar to that shown in FIG. 8 which includes an internal lasting plate including a post having a longitudinal passage, and an external heel counter in the rearfoot area.

FIG. 33 is a lateral side view of a shoe upper 23 generally similar to that shown in FIG. 4 which includes a lasting plate 79 including a post 16 having a longitudinal post passage 49, and an external heel counter 24 in the rearfoot area 68. The heel counter 24 can include a registered opening 72 for mechanically mating with a post 16 of the lasting plate 79. Alternatively, the heel counter 24 can also include a post 16 having a registered opening 72 which aligns with that of the lasting plate 79.

Figure 34:
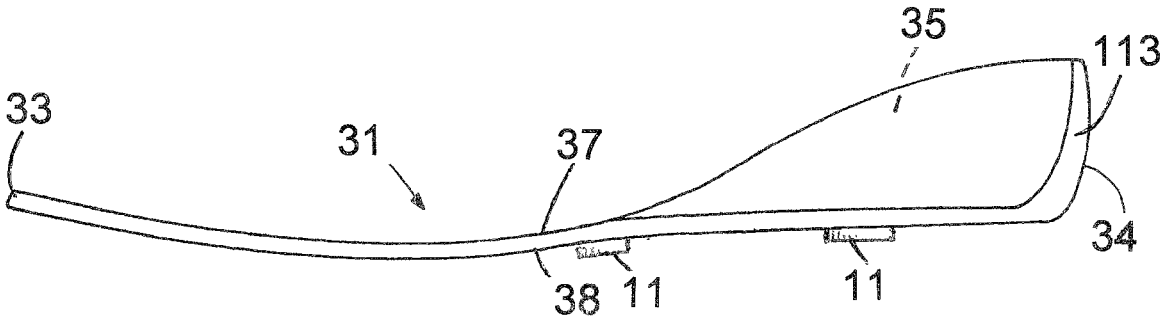
FIG. 34 is a lateral cross-sectional side view an insole generally similar to that shown in FIG. 31 which includes a plurality of protrusions on its inferior side for mechanically mating and removably coupling with a plurality of registered openings in a lasting plate.

FIG. 34 is a lateral cross-sectional side view an insole 31 generally similar to that shown in FIG. 31 which includes a plurality of protrusions 11 on its inferior side 38 for mechanically mating and removably coupling with a plurality of registered openings 72 in a lasting plate 79.

Figure 35:
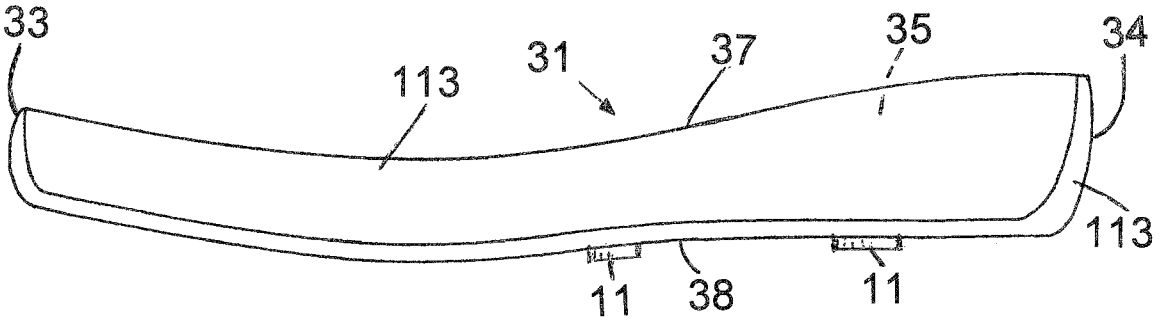
FIG. 35 is a lateral cross-sectional side view an insole generally similar to that shown in FIG. 31 which includes a plurality of protrusions on its inferior side for mechanically mating and removably coupling with a plurality of registered openings in a lasting plate, and also a raised sidewall portion that extends completely around the anterior side, posterior side, medial side, and lateral side of the insole.

FIG. 35 is a lateral cross-sectional side view an insole 31 generally similar to that shown in FIG. 31 which includes a plurality of protrusions 11 on its inferior side 38 for mechanically mating and removably coupling with a plurality of registered openings 72 in a lasting plate 79, and also a raised sidewall portion 113 that extends completely around the anterior side 33, posterior side 34, medial side 35, and lateral side 36 of the insole 32. In this regard, the thickness of the raised sidewall portion 113 can be varied in order to provide a plurality of different insoles 31 which when inserted into an upper 23 can then effectively provide different length and/or width sizes.

Figure 36:
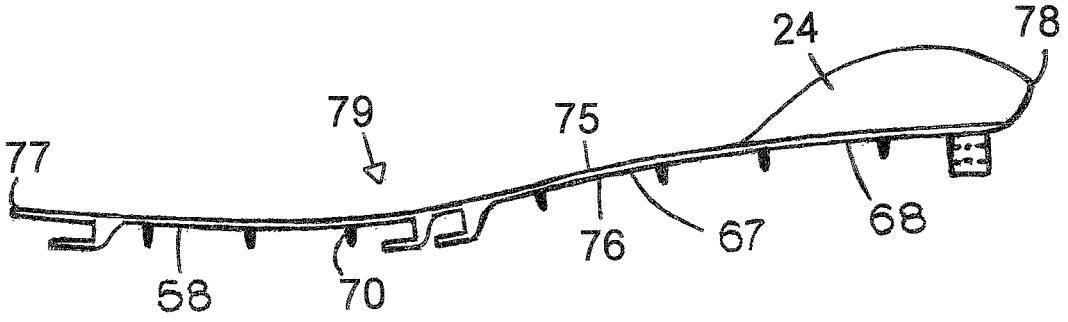
FIG. 36 is a lateral side view of a lasting plate generally similar to FIG. 18, which includes a post that has a longitudinal passage, but having an integral heel counter with a lower profile in the rearfoot area and a plurality of projections which do not have an enlarged head portion.

FIG. 36 is a lateral side view of a lasting plate 79 which include an integral heel counter 24 in the rearfoot area 68 and on its bottom side 76 a post 16 which has a longitudinal post passage 49, a plurality of projections 70 which do not have an enlarged head portion.

Figure 37:
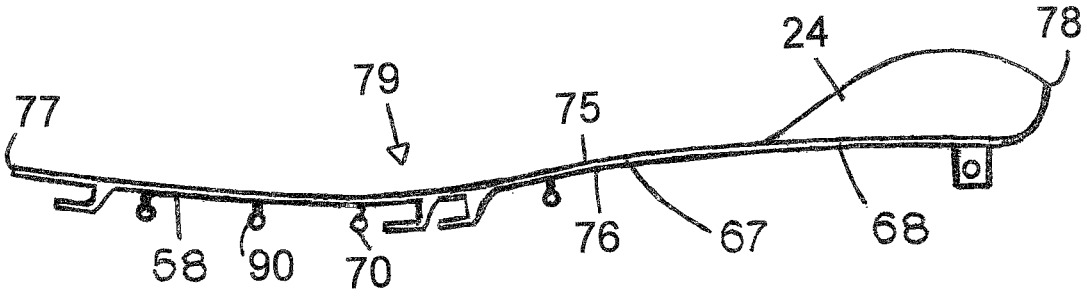
FIG. 37 is a lateral side view of a lasting plate generally similar to FIG. 25, which includes a post that has a transverse passage, but having an integral heel counter with a lower profile in the rearfoot area.

FIG. 37 is a lateral side view of a lasting plate 79 generally similar to FIG. 25, but having an integral heel counter 24 with a lower vertical profile in the rearfoot area 68, and which includes a post 16 that has a transverse post passage 48.

Figure 38:
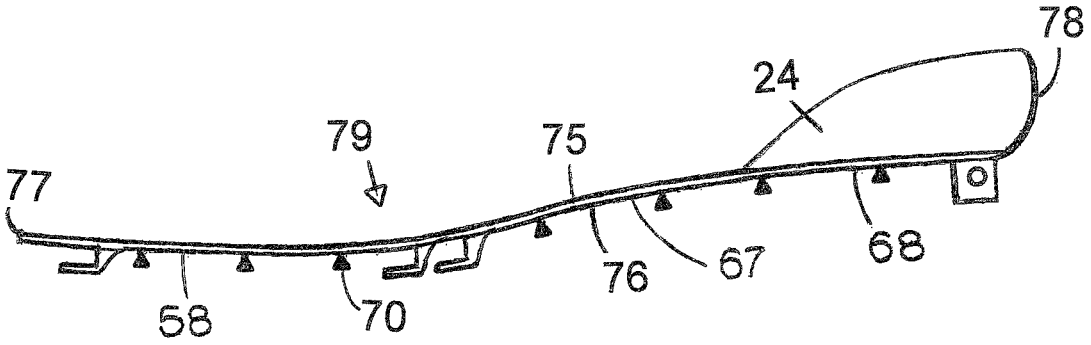
FIG. 38 is a lateral side view of a lasting plate generally similar to FIG. 20, which includes a post that has a transverse passage, but having an integral heel counter with a lower profile in the rearfoot area and a plurality of projections which have an inverted conical shape.

FIG. 38 is a lateral side view of a lasting plate 79 generally similar to FIG. 20, which includes a post 16 that has a transverse post passage 48, but having an integral heel counter 24 with a lower vertical profile in the rearfoot area 68 and a plurality of projections 70 which have an inverted conical shape.

Figure 39:
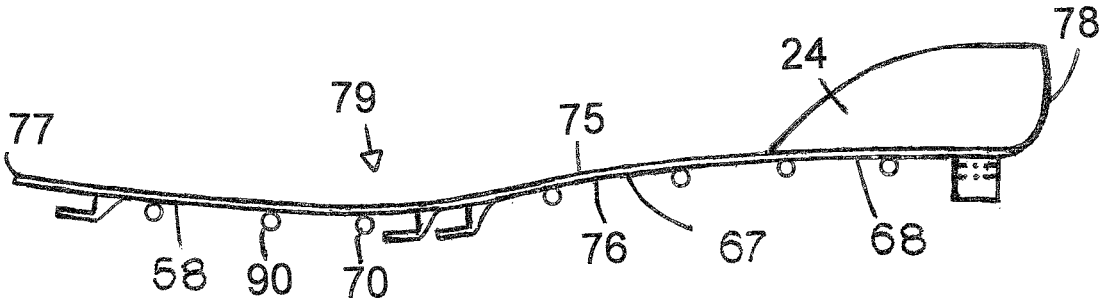
FIG. 39 is a lateral side view of a lasting generally similar to FIG. 21, which includes a post that has a longitudinal passage, but having an integral heel counter with a lower profile in the rearfoot area and a plurality of projections which do not have an elongated stem portion, but only an annular head.

FIG. 39 is a lateral side view of a lasting plate 79 which includes an integral heel counter 24 in the rearfoot area 68 and a plurality of projections 70 which do not have a stem portion, but only an annular head 90. In this regard, the annular head 90 can have a circular or oval shape and be connected to the lasting plate 79 in a configuration which locates the diameter of the annular head 90 at a relatively short distance from the bottom side 76 of the lasting plate 79.

Figure 40:
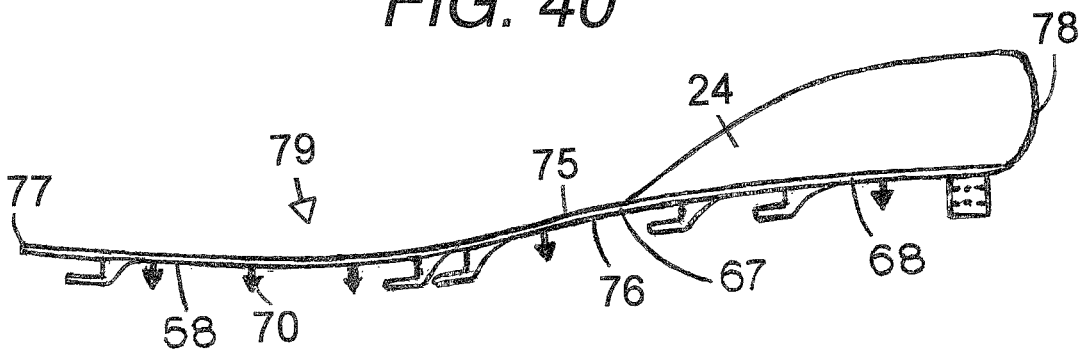
FIG. 40 is a lateral side view of a lasting plate and/or superior spring element generally similar to FIG. 18 which includes a post that has a longitudinal passage, but which also includes several more hooks in the midfoot area and/or rearfoot area.

FIG. 40 is a lateral side view of a lasting plate 79 generally similar to FIG. 18, which includes a post 16 that has a longitudinal passage 69 and projections 70 having conical heads 91, but which also includes additional male hooks 27 in the midfoot area 67 and/or rearfoot area 68.

Figure 41:
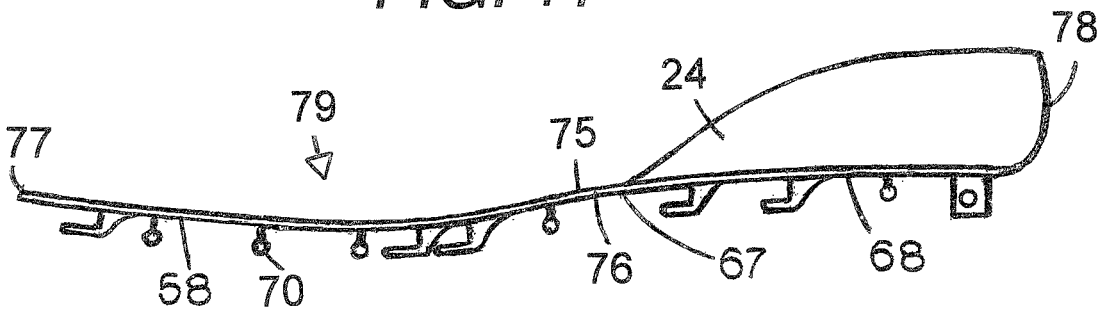
FIG. 41 is a lateral side view of a lasting plate generally similar to FIG. 21, which includes a post that has a transverse passage, but also includes several more hooks in the midfoot area and/or rearfoot area.

FIG. 41 is a lateral side view of a lasting plate 79 generally similar to FIG. 40, but which includes a post 16 that has a transverse post passage 48 and projections 70 having annular heads 90, and includes additional male hooks 27 in the midfoot area 67 and/or rearfoot area 68.

Figure 42:
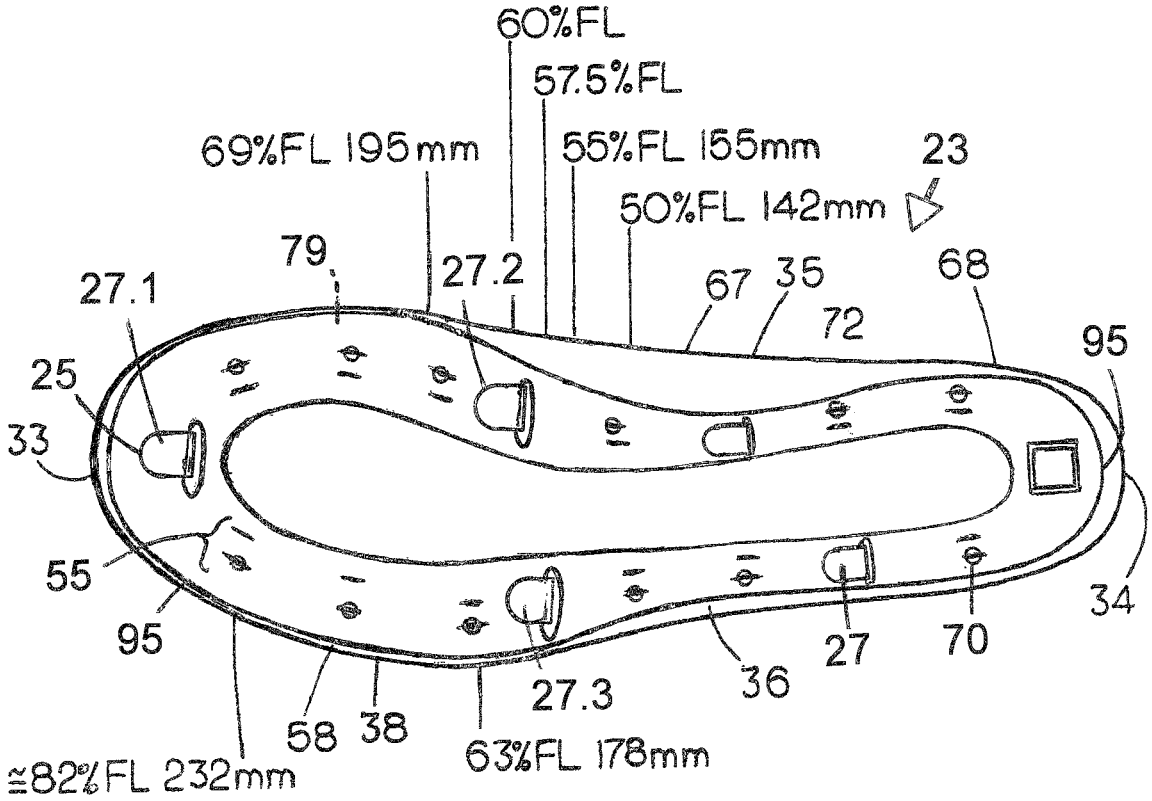
FIG. 42 is a bottom view of a shoe upper generally similar to that shown in FIG. 24 which includes a lasting plate including a plurality of hooks having rounded tips in the forefoot area and midfoot area, but also at least one hook and a post in the rearfoot area.

FIG. 42 is a bottom view of a shoe upper 23 generally similar to that shown in FIG. 24 which includes a lasting plate 79 including a plurality of male hooks 27 having rounded tips 25 in the forefoot area 58 and midfoot area 67, but also at least one male hook 27 and a post 16 in the rearfoot area 68.

Figure 43:
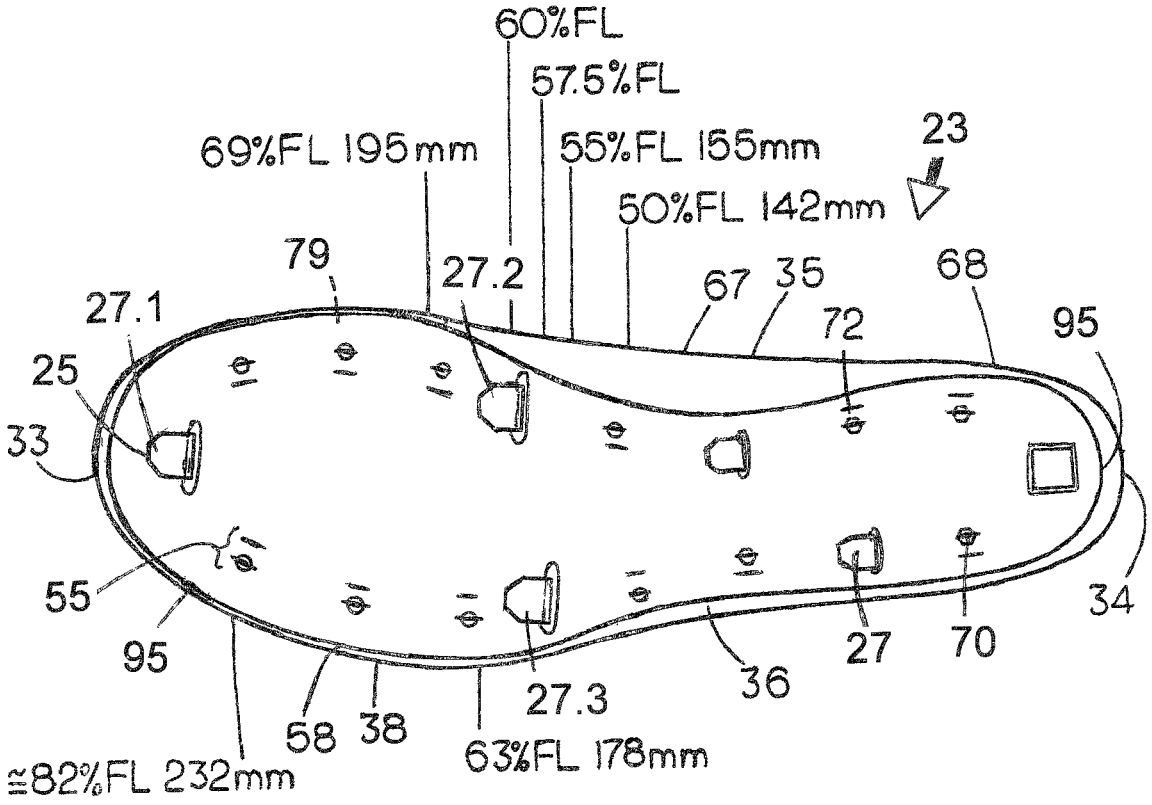
FIG. 43 is a bottom view of a shoe upper generally similar to that shown in FIG. 24 which includes a lasting plate with a plurality of hooks having semi-octagonal tips in the forefoot area and midfoot area, but also at least one hook and a post in the rearfoot area.

FIG. 43 is a bottom view of a shoe upper 23 generally similar to that shown in FIG. 24 which includes an lasting plate 79 including a plurality of male hooks 27 having semi-octagonal tips 25 in the forefoot area 58 and midfoot area 67, but also at least one male hook 27 and a post 16 in the rearfoot area 68.

FIG. 44 is a posterior and partial x-ray view of an embodiment of an article of footwear 22 including a shoe upper 23 including a lasting plate 79 including a plurality of male hooks 27 and a post 16 having a circular longitudinal post passage 49, and a sole 32. Also shown is a support surface 117, a collar portion 122 of the upper 23, a trademark indicia 171, a sidewall portion 184, and a bevel 197 in the sole 32.

Figure 45:
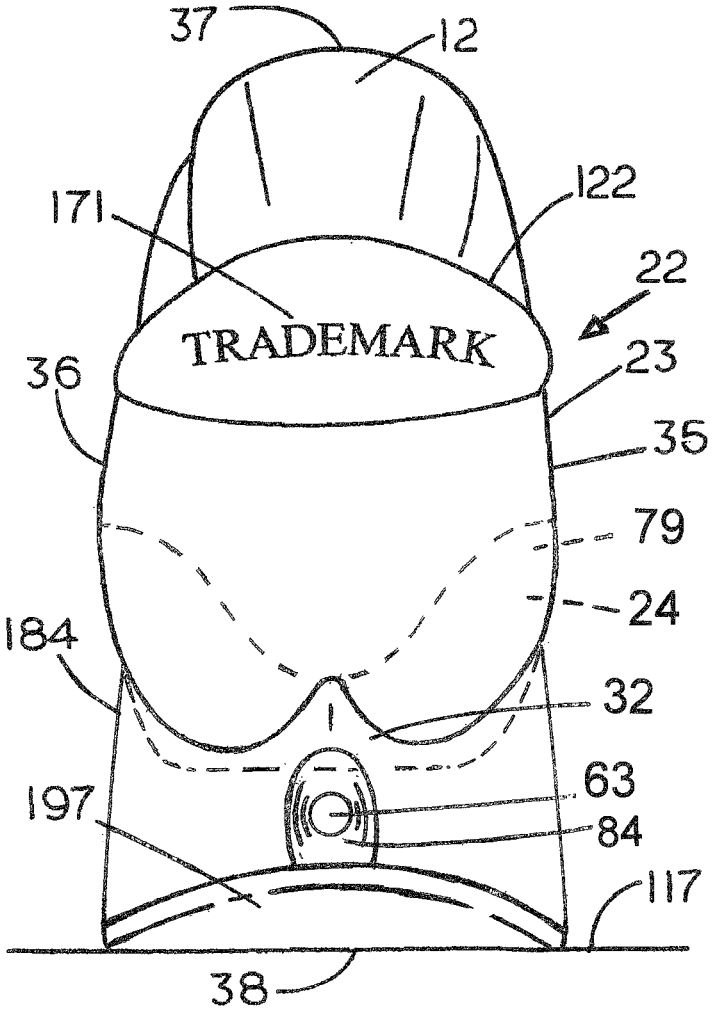
FIG. 45 is a posterior view of the article of footwear shown in FIG. 44, but also showing a removable pin located in a recess and secured within a longitudinal passage in the sole.

FIG. 45 is a posterior view of the article of footwear 22 shown in FIG. 44, and showing a removable retaining pin 63 located in a recess 84 and secured within a sole passage 92 in the sole 32.

Figure 46:
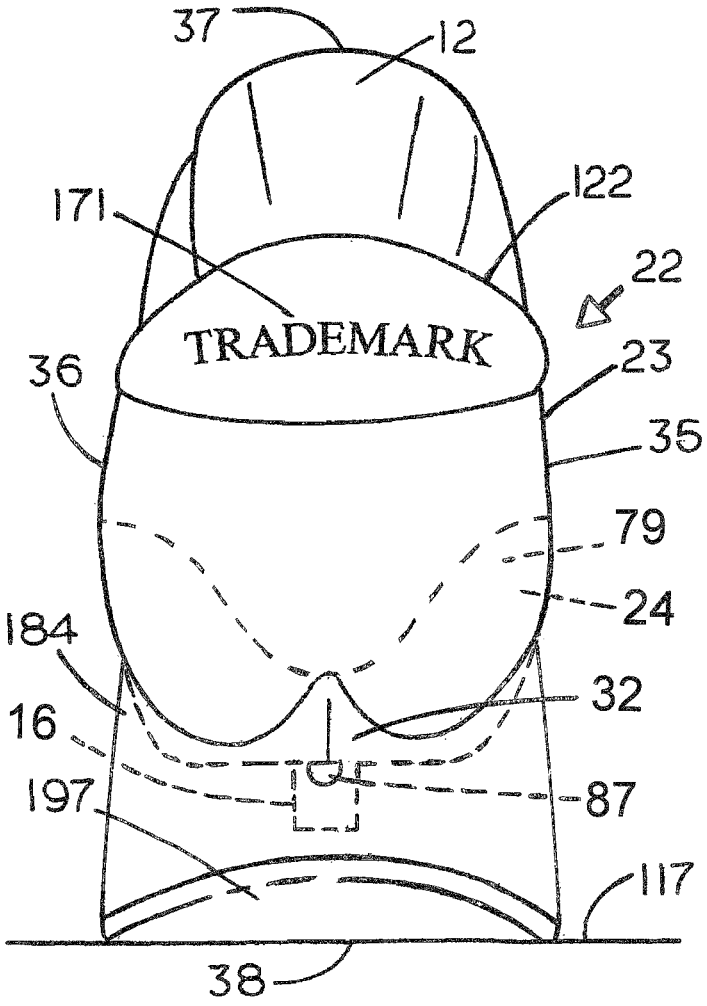
FIG. 46 is a posterior and partial x-ray view of an embodiment of an article of footwear similar to that shown in FIG. 44 including a lasting plate including a plurality of hooks and a post having a keyed longitudinal passage, and a sole.

FIG. 46 is a posterior and partial x-ray view of an embodiment of an article of footwear 22 similar to that shown in FIG. 44 including a lasting plate 79 including a plurality of male hooks 27, a post 16 having a longitudinal post passage 49 having a keyed configuration 87, and a sole 32.

Figure 47:
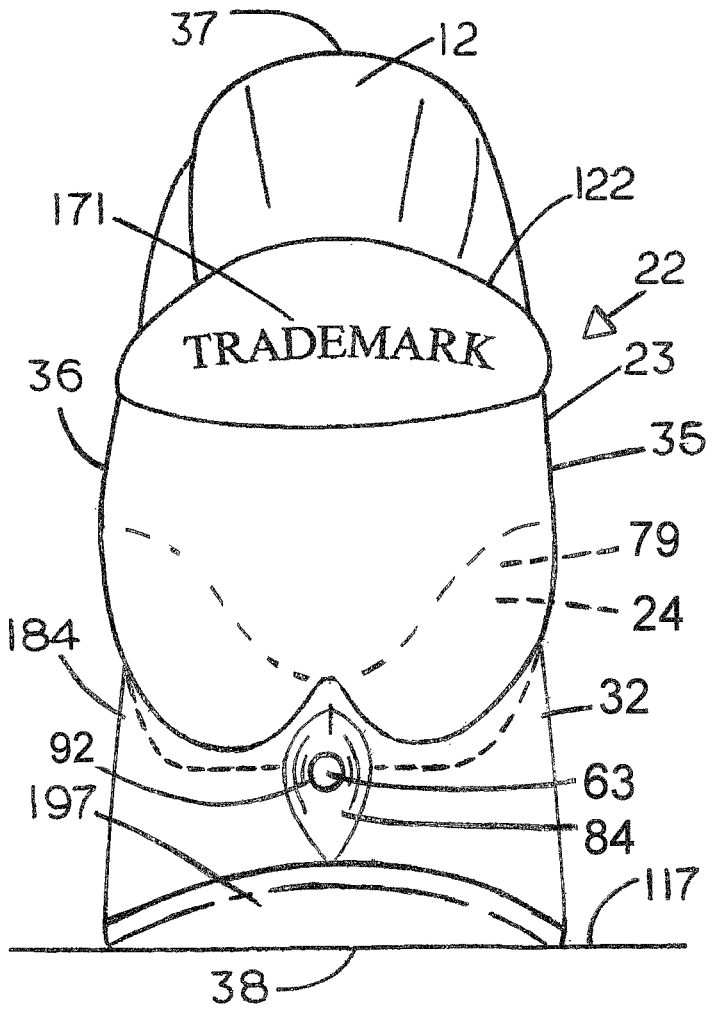
FIG. 47 is a posterior view of the article of footwear shown in FIG. 46, and showing a removable pin located in a recess and secured in a longitudinal passage of the sole.

FIG. 47 is a posterior view of the article of footwear 22 shown in FIG. 46, and showing a removable retaining pin 63 located in a recess 84 and secured in a sole passage 92 of the sole 32.

Figure 48:
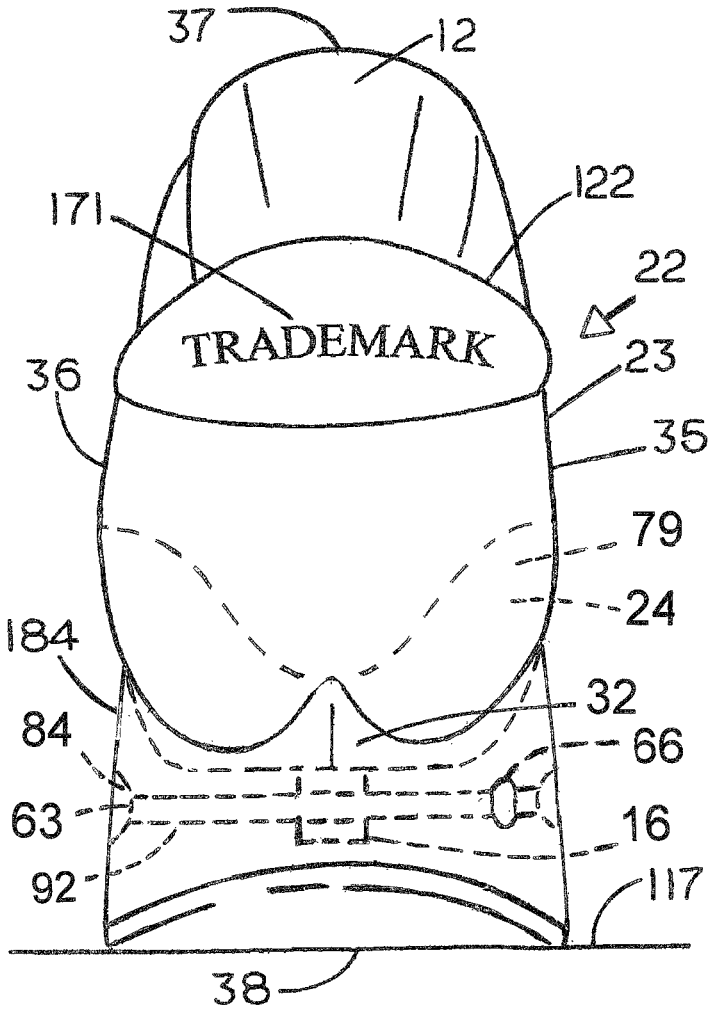
FIG. 48 is a posterior and partial x-ray view of an embodiment of an article of footwear similar to that shown in FIG. 44 including a lasting plate including a plurality of hooks, a post having an transverse passage, and a sole including a transverse passage for removably securing a retaining pin.

FIG. 48 is a posterior and partial x-ray view of an embodiment of an article of footwear 22 including a lasting plate 79 including a plurality of male hooks 27, a post 16 having an annular transverse post passage 48, and a sole 32 including a transverse sole passage 92 for removably securing a retaining pin 63 which includes a bump 66 for mating with a corresponding void space 102 in the sole 32.

Figure 49:
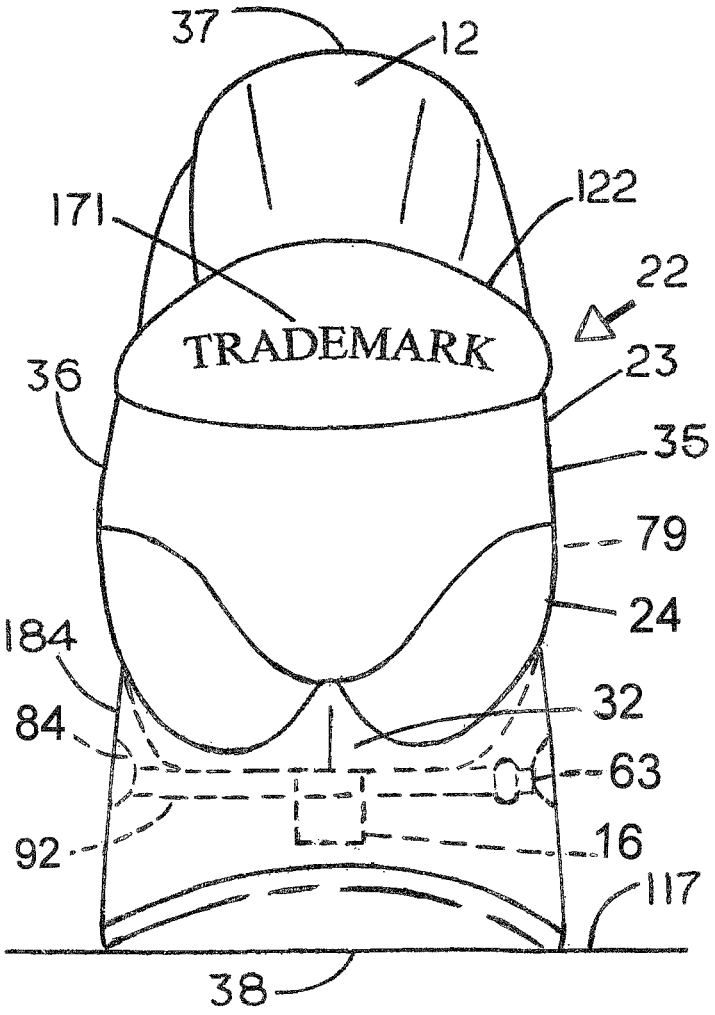
FIG. 49 is a posterior and partial x-ray view of an embodiment of an article of footwear similar to that shown in FIG. 44 including a lasting plate including a plurality of male hooks and a post having a keyed transverse passage, and a sole including a transverse passage for removably securing a keyed retaining pin.

FIG. 49 is a posterior and partial x-ray view of an embodiment of an article of footwear 22 including a lasting plate 79 including a plurality of male hooks 27 and a post 16 having a transverse post passage 48 having a keyed configuration 87, and a sole 32 including a transverse sole passage 92 for removably securing a retaining pin 63 which has a keyed configuration 87 and also includes a bump 66 for mating with a corresponding void space 102 in the sole 32.

Figure 50:
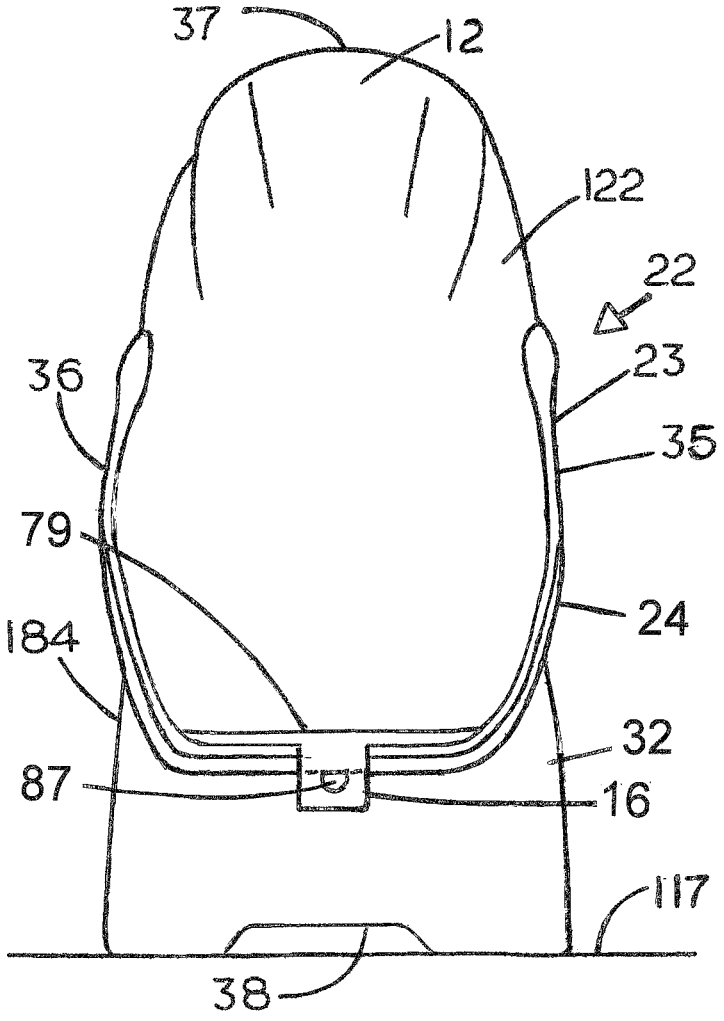
FIG. 50 is a posterior cross-sectional view of an article of footwear similar to that shown in FIG. 47 showing a lasting plate including a post which projects through a corresponding registered opening in the shoe upper and external heel counter which also includes a keyed passage for a retaining pin.

FIG. 50 is a posterior cross-sectional view of an article of footwear 22 similar to that shown in FIG. 47 showing a lasting plate 79 with a post 16 having a longitudinal post passage 49 having a keyed configuration 87 for receiving a retaining pin 63, and which projects through a corresponding registered opening 72 in the shoe upper 23 and an external heel counter 24.

Figure 51:
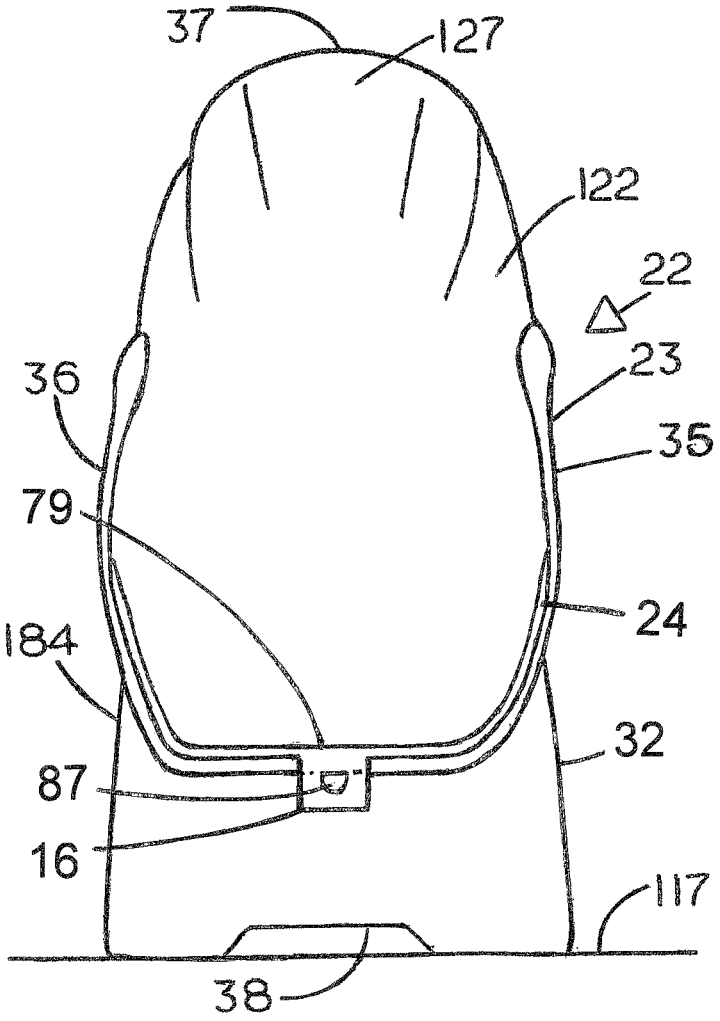
FIG. 51 is a posterior cross-sectional view of an article of footwear including a shoe upper similar to that shown in FIG. 30 showing a lasting plate which projects through a registered opening in the upper and internal heel counter, and also includes a post having a keyed longitudinal passage for a retaining pin.

FIG. 51 is a posterior cross-sectional view of an article of footwear 22 including a shoe upper 23 showing a lasting plate 79 with a post 16 having a longitudinal post passage 49 with a keyed configuration 87 for receiving a retaining pin 63, and which projects through a corresponding registered opening 72 in the shoe upper 23 and an internal heel counter 24.

Figure 52:
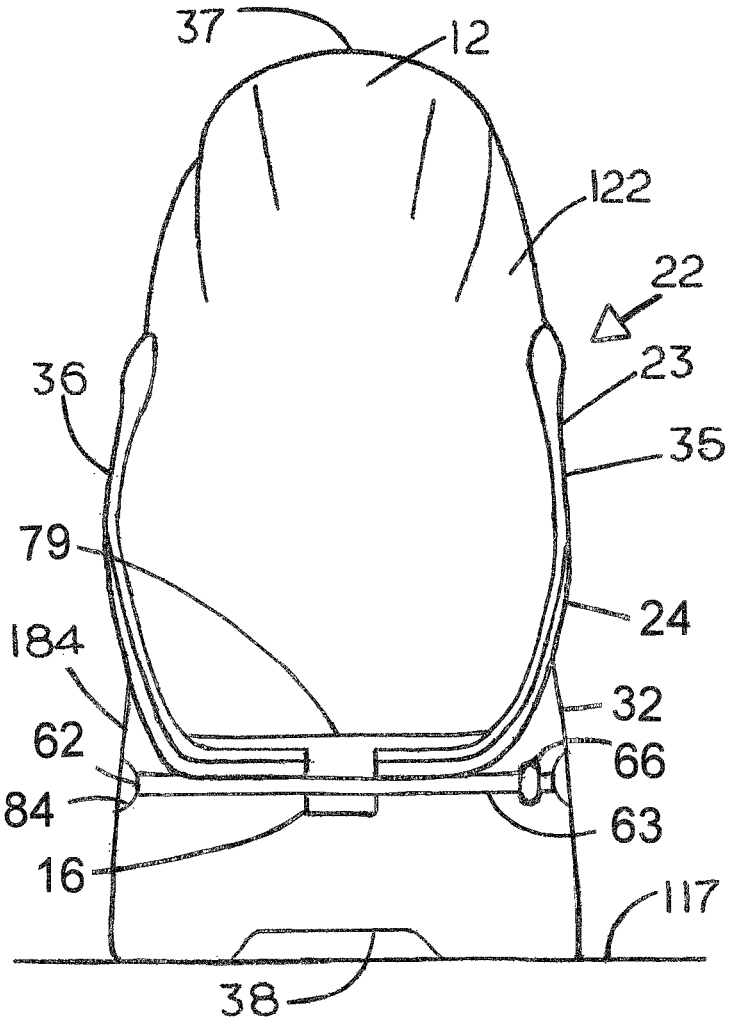
FIG. 52 is a posterior cross-sectional view of an article of footwear including a shoe upper similar to that shown in FIG. 34 showing a lasting plate including a post that projects through a registered opening in the shoe upper and an external heel counter, and which also has a transverse keyed passage for a retaining pin.

FIG. 52 is a posterior cross-sectional view of an article of footwear 22 including a shoe upper 23 showing a lasting plate 79 with a post 16 having a transverse post passage 48 having a keyed 87 configuration for receiving a retaining pin 63, and which projects through a corresponding registered opening 72 in the shoe upper 23 and an external heel counter 24. The retaining pin 63 includes a bump 66 for mechanically mating and being removably secured in functional relation with a corresponding void space 102 in the sole 32. As shown, the retaining pin 63 can be in direct contact with the external heel counter 23 and removably secure the post 16 of the lasting plate 79 and shoe upper 23 to the sole 32.

Figure 53:
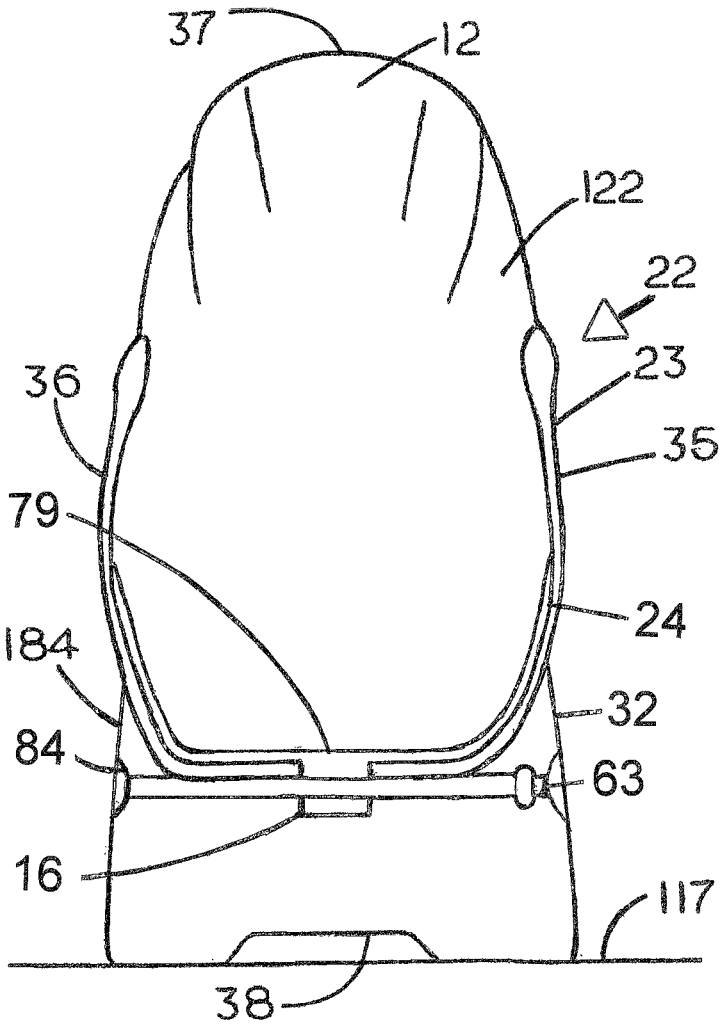
FIG. 53 is a posterior cross-sectional view of an article of footwear including a shoe upper similar to that shown in FIG. 31 showing a lasting plate including an integral heel counter and a post, and which also has a transverse keyed passage for a retaining pin.

FIG. 53 is a posterior cross-sectional view of an article of footwear 22 including a shoe upper 23 showing a lasting plate 79 which includes an integral heel counter 24 and a post 16 having a transverse post passage 48 including a keyed configuration 87, and which extends downwards from a corresponding registered opening 72 in the shoe upper 23 and an internal heel counter 24. Also shown is a retaining pin 63 which includes a bump 66 for mating with a corresponding void space 102 in the sole 32.

Figure 54:
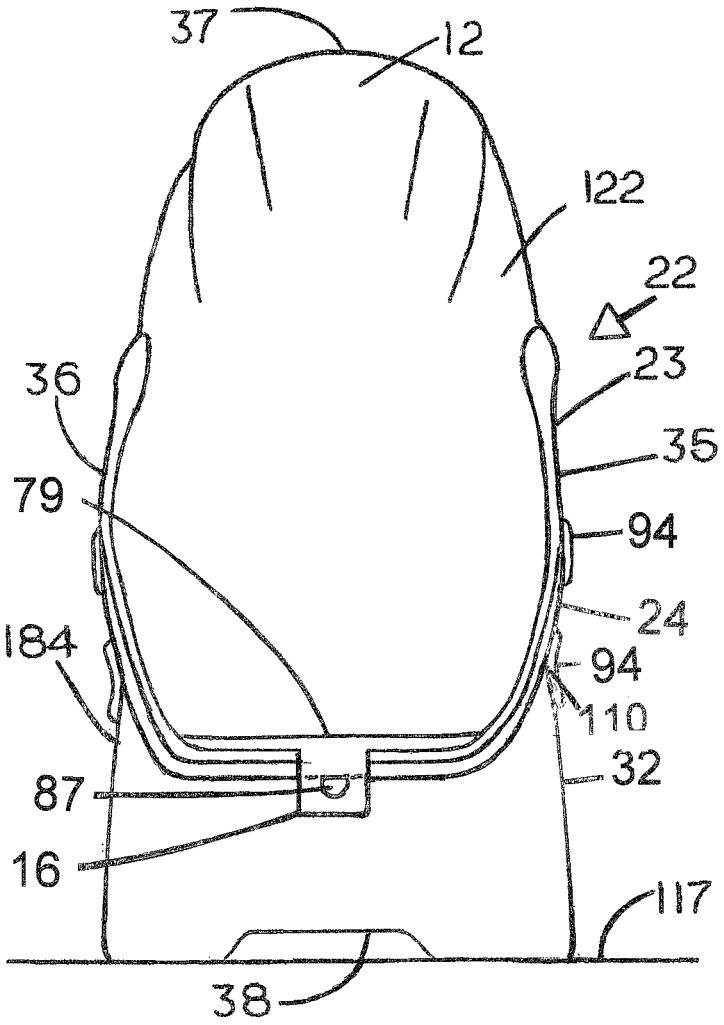
FIG. 54 is a posterior cross-sectional view of an article of footwear including a shoe upper similar to that shown in FIG. 76 including two V or U shaped channels for removably securing a portion of an external heel counter and a sole, and showing a lasting plate including a post having a longitudinal keyed passage for a retaining pin.

FIG. 54 is a posterior cross-sectional view of an article of footwear 22 including a shoe upper 23 including two V or U shaped channels 94 for removably securing a portion of an external heel counter 24 and a sole 32, showing a lasting plate 79 with a post 16 having a longitudinal post passage 49 including a keyed configuration 87 for receiving a retaining pin 63, and which extends downwards through a corresponding registered opening 72 in the shoe upper 23 and the external heel counter 24. As shown in FIG. 54, the top edge 110 of the sole 32 mechanically mates and is removably coupled with the V or U shaped channel 94 which is disposed on the upper 23. In this regard, the U or V shaped channel 94 can be made of an elastomer or thermoplastic material that is injection molded, bonded, fused, or otherwise secured to the upper 23.

Figure 55:
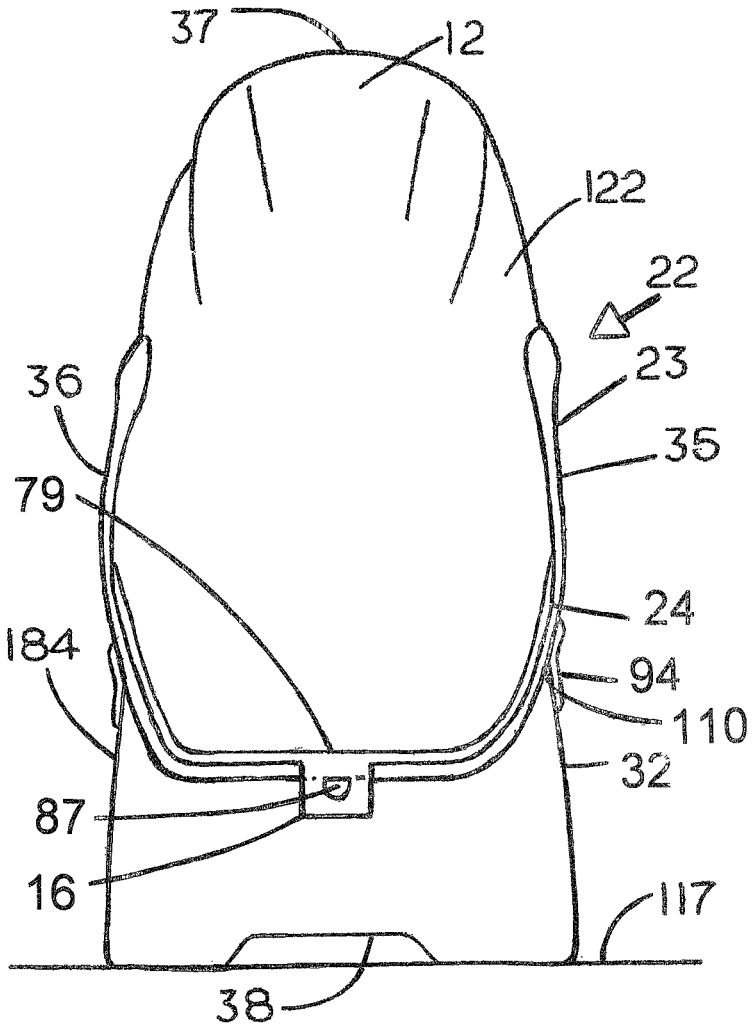
FIG. 55 is a posterior cross-sectional view of an article of footwear including a shoe upper similar to that shown in FIG. 73 including a V or U shaped channel for removably securing a portion of a sole, and showing a lasting plate including a post having a longitudinal keyed passage for a retaining pin which projects through a registered opening in the shoe upper.

FIG. 55 is a posterior cross-sectional view of an article of footwear 22 including a shoe upper 23 including a V or U shaped channel 94 for removably securing a portion of a sole 32, showing a lasting plate 79 including a heel counter 24 and a post 16 having longitudinal post passage 49 including a keyed configuration 87 for receiving a retaining pin 63 extends downwards through a corresponding registered opening 72 in the shoe upper 23.

Figure 56:
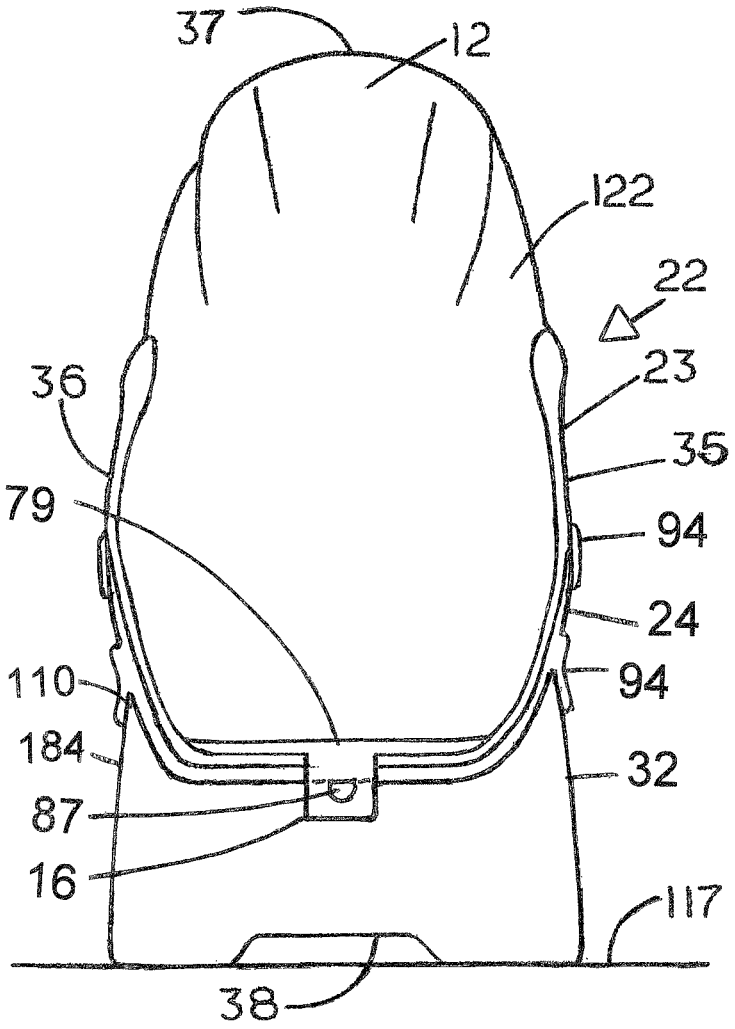
FIG. 56 is a posterior cross-sectional view of an article of footwear including a shoe upper generally similar to that shown in FIG. 76 including a V or U shaped channel for removably securing a portion of an external heel counter, and showing a lasting plate including a post having a longitudinal keyed passage for a retaining pin, and an external heel counter which also includes a V or U shaped channel for removably securing a portion of a sole.

FIG. 56 is a posterior cross-sectional view of an article of footwear 22 including a shoe upper 23 including a V or U shaped channel 94 for removably securing a portion of an external heel counter 24. A lasting plate 79 including a post 16 including a longitudinal post passage 49 having a keyed configuration 87 for receiving a retaining pin 63 extends downwards through a corresponding registered opening 72 in the shoe upper 23, and also an external heel counter 24. The shoe upper 23 also includes a V or U shaped channel 94 for removably securing a top edge portion 110 of a sole 32.

Figure 57:
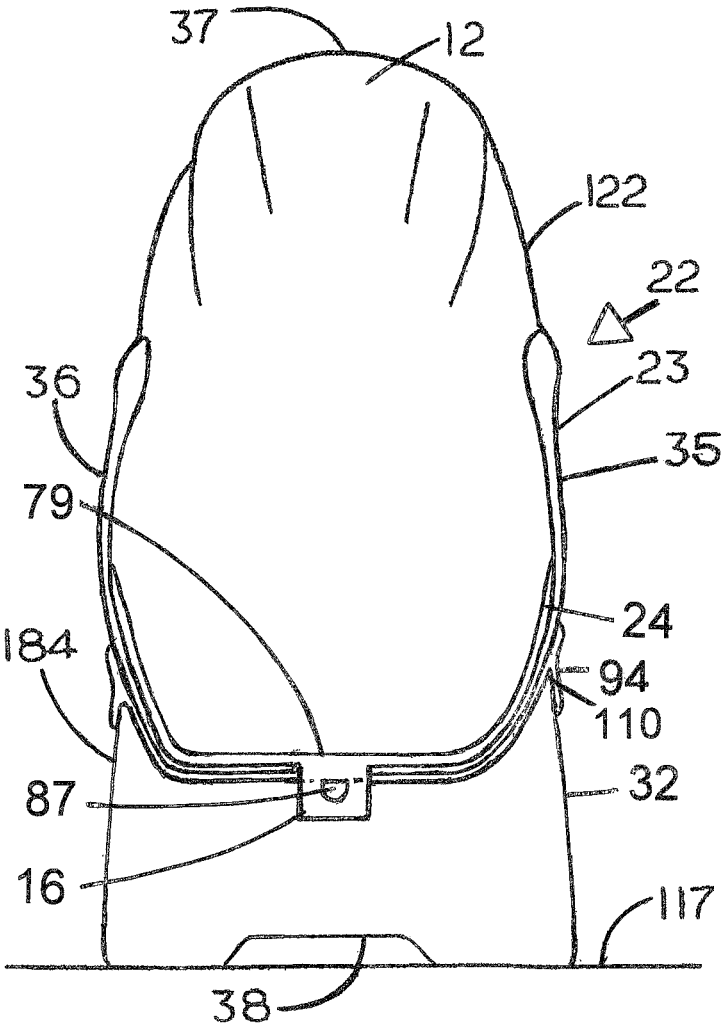
FIG. 57 is a posterior cross-sectional view of an article of footwear including a shoe upper similar to that shown in FIG. 73 including a V or U shaped channel for removably securing a portion of a sole, and showing a lasting plate with an integral heel counter and a post which projects through a corresponding registered opening in the shoe upper and includes a longitudinal keyed passage for a retaining pin.

FIG. 57 is a posterior cross-sectional view of an article of footwear 22 including a shoe upper 32 including a V or U shaped channel 94 for mechanically mating with and removably securing a top edge portion 110 of a sole 32, and showing a lasting plate 79 with an integral heel counter 24 and a post 16 having a longitudinal post passage 49 having a keyed configuration 87 for receiving a retaining pin 63 and which extends downwards through a corresponding registered opening 72 in the shoe upper 23. The shoe upper 23 also includes a V or U shaped channel 94 for mechanically mating with and removably securing a top edge portion 110 of a sole 32.

Figure 58:
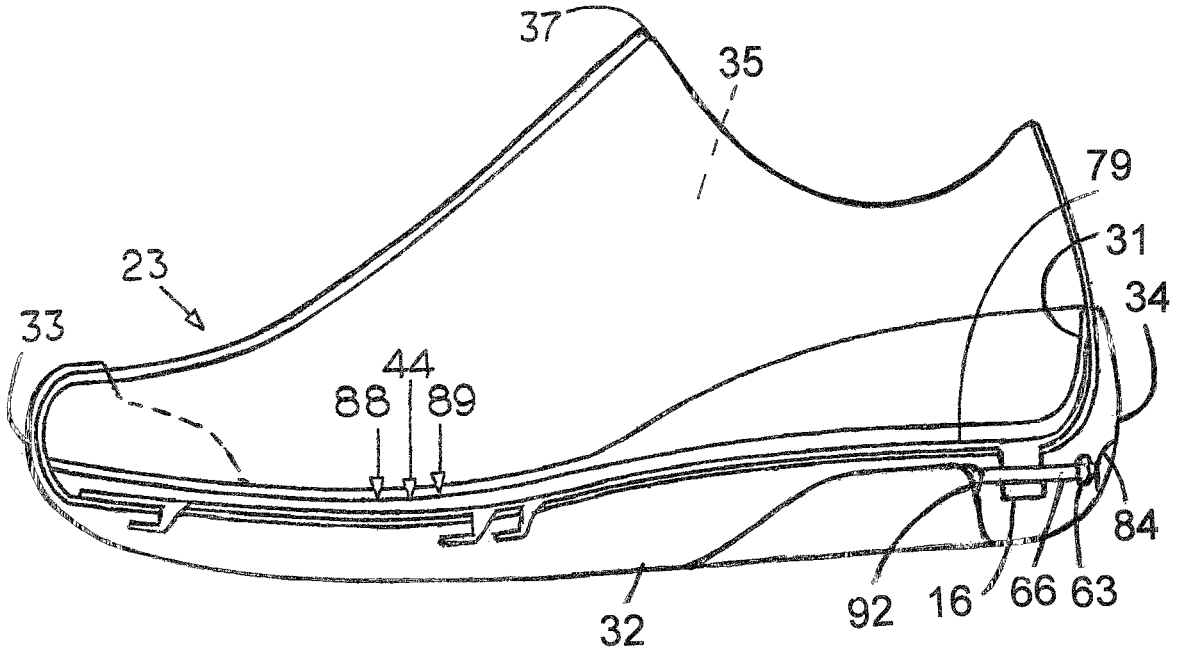
FIG. 58 is a lateral cross-sectional view of an article of footwear including a shoe upper similar to that shown in FIG. 51 showing a lasting plate including a post which projects through a corresponding registered opening in the shoe upper, and which has a longitudinal keyed passage for a retaining pin.

FIG. 58 is a lateral cross-sectional view of an article of footwear 22 including a shoe upper 23 similar to that shown in FIG. 51 showing a lasting plate 79 with a post 16 having a longitudinal post passage 49 including a keyed configuration 87 which extends downwards through a corresponding registered opening 72 in the shoe upper 23, and a retaining pin 63 including a bump 66 which is disposed in a void space 102 and longitudinal sole passage 92 in the sole 32, and which removably secures together the upper 23, lasting plate 79, and sole 32.

Figure 59:
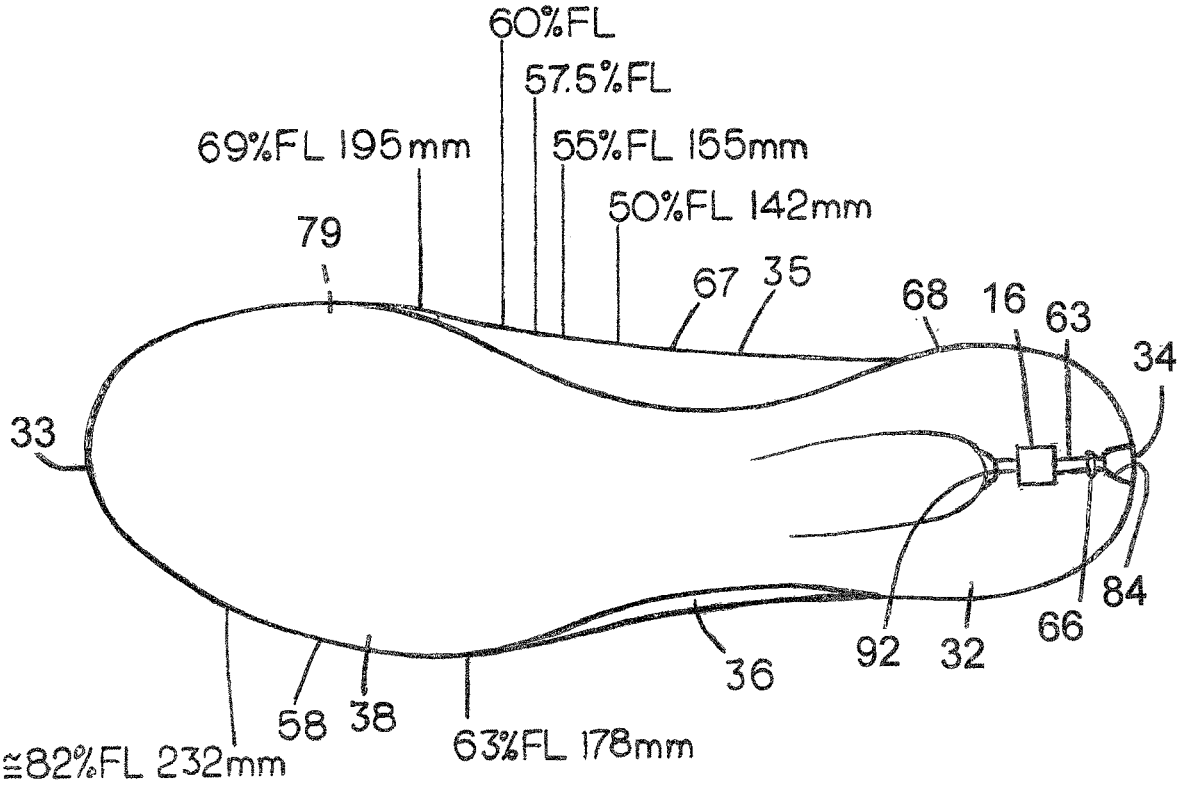
FIG. 59 is a bottom and partial x-ray view of the article of footwear shown in FIG. 58 showing a retaining pin that is removably secured to the post and sole.

FIG. 59 is a bottom partial x-ray view of the article of footwear 22 shown in FIG. 58 showing a retaining pin 63 that is removably secured to the post 16 and sole 32, and thereby removably secures together the upper 23, lasting plate 79, and sole 32.

Figure 60:
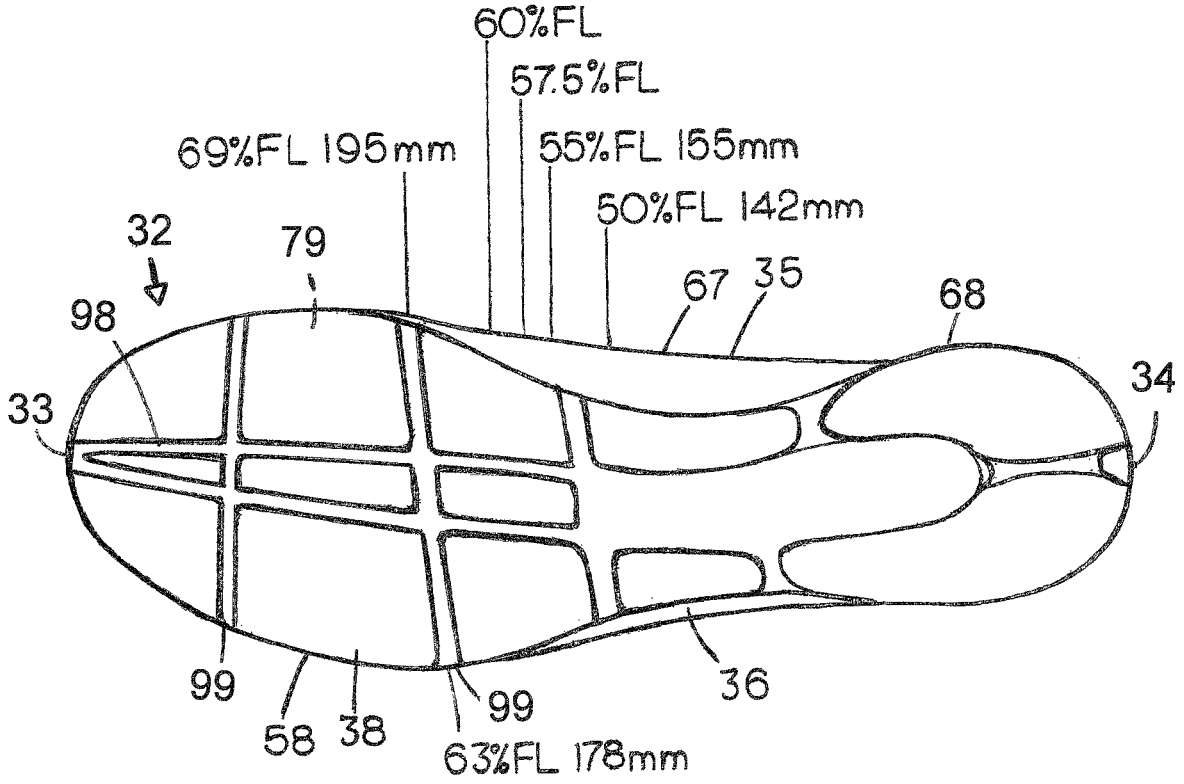
FIG. 60 is a bottom view of an embodiment of a sole for use with the article of footwear shown in FIG. 58.

FIG. 60 is a bottom view of one embodiment of a sole 32 for use with the article of footwear 22 shown in FIG. 58.

Figure 61:
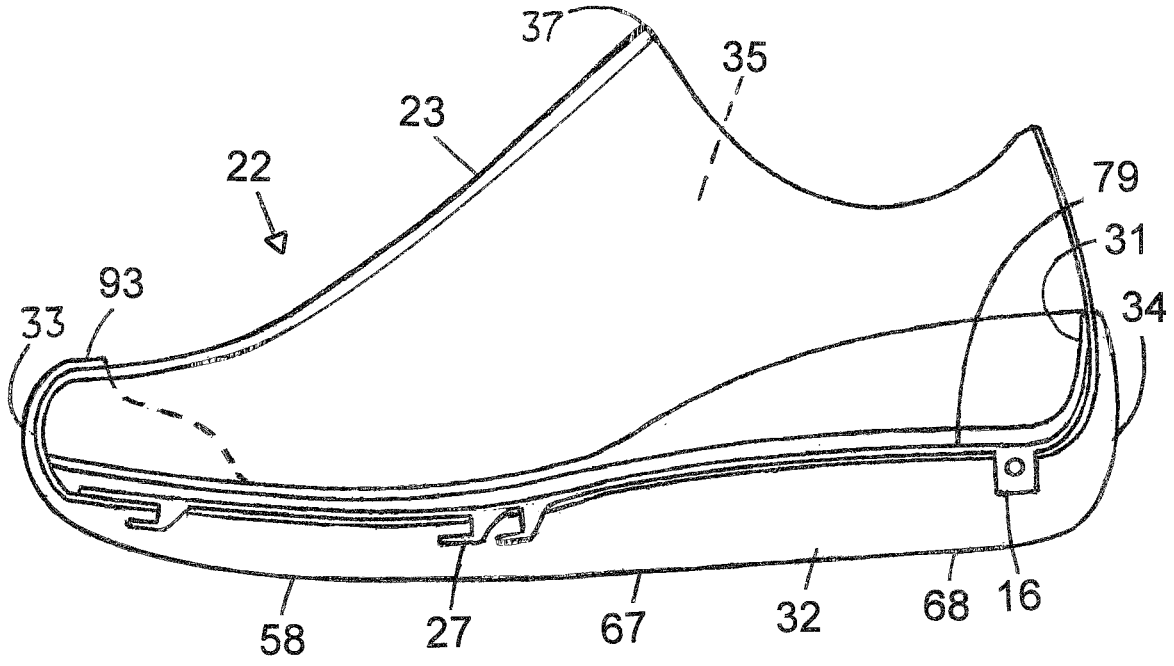
FIG. 61 is a lateral cross-sectional view of an article of footwear including a shoe upper similar to that shown in FIG. 51 showing a lasting plate including a post which projects through a corresponding registered opening in the shoe upper, and which includes a transverse keyed passage for a retaining pin.

FIG. 61 is a lateral cross-sectional view of an article of footwear 22 including a shoe upper 23 similar to that shown in FIG. 51 showing a lasting plate 79 with a post 16 having transverse post passage 48 including a keyed configuration and which extends downwards through a corresponding registered opening 72 in the shoe upper 23. The sole 32 also includes an integral toe cap 93 having a reverse wingtip shape which can help to provide some protection for a wearer's toes and provide stability in the forefoot area 58 of the article of footwear 22.

Figure 62:
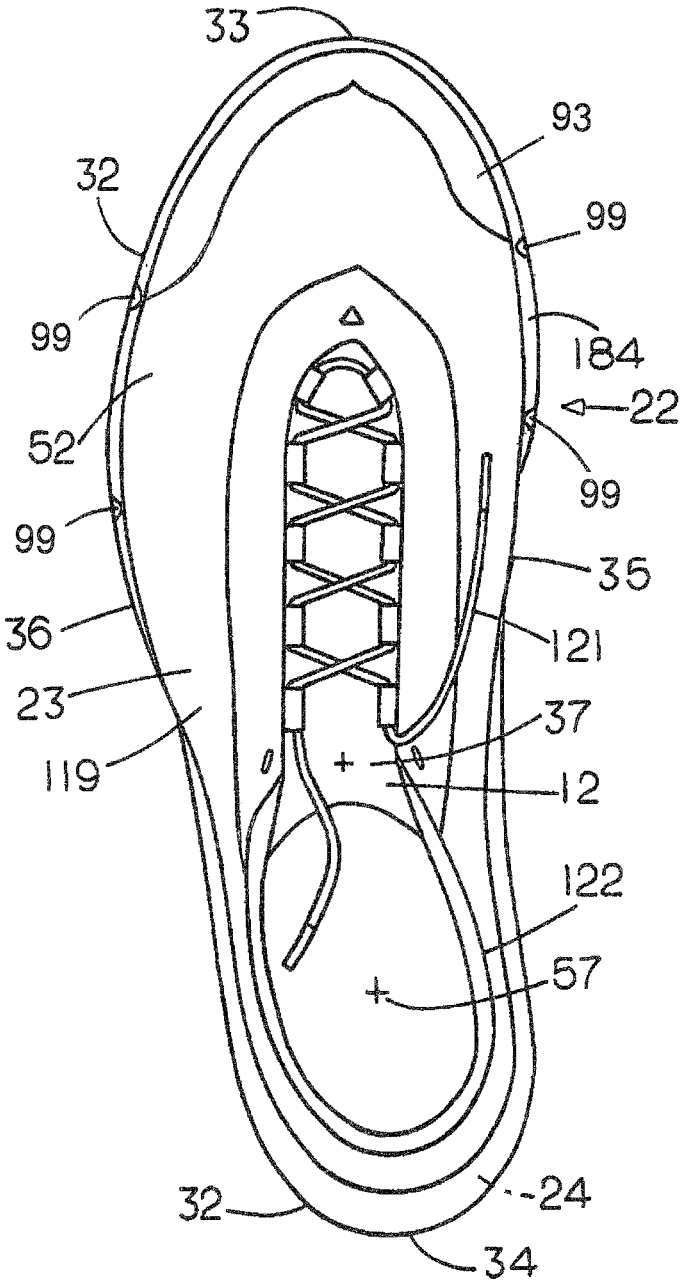
FIG. 62 is top view of an article of footwear having a shoe upper including lace loops generally similar to FIG. 2, and a sole including an integral toe cap having a reverse wingtip shape generally similar to FIGS. 58-60.

FIG. 62 is top view of an article of footwear 22 having a shoe upper 23 including lace loops 26 for retaining laces 121 generally similar to the embodiment shown in FIG. 2, and a sole 32 including an integral toe cap 93 having a reverse wingtip shape generally similar to FIGS. 58 and 61. Also shown in FIG. 62, are flex grooves 99 in the sole 32, and the vamp 52 and quarter 19 portions of the upper 23.

Figure 63:
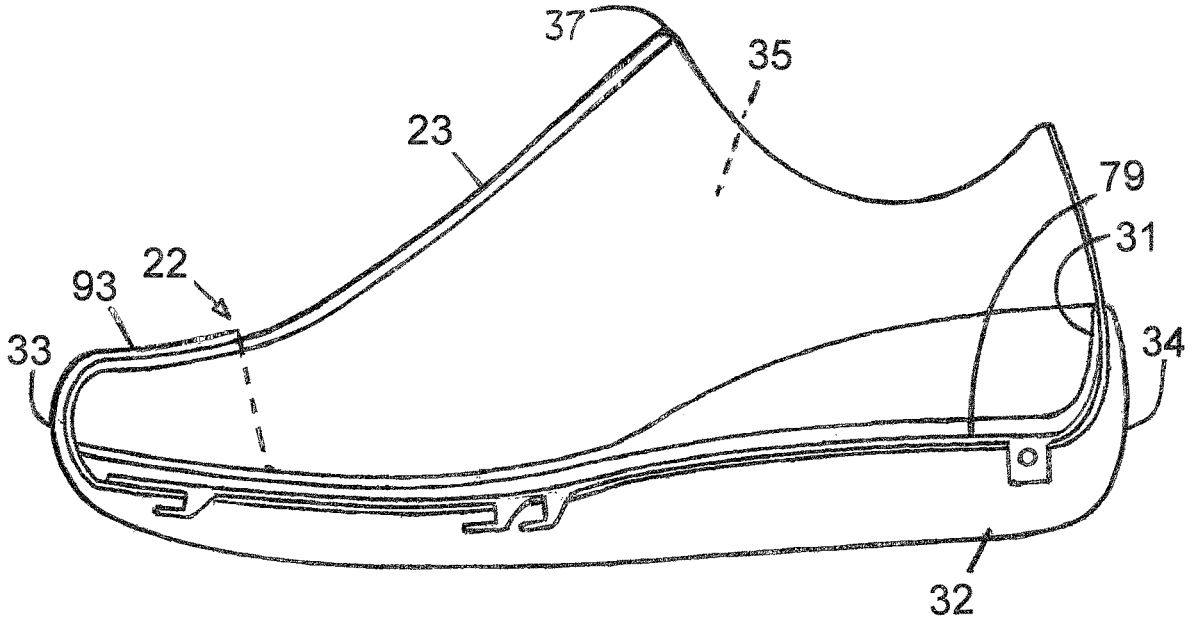
FIG. 63 is a lateral side view of an article of footwear having a shoe upper similar to FIG. 8, and a sole including an integral toe cap having a relatively straight configuration as shown in a top view in FIG. 64.
Figure 64:
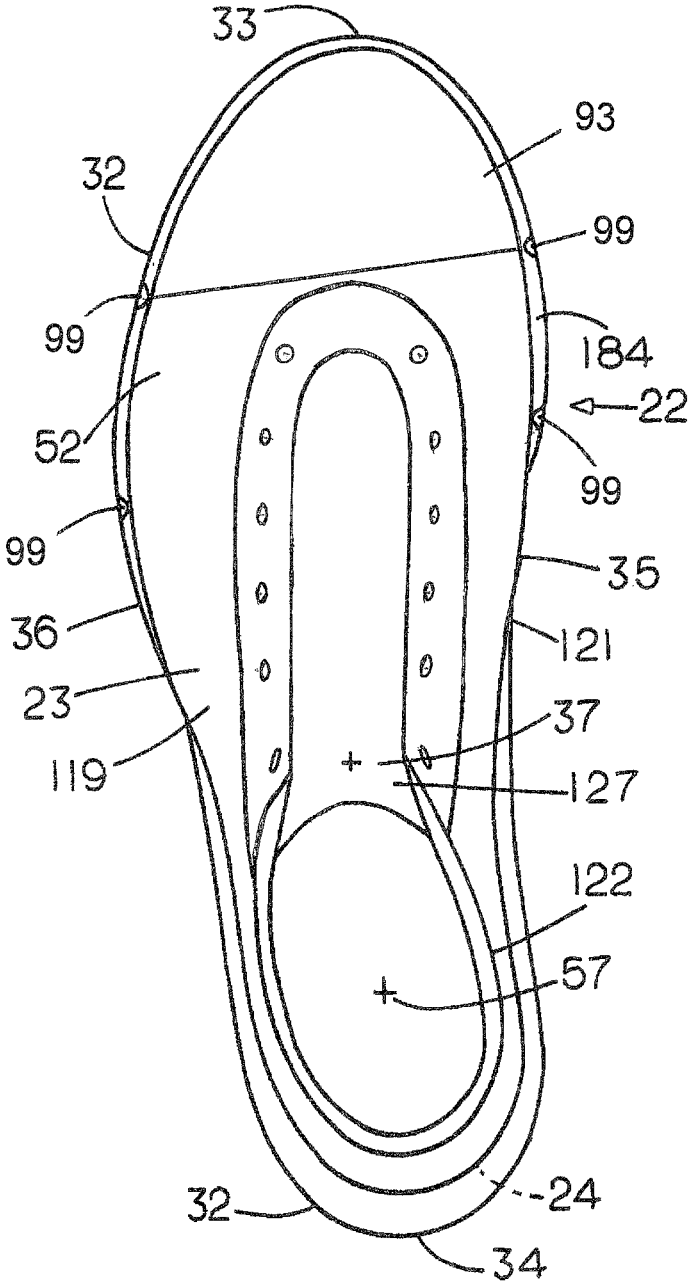
FIG. 64 is a top view of the article of footwear having a shoe upper similar to FIG. 3, and a sole including an integral toe cap having a relatively straight configuration as shown in FIG. 63.

FIG. 63 is a lateral side view of an article of footwear 22 having a shoe upper 23 similar to FIG. 4, and a sole 32 including an integral toe cap 93 having a relatively straight configuration or shape which is shown in a top view in FIG. 64.

FIG. 64 is a top view of the article of footwear 22 having a shoe upper 23 similar to FIG. 3, and a sole 32 including an integral toe cap 93 having relatively straight configuration or shape as shown in FIG. 63.

Figure 65:
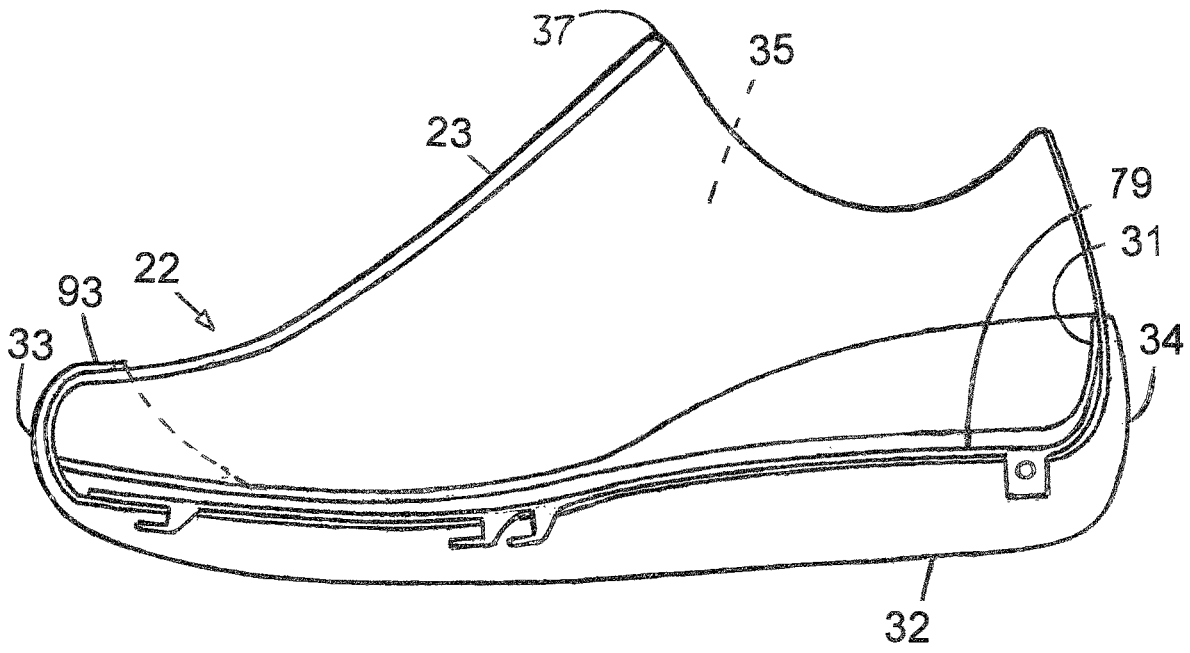
FIG. 65 is a lateral view of the article of footwear having a shoe upper similar to FIG. 8, and a sole including an integral toe cap having a relatively curved configuration as shown in FIG. 66.
Figure 66:
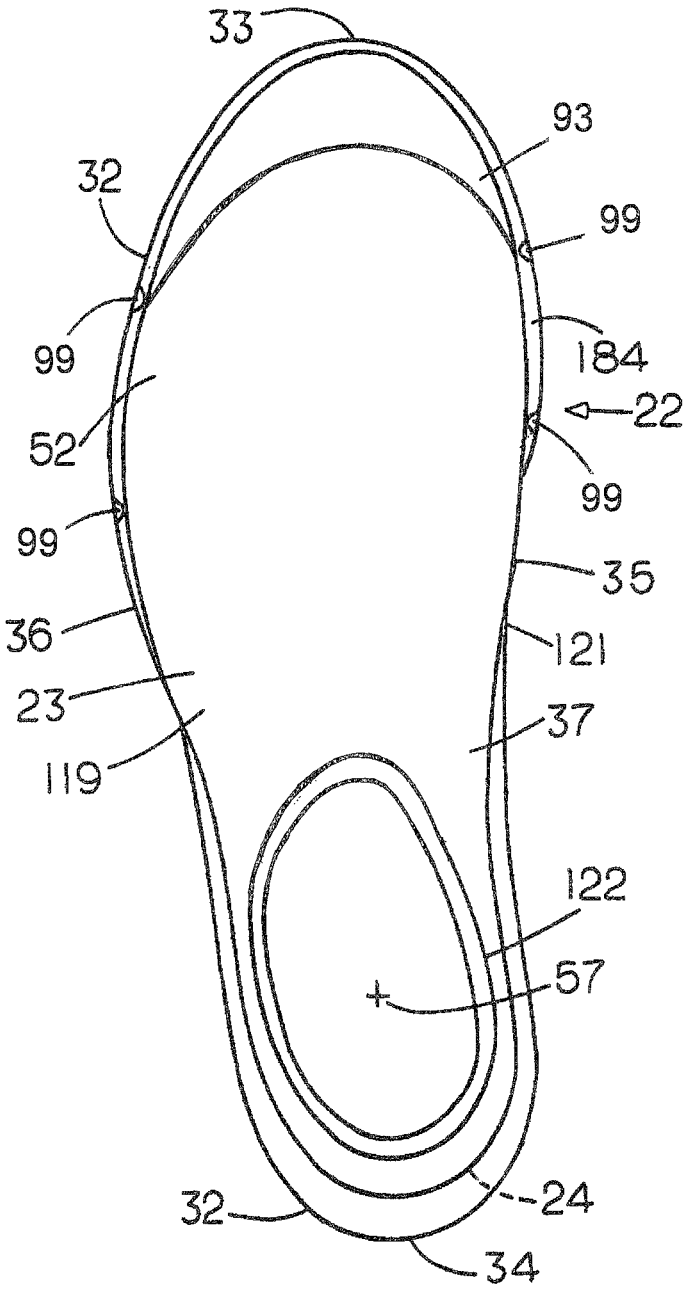
FIG. 66 is a top view of the article of footwear having a shoe upper similar to FIG. 8, and a sole including an integral toe cap having a relatively curved configuration as shown in FIG. 65.

FIG. 65 is a lateral view of the article of footwear 22 having a shoe upper 23 similar to FIG. 4, and a sole 32 including an integral toe cap 93 having relatively curved configuration or shape as shown in a top view in FIG. 66.

FIG. 66 is a top view of the article of footwear 22 having a shoe upper 23 similar to FIG. 4, and a sole 32 including an integral toe cap 93 having relatively curved configuration or shape as shown in FIG. 65.

Figure 67:
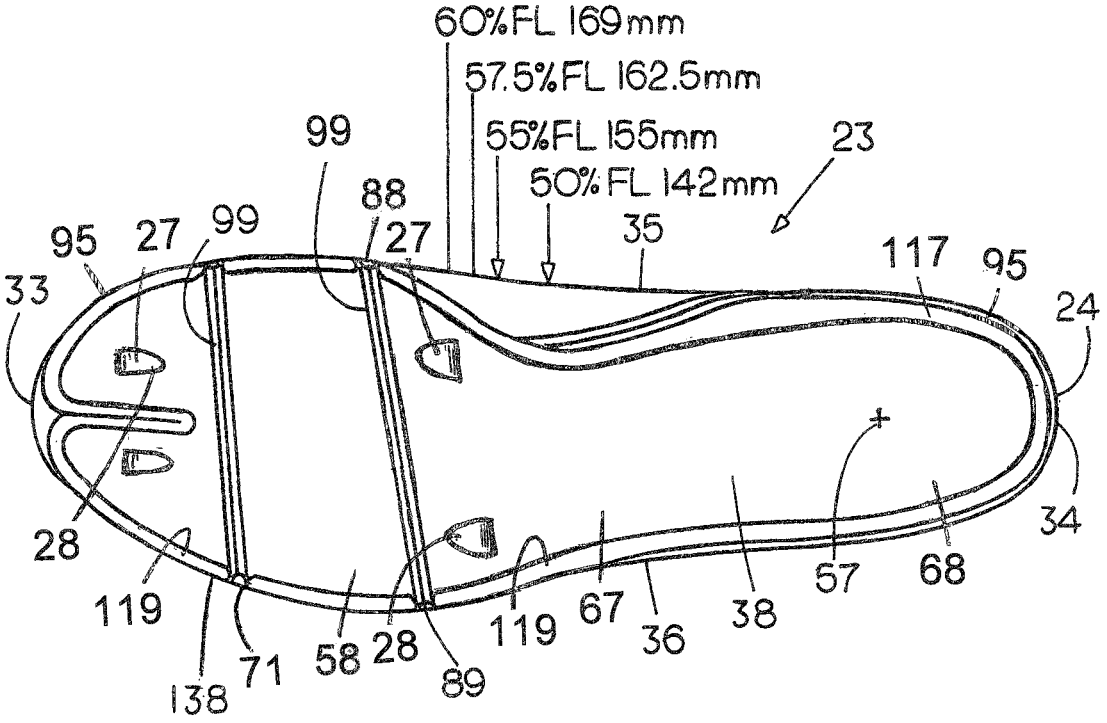
FIG. 67 is a bottom view of a shoe upper including a lasting plate including a plurality of hooks and a post, and an exoskeleton including a narrow slot which extends about the anterior side, medial side, lateral side, and posterior side near the lasting margin for receiving and removably securing a sole including a backing plate having a lip as shown in FIGS. 68-69.
Figure 68:
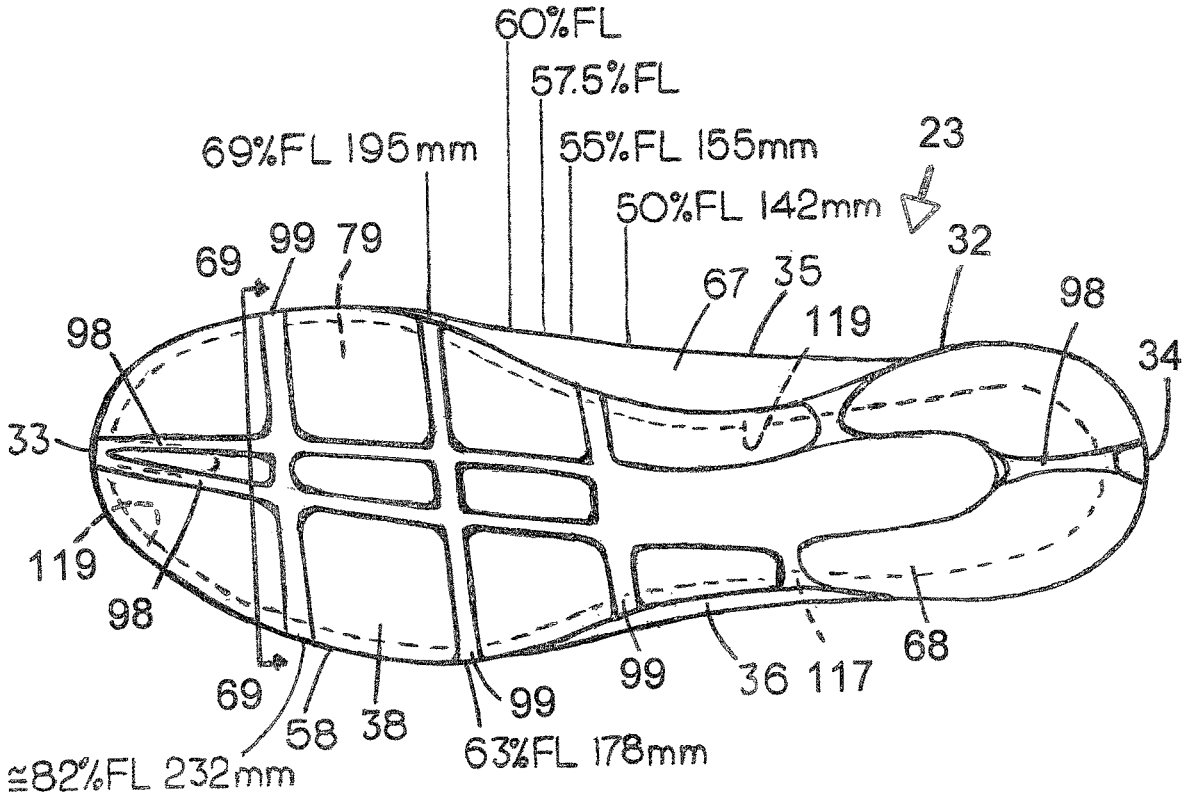
FIG. 68 is a bottom view of a sole which also shows with phantom lines the inside edge of the slot shown in FIG. 67.
Figure 69:
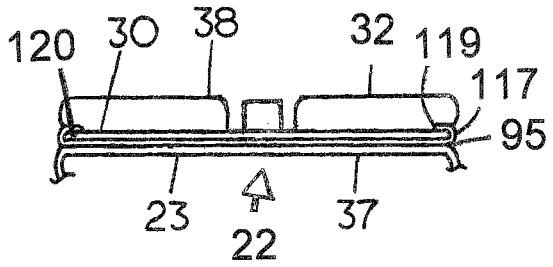
FIG. 69 is a cross-sectional view taken along line 69-69 in drawing FIG. 68 showing a sole including a backing plate including a lip which can be removably secured in the slot shown in drawing FIG. 67.

FIG. 67 is a bottom view of a shoe upper 23 including an exoskeleton 117 including a slot 119 which is generally horizontally disposed on the anterior side 33, medial side 35, lateral side 36, and posterior side 34 near the lasting margin 95 of the upper 23 for receiving and removably securing a sole 32 including a backing 30 having a lip 120 as shown in FIGS. 68-69. The position of the weight bearing center of the heel 57 is indicated as being approximately 45 mm anterior of the posterior side 34 of the corresponding footwear last 80.

FIG. 68 is a bottom view of an upper 23 including a sole 32 and shows in phantom lines the inside edge of the slot 119 which is a portion of the exoskeleton 117 disposed on the upper as shown in FIG. 67. Shown is a first transverse flex groove 99 which can facilitate bending of the sole 32 which is configured to be disposed beneath and extend between the approximate position of a wearer's 1st and 5th metatarsal-phalangeal joints which are located at about 69% of foot length, and at about 63% of foot length with reference to a men's size 9, or other footwear last, pattern, or 3D digital modeling size, respectively. Accordingly, the shoe upper 23 and sole 32 can be folded near and/or along the transverse flex groove 99 associated with the metatarsal-phalangeal joints, and the upper 23 and sole 32 can be aligned and the lip 120 of the backing 30 portion of the sole 32 shown in FIG. 69 can be inserted into the slot 119 portion of the exoskeleton 117 which is disposed on the anterior side 33, medial side 35, lateral side 36, and posterior side 34 near the lasting margin 95 of the upper 23 for receiving and removably securing the sole 32. As shown in FIG. 67, a plurality of hooks 27 are disposed in the forefoot area 58 each having a free end 28 facing the posterior side 34 of the shoe upper 23, and a plurality of hooks 27 are also disposed in the midfoot 67 and/or rearfoot area 68 each having a plurality of free ends 28 facing the anterior side 33 of the shoe upper 23. As also shown in FIG. 68, at least one longitudinal flex groove 98 extends substantially between the anterior side 33 and posterior side 34 of the sole 32 and article of footwear 22, and a second transverse flex groove 99 is disposed closer to the anterior side 33 of the sole 32 and is configured to be approximately disposed beneath a plurality of a wearer's phalangeal-phalangeal joints.

FIG. 69 is a cross-sectional view taken along line 69-69 in drawing FIG. 68 showing an article of footwear 22 including a sole 32 have a backing plate 30 including a lip 120 which can be removably secured in the slot 119 disposed on a shoe upper 23 generally similar to that shown in drawing FIG. 67. The backing plate 30 can be made of a thermoplastic material such as nylon, ethylene, or polypropylene and have a thickness approximately between 0.75-1.5 mm.

Figure 70:
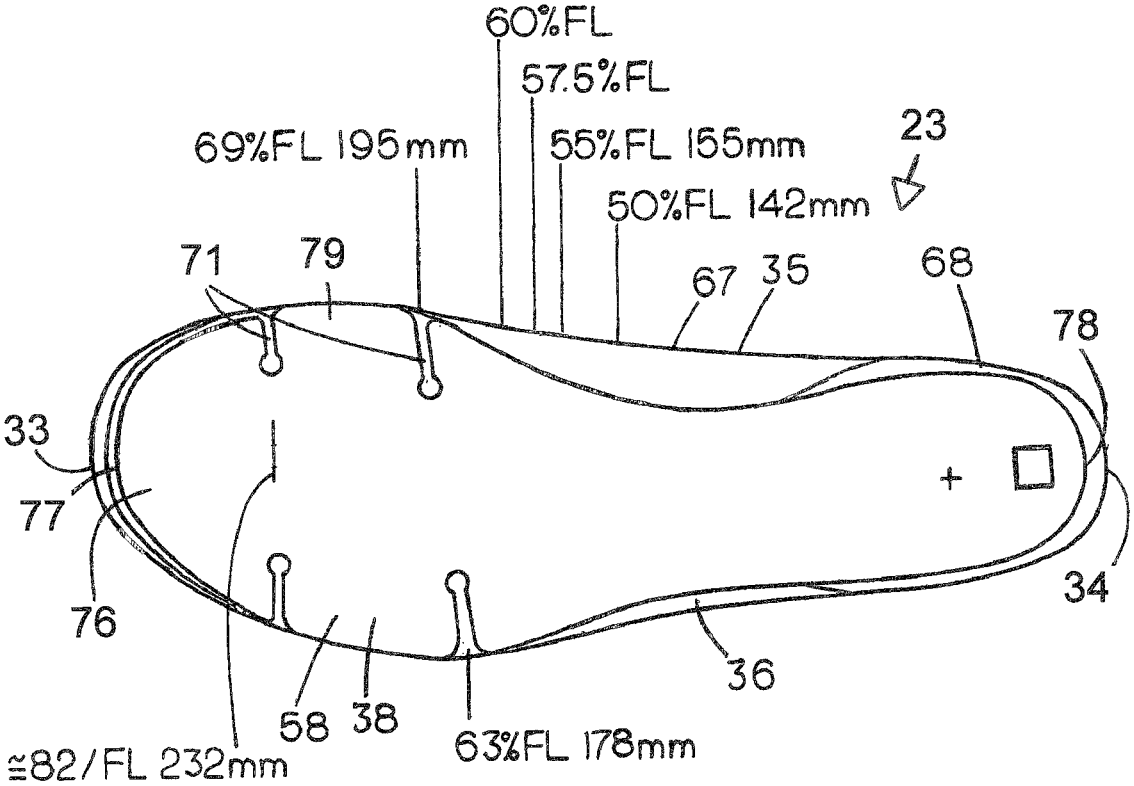
FIG. 70 is a bottom view of an embodiment of a lasting plate which is resting upon the inferior side of a shoe upper similar to that shown in FIG. 8, and which includes a plurality of flex notches in the forefoot area, and also a post in the rearfoot area.

FIG. 70 is a bottom view of an embodiment a shoe upper 23 and of a lasting plate 79 which includes a plurality of flex notches 71 in the forefoot area 58 and a post 16 in the rearfoot area 68, and which is resting upon the inferior side 38 of a shoe upper 23 similar to that shown in FIG. 4.

Figure 71:
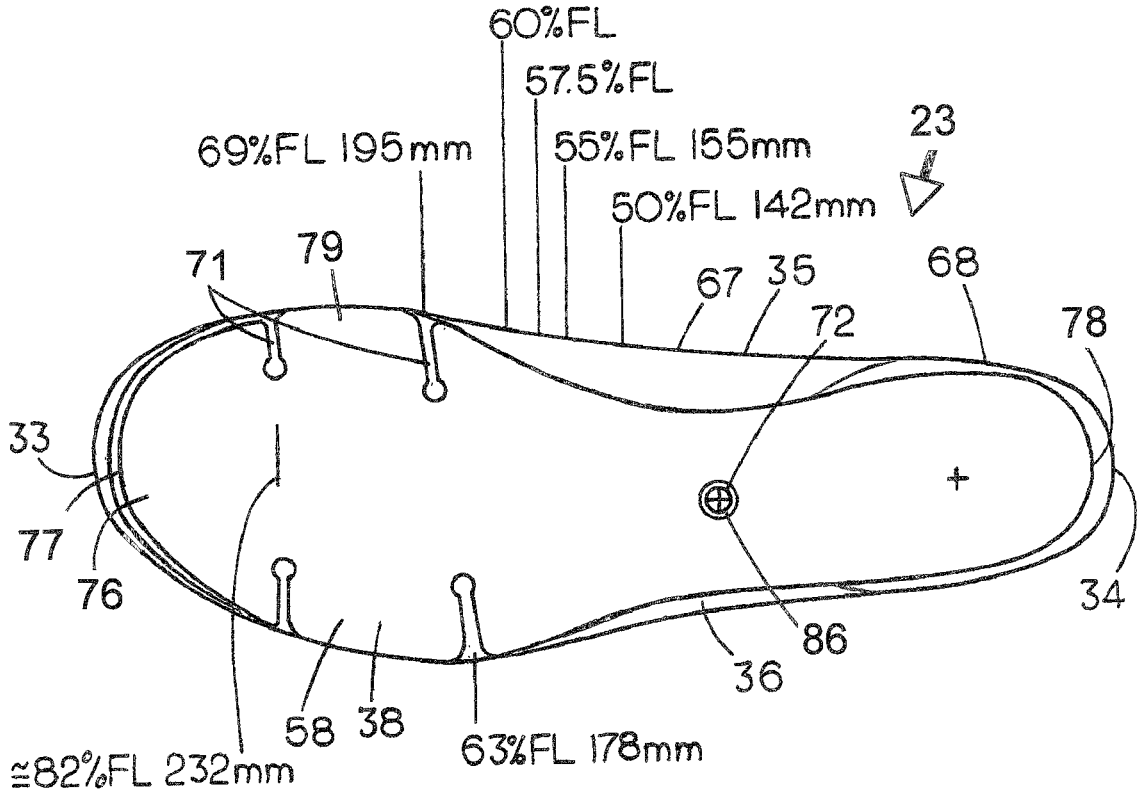
FIG. 71 is a bottom view of an embodiment of a lasting plate resting upon the inferior side of a shoe upper which includes a plurality of flex notches in the forefoot area and an opening in the midfoot area for receiving a fastener.

FIG. 71 is a bottom view of an embodiment a shoe upper 23 and of a lasting plate 79 which is resting upon the inferior side 38 of a shoe upper 23 and which includes a plurality of flex notches 71 in the forefoot area 58 and an opening 72 in the midfoot area 67 including a female fastener portion 86 for receiving and coupling with a male fastener portion 85 of a fastener 29.

Figure 72:
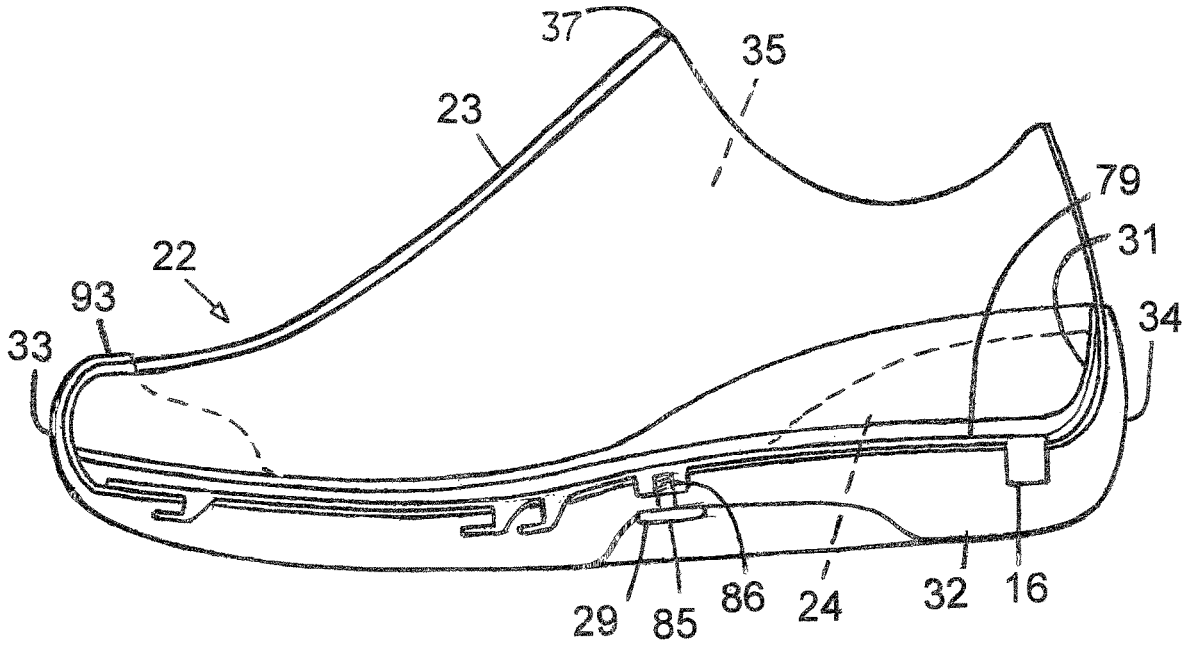
FIG. 72 is a lateral side view of an article of footwear including a lasting plate which is shown in FIG. 71, and also coupled male and female fastener components.

FIG. 72 is a lateral side view of an article of footwear 22 including a shoe upper 23, and a lasting plate 79 generally similar to the one shown in FIG. 71, and a fastener 29 including a male fastener portion 85 and a female fastener portion 86 which are coupled together, thus removably securing the upper, lasting plate 79, and sole 32.

Figure 73:
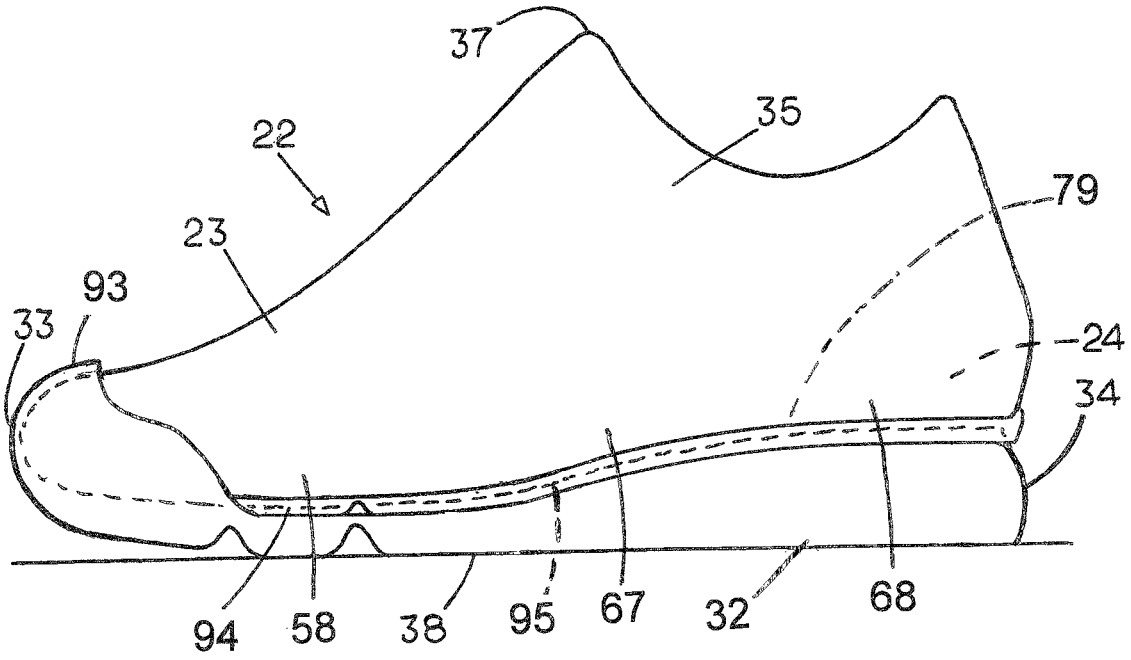
FIG. 73 is a lateral side view of an article of footwear including an upper including a V or U shaped channel near the lasting margin for receiving a portion of a sole including a toe cap resembling one shown in FIG. 62.

FIG. 73 is a medial side view of an article of footwear 22 including an upper 23 including a V or U shaped channel 94 which is disposed near the lasting margin 95 about most of the medial side 35, lateral side 36, and posterior side 34 for receiving a portion of the sole 32. The article of footwear 22 includes a sole 32 having an integral toe cap 93 on the anterior side 33 resembling the one shown in FIG. 62.

Figure 74:
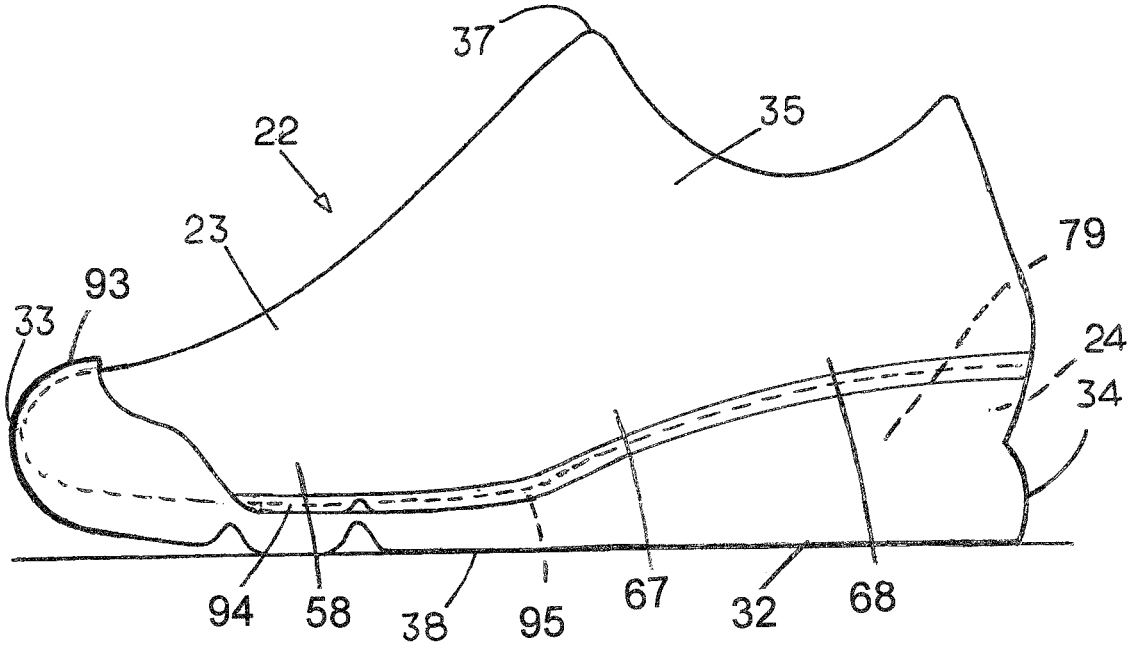
FIG. 74 is a lateral side view of an article of footwear including an upper including a V or U shaped channel near the lasting margin in a portion of the forefoot area and which is more elevated in the midfoot area and rearfoot area relative to the embodiment shown in FIG. 73, and which is configured to receive a portion of a sole which includes a toe cap resembling one shown in FIG. 62.

FIG. 74 is a medial side view of an article of footwear 22 including an upper 23 including a V or U shaped channel 94 about at least a portion of the medial side 35, lateral side 36, and posterior side 34 for receiving a portion of the sole 32. The V or U shaped channel 94 for receiving a portion of a sole 32 is more elevated in the midfoot area 67 and rearfoot area 68 relative to the embodiment shown in FIG. 73. The article of footwear 22 includes a sole 32 having a toe cap 93 on its anterior side 33 resembling the one shown in FIG. 62.

Figure 75:
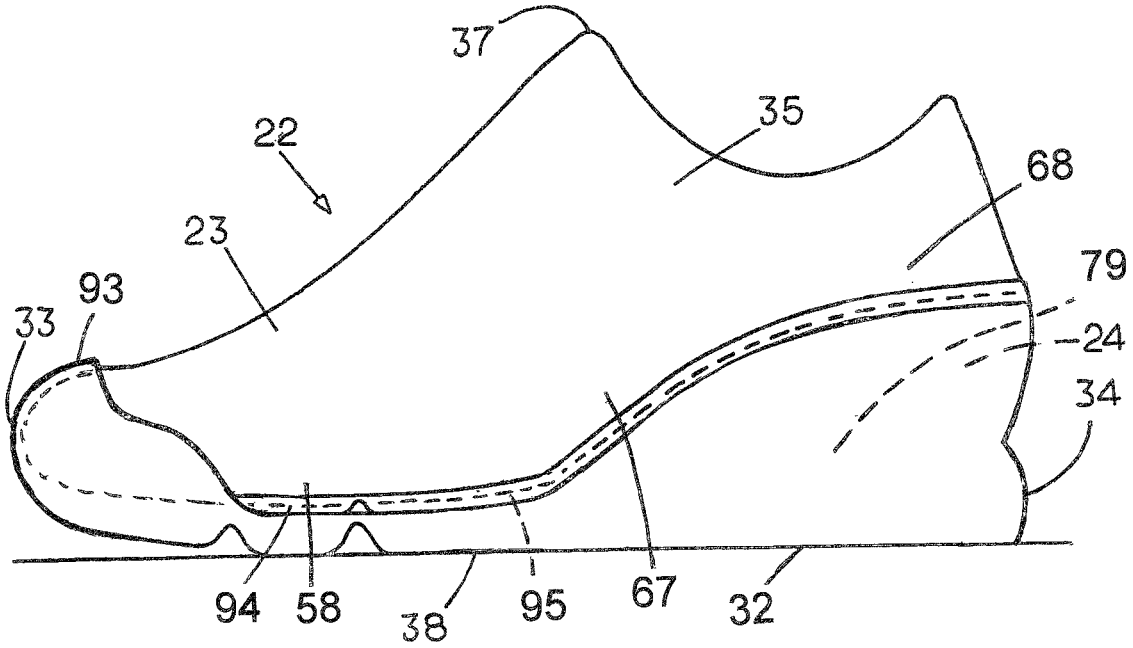
FIG. 75 is a lateral side view of an article of footwear including an upper including a V or U shaped channel near the lasting margin in a portion of the forefoot area and which is more elevated in the midfoot area and rearfoot area relative to the embodiment shown in FIG. 74 and which is configured to receive a portion of a sole which includes a toe cap resembling one shown in FIG. 62.

FIG. 75 is a medial side view of an article of footwear 22 including an upper 23 including a V or U shaped channel 94 disposed about at least a portion of the medial side 35, lateral side 36, and posterior side 34 of the shoe upper 23 for receiving a portion of sole 32. The V or U shaped channel 94 is more elevated in the midfoot area 67 and rearfoot area 68 relative to the embodiment shown in FIG. 74. The article of footwear 22 includes a sole 32 having a toe cap 93 on its anterior side 33 resembling that shown in FIG. 62.

Figure 76:
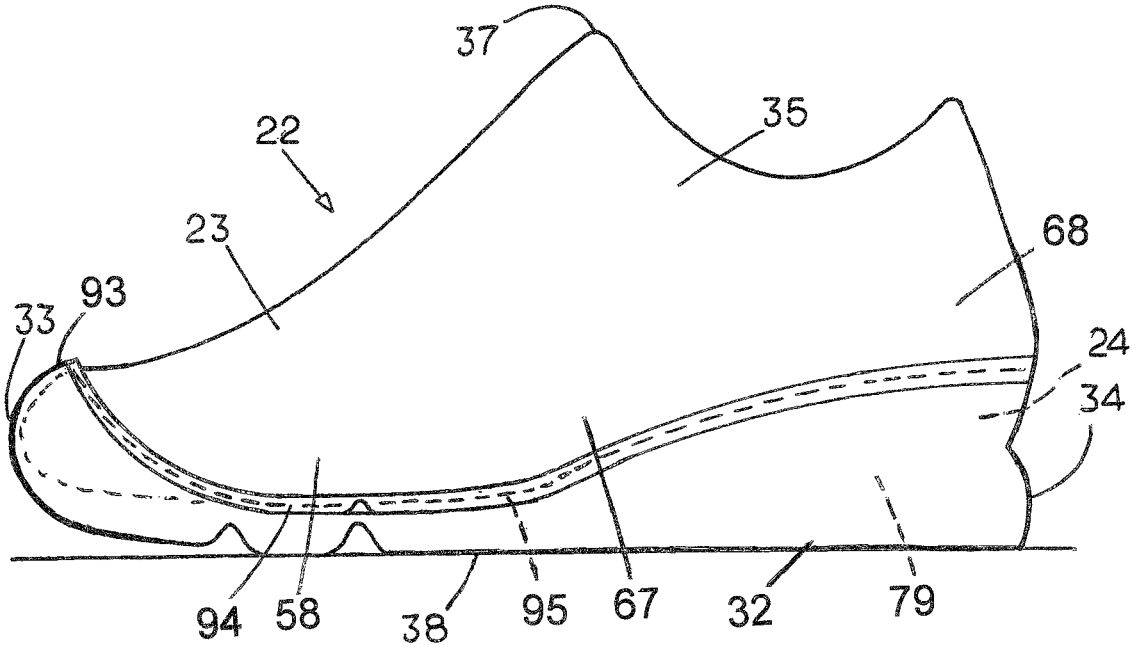
FIG. 76 is a lateral side view of an article of footwear including an upper including a V or U shaped channel near the lasting margin in a portion of the forefoot area and which is more elevated in the midfoot area and rearfoot area relative to the embodiment shown in FIG. 73 and which is configured to receive a portion of a sole which includes a toe cap resembling one shown in FIG. 66.

FIG. 76 is a medial side view of an article of footwear 22 including an upper 23 including a V or U shaped channel 94 which is disposed about at least a portion of the medial side 35, lateral side 36, and posterior side 34 of the shoe upper 23 for receiving a portion of a sole 32. The V or U shaped channel 94 is more elevated in the midfoot area 67 and rearfoot area 68 relative to the embodiment shown in FIG. 73. The article of footwear 22 includes a sole 32 having a toe cap 93 resembling that shown in FIG. 66.

Figure 77:
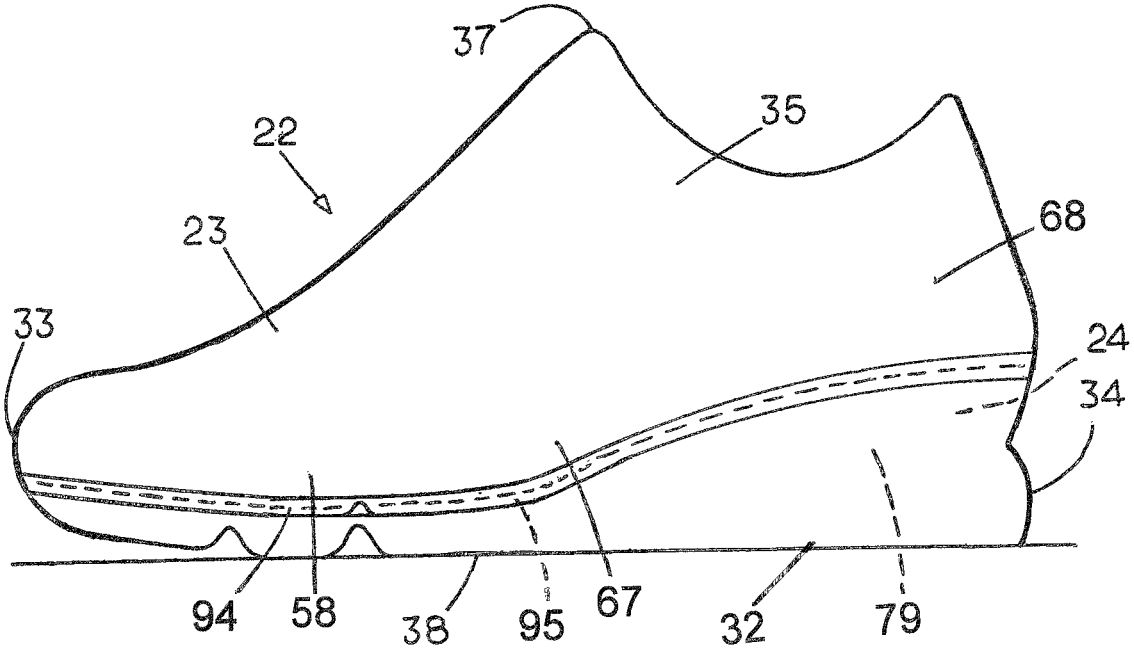
FIG. 77 is lateral side view of an article of footwear including an upper including a V or U shaped channel near the bottom lasting margin in a portion of the forefoot area and which is more elevated in the midfoot area and rearfoot area relative to the embodiment shown in FIG. 73 and which is configured to receive a portion of a sole which does not include an integral toe cap.

FIG. 77 is medial side view of an article of footwear 22 including an upper 23 including a V or U shaped channel 94 which is disposed about at least a portion of the medial side 35, lateral side 36, posterior side 34 of the shoe upper 23. The V or U shaped channel 94 is more elevated in the midfoot area 67 and rearfoot area 68 relative to the embodiment shown in FIG. 73. However, the article of footwear 22 shown in FIG. 77 includes a sole 32 which does not include an integral toe cap 93.

Figure 78:
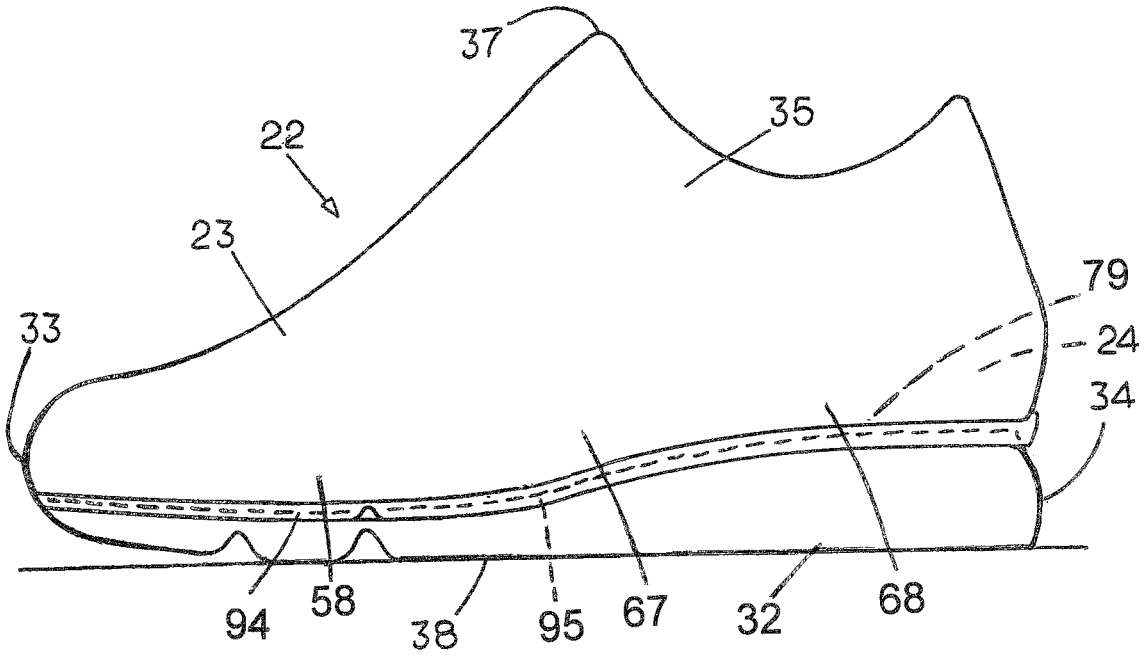
FIG. 78 is lateral side view of an article of footwear including an upper including a V or U shaped channel near the lasting margin in the forefoot area, midfoot area, and rearfoot area for receiving a portion of a sole and which does not include an integral toe cap.

FIG. 78 is medial side view of an article of footwear 22 including an upper 23 including a V or U shaped channel 94 which is disposed near the lasting margin 95 about most of the anterior side 33, medial side 35, lateral side 36, and posterior side 34 of the shoe upper 23 for receiving a portion of a sole 32. The article of footwear 22 shown in FIG. 78 includes a sole 32 which does not include an integral toe cap 93.

Figure 79:
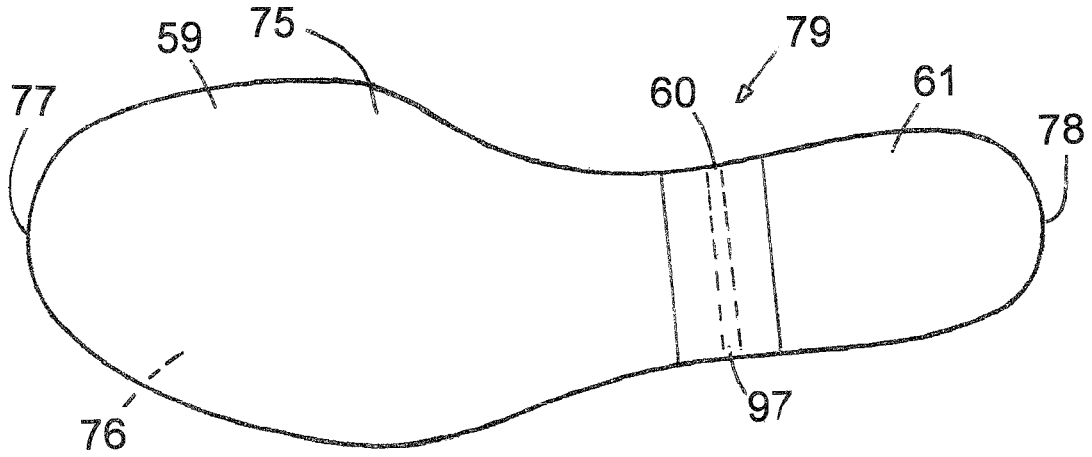
FIG. 79 is top view of a lasting plate including an anterior portion, a posterior portion, and a flexible elastomeric portion therebetween.

FIG. 79 is top view of a lasting plate 79 including an anterior portion 59, a posterior portion 61, and a flexible middle portion 60 therebetween. The flexible middle portion 60 can be made of a resilient elastomeric material such as a thermoplastic, a thermoplastic elastomer, a thermoplastic rubber, or a thermoset rubber. A thermoplastic elastomer such as Santoprene® can be injection molded or co-injection molded and be bonded to the anterior portion 59 and posterior portion 61 to create the flexible middle portion 60. The thermoplastic elastomer or other resilient elastomeric material can also extend and overlap a portion of the top side 75 of the anterior portion 59 and posterior portion 61 of the lasting plate 79. As a result, the lasting plate 79 will be elongated and provide some resistance to flexion or bending when the posterior side 61 is pushed downwards, but will then recover its normal shape when the force causing the flexion or bending is released. Accordingly, the lasting plate 79 can be inserted into the upper 23 and the male hooks 27 each having a free end 28 which face the front or anterior side 33 of the article of footwear 22 which are present on the anterior portion 59 of the lasting plate 79 can be positioned and inserted through registered openings 72 in the inferior side 38 of the upper 23 and into some of the female receptacles 103 which are disposed in the sole 32, and the lasting plate 79 can be momentarily flexed or bent in the flexible middle portion 60, and the posterior portion 61 including a post 16 and/or at least one male hook 27 having a free end 28 which faces the back or posterior side 34 of the article of footwear 22 can then be inserted through at least one corresponding registered opening 72 in the shoe upper 23 and into at least one mating female receptacle 103 in the sole 32. An insole 31 can then be selected and placed in the interior side 39 of the shoe upper 23. As a result, it can be readily understood that the shoe upper 23, lasting plate 79, and sole 32 can be quickly and easily removably secured together. Alternatively, the lasting plate 79 can include an integral insole 31 or one that can be mechanically coupled thereto, and the footwear component parts to be assembled can then possibly be reduced to only three in number.

Figure 80:
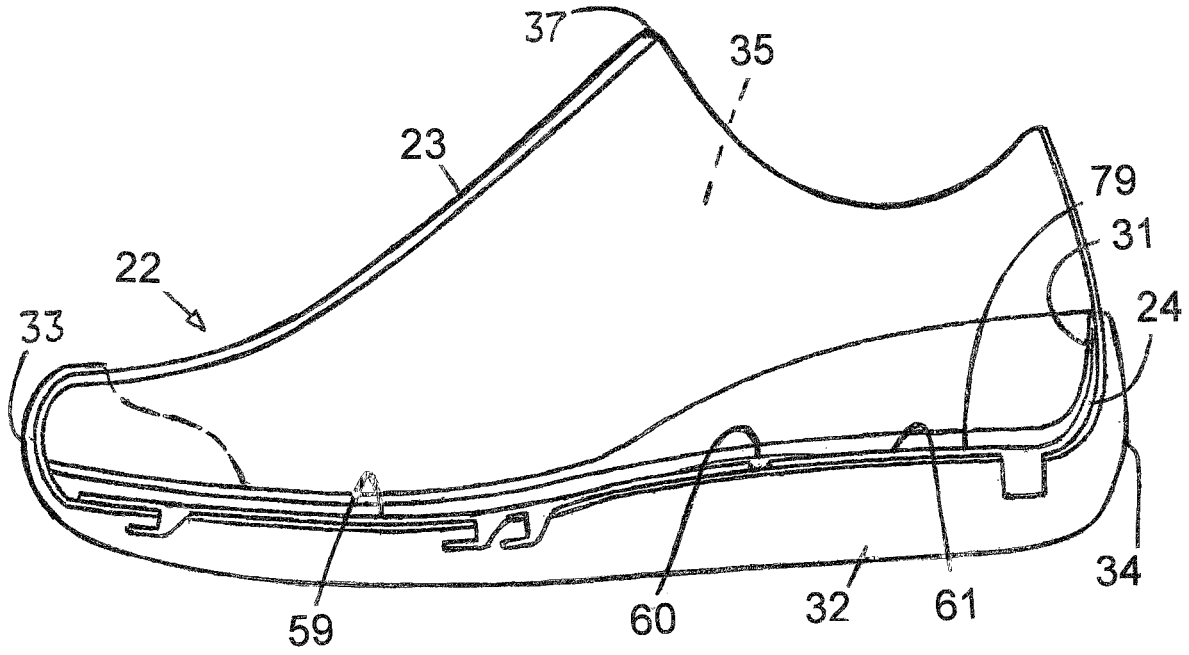
FIG. 80 is a lateral side view of an article of footwear generally similar to that shown in FIG. 61, but instead including a lasting plate resembling the one shown in FIG. 79.

FIG. 80 is a lateral side view of an article of footwear 22 generally similar to that shown in FIG. 61, but instead including a lasting plate 79 similar to that shown in FIG. 79.

Figure 81:
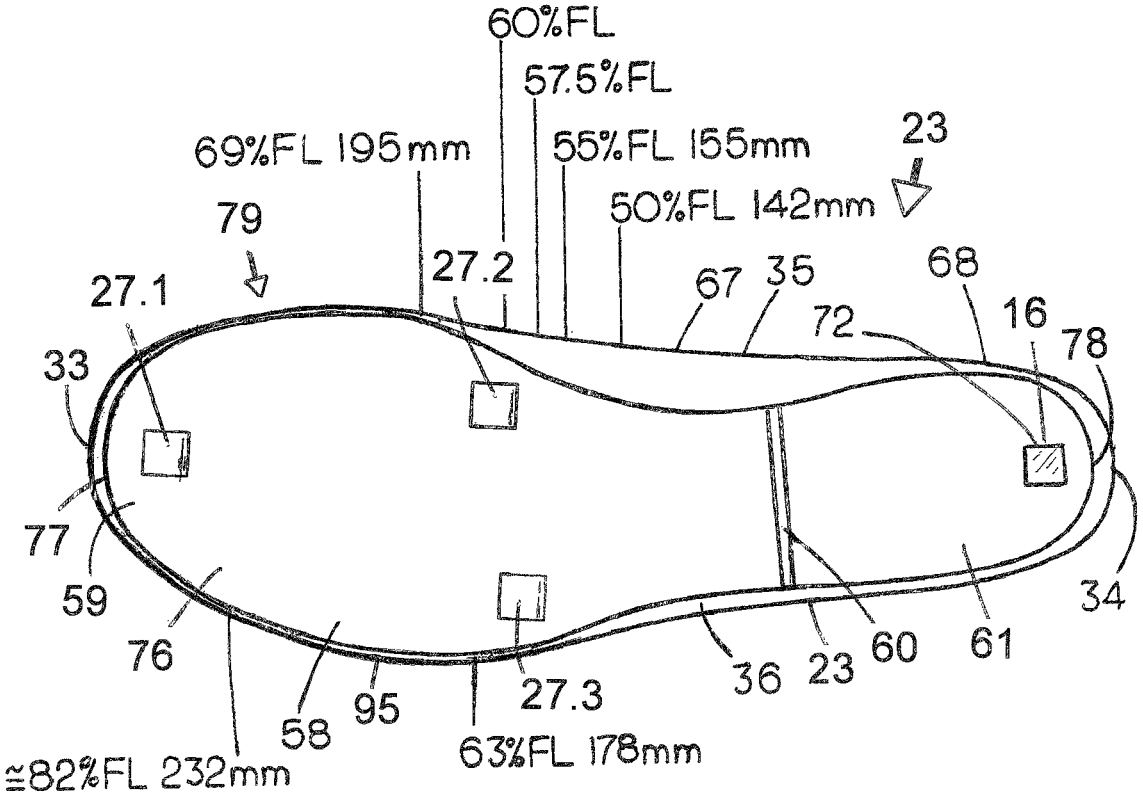
FIG. 81 is a bottom view of a lasting plate similar to the one shown in FIG. 79 which is resting upon the inferior side of a shoe upper resembling the one shown in FIG. 61.

FIG. 81 is a bottom view of a shoe upper 23 and a lasting plate 79 similar to that shown in FIG. 79 which is resting upon the inferior side 38 of a shoe upper 23.

Figure 82:
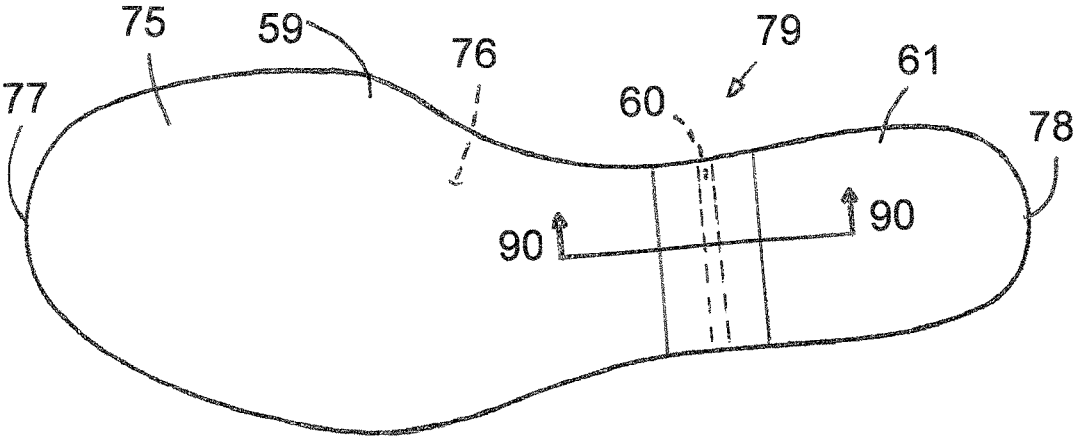
FIG. 82 is top view of an alternative lasting plate including an anterior portion, a posterior portion, a flexible elastomeric portion therebetween, and also indicating a cross-sectional view taken at line 90-90.

FIG. 82 is top view of an alternative lasting plate 79 including an anterior portion 59, a posterior portion 61, and a flexible middle portion 60 therebetween, and which indicates a cross-sectional taken at line 90-90.

Figure 83:
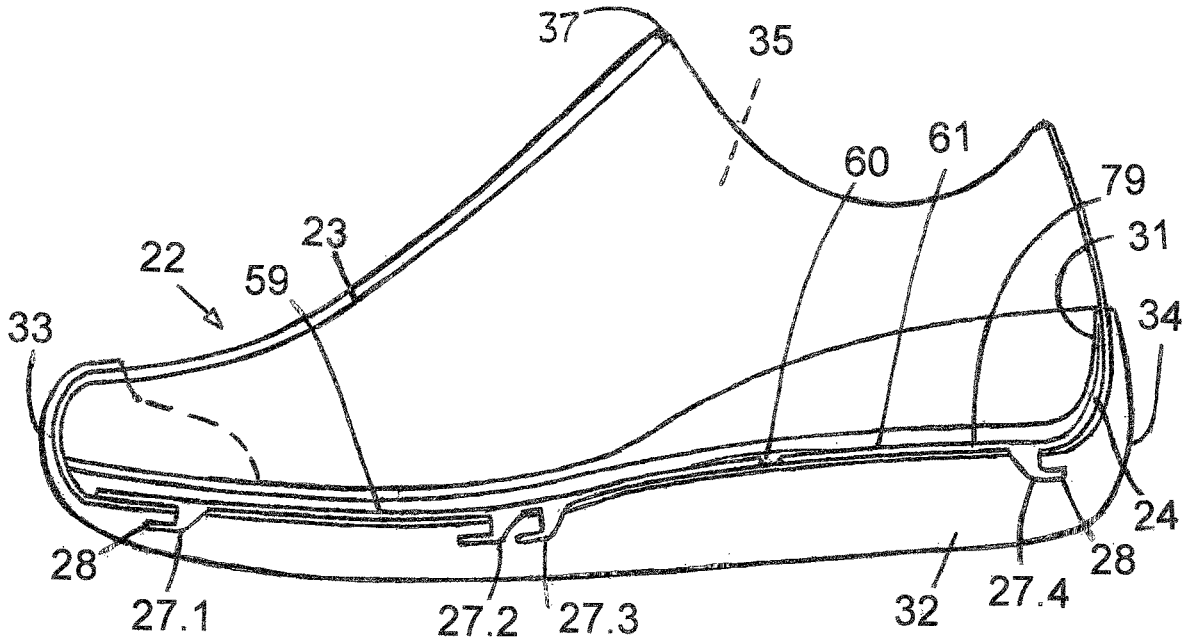
FIG. 83 is a lateral side view of an article of footwear generally similar to that shown in FIG. 61, but including an alternative lasting plate having an anterior portion including a plurality of male hooks with free ends facing towards the anterior side of the article of footwear, and a posterior portion including at least one male hook with a free end facing the posterior side of the article of footwear, and a flexible elastomeric portion therebetween resembling the one shown in FIG. 79.

FIG. 83 is a lateral side view of an article of footwear 22 generally similar to FIG. 61, but including an alternative lasting plate 79 including an anterior portion 59 including a plurality of male hooks 27.1, 27.2, and 27.3 each having free ends 28 facing towards the front or anterior side 33 of the article of footwear 22, and a posterior portion 61 including at least one male hook 27.4 with a free end 28 facing the back or posterior side 34 of the article of footwear 22, and a flexible middle portion 60 disposed therebetween which is generally similar to that shown in FIG. 79.

Figure 84:
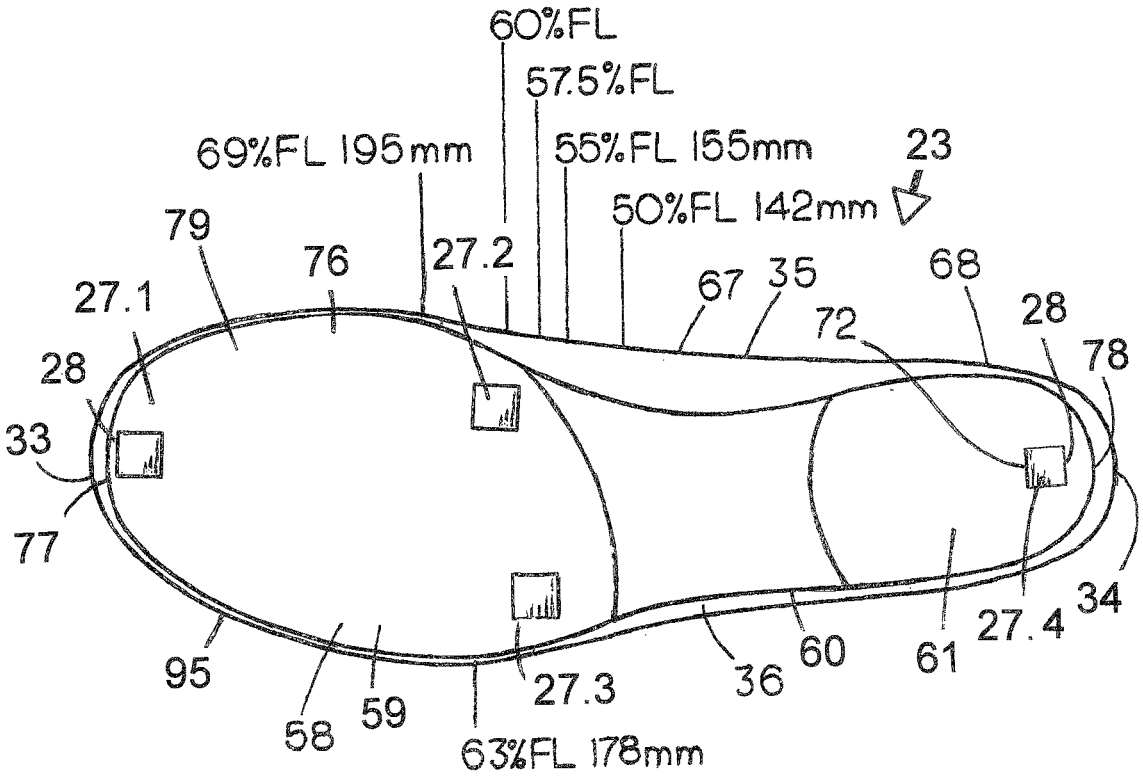
FIG. 84 is a bottom view of the lasting plate shown in FIG. 83 which is resting on the inferior side of a shoe upper resembling the one shown in FIG. 61, but which instead includes registered openings for the three male hooks having free ends facing towards the anterior side of the shoe upper, and also a male hook having a free end facing the posterior side of the shoe upper.
Figure 122:
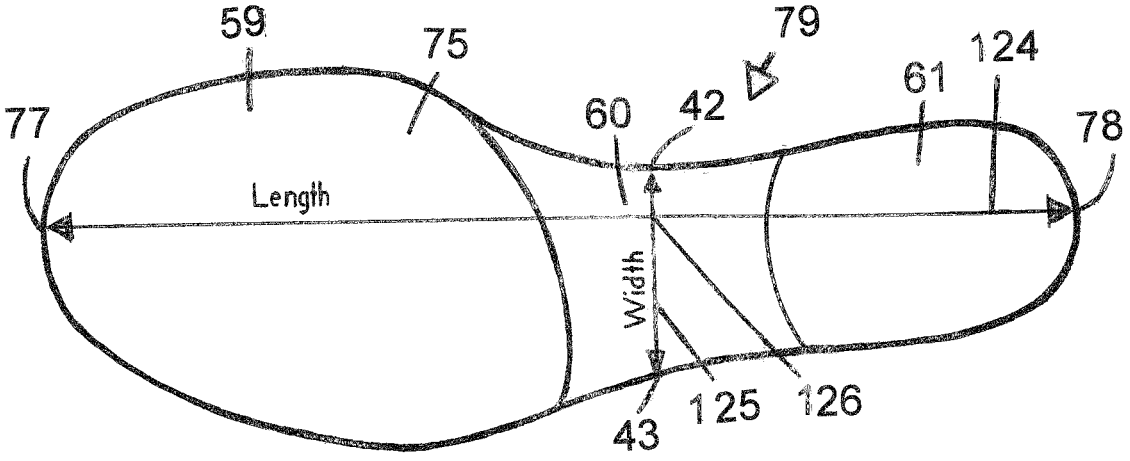

FIG. 84 is a bottom view of a shoe upper 23 and an alternative embodiment of a lasting plate 79 which is also shown in a top view in FIG. 122. The lasting plate 79 is resting upon the inferior side 38 of the shoe upper 23. The shoe upper 23 includes registered openings 72 for the three male hooks 27.1, 27.2, and 27.3 each having free ends 28 which face towards the front or anterior side 33 of the shoe upper 23, and a male hook 27 having a free end 28 which faces the back or posterior side 34 of the shoe upper 23.

Figure 85:
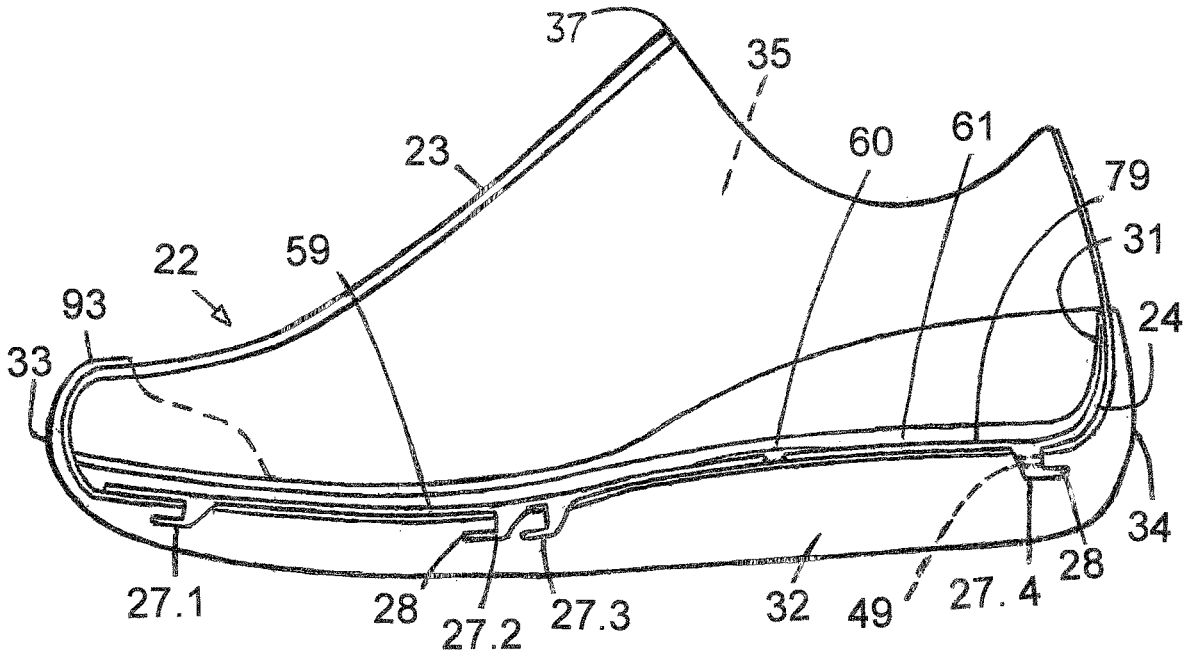
FIG. 85 is a lateral view of an article of footwear generally similar to that shown in FIG. 83, but also showing in phantom lines a longitudinal passage in the hook located in the rearfoot area for possibly receiving a retaining pin.

FIG. 85 is a lateral view of an article of footwear 22 generally similar to that shown in FIG. 83 but which also shows in phantom lines a longitudinal post passage 49 in the hook 27.4 located in the rearfoot area 68 for possibly receiving a retaining pin 63.

Figure 86:
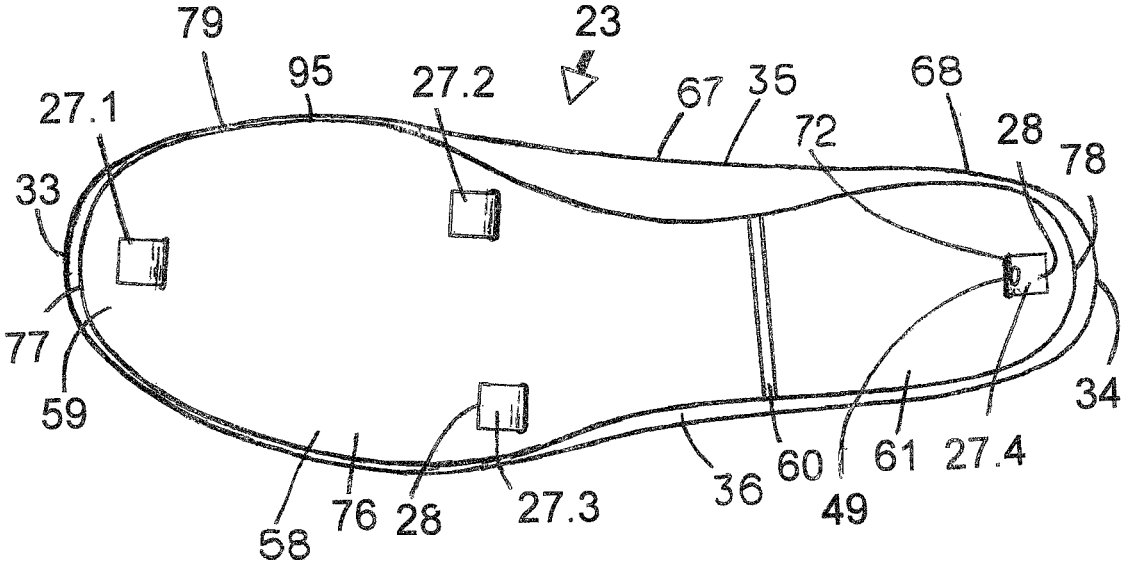
FIG. 86 is a bottom view of the lasting plate shown in FIG. 85 resting upon the inferior side of a shoe upper.

FIG. 86 is a bottom view of a shoe upper 23 and the lasting plate 79 shown in FIG. 85 which is resting upon the bottom or inferior side 38 of the shoe upper 23.

Figure 87:
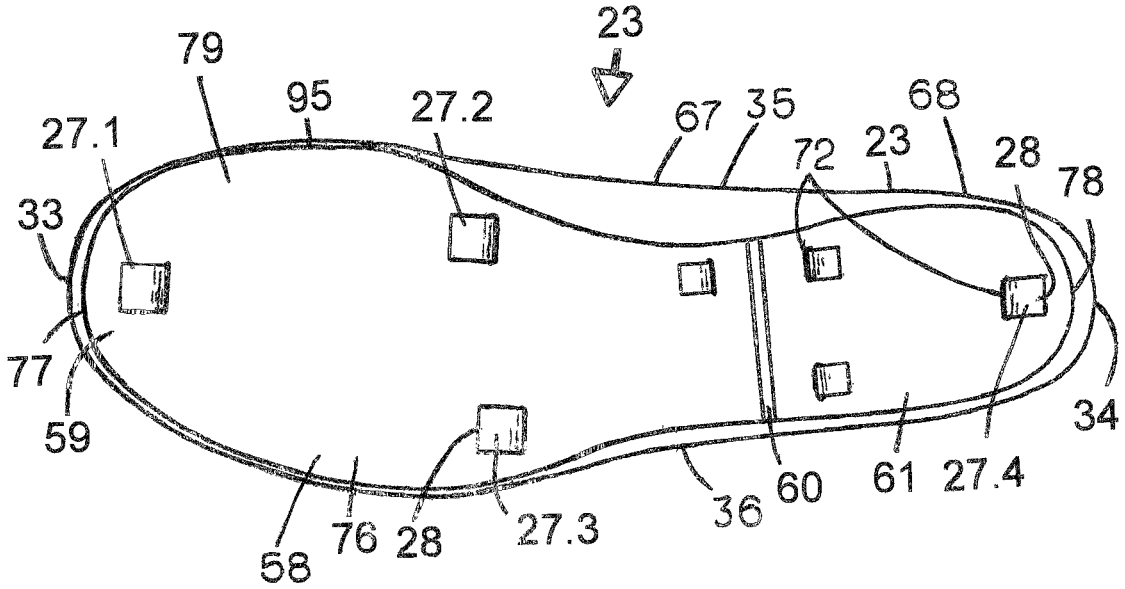
FIG. 87 is a bottom view of an alternative lasting plate including an anterior portion including a plurality of male hooks in the forefoot area and midfoot area having free ends facing towards the anterior side of the upper, and a posterior portion including a plurality of male hooks having free ends facing towards the posterior side of the upper and a flexible elastomeric portion disposed therebetween, and which is resting on the inferior side of a shoe upper.
Figure 89:
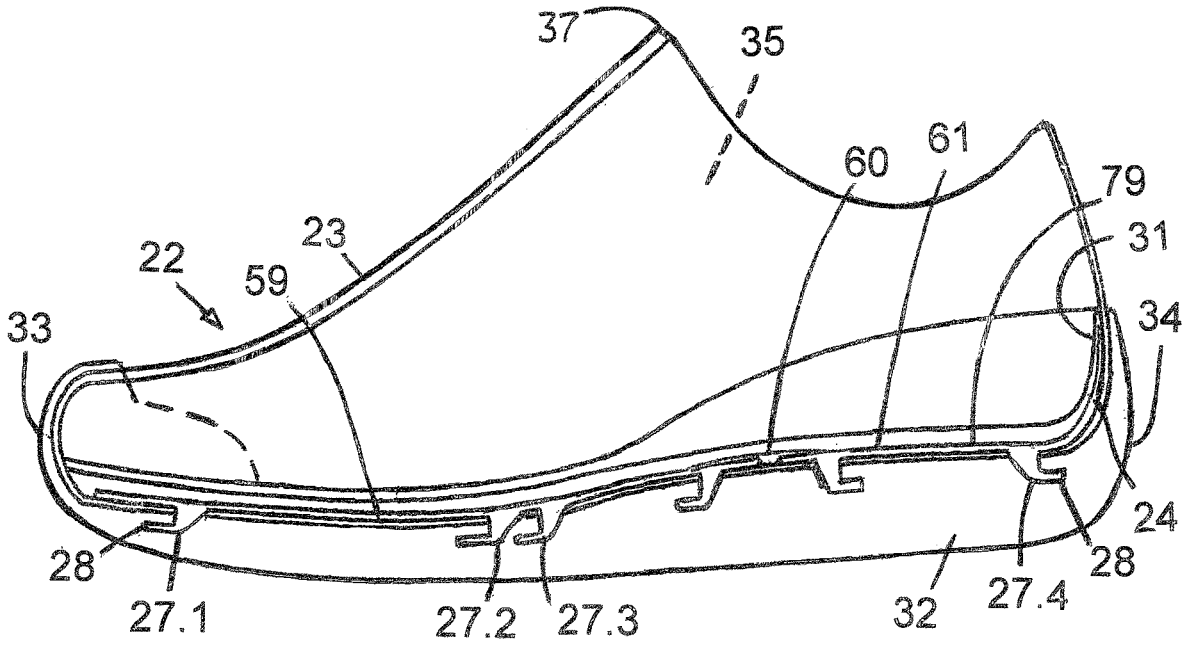
FIG. 89 is a lateral side view of a shoe upper generally similar to that shown in FIG. 87 and a lasting plate including a plurality of male hooks disposed in the anterior portion and also in the posterior portion as shown in at least one of the embodiments shown in FIGS. 88, 90-93.

FIG. 87 is a bottom view of a shoe upper 23 and an alternative lasting plate 79 which is also shown in FIG. 89 which includes an anterior portion 59 including a plurality of male hooks 27.1, 27.2, and 27.3 and one additional hook located in the forefoot area 58 and midfoot area 67 each having free ends 28 facing towards the front or anterior side 33 of the upper 23, and a posterior portion 61 including a male hook 27.4 and also two additional hooks having free ends 28 facing towards the back or posterior side 34 of the upper 32 and a flexible middle portion 60 disposed therebetween. The lasting plate 79 rests upon the bottom or inferior side 38 of a shoe upper 23 including a plurality of registered openings 72 for permitting the plurality of male hooks 27 to extend downwards therethrough.

Figure 88:
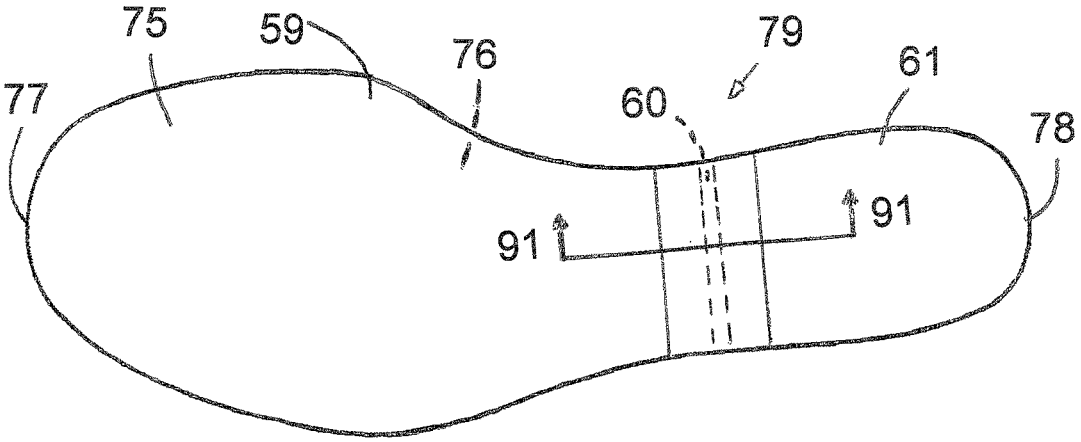
FIG. 88 is a top view of an alternative lasting plate including a flexible elastomeric portion generally similar to at least one of the embodiments shown in FIGS. 90-93, and indicating a cross-section along line 91-91.
Figure 91:
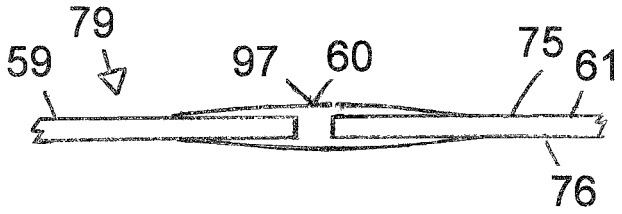
FIG. 91 is a lateral cross-sectional view of a portion of a lasting plate generally similar to the embodiment shown in FIG. 88 showing a flexible elastomer disposed on both the top and bottom sides.
Figure 93:
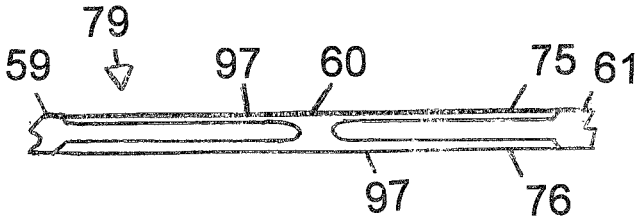
FIG. 93 is a lateral cross-sectional view of a portion of a lasting plate generally similar to the embodiment shown in FIG. 88 showing a flexible elastomer disposed in recesses which are present on both the top side and the bottom side of the anterior portion and the posterior portion.

FIG. 88 is a top view of an alternative lasting plate 79 showing a cross-section along line 91-91 including a flexible middle portion 60 generally similar to the embodiments shown in the cross-sectional views shown in FIGS. 91 and 93.

FIG. 89 is a lateral side view of a shoe upper 23 generally similar to that shown in FIG. 87 and a lasting plate 79 including a plurality of male hooks 27 disposed in the anterior portion 59 and also in the posterior portion 61.

Figure 90:
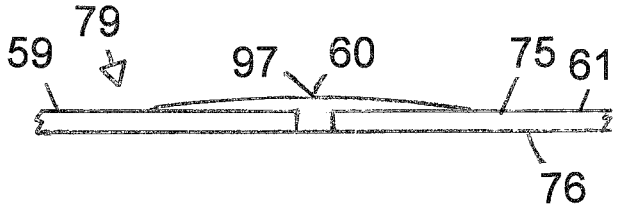
FIG. 90 is a lateral cross-sectional view of a portion of a lasting plate generally similar to the embodiment shown in FIG. 82 showing a flexible elastomer disposed on the top side.

FIG. 90 is a lateral side cross section view taken along a portion of the length of a lasting plate 79 generally similar to the embodiment shown in FIG. 82 showing a flexible middle portion 60 disposed between the anterior portion 59 and posterior portion 61, and also the presence of a flexible elastomeric material 97 on the top side 75 and overlapping a portion of the anterior portion 59 and posterior portion 61. When the posterior portion 61 is momentarily flexed and bent downwards the resilient flexible elastomeric material 97 on the top side 75 will be stretched and elongated, but then cause the lasting plate 79 to substantially return to its original configuration when the force application causing the bending and elongation is released.

FIG. 91 is a lateral cross section view taken along a portion of the length of a lasting plate 79 generally similar to the embodiment shown in FIG. 88 showing the presence of an elastomer 97 in the flexible middle portion 60, but also on a portion of both the top side 75 and bottom side 76 of the anterior portion 59 and posterior portion 61. As shown, the flexible middle portion 60 is disposed between the anterior portion 59 and posterior portion 61, and the elastomeric material 97 in the flexible middle portion 60 is present therebetween and also overlaps a portion of the anterior portion 59 and posterior portion 61 on both the top side 75 and bottom side 76. When the posterior portion 61 is flexed and bent downwards the resilient flexible elastomer 97 on the top side 75 will be stretched and elongated, and the resilient flexible elastomer 97 on the bottom side 76 will also then be caused to compress, and then cause the lasting plate 79 to return to its original configuration when the force application causing the flexing or bending is released.

Figure 92:
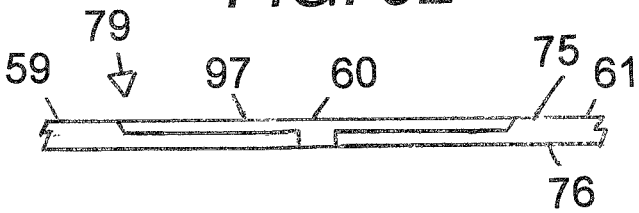
FIG. 92 is a lateral cross-sectional view of a portion of a lasting plate generally similar to the embodiment shown in FIG. 82 showing a flexible elastomer disposed in a recess present on the top side of both the anterior portion and posterior portion.

FIG. 92 is a lateral cross section view of the lasting plate 79 generally similar to the embodiment shown in FIG. 82 showing an elastomeric material 97 located the flexible middle portion 60 and in recesses 84 on the top sides 75 of the anterior portion 59 and posterior portion 61 of the lasting plate 79.

FIG. 93 is a lateral cross section view of a lasting plate 79 generally similar to the embodiment shown in FIG. 88 showing the presence of an elastomeric material 97 located in the flexible middle portion 60 and in recesses 84 which are present on both the top sides 75 and the bottom sides 76 of the anterior portion 59 and the posterior portion 61 of the lasting plate 79.

Figure 94:
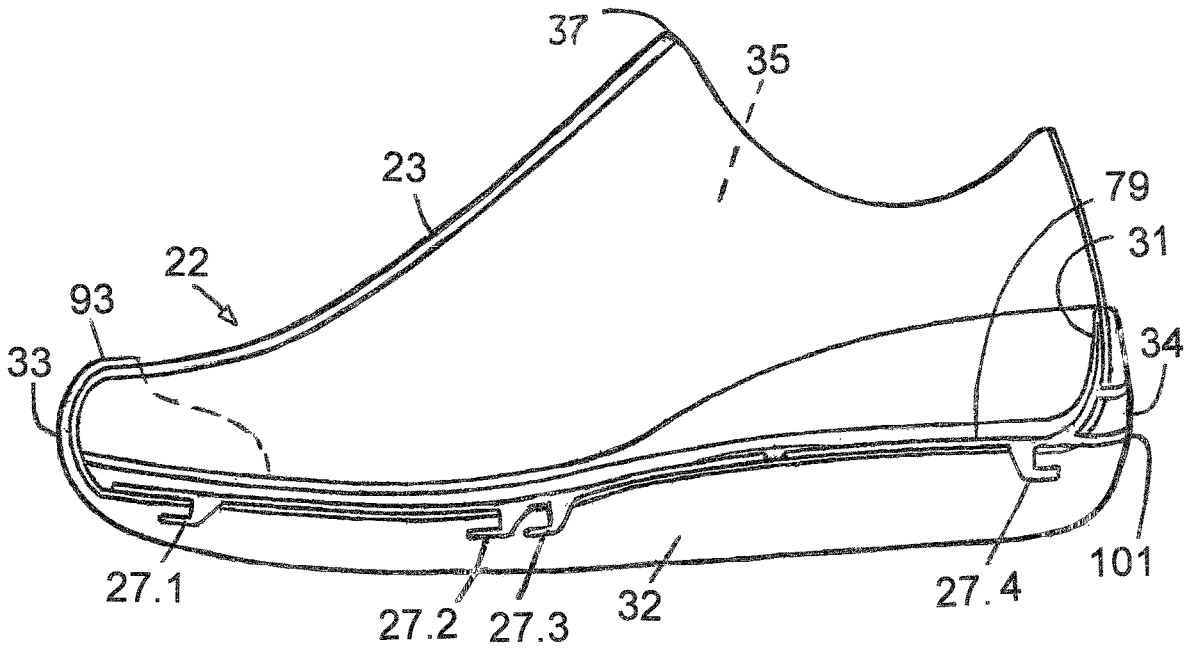
FIG. 94 is a lateral cross-sectional view of a shoe upper including a lasting plate generally similar to the embodiment shown in FIG. 83, but further including at least one locking tab near the back side which is removably secured in a corresponding registered opening in the posterior side of the upper and also a void space or receptacle in the sole.

FIG. 94 is a lateral cross section view of a shoe upper 23 including a lasting plate 79 generally similar to the embodiment shown in FIG. 82, but further including at least one locking tab 101 near the back side 78 which is removably secured in a corresponding registered opening 72 in the back or posterior side 34 of the upper 23, and also a void space 102 and/or female receptacle 103 in the sole 32. Alternatively, the locking tab 101 could extend through the upper 23, but not into a void space 102 and/or female receptacle 103 in the sole 32.

Figure 95:
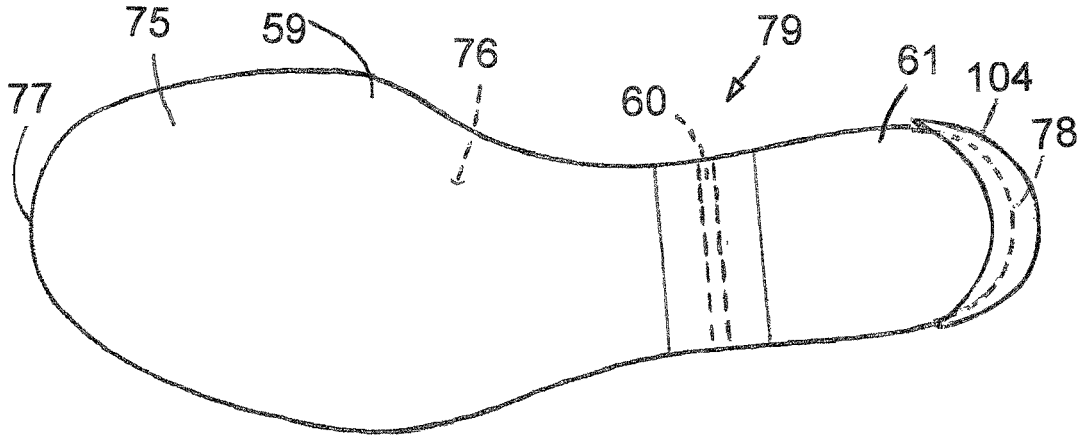
FIG. 95 is a top view of a lasting plate generally similar to that shown in FIG. 90, but also showing the overlapping relationship of a flange having a crescent shape.

FIG. 95 is a top view of a lasting plate 79 generally similar to that shown in FIG. 90, but also showing the overlapping relationship of a flange 104 having a crescent shape which can be included or alternatively be inserted and secured within the interior side 39 of the shoe upper 23.

Figure 96:
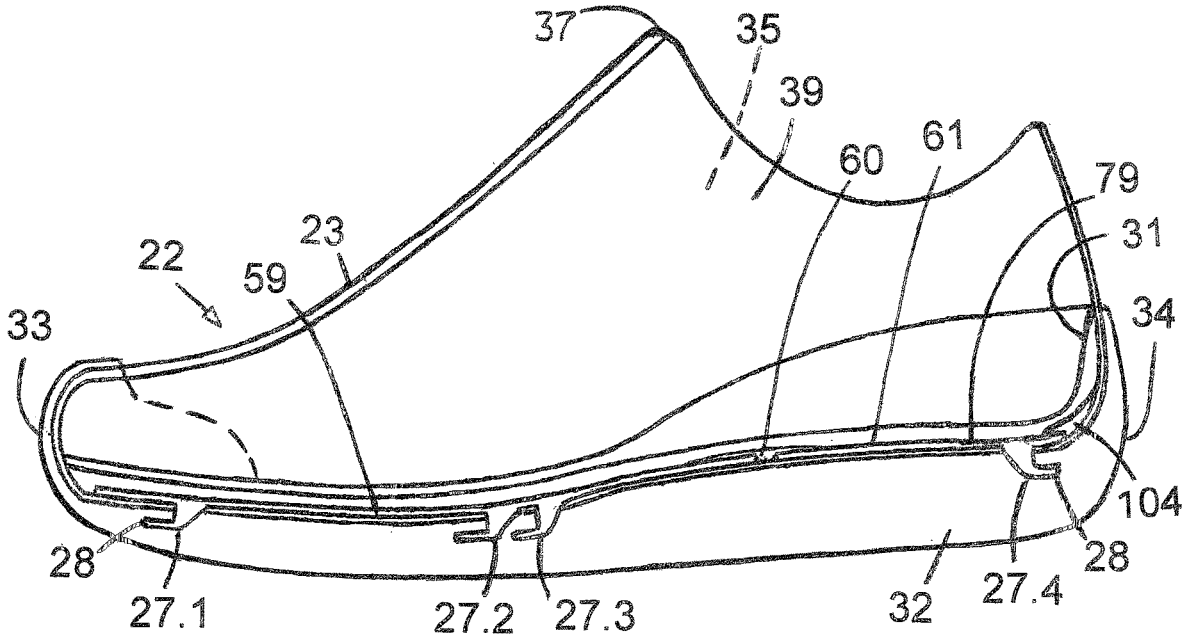
FIG. 96 is a lateral side cross-sectional view of a shoe upper including a lasting plate generally similar to the embodiment shown in FIG. 95, and also showing the overlapping relationship of a flange having a crescent shape located on the interior side of the shoe upper.

FIG. 96 is a lateral side cross sectional view of a shoe upper 23 including a lasting plate 79 generally similar to the embodiment shown in FIG. 95, and also showing the overlapping relationship of a flange 104 having a crescent shape similar to that shown in FIG. 95 disposed in the interior side 39 of the shoe upper 23.

Figure 97:
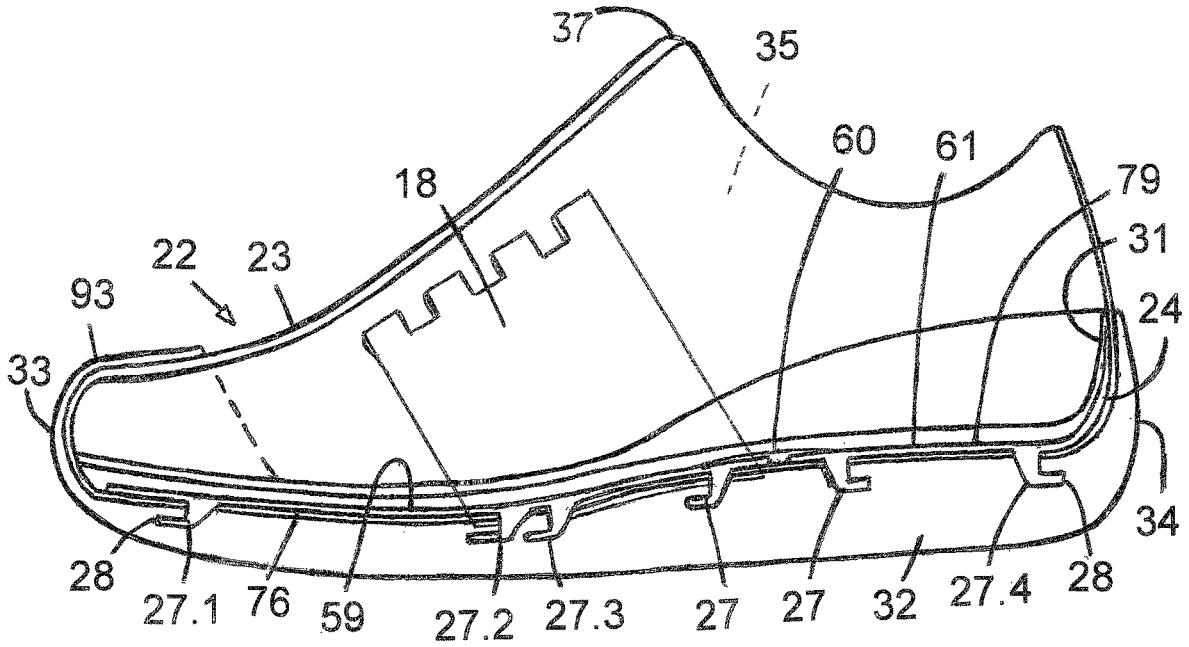
FIG. 97 is a lateral side cross-sectional view showing an article of footwear generally similar to the shoe shown in FIG. 89, but further including a strap including a plurality of openings for laces which can be removably secured between the upper and the sole.

FIG. 97 is a lateral side cross-sectional view showing an article of footwear 22 generally similar to the one shown in FIG. 89, but further including a strap 18 including a plurality of openings 72 for laces, and which can be removably secured between the upper 23 and the sole 32. In this regard, the strap 18 includes registered openings 72 for permitting the strap 18 to be removably secured to at least two of the male hooks 27 which extend downwards from the bottom side 76 of the lasting plate 79. In FIG. 97, the strap 18 is shown as being transparent in order to better illustrate the structure and functional relationship of the strap 18 with the shoe upper 23, lasting plate 79, and sole 32 of the article of footwear 22.

Figure 98:
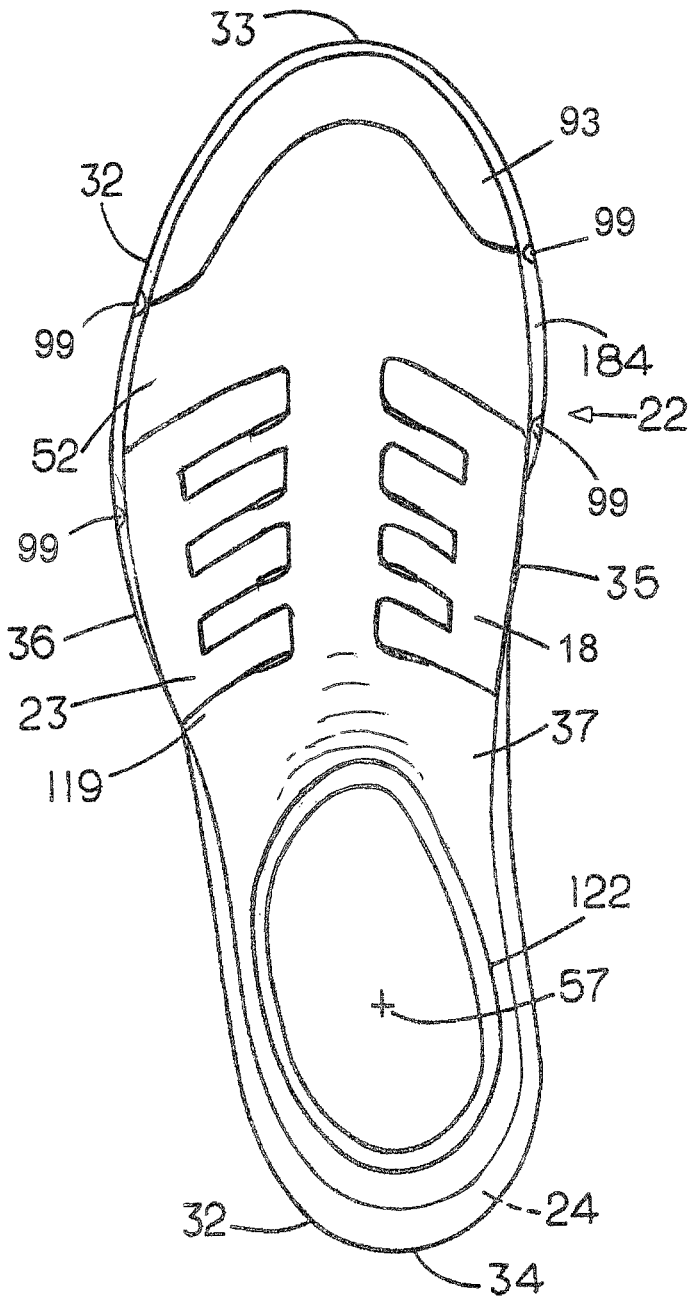
FIG. 98 is a top view of the article of footwear shown in FIG. 97.

FIG. 98 is a top view of the article of footwear 22 shown in FIG. 97.

Figure 99:
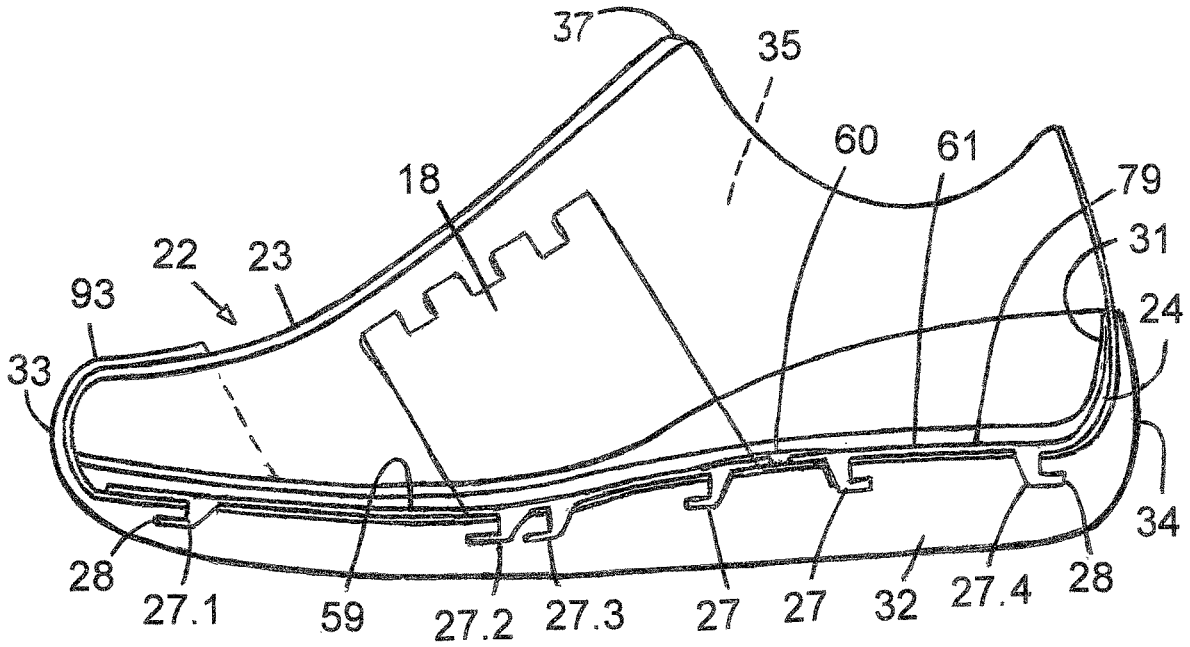
FIG. 99 is a lateral side cross-sectional view showing an article of footwear generally similar to the shoe shown in FIG. 97, but further including a strap including a plurality of openings for laces which is an integral part of the upper.

FIG. 99 is a lateral side cross-sectional view showing an article of footwear 22 generally similar to the one shown in FIG. 97, but further including a strap 18 including a plurality of openings 72 for laces which is an integral part of the upper 23. In this regard, the portions of the strap 18 on both the medial side 35 and lateral side 36 can be made part of the pattern of at least a portion of the upper 23, or alternatively, the strap 18 portion can be knitted as an integral part of the upper 23, or otherwise be made, formed, or joined to made a unitary component with the upper 23. In FIG. 99, the strap 18 is shown as being transparent in order to better illustrate the structure and functional relationship of the strap 18 with the shoe upper 23, lasting plate 79, and sole 32 of the article of footwear 22.

Figure 100:
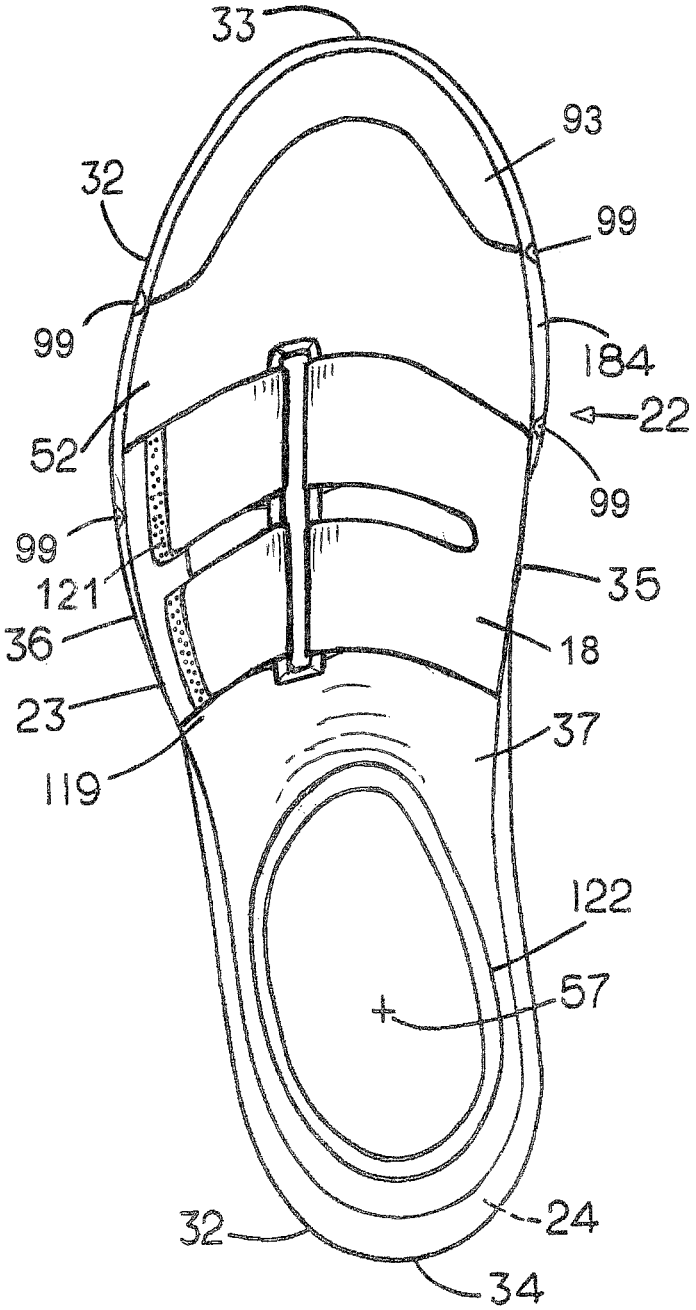
FIG. 100 is a top view of an article of footwear including a strap having two ends removably secured with hook and pile.

FIG. 100 is a top view of an article of footwear 22 generally similar to the one shown in FIG. 99, but including an alternative embodiment of a strap 18 which has two strap portions which are removably secured with hook and pile 121.

Figure 101:
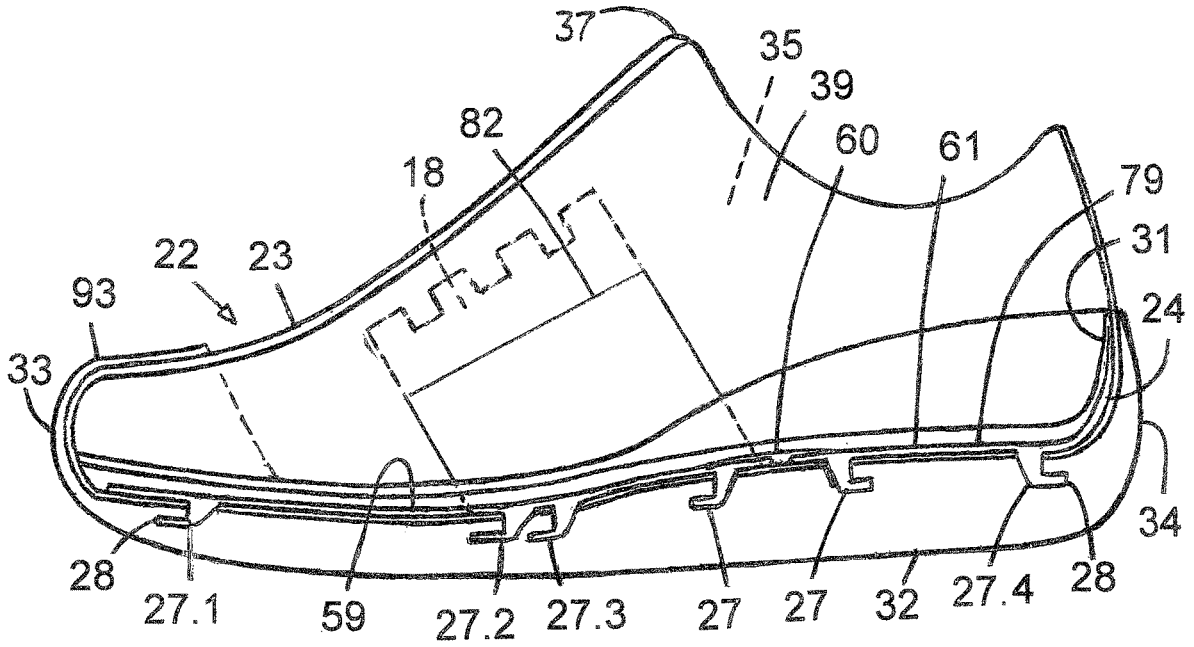
FIG. 101 is a lateral side cross-sectional view showing an article of footwear generally similar to the shoe shown in FIG. 97, but further including a strap including a plurality of openings for laces which can be removably secured on the interior side of the upper.

FIG. 101 is a lateral side cross-sectional view showing an article of footwear 22 generally similar to the one shown in FIG. 97, but further including a strap 18 including a plurality of openings 72 for laces which can be removably secured on the interior side 39 of the upper 23. The strap 18 can be removably secured to at least two hooks 27 on the bottom side 76 of the lasting plate 79 and a top portion of the strap 18 on the medial side 35 and lateral side 36 can pass through slits 82 in the upper 23. In FIG. 101, the strap 18 is shown as being transparent in order to better illustrate the structure and functional relationship of the strap 18 with the shoe upper 23, lasting plate 79, and sole 32 of the article of footwear 22.

Figure 102:
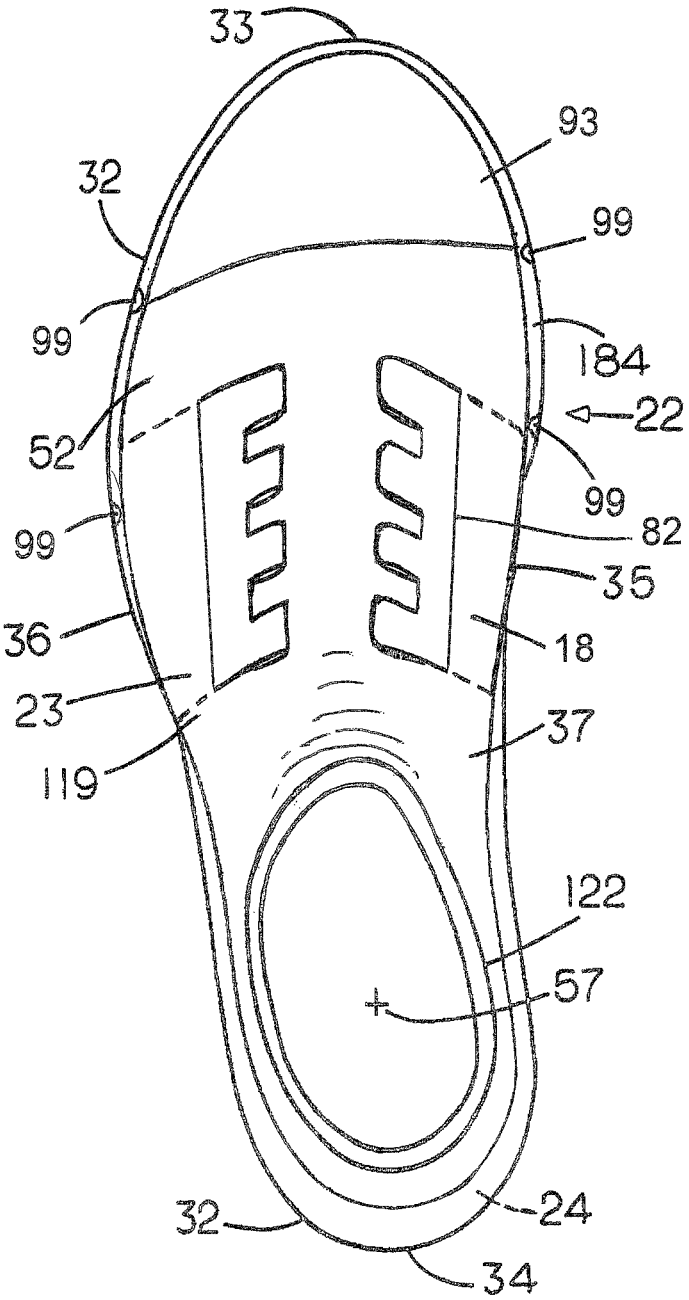
FIG. 102 is a top view of the article of footwear shown in FIG. 101.

FIG. 102 is a top view of the article of footwear 22 shown in FIG. 101.

Figure 103:
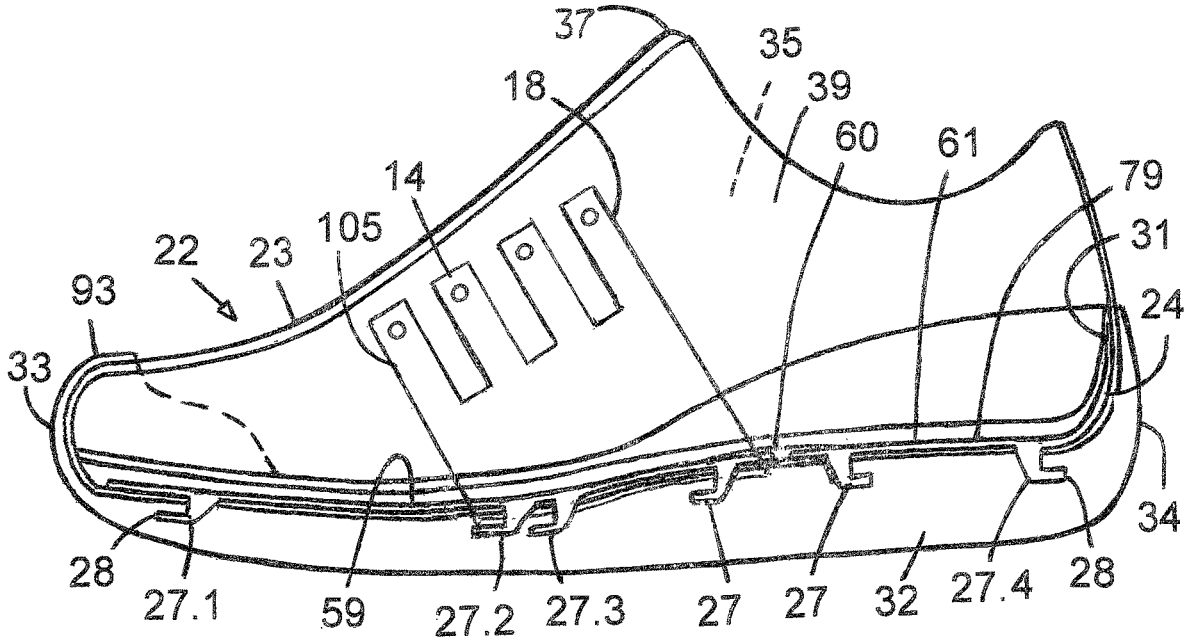
FIG. 103 is a lateral side cross-sectional view showing an article of footwear generally similar to the shoe shown in FIG. 97, but further including a strap including a plurality of elongated fingers having openings for laces which can be removably secured between the upper and sole.

FIG. 103 is a lateral side cross-sectional view showing an article of footwear 22 generally similar to the one shown in FIG. 97, but further including a strap 18 including a plurality of elongated fingers 105 having openings 72 which are configured as eyelets 14 for laces 121, and which can be removably secured between the upper 23 and sole 32. In this regard, the strap 18 can include registered openings 72 for permitting the strap 18 to be removably secured in functional relation to at least two of the male hooks 27 which extend downwards from the bottom side 76 of the lasting plate 79. In FIG. 103, the strap 18 is shown as being transparent in order to better illustrate the structure and functional relationship of the strap 18 with the shoe upper 23, lasting plate 79, and sole 32 of the article of footwear 22.

Figure 104:
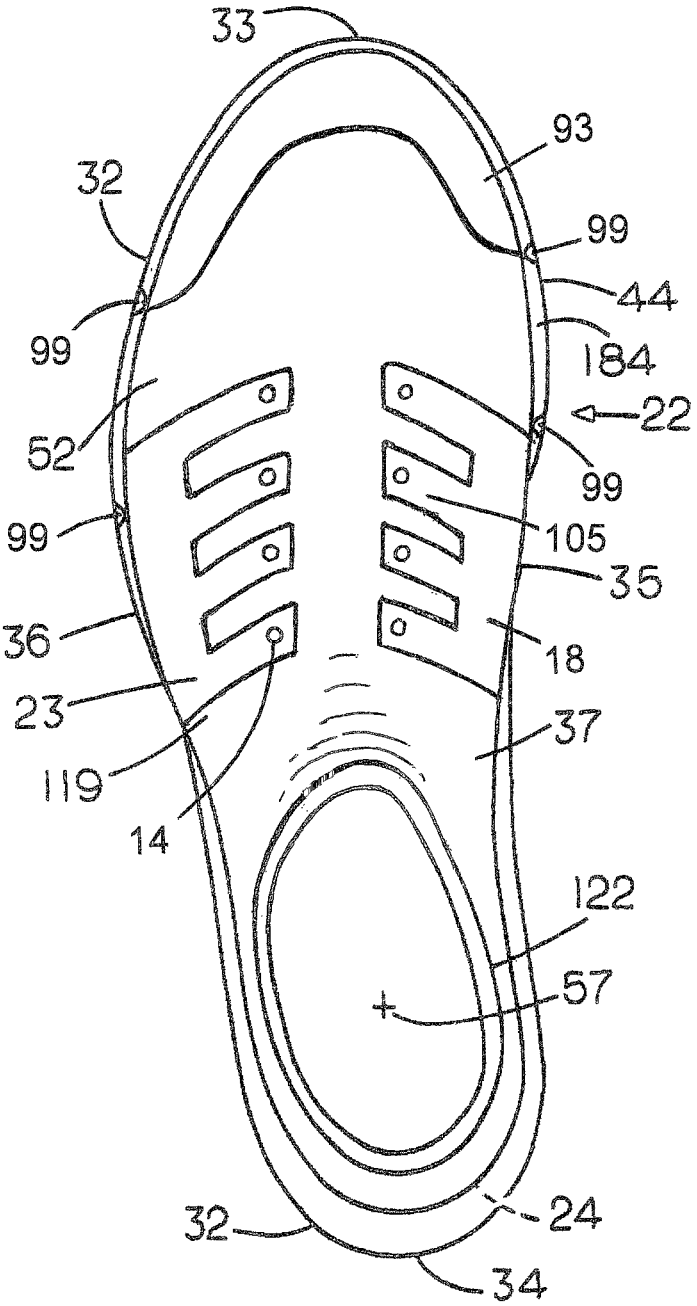
FIG. 104 is a top view of the article of footwear shown in FIG. 103.

FIG. 104 is a top view of the article of footwear 22 shown in FIG. 103.

Figure 105:
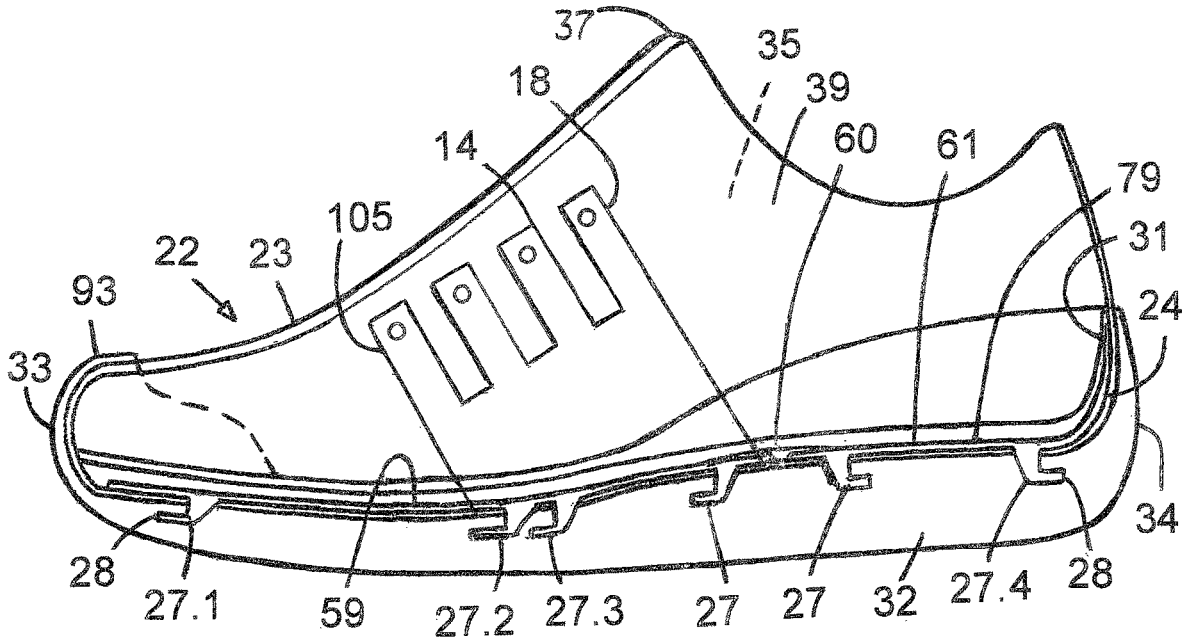
FIG. 105 is a lateral side cross-sectional view showing an article of footwear generally similar to the shoe shown in FIG. 97, but further including a strap which is an integral part of the upper and includes a plurality of elongated fingers having openings for laces.

FIG. 105 is a lateral side cross-sectional view showing an article of footwear 22 generally similar to the one shown in FIG. 97, but further including a strap 18 including a plurality of elongated fingers 105 having openings 72 which are configured as eyelets 14 for laces 121 which is an integral part of the upper 23. In this regard, the portions of the strap 18 on both the medial side 35 and lateral side 36 can be made part of the pattern of at least a portion of the upper 23, or alternatively, the strap 18 portion can be knitted as an integral part of the upper 23, or otherwise be made, formed, or joined to made a unitary component with the upper 23. In FIG. 105, the strap 18 is shown as being transparent in order to better illustrate the structure and functional relationship of the strap 18 with the shoe upper 23, lasting plate 79, and sole 32 of the article of footwear 22.

Figure 106:
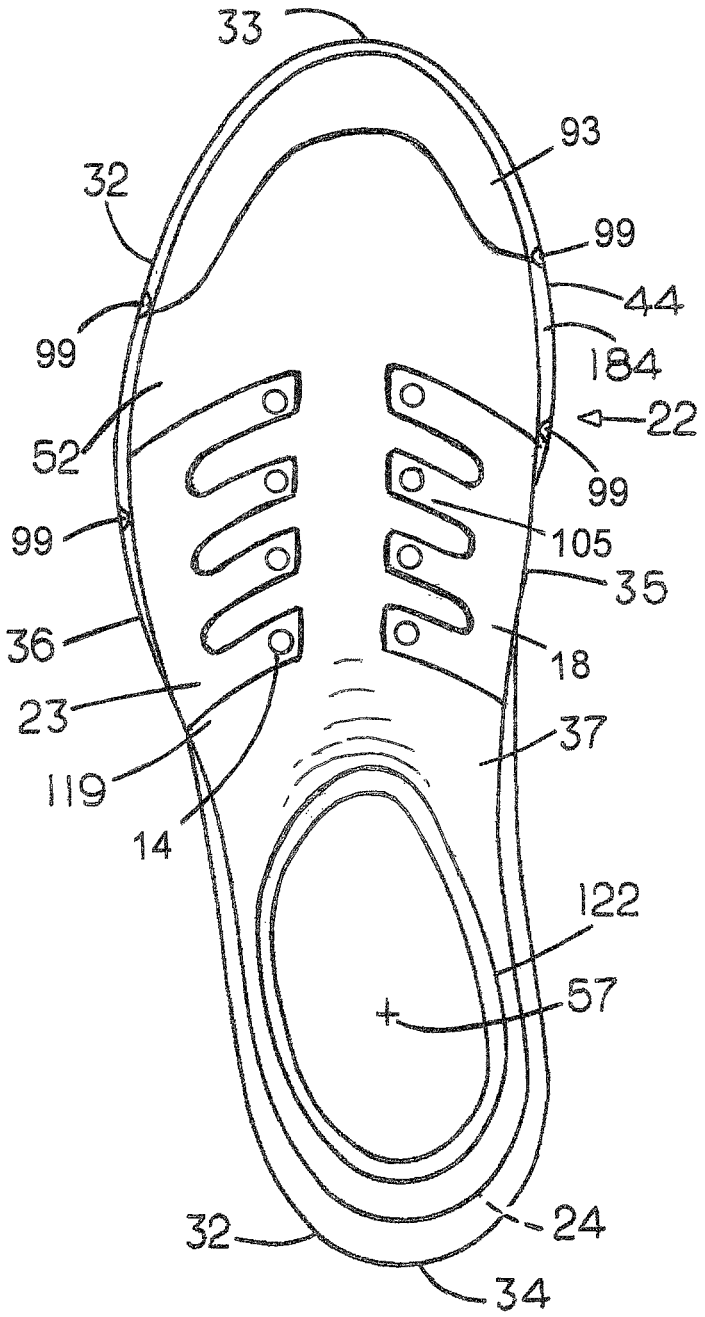
FIG. 106 is a top view of the article of footwear generally similar to the embodiment shown in FIG. 105, but including an alternative embodiment of a strap having a more rounded configuration between the individual fingers.

FIG. 106 is a top view of the article of footwear 22 generally similar to the one shown in FIG. 105, but including an alternative embodiment of a strap 18 which has a more rounded configuration between the individual fingers 105 and larger eyelets 14.

Figure 107:
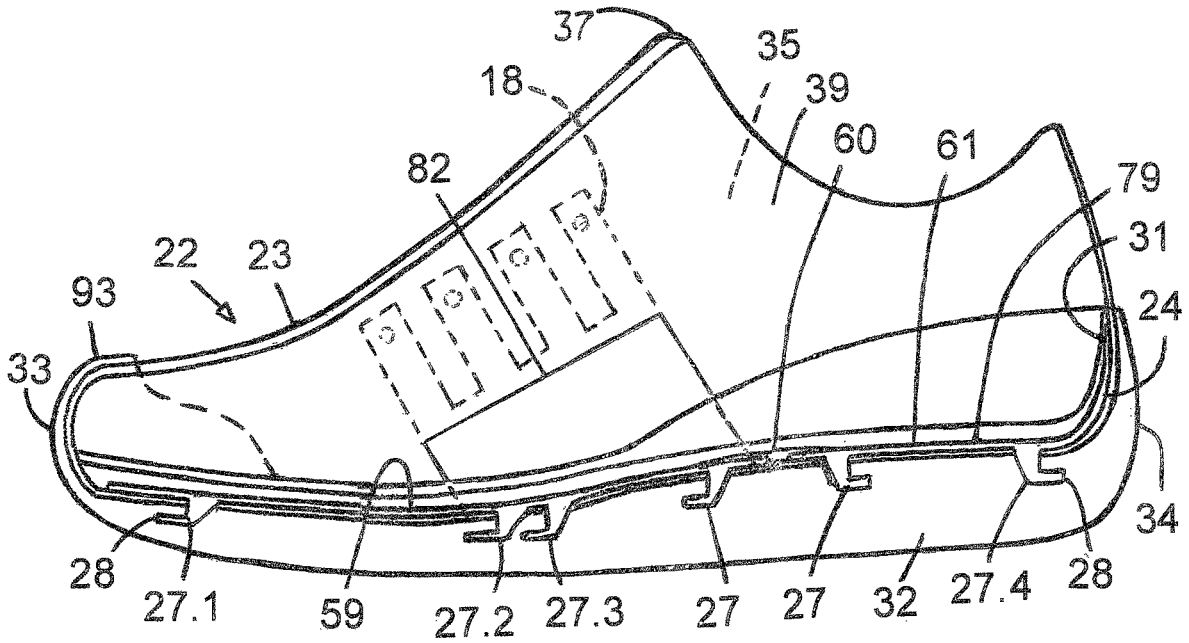
FIG. 107 is a lateral side cross-sectional view showing an article of footwear generally similar to the shoe shown in FIG. 97, but further including a strap including a plurality of elongated fingers having openings for laces which can be removably secured on the interior side of the upper.

FIG. 107 is a lateral side cross-sectional view showing an article of footwear 22 generally similar to the one shown in FIG. 97, but further including a strap 18 including a plurality of elongated fingers 105 having openings 72 which are configures as eyelets 14 for laces 121, and which can be removably secured on the interior side 39 of the upper 23. The strap 18 can be removably secured to at least two hooks 27 on the bottom side 76 of the lasting plate 79, and top portion of the strap 18 on the medial side 35 and lateral side 36 can pass through slits 82 in the upper 23. In FIG. 107, the strap 18 is shown as being transparent in order to better illustrate the structure and functional relationship of the strap 18 with the shoe upper 23, lasting plate 79, and sole 32 of the article of footwear 22.

Figure 108:
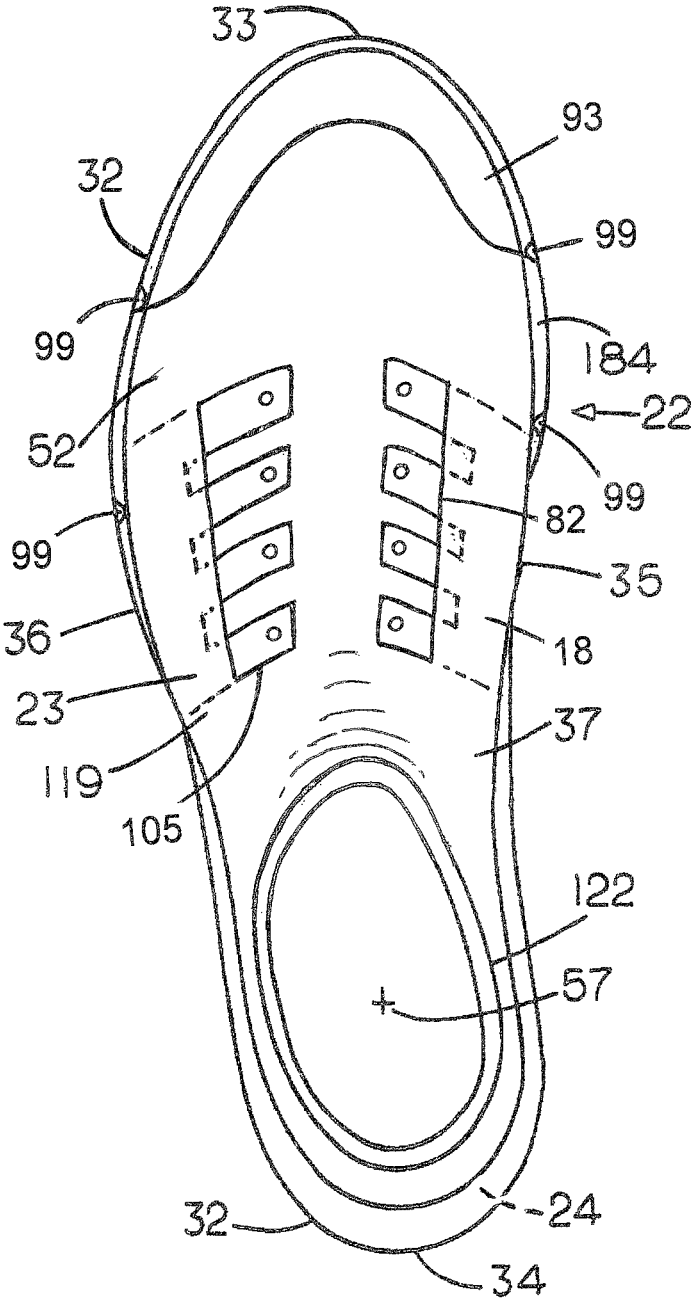
FIG. 108 is a top view of the article of footwear shown in FIG. 107.

FIG. 108 is a top view of the article of footwear 22 shown in FIG. 107.

Figure 109:
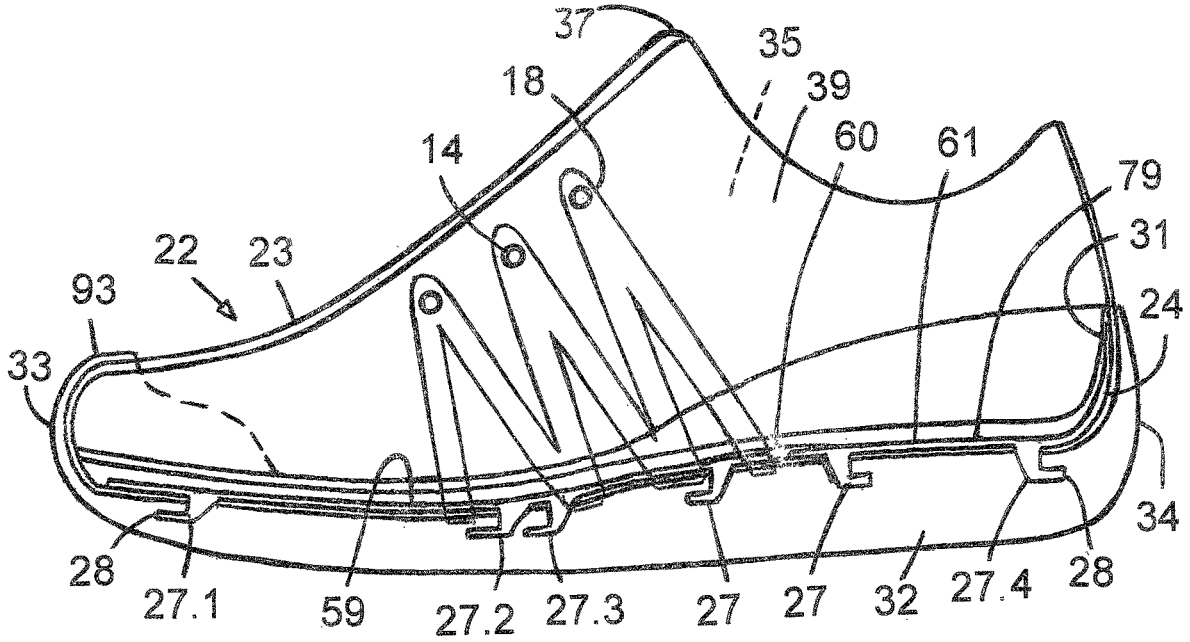
FIG. 109 is a lateral side cross-sectional view showing an article of footwear generally similar to the shoe shown in FIG. 97, but further including a strap including a plurality of V shapes having openings for laces and which can be removably secured between the upper and sole.

FIG. 109 is a lateral side cross-sectional view showing an article of footwear 22 generally similar to the one shown in FIG. 97, but further including a strap 18 including a plurality of V shapes having openings 72 which are figured as eyelets 14 for laces 121, and which can be removably secured between the upper 23 and sole 32. In this regard, the strap 18 can include registered openings 72 for permitting the strap 18 to be removably secured to at least two of the male hooks 27 which extend downwards from the bottom side 76 of the lasting plate 79. In FIG. 109, the strap 18 is shown as being transparent in order to better illustrate the structure and functional relationship of the strap 18 with the shoe upper 23, lasting plate 79, and sole 32 of the article of footwear 22.

Figure 110:
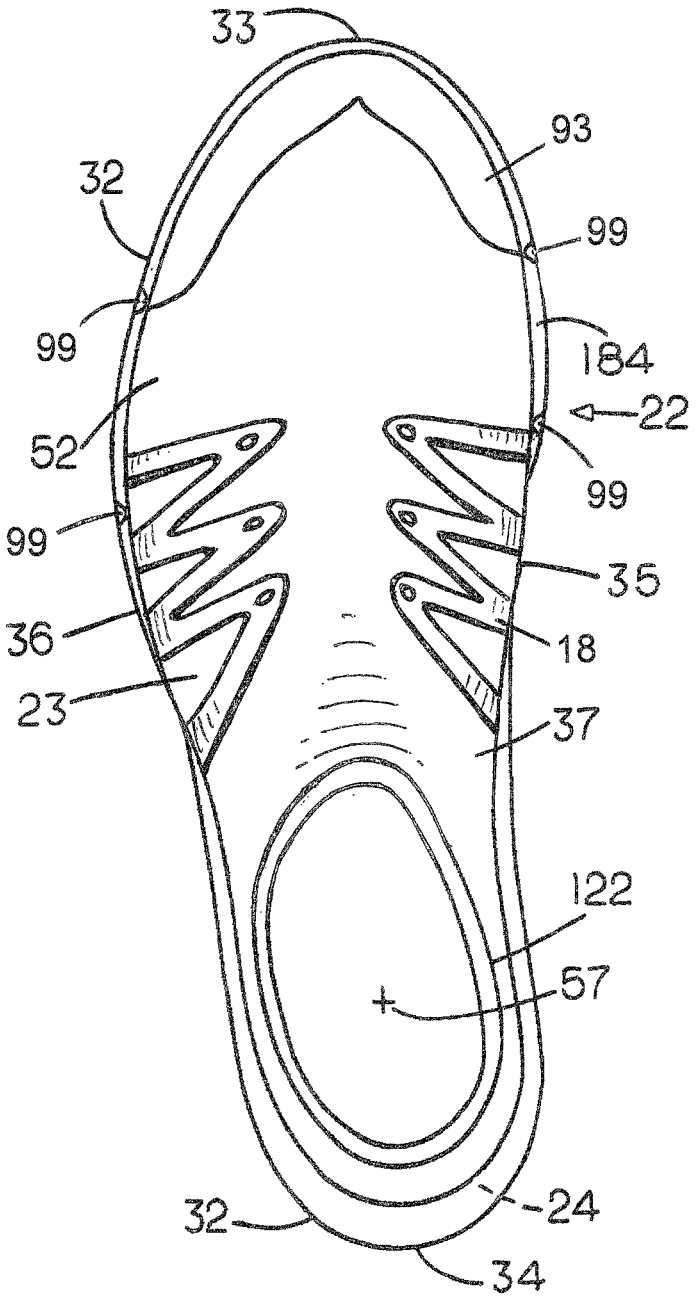
FIG. 110 is a top view of the article of footwear shown in FIG. 109.

FIG. 110 is a top view of the article of footwear 22 shown in FIG. 109.

Figure 111:
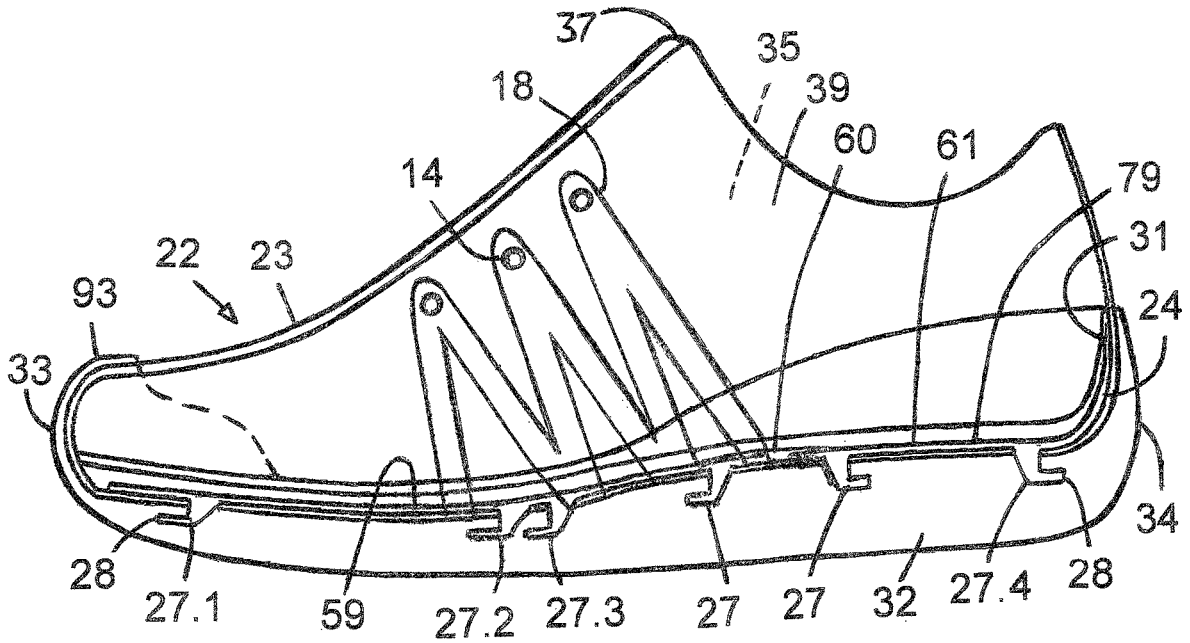
FIG. 111 is a lateral side cross-sectional view showing an article of footwear generally similar to the shoe shown in FIG. 97, but further including a strap including a plurality of V shapes having openings for laces and which is an integral part of the upper.

FIG. 111 is a lateral side cross-sectional view showing an article of footwear 22 generally similar to the one shown in FIG. 97, but further including a strap 18 including a plurality of V shapes having openings 72 which are configured as eyelets 14 for laces 121 which is an integral part of the upper 23. In this regard, the portions of the strap 18 on both the medial side 35 and lateral side 36 can be made part of the pattern for a portion of the upper 23, or alternatively, can be knitted as an integral part of the upper 23, or otherwise be made, formed, or joined to made a unitary component with the upper 23. In FIG. 97, the strap 18 is shown as being transparent in order to better illustrate the structure and functional relationship of the strap 18 with the shoe upper 23, lasting plate 79, and sole 32 of the article of footwear 22.

Figure 112:
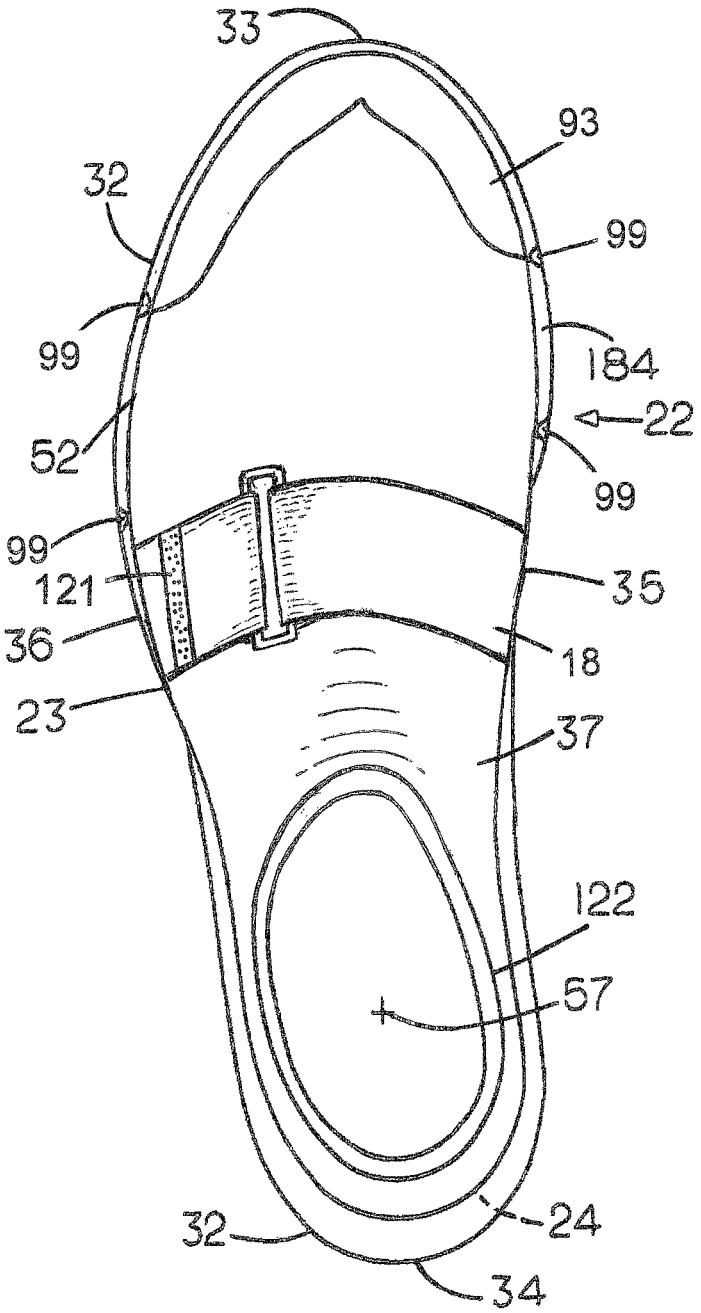
FIG. 112 is a top view of the article of footwear including a strap having a single end removably secured with hook and pile.

FIG. 112 is a top view of the article of footwear 22 generally similar to the one shown in FIG. 111, but including an alternative embodiment of a strap 18 having a single portion removably secured with hook and pile 121.

Figure 113:
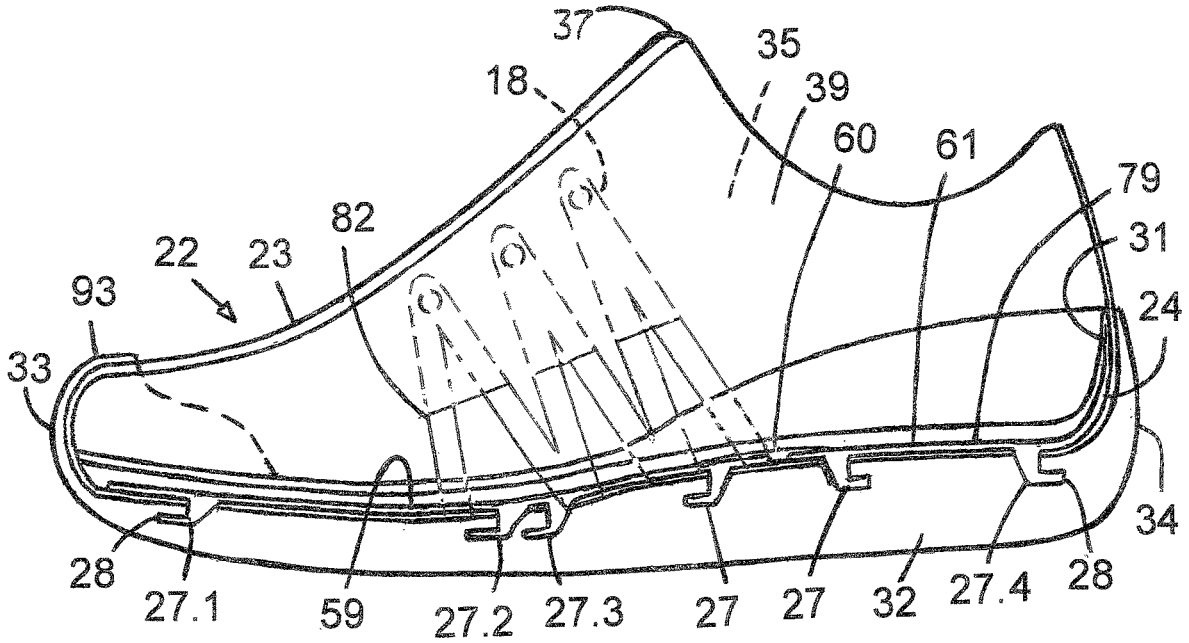
FIG. 113 is a lateral side cross-sectional view showing an article of footwear generally similar to the shoe shown in FIG. 97, but further including a strap including a plurality of V shapes having openings for laces and which can be removably secured on the interior side of the upper.

FIG. 113 is a lateral side cross-sectional view showing an article of footwear 22 generally similar to the one shown in FIG. 97, but further including a strap 18 including a plurality of V shapes having openings 72 which are configured as eyelets 14 for laces, and which can be removably secured on the interior side 39 of the upper 18. The strap 18 can be removably secured to at least two hooks 40 on the bottom side 76 of the lasting plate 79 and a top portion of the strap 18 on the medial side 35 and the lateral side 36 can pass through slits 82 in the upper 23. In FIG. 113, the strap 18 is shown as being transparent in order to better illustrate the structure and functional relationship of the strap 18 with the shoe upper 23, lasting plate 79, and sole 32 of the article of footwear 22.

Figure 114:
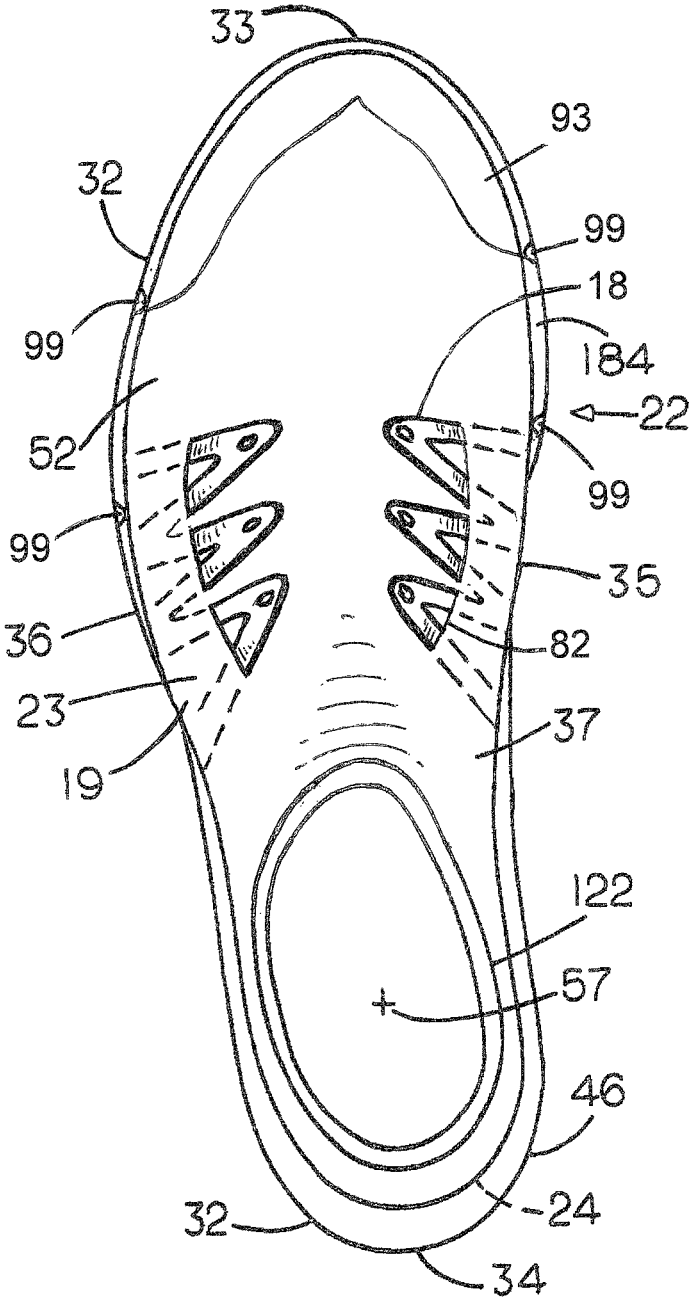
FIG. 114 is a top view of the article of footwear shown in FIG. 113.

FIG. 114 is a top view of the article of footwear 22 shown in FIG. 113.

Figure 115:
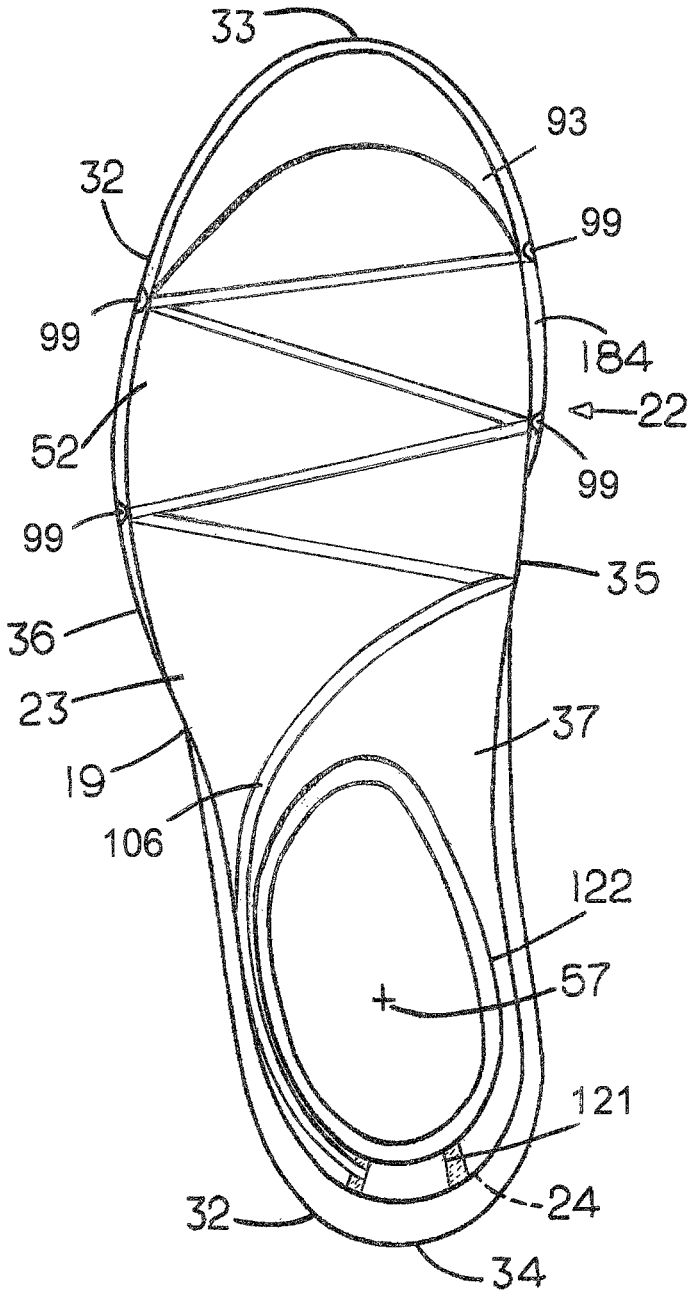
FIG. 115 is a top view of an article of footwear including a draw cord which cross-crosses over the upper in the forefoot area and midfoot area and is secured in the rearfoot area.

FIG. 115 is a top view of an article of footwear 22 including a lasting plate 79, upper 23, and sole 32 which can be removably secured together as disclosed herein, which includes a draw cord 106 which repeatedly crosses over the upper 23 in the forefoot area 58 and midfoot area 67 and is secured in the rearfoot area 68 with hook and pile 121. U.S. Pat. Nos. 9,364,046, 9,565,899, and 10,149,514 by Adams et al. disclose means for closure and closure mechanisms for use in articles of footwear, and all of these patents are hereby incorporated by reference herein.

Figure 116:
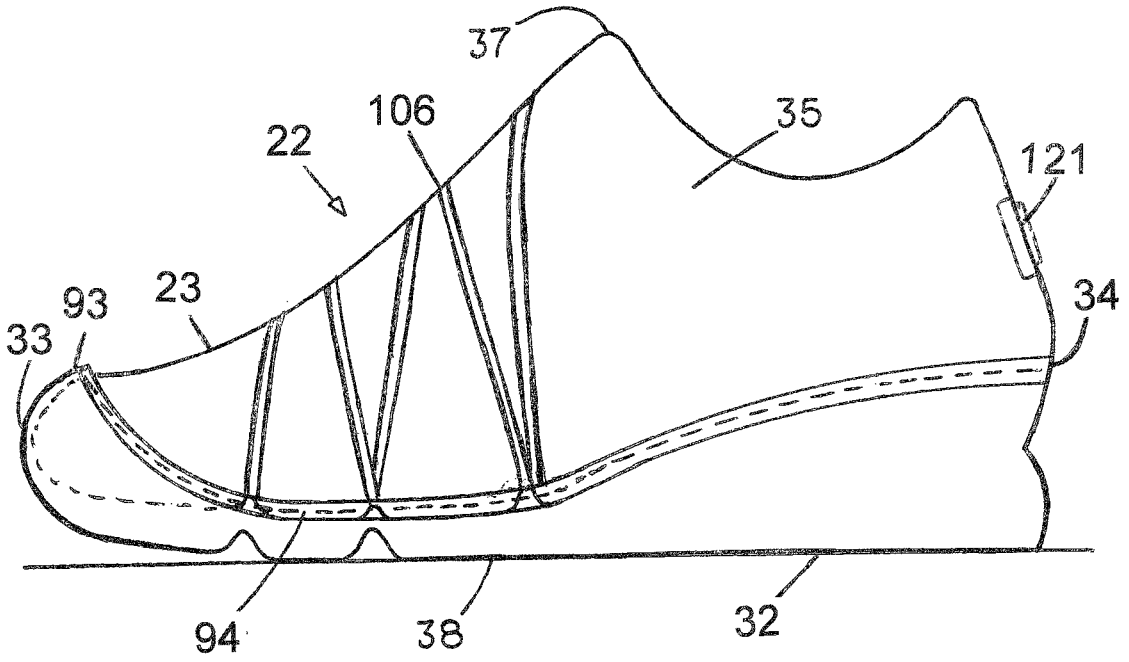
FIG. 116 is a medial side view of the article of footwear shown in FIG. 115.

FIG. 116 is a medial side view of an article of footwear 22 generally similar to the one shown in FIG. 115, but in this embodiment the draw cord 106 repeatedly crosses both over and under the shoe upper 23 in the forefoot area 58 and midfoot area 67 before extending towards the rearfoot area 68 and posterior side 34 of the upper 23 and being secured with hook and pile 121, or other mechanical means.

Figure 117:
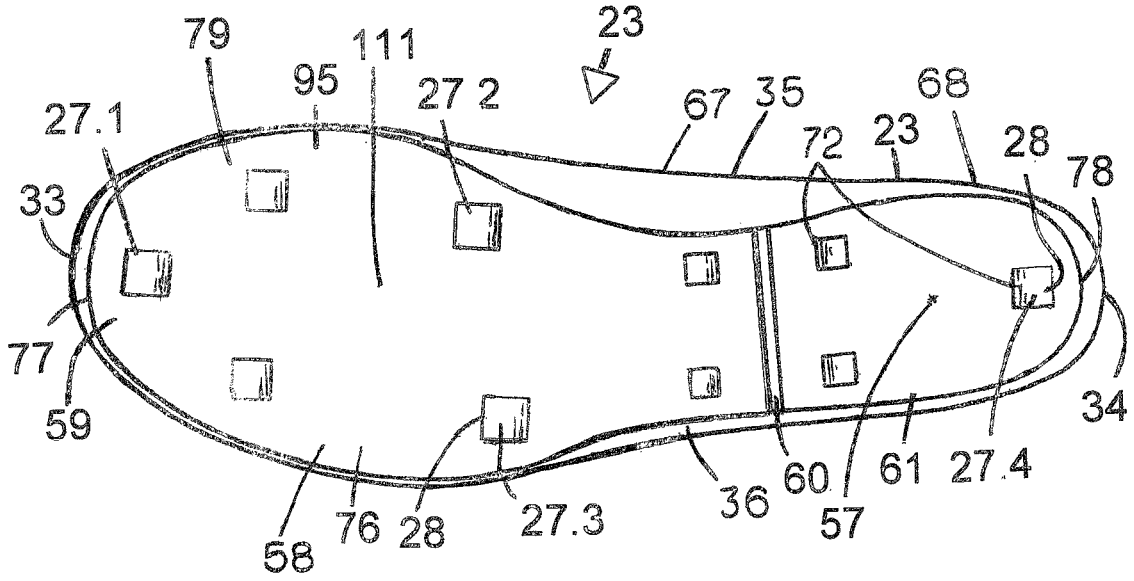
FIG. 117 is a bottom view of an alternative embodiment of a lasting plate which includes three more male hooks that the embodiment shown in FIG. 87, and which is resting upon the inferior side of a shoe upper.

FIG. 117 is a bottom view of a shoe upper 23 and an alternative embodiment of a lasting plate 79 which includes three additional male hooks 27 relative to the embodiment shown in FIG. 87, and is shown resting upon the inferior side 38 of a shoe upper 23. This embodiment of a lasting plate 79 includes a plurality of hooks 27, but they are disposed to substantially avoid the area underlying the weight bearing center of the heel 57, and also of the ball 111 of a wearer's foot 112.

Figure 118:
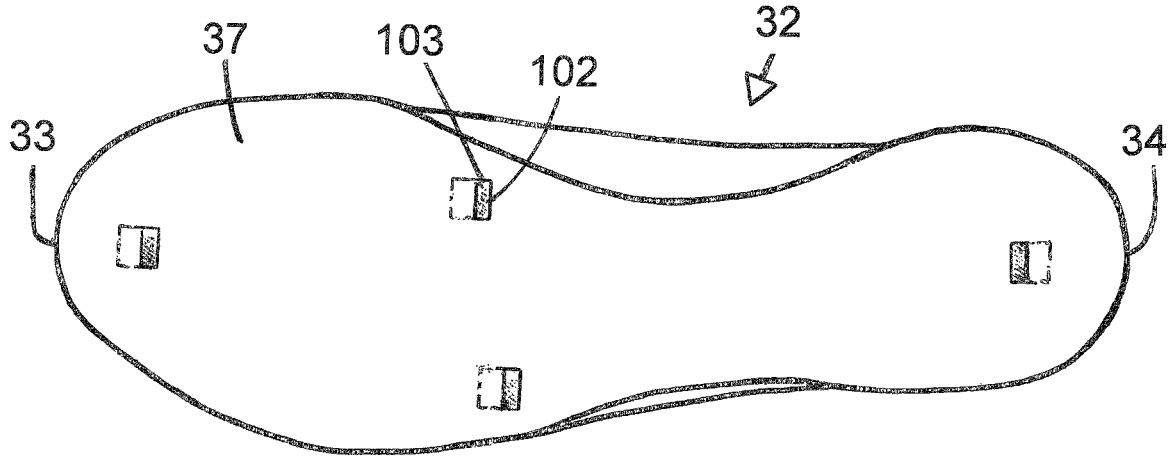
FIG. 118 is a top view of an embodiment of a sole including female receptacles which are configured as mating void spaces in the elastomeric material of the sole 21.

FIG. 118 is a top view of an embodiment of a sole 32 including a plurality of female receptacles 103 which are shown in part by dashed phantom lines and configured as mating void spaces 102 in the elastomeric material of the sole 32.

Figure 119:
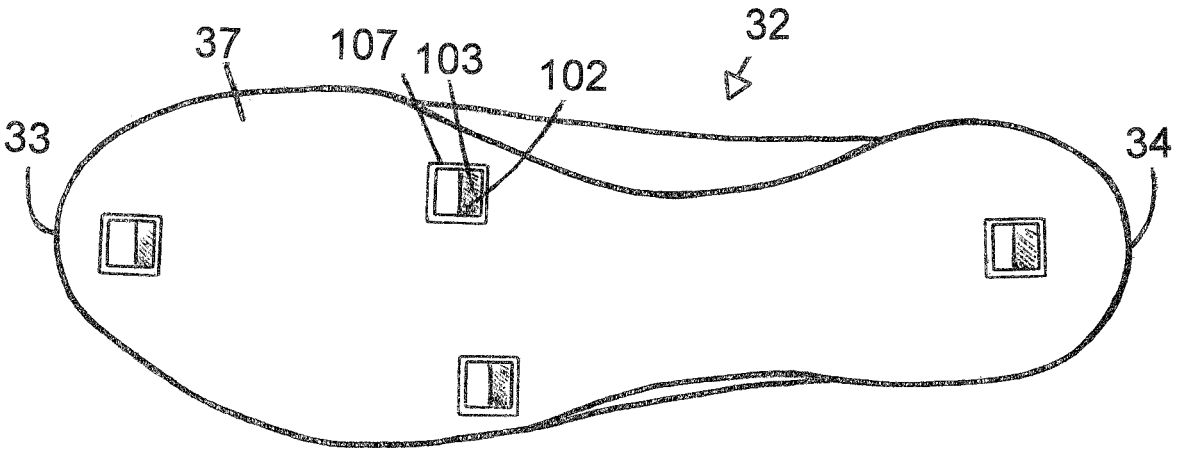
FIG. 119 is a top view of an alternative embodiment of a sole including a plurality of separate plastic or elastomeric female receptacles which are inserted, coupled or bonded in the sole.

FIG. 119 is a top view of an alternative embodiment of a sole 32 including a plurality of female receptacles 103 which are configured as female receptacle inserts 107 which are coupled, bonded, or otherwise secured to the sole 32. For example, the female receptacle inserts 107 can be made of an injected molded thermoplastic and be inserted or co-injected in a mold, and the foam material or other elastomeric material which is used to make most of the sole 32 can also be injected or otherwise placed into the mold which results in the components being chemically bonded, and/or mechanically or adhesively secured together.

Figure 120:
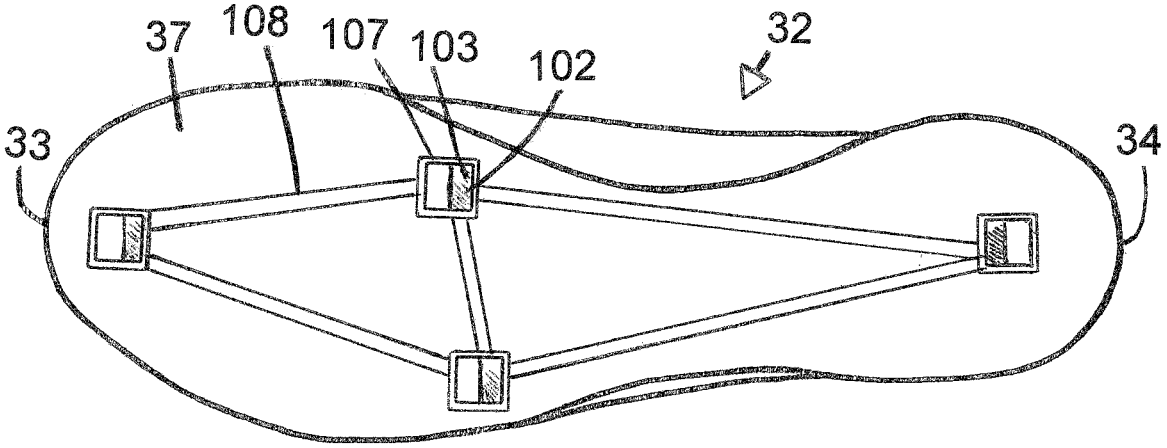

FIG. 120 is a top view of an alternative embodiment of a sole 32 including a plastic or elastomeric sole insert 108 which includes a plurality of female receptacles 103 which are configured as female receptacle inserts 107. The sole insert 108 can maintain the plurality of female receptacle inserts 107 in the correct spatial relationship so that they can be disposed in a mold correctly before the foam material or other elastomer which is used to make part of the sole 32 is injected or otherwise placed in the mold.

Figure 121:
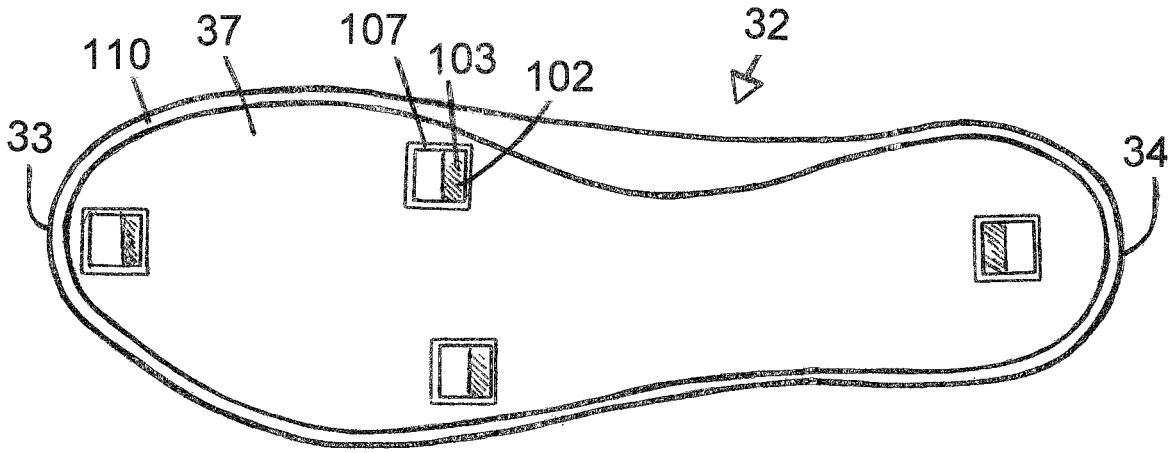

FIG. 121 is a top view of an alternative embodiment of a sole 32 including a frame 109 which extends upwards near, at or proximate to the top edge 110 of the sole 32. The frame 109 can be made of a foam material or other elastomer having a higher density and greater stiffness in compression than a different foam material or elastomer which is used for providing cushioning in the middle portion of the sole 32. Alternatively, the frame 109 can be made at least in part of polyurethane material which can be used to make a fluid-filled bladder, or a thermoplastic material such as nylon, ethylene, or propylene which has a higher density and greater stiffness in compression and/or modulus of elasticity than the foam materials which are used to provide cushioning in those areas of the sole 32 which are configured to support, e.g., the middle of the ball of the foot 111 and weight bearing center of the heel 57 of a wearer's foot 112.

FIG. 122 is a top view of an alternative embodiment of a lasting plate 79 having a flexible middle portion 60 made of a flexible and resilient thermoplastic material which can be flexed or bent with an application of force, and then substantially recover its original configuration when the force causing the flexion or bending is removed. The thermoplastic or other material which is used to make the anterior portion 59 and posterior portion 61 can possibly exhibit less flexibility and have a lower modulus of elasticity relative to the middle portion 60. A lasting plate 79 has a length dimension which can be measured between a single point on its front side 77 and a single point on its back side 78, and also a width dimension which can be measured as between a single point on its inner edge 42 which is disposed on the medial side 35 and a single point on its outer edge 43 which is disposed on the lateral side 36 of a shoe upper 23 when the lasting plate 79 is removably secured thereto. For the purpose of disclosing a range of flexion which can be advantageous to provide with the use of a flexible middle portion 60 of a lasting plate 79, it can be readily understood that a longitudinal line 124 can be drawn between a single point on the front side 77 and a single point on the back side 78 which can be used measure the overall length of the lasting plate 79. The middle portion 60 will then also have a measurable length along this same longitudinal line 124, and the middle point 126 of the length of the middle portion 60 can then also be derived and located. A transverse line 125 can be drawn perpendicular to this longitudinal line 124 at the middle point 126 of the length of the middle portion 60, and when the lasting plate 79 is to evaluated and tested for its exhibited range of flexibility and modulus of elasticity the anterior portion 59 and/or posterior portion 61 can be secured, e.g., in functional relation to an Instron® lab instrument and measuring device, and the transverse line 125 can be so positioned as to provide a transverse axis about which the anterior portion 59 and/or posterior portion 61 can be rotated and placed in flexion relative to one another.

In order to provide a simple illustrative example, a lasting plate 79 for use in a men's size 9 article of footwear made on a footwear last 80 having an overall length of about 283 mm could be made to have a length corresponding to the bottom net of the last 80 which when measured in a linear manner could be around 274 mm which about 10.78 inches in length. The middle point 126 of a flexible middle portion 60 could then possibly be located about 4 inches from the back side 78 of the lasting plate 79, and this point could be used to establish a transverse axis about which the anterior portion 59 and/or posterior portion 61 could be flexed and rotated. In order to make a very simple illustrative model, an individual can take a piece of paper which measures about 11 inches in length, and then draw a line at 4 inches and make a fold straight across the width of the paper at that location in order to create a simulated transverse axis. The top edge of the longer portion of this piece of paper can fixed in place with tape to a desktop, and the rest of the piece of paper can be laid flat, but with its bottom edge then extending over a ruler. The bottom edge of the paper which corresponds to shorter portion can then be moved closer to the fixed top edge which will cause the position of the fold and transverse axis to rise vertically and then simultaneously create various angles of flexion as between the longer portion and shorter portion of the sheet of paper which can then be seen and measured using a protractor. It can then be observed that flexing or bending about 10 degrees can cause the bottom edge of the piece of paper to move about ¼ inch, and that about 20 degrees can cause the bottom edge to move about ½ inch and that about 30 degrees can cause the bottom edge of the paper to move about ¾ inches. Accordingly, it can be readily understood that flexing or bending a lasting plate 79 and then using a more substantial portion of the length of its flexible middle portion 60 to cause the anterior portion 59 and posterior portion 61 to be displaced between 5-35 degrees from their original configuration and orientation can provide sufficient movement to enable a lasting plate 79 including mechanical mating and coupling means, and in particular, a hook 27 which extends downwards from the bottom side 76 of the lasting plate 79, to be inserted through an opening 72 in the inferior side 38 of the shoe upper 23 and into a female receptacle 103 disposed in a sole 32, thereby removably securing the shoe upper 23, lasting plate 79, and sole 32.

In the embodiment of a lasting plate 79 shown in FIG. 122, the flexible middle portion 60 extends for a more substantial portion of the length of the lasting plate 79 as compared to some of the other alternate embodiments, e.g., as shown in FIGS. 79-80. In this embodiment, the flexible middle portion 60 can be made of a thermoplastic material having a lower modulus of elasticity and which exhibits less stiffness when it is being flexed or bent relative to the same or other thermoplastic material which used to make the anterior portion 59 and posterior portion 61. For example, a relatively flexible and resilient thermoplastic elastomer such as Santoprene® could be used to make the flexible middle portion 60, and then a less flexible thermoplastic formulation of Santoprene®, or alternatively, a less flexible formulation of a different thermoplastic material such as nylon, ethylene, or polyethylene can be used to make the anterior portion 59 and posterior portion 61. In this regard, the materials which are used to make the middle portion 60, and also the anterior portion 59 and posterior portion 61 can be co-injection molded, or one or more of these components can be formed or placed in a mold and then over-molded with one or more other materials which are suitable for use in making the lasting plate 79. Alternatively, the thickness of a thermoplastic material or other material which is used to make the lasting plate 79 can be reduced in the middle portion 60, and/or the width of the lasting plate 79 can be reduced in the middle portion 60, thus making the middle portion 60 exhibit less stiffness when being flexed or bent while retaining the ability to substantially recover its original shape when the force causing the flexion or bending is removed. Alternatively, the middle portion 60 of the lasting plate 79 can include a plurality of openings 72 which can serve to reduce its stiffness when being flexed or bent, as shown in FIG. 31. It can be advantageous for a lasting plate 79 to be capable of flexing or bending such that the top surfaces of the anterior portion 59 near the front side 77 and posterior portion 61 near the back side 78 can be displaced at least in the range between 10-30 degrees from their original configuration and orientation, and even in the range between 20-45 degrees when the lasting plate 79 is flexed or bent in response to a force application, and then substantially recover its original configuration. In this regard, the lasting plate 79 when installed in functional relation to the shoe upper 23 and sole 32 does not necessarily have to completely recover to its original configuration, but rather it can sometimes be advantageous that the lasting plate 79 maintain some amount flexion and spring tension when removably securing the shoe upper 23, lasting plate 79 and sole 32 together.

The lasting plate 79 can be inserted into the upper 23 and the male hooks 27 each having a free end 28 which face the front side 77 of the lasting plate 79 which are present on the bottom side 76 of the anterior portion 59 of the lasting plate 79 can be positioned and inserted through registered openings 72 in the inferior side 38 of the upper 23 and into some of the female receptacles 103 which are disposed in the sole 32, and the lasting plate 79 can then be momentarily flexed or bent in the flexible middle portion 60, and the posterior portion 61 including a post 16 and/or at least one male hook 27 having a free end 28 which faces the back side 78 of the lasting plate 79 can then be inserted through at least one corresponding registered opening 72 in the shoe upper 23 and into at least one mating female receptacle 103 in the sole 32. An insole 31 can then be selected and also placed in the interior side 39 of the shoe upper 23. As a result, the shoe upper 23, lasting plate 79, and sole 32 can be quickly and easily removably secured together. Alternatively, a lasting plate 79 can include an integral insole 31 or one which mechanically mates and couples with a lasting plate, e.g., as shown in FIGS. 31, 34 and 35, and so the sub-component parts to be assembled can possibly be reduced to only three in number.

Figure 123:
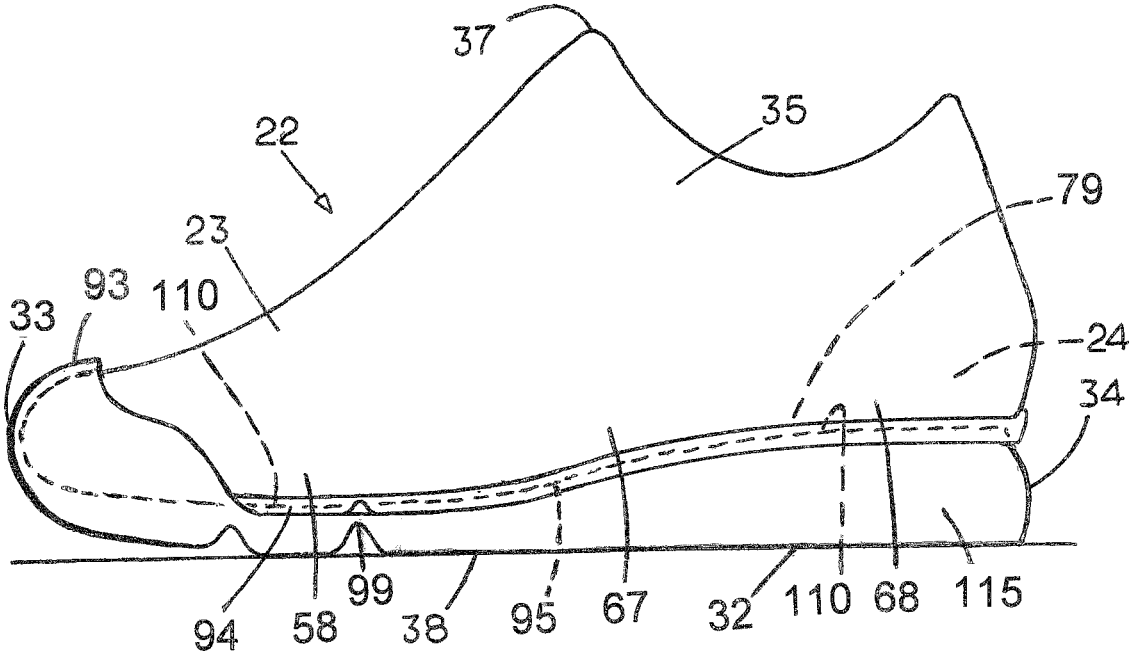

FIG. 123 is a medial side view of an embodiment of an article of footwear having a sole 32 including a fluid-filled bladder 115 disposed about a portion of the medial side 35, lateral side 36, posterior side 34, and a generally transverse flex groove 99 extending from the medial side 35 to the lateral side 36 of the sole 32. The shoe upper 23 includes a mating U or V shaped channel 94 disposed about a portion of the medial side 35, lateral side 36, and back or posterior side 34. An extended top edge 110 and/or a frame 109 disposed near, at, or proximate the top edge 110 of a sole 32 which includes a fluid-filled bladder 115 is coupled with and removably secured in the mating U or V shaped channel 94. As shown in FIG. 123, the sole 32 also includes an integral toe cap 93 having a reverse wingtip configuration, but other alternative toc cap configurations can be used.

Figure 124:
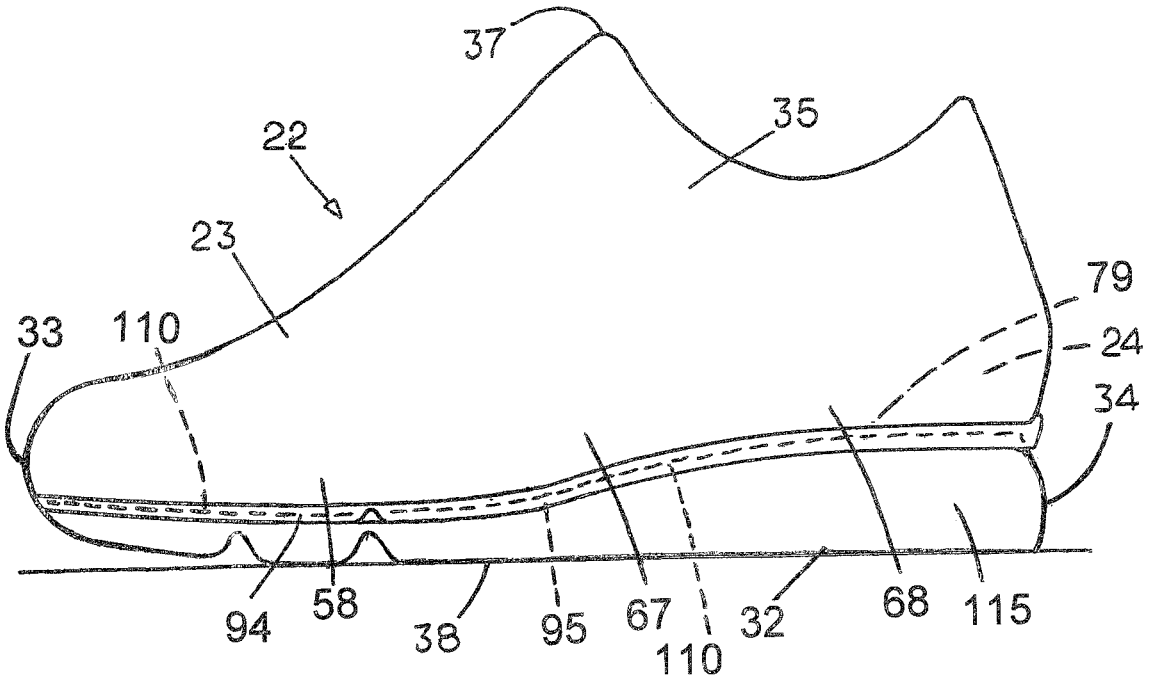

FIG. 124 is a medial side view of an embodiment of an article of footwear 22 having a sole 32 including at least one fluid-filled bladder 115. The fluid can be a gas, or a liquid. The gas can be ambient air, nitrogen or a so-called "super-gas" as disclosed in U.S. Pat. Nos. 4,183,156, and 4,340,626 by Marion F. Rudy, and all of these patents are hereby incorporated by reference herein. The sole 32 can include an extended top edge 110 and/or a frame 109 extending upwards about the front or anterior side 33, medial side 35, lateral side 36 and back or posterior side 34, thus substantially about the entire top edge 110 perimeter of the sole 32, and the top edge 110 and/or frame 109 is inserted, coupled, and removably secured in the mating U or V shaped channel 94 of the shoe upper 23. This will effectively create a seal as between the top edge of the sole 32 and the upper 23 and serve to reduce or prevent foreign matter from becoming lodged between the sole 32 and the upper 23. Further, it can also help to prevent the top edge 110 of the sole 32 from possibly becoming snagged during use of the article of footwear 22. The article of footwear 22 can include a lasting plate 79 generally similar to those shown in the other drawing figures, and so the upper 23, lasting plate 79 and sole 32 can be quickly and easily removably secured in order to make an article of footwear 22 as desired, but also permit its sub-component parts to be customized and later recycled.

Figure 125:
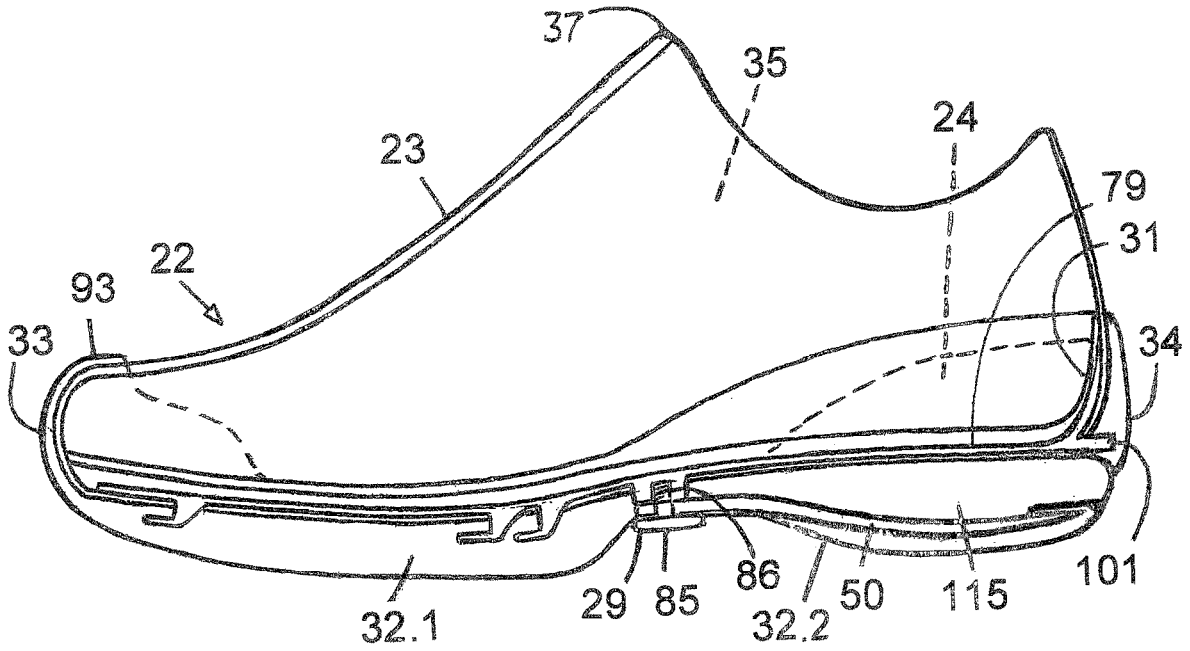

FIG. 125 is a medial side view of an embodiment of an article of footwear 22 including a lasting plate 79 which can be configured to provide a high flexural modulus and spring to dampening ratio of over 90 percent, and be made, e.g., of a carbon fiber composite, or spring grade titanium. The lasting plate and/or superior spring element 79 can include a locking tab 101 near its back side 78 which can be removably secured and extend through a corresponding mating opening 72 disposed near the posterior side 34 of the shoe upper 23. The article of footwear 22 includes a first sole portion 32.1 which includes means for cushioning such as an elastomeric foam material and/or a fluid-filled bladder 115, but also a removeable inferior spring element 50 and a replaceable second sole portion 32.2. The length of the inferior spring element 50 can be in the range between 100-150 mm, and the width can be in the range of 65-85 mm for a men's size 9 article of footwear 22. In particular, the length of the inferior spring element 50 may be in the range between 120-135 mm, and the width may be in the range of 70-80 mm for a men's size 9 article of footwear 22. The inferior spring element 50 may be made of carbon fiber composite materials, carbon nanofiber materials, fiberglass, hemp fiber composite materials, and/or metal materials such as spring grade titanium. In this regard, the inferior spring element 50 can include a top and bottom cover layer of woven carbon fiber material each having a thickness of about 0.23 mm, and also 33 internal layers of unidirectional carbon fiber composite material each having a thickness of about 0.15 mm. Tapering can be introduced in the inferior spring element 50 by shortening the length of about eighteen layers of the unidirectional carbon fiber material at approximately 3-4 mm intervals. Accordingly, the thickness of the inferior spring element 50 can be in the range between approximately 4-5.5 mm at its front side, and in the range between 2-3.5 mm at its back side. In particular, the thickness of the inferior spring element 50 can be in the range between approximately 4.8-5.25 mm at the front side, but then in the range between 2.6-3.25 mm at the back side. This particular example and configuration may be suitable for an individual having a body weight of approximately 160 pounds. In this regard, for an average runner having a body weight of approximately 160 pounds, it can be advantageous that an article of footwear 22 including an insole 31, inferior spring element 50, and sole 32 be capable of providing deflection in the range between 10-20 mm, and that the inferior spring element 50 be capable of providing at least 10 mm of deflection. The inferior spring element 50 can provide a runner or other individual with possible improved cushioning, stability, running economy, and a relatively long service life.

The inferior spring element 50 can be removably secured with the use of a male fastener 29 including a male portion 85 and a female portion 86. The head 65 of the male portion 85 can include a receptacle including an aperture for receiving a screwdriver or other configuration for receiving an alternative tool such as a star drive or Allen wrench. The aperture can also be made wide enough to receive a penny having a thickness of about 1.5 mm; a quarter having a thickness of about 1.76 mm; a nickel having a thickness of about 1.93 mm; or a Euro having a thickness about 2.4 mm. The head 65 of the male portion 85 can have a thickness in the range between 2-2.25 mm and for the sake of robustness it can be advantageous for it to include a tapered and reinforced shoulder where it merges with the shaft. The length of the shaft can be less than or equal to approximately 10 mm, and the width of the shaft can be approximately 5/16 inch or the metric equivalent. The threads can be coated with a material which serves to prevent the male portion 85 of the fastener 29 from becoming loose during use. Accordingly, the length of the threaded opening 72 in the female portion 86 of the fastener 29 can be less than or equal to approximately 10 mm. A product trademark indicia can be included and visible on the head 65 of the male portion 85 of the fastener 29. The male portion 85 and female portion 86 of the fastener 29 can be made of a non-ferrous metal such as titanium for the sake of preventing rust, and avoiding the possibly of tripping airport or other security devices.

The fluid-filled bladder 115 is located in the sole 32.1 between the inferior spring element 50 and shoe upper 23. The fluid-filled bladder 115 can be permanently secured to the sole 32.1, or alternatively be selectively removable and replaceable. The fluid-filled bladder 115 can be made of a blow molded thermoplastic polyurethane material and have a thickness in the range between 10-30 mils. The sole portion 32.2 which is disposed on the inferior spring element 50 can be 5-6 mm in thickness, and it can be alternatively configured to also include a relatively thin plastic backing 30 having a thickness which can be between 0.75-1.5 mm. The backing 30 can extend to the front side of the inferior spring element 50 and also include a registered opening 72 and so can then be removably secured along with the inferior spring element 50 to the lasting plate/superior spring element 79 with a fastener 29. As shown in FIG. 125, the backing 30 and/or sole 32.2 can be configured to extend over the bottom side and at least a portion of the top side of the inferior spring element 50.

Figure 126:
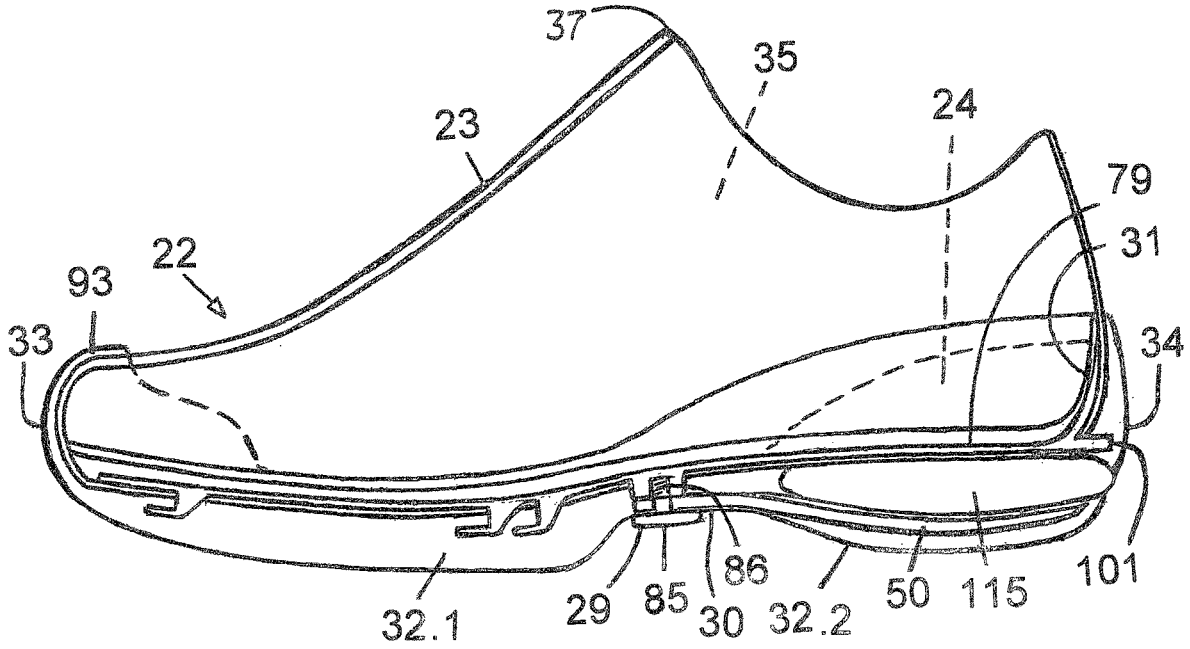

FIG. 126 is a medial side view of an embodiment of an article of footwear 22 including a first sole portion 32.1, and an inferior spring element 50 including a removable and replaceable fluid-filled bladder 115 and second sole 32.2 portion. The fluid-filled bladder 115 is disposed between the inferior spring element 50 and the upper 23. The bladder 115 can be secured to the inferior spring element 50 and/or sole 32.2 by chemical bonding and/or being at least partially encapsulated, or being mechanically mated and coupled thereto. For example, the bladder 115 and/or sole 32.2 can slip over the back side of the inferior spring element 50 and include a registered opening 72 for being removably secured with a fastener 29 including a male portion 85 and female portion 86.

Figure 127:
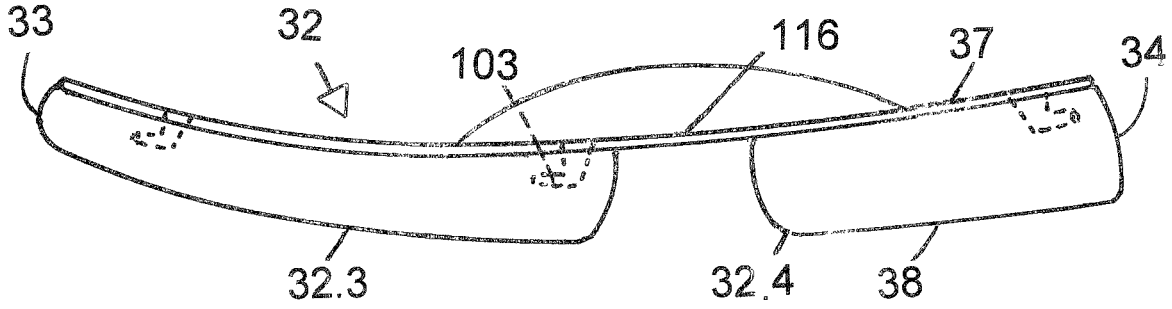

FIG. 127 is a medial side view of an alternate embodiment of a sole 32 including and anterior sole portion 32.3 and a posterior sole portion 32.4 which can be secured by chemical bonding, mechanical means, or adhesives on their top sides and associated surfaces to a bridging arch plate 116. Also shown in phantom lines are a plurality of female receptacles 103 for receiving and mechanically coupling with a plurality of hooks 27 which extend from the bottom side 76 of a lasting plate 79.

Figure 128:
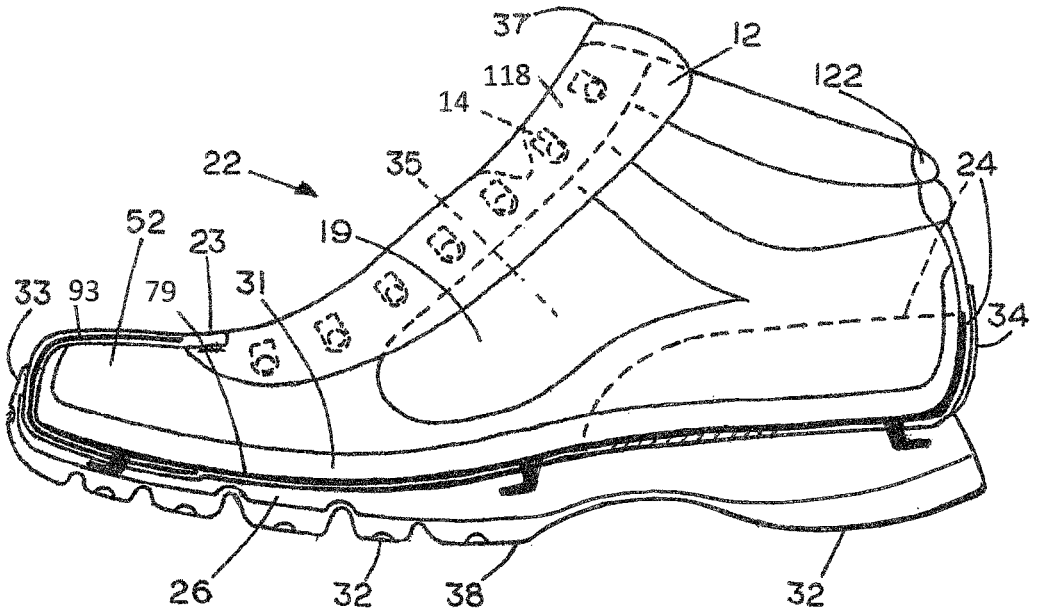

FIG. 128 is a lateral side partial cross-sectional view of an article of footwear 22 which is a boot 118 including an upper 23, a lasting plate 79 which is illustrated and highlighted in solid black for contrast which includes an integral toe cap 93 for protecting the toes of a wearer, and sole 32.

Figure 129:
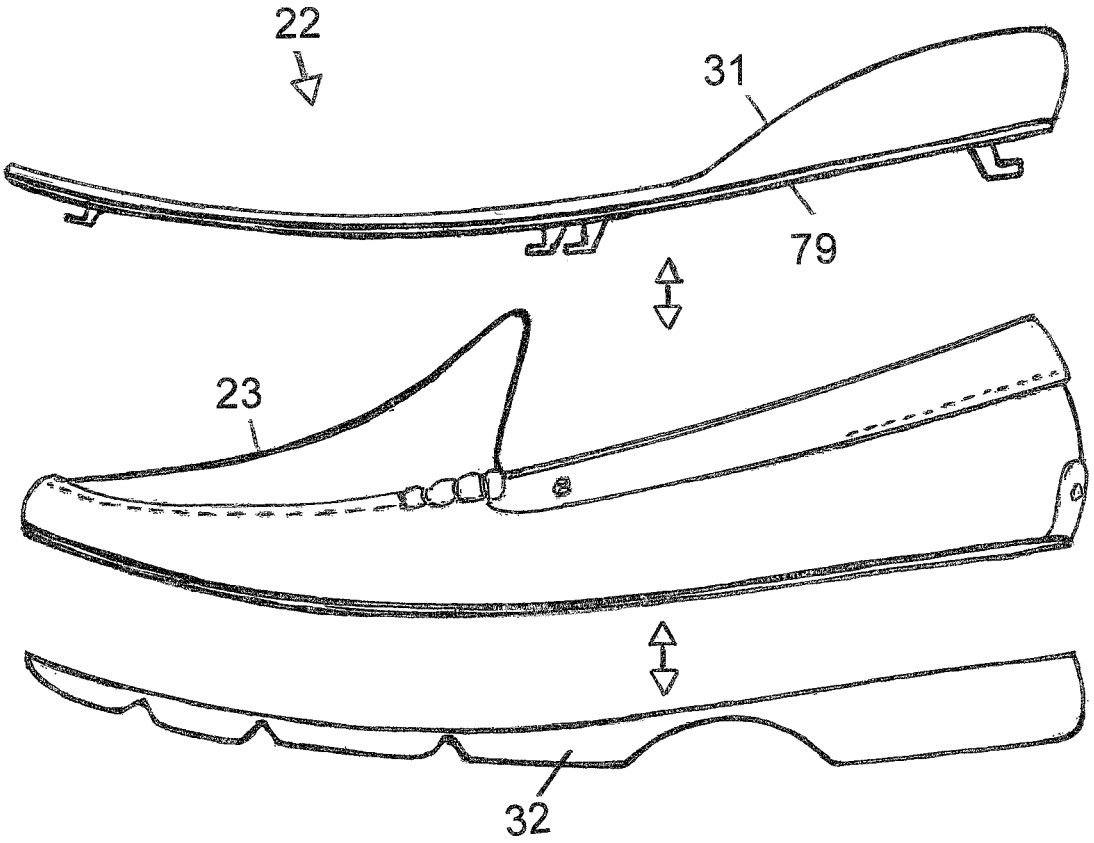

FIG. 129 is an exploded lateral side view of an embodiment of an article of footwear 22 including an upper 23, a lasting plate 79, an insole 31, and a sole 32.

FIG. 130 is a lateral side view of two embodiments of casual articles of footwear 22 each including an upper 23, a lasting plate 79, and a sole 32. In this regard, the two embodiments have uppers 23 and soles 32 having different configurations, but can be assembled using lasting plates 79 having the same configuration. Alternatively, a plurality of the lasting plates 79 can be made in different configurations for selection and use by wearers having high, low, or medium arches for use in the same size article of footwear 22.

FIG. 131 is a top view of a lasting plate 79 including an anterior portion 59, a flexible middle portion 60, a posterior portion 61, and including a plurality of hooks 27.1, 27.1, 27.3, 27.4, 27.5, 27.6, and 27.8. The five hooks 27.1, 27.2, 27.3, 27.5, and 27.6 in the anterior portion 59 have free ends 28 which face the front side 77 of the lasting plate 79, whereas the three hooks 27.4, 27.7, and 27.8 in the posterior portion 61 have free ends 28 which face the back side 78 of the lasting plate 79. Shown with dashed lines is the location of the flexible middle portion 60. Also shown is a circular recess 84 including an opening 72 for receiving a fastener 29 which can be a push-fastener 202 similar to the one shown in drawing FIGS. 157 and 158.

Once again, the lasting plate 79 has a plurality of hooks 27.1-8 on the bottom side 76 and can be inserted into a shoe upper 23 which includes a plurality of registered slits 82 on its bottom or inferior side 38 as shown, e.g., in drawing FIG. 156. The plurality of five hooks 27.1, 27.2, 27.3, 27.5, and 27.6 which have free ends 28 which face the front side 77 of the lasting plate 79 can then be inserted through the corresponding slits 82 in the bottom or inferior side 38 of the upper 23. The shoe upper 23 can then be removably connected to the sole 32 when hooks 27.1, 27.2, 27.3, 27.5, and 27.6 are inserted into the corresponding registered openings 72 associated with the female receptacles 103 which each include a void space 102 in the sole 32, as shown, e.g. in drawing FIG. 138. This will attach the forefoot area 58 and front half of the shoe upper 23 to the sole 32. The lasting plate 79 can include a flexible middle portion 60 which provides a living hinge so that an individual can put their index finger beneath it in the area typically corresponding to the arch of a wearer's foot and cause the lasting plate 79 to bend upwards in the middle portion 60 enough so that the hooks 27.4, 27.7, and 27.8 in the posterior portion 61 can be withdrawn and moved forward enough to clear and then be inserted with the use of downwards guiding pressure of an individual's thumb and index finger into the corresponding registered openings 72 and female receptacles 103 which each include a void space 202 which are located in the rearfoot area 68 of the sole 32. During this process, the presence of a recess 84 disposed on the top or superior side 37 of the sole 32 which is located proximate the openings 73 associated with the female receptacles 103 can facilitate the hooks 27 being more easily inserted therein. Once the lasting plate 79 is in place, when an individual releases their hold the lasting plate 79 can spring back to shape and substantially conform to the top or superior side 37 surface of the sole 32. Moreover, when a wearer inserts their foot into the assembled shoe 22 and is weight bearing the shoe upper 23, lasting plate 79, and sole 32 footwear components cannot be readily taken apart. Accordingly, the described structure and method of making a shoe provides a very fast and easy way to assemble a custom article of footwear in a few seconds, and it is also easy to renew the footwear components and/or recycle the article of footwear. Again, the lasting plate 79 and shoe upper 23 can also be further secured to the sole 32 in the middle portion 60 with the use of a removable fastener 29. In this regard, the lasting plate 79 can include circular recess 84 including an opening 72 for receiving a fastener 29 which can be a push-fastener 202 similar to the one shown in drawing FIGS. 157 and 158.

In an alternative embodiment, it would be possible to bond, fuse, cement or otherwise secure a lasting plate 79 to the bottom or inferior side 38 of a shoe upper 32, and to then manipulate the lasting plate 79 and shoe upper 32 to removably secure them to a sole 32. However, this structure and method is not so conducive to facilitating the renewal and recycling of footwear components and an article of footwear. In another alternative embodiment, it would be possible to bond, fuse, cement or otherwise secure a lasting plate 79 inside of the upper 32 above the bottom or inferior side 38 of a shoe upper 32, and to then manipulate the lasting plate 79 and shoe upper 32 to removably secure them to a sole 32. However, this structure and method is not so conducive to facilitating the renewal and recycling of footwear components and an article of footwear.

The typical method of making and assembling conventional articles of footwear often involves cleaning the bottom or inferior side of and shoe upper, and also the top or superior side of a sole with a chemical such as methyl ethyl ketone, then sometimes roughing the surfaces to be joined with a buffing wheel, then applying a primer to both surfaces to be joined and letting it dry, and then applying a heat activated and/or contact cement to one or both surfaces to be joined and letting the parts set for a specific period of time, and then briefly heating the cement on the upper and sole components and placing them together with the application of a pressure in a press. From start to finish this process commonly takes at least 6-8 hours, and also involves the use and release of volatile chemicals into the atmosphere. Accordingly, it can be readily understood that conventional footwear structures and methods of making the conventional footwear include many more steps in production and consume more resources, and also require more labor than the structure and method of making an article of footwear disclosed herein.

FIG. 132 is a bottom view of the lasting plate 79 shown in FIG. 131. The flexible middle portion 60 can have less thickness and/or be made of a more flexible material than is used to make the anterior portion 59 and posterior portion 61. Also shown with dashed lines is a circular recess 84 and an opening 72 for receiving a fastener 29 such as a push-fastener 202 similar to the one shown in drawing FIGS. 157 and 158.

FIG. 133 is a side view of the lasting plate 79 shown in FIGS. 131 and 132. In this embodiment, it can be seen that the flexible middle portion 60 has a thinner vertical profile than the anterior portion 59 and posterior portion 61. The recess 84 in the lasting plate 79 for accommodating a fastener 29 such as a push-fastener 202 similar to the one shown in drawing FIGS. 157 and 158 is also shown.

FIG. 134 is a perspective view of the lasting plate 79 shown in FIGS. 131, 132, and 133. As shown, the hooks 27.1-8 extend below the bottom side 76 of the lasting plate 79 and a plurality of openings 72 are present on the top side 75 of the lasting plate 79. The recess 84 in the lasting plate 79 for accommodating a fastener 29 such as a push-fastener 202 similar to the one shown in drawing FIGS. 157 and 158 is also shown.

FIG. 135 is a top view of an insole 31 for use with the lasting plate 79 shown in drawing FIGS. 131, 132, 133, and 134.

FIG. 136 is a bottom view of the insole 31 shown in FIG. 135 which includes a plurality of protrusions 11 which extend below the inferior side 38 of the insole 31 and which register and can be mechanically coupled with the plurality of openings 72 which are present on the top side 75 of the lasting plate 79.

FIG. 137 is a side view of the insole 31 shown in FIGS. 135 and 136 disposed on the lasting plate 79 shown in FIG. 131, showing the projections 11 mechanically coupled with the openings 72 in the lasting plate 79.

FIG. 138 is a top view of a sole 32 including an elevated top edge 110, a sidewall 184, and a plurality of female receptacles 103 each including a recess 84 disposed proximate to an opening 72 and a void space 102. The inclusion of a shallow recess 84 can facilitate the hooks 27.1-8 of the lasting plate 79 being inserted into the female receptacles 103. Also shown in a recess 84 in the sole and a void space or opening 72 for receiving a fastener 29 such as a push-fastener 202 like the one shown in drawing FIGS. 157 and 158.

FIG. 139 is a top view of a sole 32 generally similar to the one shown in FIG. 138, but instead including a pressure sensitive adhesive 198 disposed on the top or superior side 37 of the sole 32 in the midfoot area 67.

With regards to the subject of adhesion, the surface contact angles exhibited on various typical footwear components can be in the range of approximately 30-90 degrees. In this regard, see the surface contact angle measurements and tables provided in U.S. Pat. No. 5,832,636 by Robert Lyden and Souheng Wu, this patent hereby being incorporated by reference herein. Materials which have a water contact angle equal to or greater than 92 degrees are considered to be hydrophobic.

Self-adhesive tapes or rolls which can include a removable peel-ply backing can be used to partially join and help to connect a shoe upper 23 with a sole 32, as shown in drawing FIGS. 139, 142, 143, and this is also be possible with regards to the configurations shown drawing FIGS. 140 and 144. Further, self-adhesive tapes or rolls which can include a removable peel-ply backing can be used to substantially and/or completely join a shoe upper 23 with a sole 32 as shown in drawing FIGS. 150, 151, 152, 153, and 159.

In this regard, the sole 32 can be formed with a substantially smooth surface 199 by using a plastic, urethane, thermoplastic elastomer, or rubber material having an open cell or a closed cell foam structure which has a smooth skin and/or smooth surface 199. Further, a sole 32 made of one or more of these materials can also further include a thin plastic film material which is adhered, bonded, fused, or otherwise joined to the top or superior side of the sole 32 to form a substantially smooth surface 199. For example, plastic film materials can be made of polyurethane, polyester, polyamine, polyethylene, polypropylene, as well as other plastic materials. The bottom or inferior side 38 of the shoe upper 23 can also include a substantially smooth surface 199 which can be made of a natural or synthetic fabric or textile, a natural of synthetic leather, a plastic, a polyurethane, a thermoplastic elastomer, a rubber material, and/or a thin plastic film material which is stitched, adhered, bonded, fused or otherwise joined to the bottom or inferior side 38 of the shoe upper 23. The substantially smooth surface 199 provided on the bottom or inferior side 38 of the shoe upper 23 can be made of the same material, or a different material than is used to make the substantially smooth surface 199 on the top or superior side 37 of the sole 32.

As discussed in U.S. Pat. No. 5,832,636 by Robert Lyden and Souheng Wu, the presence of some surface roughness on the surfaces to be joined can sometimes possibly improve the strength of an adhesive bond. For example, the presence of some surface roughness on the surfaces to be joined can potentially increase the surface area with which an adhesive or cement can make contact when forming a bond. However, the problem with many of the typical shoe uppers being made today is that the materials used on the bottom or inferior side of the upper and also on the top or superior side of the sole are too dissimilar with regards to their surface roughness, chemical composition, and surface energies to be effectively joined using a self-adhesive tape material. However, when the materials to be joined have a generally similar and not great surface roughness, and are made of chemical compositions which are the same, or similar, or at least compatible from the standpoint of being able to be joined or bonded together with the use of a self-adhesive tape which has one or alternatively possibly two different adhesives on opposite sides which are formulated to join those materials, and when the bottom of the shoe upper and the top of the sole also have surface energies which are not extremely low, then a self-adhesive tape material can be used to effectively join a shoe upper 23 and sole 32. For example, a polyurethane foam material can be used to make at least a portion of a sole 32, and if desired, a polyurethane film can also be bonded or otherwise included on the top or superior side 37 of the sole 32 to create a substantially smooth surface 199 having good potential adhesive qualities. Further, the shoe upper 23 can have a bottom or inferior side 38 can be made, e.g., of a natural fiber such as cotton, hemp, or wool, leather, a synthetic fiber or textile made of polyurethane, polyester, polyamide, or other plastic material, a polyurethane or plastic film, a thermoplastic elastomer, or a rubber material which does not have extreme surface roughness, but which does have a moderate or high surface energy as opposed to extremely low surface energy.

In this regard, the irregularity or surface roughness of the surfaces which are present on the bottom or inferior side 38 of the shoe upper 23 and also on the top or superior side 37 of the sole 32 to be joined are typically such as to not exceed a range of variation which is in the range between the smoothness of the surface of typical window glass, and a surface having peaks and valleys and/or other irregularities which do not typically exceed variations in height or depth greater than 1.75 mm which is 0.06889764 inches. In this disclosure, surfaces falling within this range have been defined and will be henceforth be referred to as being substantially smooth. In order to joint surfaces which would be more irregular and have greater surface roughness than 1.75 mm the thickness of the self-adhesive tape or other adhesive which is being used would then need to flow and fill the air gaps between the surfaces to be joined otherwise the adhesive bond can be compromised. This can potentially compromise aesthetics, add to expense, and introduce other variables which can potentially lead to the degradation of an adhesive bond. For this reason, it can be advantageous to use materials having a surface roughness characterized by typical variations in height or depth that are equal to or less than 0.062 inches which is 1.5748 mm. In this regard, 0.045 inches is 1.143 mm, 0.025 inches is 0.635 mm, 0.019685 inches is 0.5 mm, and 0.00984252 inches is 0.25 mm. Accordingly, certain weft or warp knitted textiles, natural leather, or synthetic leather materials having typical surface variations equal to or less than 1.75 mm, and can be used. Many thin film materials made of plastic material which have smaller typical surface variations and less surface roughness can be used.

When measuring and evaluating the surface roughness of metal and other relatively hard materials the parameters known as Ra and Rz are sometimes used. However, a textile surface tester can be used to evaluate the surface roughness of textile materials and some plastic films using the Standard ISO 4287 (1997). For example, see the paper entitled "Surface Roughness Evaluation of Weft Knitted Fabric by Using a Textile Surface Tester" by Najeh Maatoung, Mehdi Sahnoun and Faouzi Sakli of the Textile Research Unit of ISET Ksar Hellal, Tunisia published in the journal RJTA Vol. 15 No. 42021, and online at https://www.researchgate.net.

The 3M company of Maplewood, Minnesota makes several adhesive tape materials which can be used to join a shoe upper to a sole, and also provides a selection guide for joining different materials. Given the disclosure provided herein, the 3M VHB family of tape products can be used to join a shoe upper and sole, and in particular, LSE-060 0.025 inches thick and 1 inch wide roll, Part Number LSE-060WF, 3M ID 70007542668; LSE-110 0.045 inches thick and 1 inch wide roll, Part Number LSE-110WF, 3M ID 70007542544; LSE-160 0.062 inches thick and 1 inch wide roll, Part Number LSE-160WF, 3M ID 70007542676. These products can also be made available for use in different custom widths and roll lengths. Further, the 3M 4945 FAMILY including 4946 in 1 inch wide roll 3M ID 70006178118; 4945 in 1 inch wide roll 3M ID 70006067733 and also 2 inch wide roll 3M ID 70006074838 can be used to join a shoe upper to a sole. In addition, the 3M product 9775WL Adhesive Transfer Tape which is available in different widths, e.g., 12 inches wide roll 3M ID 70006657244; and also custom widths 3M ID 70000211097 can be used to join a shoe upper to a sole. Moreover, 3M product 9832 Double Coated Tape in 2 inch wide roll 3M ID 70006415411, and one inch wide roll 3M ID 70006415403 can be used to join a shoe upper to a sole. Some of these 3M products are specifically engineered to adhere well to fabric and textile materials, and/or foam materials, and/or rubber materials, and/or plastics. The selection of a 3M self-adhesive tape product for use can be made on the partial basis of the materials which are selected and being used on the bottom or inferior side 38 of the upper and on the top or superior side 37 of the sole 32. In general, a thinner self-adhesive tape can be used to join surfaces having less surface roughness, whereas a thicker self-adhesive tape can be used to join surfaces having greater irregularities and surface roughness. The material selection process and results can be simplified and enhanced by selecting like materials to be joined which both have a typical surface roughness in the aforementioned range, and which are also not characterized as having extremely low or low surface energies something which can be determined by measuring water contact angles, but rather materials which are characterized by having moderate or high surface energies. In this disclosure, a material which has a water contact angle equal to or greater than 92 degrees is defined as having an extremely low surface energy, a material having a low surface energy is defined as a material which exhibits a water contact angle between 80-92 degrees, a material having a moderate surface energy is defined as a material which exhibits a water contact angle between 70-80 degrees, and a material having a high surface energy is defined as a material which exhibits a water contact angle between 30-70 degrees. In order to provide good adhesion, the materials used on the substantially smooth surfaces 199 on the inferior side 38 of a shoe upper 23 and also on the superior side 37 of a sole 32 which are to be joined using pressure sensitive double-sided adhesive tape 198 typically have water contact angles in the range at least between 30-80 degrees and are then characterized as having moderate and/or high surface energies, or water contact angles between 30-70 degrees and high surface energies as defined in this disclosure.

When using a double-sided adhesive tape the type of adhesive used of the top side of the adhesive tape and also its thickness and flowability needs to be compatible and effective with the material and surface which is being used on the bottom or inferior side 38 of a shoe upper 23, and the type of adhesive used on the bottom side of the adhesive tape and also its thickness and flowability needs to be compatible with the material and surface which is being used on the top or superior side 37 of the sole 32. In this regard, it is possible to make a double-sided adhesive tape which has the same type of adhesive and thickness on both of its top and bottom sides. Alternatively, it is possible to make a double-sided adhesive tape which has one type of adhesive and/or thickness on its top side, but a different type or formulation of adhesive and/or thickness on its bottom side for bonding two materials which are dissimilar in composition and/or have different typical surface roughness.

FIG. 140 is a side x-ray and/or parts broken away view of an article of footwear 22 including the lasting plate 79 generally similar to the one shown in FIGS. 131, 132, 133, 134 with hooks 27.1-8 being mechanically coupled with a plurality of female receptacles 103 of a sole 32 which is generally similar to the ones shown in FIGS. 138 and 139. In this regard, the sole 32 in this embodiment extend upwards and around the shoe upper 23 on one or more sides.

FIG. 141 is a top view of an alternative sole 32 including a plurality of female receptacles 103. Unlike the sole 32 shown in drawing FIG. 138, this sole 32 does not include an elevated top edge 110 about its perimeter.

FIG. 142 is a top view of a sole 32 generally similar to the one shown in FIG. 141, but which instead includes a double-side pressure sensitive adhesive tape 198 disposed in the midfoot area 67.

FIG. 143 is a top view of a sole 32 generally similar to the one shown in FIG. 142 including a double-sided pressure sensitive adhesive tape 198 disposed in the midfoot area 67 and also about the perimeter of the sole 32.

FIG. 144 is a side x-ray and/or parts broken away view of an article of footwear 22 including a lasting plate 79 generally similar to the one shown in FIGS. 131, 132, 133, 134, and a sole 32 generally similar to the one shown in FIGS. 141 and 142 which does not include an elevated top edge 110 about its perimeter like the sole 32 used on the article of footwear shown in FIG. 140.

FIG. 145 is a top view of an alternative lasting plate 79 including an anterior portion 59, a flexible middle portion 60 including a plurality of recesses 84 and openings 72, a posterior portion 61, and a plurality of hooks 27.1*m*, 27.1*n*, 27.2-8. As shown, the lasting plate 79 includes two hooks 27.1*m* and 27.*n* near the front side 77 instead of one hook 27.1, as shown in previously shown embodiments of a lasting plate 79. Further, the lasting plate 79 includes a plurality of openings 72 in the flexible middle portion 60 which can enhance its flexibility, and also provide for the insertion of one or more fasteners 29 such as the push-fastener 202 shown in drawing FIGS. 157-158 for helping to removably secure the lasting plate 79 and shoe upper 23 to the sole 32. In this regard, a single fastener 29 such as push-fastener 202 can be used in the middle opening 72 and/or a plurality of fasteners can be used to removably secure the midfoot area 67 of the shoe upper 23 to the lasting plate 79 and sole 32.

FIG. 146 is a top view of a sole 32 including a plurality of female receptacles 103 and a plurality of openings 72 in the midfoot area 67 for receiving and mechanically coupling with the lasting plate 79 shown in drawing FIG. 145.

FIG. 147 is a bottom view of an alternative shoe upper 23 including a bottom or inferior side 38 including a substantially smooth surface 199. The substantially smooth surface 199 can be made of a fabric or textile material, a natural or synthetic leather, a plastic, a rubber, or a thermoplastic elastomer. In this regard, a substantially smooth surface 199 can be made of a thin polyurethane film, or alternatively, a polyester, polyamine, styrene, polyethylene, polypropylene, or other plastic material, but plastic materials having extremely low surface energies are typically contra-indicated for use. The inclusion of a substantially smooth surface 199 on the inferior side 38 of the upper 23 can facilitate the use of a double-sided self-adhesive tape 198 to couple the shoe upper 23 with a sole 32, as previously discussed above in connection with drawing FIG. 139.

FIG. 148 is a bottom view of an alternative shoe upper 32 including a bottom or inferior side 38 including a T-shock 56 including a substantially smooth surface 199. In this regard, the superior side 37 of the shoe upper 23 is connected to the t-sock 56 near the bottom net and/or lasting margin 95 of the shoe upper 23 with the use of stitching, or being fused, or adhesives, or by being integrally formed as is possible with modern 2D and 3D knitting machines. The use of a substantially smooth surface 199 on the inferior side 38 of the upper 23 can facilitate the use of a self-adhesive material 198 to couple the shoe upper 23 with a sole 32. In this regard, the possible materials which can be used have been discussed in connection with the embodiment shown in drawing FIG. 147.

FIG. 149 is a top view of an alternative sole 32 including a pressure sensitive double-sided adhesive tape 198 disposed on the top or superior side 37 of the sole 32. In this regard, the sole 32 can be formed with a substantially smooth surface 199 in the form of an elastomeric skin and/or further include a thin plastic film material which is bonded or otherwise connected to the natural of synthetic leather, foam, rubber, plastic, or thermoplastic elastomer material which is used to make the sole 32. Once again, the substantially smooth surface 199 can be made of a thin polyurethane film, or alternatively, a polyester, polyamine, styrene, or other plastic film or coating material.

FIG. 150 is a side x-ray and/or parts broken away view of an article of footwear 22 including a shoe upper 23 generally similar to the ones shown in drawing FIGS. 147 and 148 coupled to a sole 32 which is generally similar to the one shown in FIG. 149. The shoe upper 23 and sole 32 are joined with a pressure sensitive double-sided adhesive tape 199.

FIG. 151 is a top view of an alternative sole 32 including a pressure sensitive double-sided adhesive tape 198, an elevated top edge 110, and a sidewall 184.

FIG. 152 is a side x-ray and/or parts broken away view of an article of footwear 22 including a shoe upper 23 generally similar to the ones shown in drawing FIGS. 147 and 148 coupled to a sole 32 which is generally similar to the one shown in FIG. 151. The shoe upper 23 and sole 32 are joined with a pressure sensitive double-sided adhesive tape 199.

FIG. 153 is a side x-ray and/or parts broken away view of an article of footwear 22 including a shoe upper 23 generally similar to the ones shown in drawing FIGS. 147 and 148 coupled with an alternative sole 32 generally similar to the one shown in FIG. 151, but further including an opening 72 for receiving a strap 18. Again, the shoe upper 23 and sole 32 are joined with a pressure sensitive double-sided adhesive tape 199.

FIG. 154 is a top view of an alternative sole 32 generally similar to the one shown in FIG. 141, and further including a female receptacle reinforcement 200 which can be made of a thin polyurethane film, a polyester, polyamine, styrene, polypropylene, or other plastic material, a fabric or textile material, a dense foam material, a rubber material, or a thermoplastic elastomer. In this regard, a sole 32 can further include a plurality of female receptacle reinforcements 200 disposed proximate to the other female receptacles 103.

FIG. 155 is a top view of an alternative sole 32 generally similar to the one shown in FIG. 141 further including an alternative embodiment of a female receptacle reinforcement 200 which can be made of a thin polyurethane film, a polyester, polyamine, styrene, polypropylene, or other plastic material, a fabric or textile material, a dense foam material, a rubber material, or a thermoplastic elastomer. As shown, the alternative embodiment of a female receptacle reinforcement 200 extends over most of the top or superior side 37 of the sole 32 and is bonded or otherwise joined thereto.

FIG. 156 is a bottom view of a shoe upper 23 generally similar to the ones shown in drawing FIGS. 140 and 144 including a plurality of slits 82 on the inferior side 38. The location of the plurality of slits 82 match and register with the position of the plurality of hooks 27.1-8 which are included on a lasting plate 79 such as the one shown in drawing FIGS. 131-134. Accordingly, the lasting plate 79 including hooks 27.1-8 can be removably coupled with the bottom or inferior side 38 of the shoe upper 23, and the combination of the shoe upper 23 and lasting plate 79 can then be removably coupled with a sole 32 such as the ones shown in drawing FIGS. 138 and 139. Also shown is an opening in the inferior side of the shoe upper 23 for accommodating the passage of a portion of a fastener 29 such as a push-faster 202 generally similar to the one shown in drawing FIGS. 157-158.

FIG. 157 is a side view of a prior art push-fastener 202 in the open position. As shown, the push-fastener 202 includes a push-pin portion 203 which can be inserted into the body portion 204 and cause it to expand as shown in drawing FIG. 158. Accordingly, a push-fastener 202 can be used to removably secure a lasting plate 79 and shoe upper 23 to a sole 32. The push-fastener 202 generally resemble one made by the Toyota Corporation corresponding to part number 90467-07117. Smaller push-fasteners 202 made by the Toyota Corporation corresponding to part number 90467-07201 can also be used. Many other push-fasteners 202 which can be suitable for use are made by other automobile manufacturers.

FIG. 158 is a side view of the prior art push-fastener 203 shown in drawing FIG. 157 in the closed position. As shown, the push-fastener 202 includes a push-pin portion 203 which can be inserted into the body portion 204 and cause it to expand. Accordingly, a push-fastener 202 can be used to removably secure a lasting plate 79 and shoe upper 23 to a sole 32. Push-fasteners of this type are commonly used to secure automotive trim parts, e.g., by the companies Mazda and Toyota. Other configurations of prior art fasteners can be used for this purpose.

FIG. 159 is a side x-ray and/or parts broken away view of an article of footwear 23 including an alternative sole 32 generally similar to the one shown in drawing FIG. 151 including a top edge 110 which further includes a plurality of notches 201 having U and V shapes. In this regard, the plurality of notches can facilitate the sole 32 bending more easily during flexion and then reduce or eliminate the top edge 110 and/or sidewall 184 portion of the sole 32 from exhibiting much buckling or bulging when the forefoot area 58 of the sole 32 is being flexed during use by a wearer. In this regard, the inclusion of notches in the bottom of a sole 32 and/or on the raised sidewall portion 184 of a sole 32 in the forefoot area 58 for enhancing flexion is disclosed in U.S. Pat. No. 5,384,973 by Lyden which is hereby incorporated by reference herein.

FIG. 160 is a top view of an alternative lasting plate 79 including an independent or separate anterior component 206 and a separate posterior component 207. In this regard, when it is desired to make an anterior component 206 and posterior component 207 of a two-component lasting plate 79 from a substantially inflexible or rigid material, the anterior component 206 can be inserted into the shoe upper 23 and then be joined by mechanical means using hooks 27.1-3, and 27.5-6 and a plurality of mating female receptacles 103 to an anterior portion of the shoe sole 32. The posterior component 207 can then be inserted into the shoe upper 23 and be joined by mechanical means using hooks 27.4, and 27.7-8 and a plurality of mating female receptacles 103 to about posterior portion of the shoe sole 32. In this regard, the anterior component 206 includes a semi-circular extension 208*a* which projects toward the posterior side 34 of the article of footwear 22 which includes a recess 84 and opening 72, and the posterior component 207 also includes a semi-circular extension 208*b* which project towards the anterior side 33 of the article of footwear 22 and overlaps extension 208*a* and it also includes a recess 84 and opening 72, and so when a fastener 29 such as a push-fastener 202 generally similar to the one shown FIGS. 157-158 is inserted through the registered openings 72 in the anterior component 206, posterior component 207, shoe upper 23, and at least a portion of the sole 32 and the push-fastener 202 is actuated by depressing its center pin 203, then all of these recited parts are removably secured together.

FIG. 161 is a top view of an alternative lasting plate which is discontinuous near the front side 77 and back side 78 and also includes larger hooks 27.1 and 27.4 relative to the lasting plate 79 shown in FIG. 131.

FIG. 162 is a top view of an alternative lasting plate generally similar to the one shown in FIG. 161 which is also discontinuous near the front side 77 and back side 78, but which includes larger hooks 27.1 and 27.4 relative to the lasting plate 79 shown in FIG. 161. In this regard, it can be seen that hook 27.1 is approximately even with the top side 75 near the front side 77 of the lasting plate 79, whereas hook 27.4 extends rearwards and beyond the top side 75 near the back side 78 of the lasting plate 79.

FIG. 163 is a top view of an alternative sole insert 108 including a plurality of female receptacles 103 configured as female receptacle inserts 107 disposed in sole 32 for receiving a plurality of hooks 27 of a lasting plate 79. In this regard, the sole insert 108 can be inserted into a mold and be bonded to the sole 32, or otherwise joined so as to be disposed proximate the superior side 37 of the sole 32 and provide a plurality of female receptacle inserts for receiving a plurality of hooks 27 of a lasting plate 79, and also a recess 84 and opening 72 for receiving a fastener 29 such as a push-pin fastener 202 generally similar to the one shown in drawing FIGS. 157 and 158.

FIG. 164 is a side view of an alternative lasting plate 79 including a plurality of hooks 27.1-8 projecting from the bottom side 76 at different angles. In this regard, if and when the lasting plate 79 is inserted into a shoe upper 23, and its hooks 27.1-8 are also inserted through a plurality of registered slits 82 on the inferior side 38 of the shoe upper, and hook 27.1 positioned proximate to its corresponding female receptacle 103, then the other hooks 27.2, 27.3, 27.5, and 27.6 included on the anterior portion 59 of the lasting plate 79 will also be positioned proximate to their corresponding female receptacles 103, and hooks 27.1, 27.2, 27.3, 27.5 and 27.6 can then all be inserted into their corresponding female receptacles 103 simultaneously in order to removably secure the forefoot area 58 of the shoe upper 23 to the sole 32.

The flexible middle portion 60 of the lasting plate 79 which functions as a living hinge can then be grasped with an individual's thumb and first and second fingers and raised upwards to cause the rearfoot area 68 of the shoe upper 23 and hooks 27.4, 27.7, and 27.8 to withdraw enough to permit them to be inserted with guiding downward force into the corresponding mating female receptacles 103 in the rearfoot area 68 of the sole 32. Upon release, the lasting plate 79 can include sufficient resilience and shape memory to be able to spring back into its previous unflexed configuration, or alternatively very nearly so with a small amount of spring tension still being maintained. A fastener 29 such as a push-pin fastener 202 like the one shown in drawing FIGS. 157-158 can then be inserted into the recess 84 and opening 72 in the lasting plate 79 and into a least a partial opening 72 in the sole 32 and be actuated by pushing the pin portion 203 into the expandable body portion 204, thereby removably securing a portion of the shoe upper 23, lasting plate 79 and push-pin fastener 202 to the midfoot area 67 of the sole 32.

It can be seen that hooks 27.1 and 27.4 both include an acute bend which causes a portion of the top surface of these hooks to be disposed nearly parallel to a top or bottom surface of a portion of the lasting plate 79. Hook 27.1 has a free end 28 which faces the front side 77 of the lasting plate 79, whereas hook 27.4 has a free end 28 which faces the back side 78 of the lasting plate 79. For the purpose of differentiating the configuration of hooks 27.1 and 27.4 from the other hooks 27.2, 27.3, 27.5. 27.6, 27.7, and 27.8 which are disposed between hooks 27.1 and 27.4, hooks 27.1 and 27.4 are here described as having a J or L shape. Hooks 25.5 and 25.6 both project from the bottom side 76 of the lasting plate 79 without such an acute bend, but rather at an angle and so do hooks 27.2, 27.3, and these hooks 27.5, 27.6, 27.2, and 27.3 have free ends 28 which face the front side 77 of the lasting plate 79. Hooks 27.7 and 27.8 also project from the bottom side 76 of the lasting plate 79, but these have free ends 28 which instead project rearwards toward the back side 78 of the lasting plate 79. In this embodiment, the downwards angle of hooks 27.5 and 27.6 from the bottom side 76 of the lasting plate 79 can be substantially or actually the same as one another. The downwards angle of hooks 27.2 and 27.3 from the bottom side 76 of the lasting plate 79 can be substantially or actually the same as one another. However, the value of the downwards angle of hooks 27.2 and 27.3 can either be the same as hooks 27.5 and 27.6, or alternatively the value of the downwards angle of hooks 27.2 and 27.3 can different and greater than the value of the downwards angle of hooks 27.5 and 27.6. Hooks 27.7 and 27.8 will typically extend at a different and greater downwards angle from the lasting plate 79 than hooks 27.2, 27.3, and also hooks 27.5 and 27.6. In this regard, the value of the downwards angle from the lasting plate 79 of hooks 27.7 and 27.8 can then be greater than the value of the downwards angle from the lasting plate 79 of hooks 27.2 and 27.3, and the value of the downwards angle from the lasting plate 79 of hooks 27.7 and 27.8 and also 27.2 and 27.3 can then both be greater than the downwards angle from the lasting plate 79 of hooks 27.5 and 27.6.

FIG. 165 is a top view of the alternative lasting plate 79 shown in FIG. 164.

FIG. 166 is a side view of an article of footwear 22 including a shoe upper 23, the lasting plate 79 shown in FIGS. 164 and 165, and a sole 32 which are removably secured together.

FIG. 167 is a side view of an alternative lasting plate including a plurality of hooks projecting from the bottom side at different angles. In this regard, if and when the lasting plate 79 is inserted into a shoe upper 23, and its hooks 27.1-8 are also inserted through a plurality of registered slits 82 on the inferior side 38 of the shoe upper, and hook 27.1 is fully inserted into its corresponding female receptacle 103, then the other hooks 27.2, 27.3, 27.5, and 27.6 included on the anterior portion 59 of the lasting plate 79 will be positioned above and proximate to their corresponding female receptacles 103. The point P1 proximate hook 27.1 then serves as a pivot point, and hooks 27.2, 27.3, 27.5 and 27.6 will then be configured and follow corresponding arcs which are generally consistent with the corresponding radius of curvature that is defined by their individual distances from pivot point P1. The lasting plate 79 can then be rotated downwards from pivot point P1 and the hooks 27.2, 27.3, 27.5 and 27.6 can then be inserted into their corresponding female receptacles 103 in the sole 32 to removably secure the forefoot area 58 of the shoe upper 23 to the sole 32.

In this regard, hook 27.5 which is the closest to pivot point P1 is configured with radius of curvature R1, followed by hook 27.6 which is configured with a larger radius of curvature R2, followed by hook 27.2 which is configured with a larger radius of curvature R3, followed by hook 27.3 which is configured with a larger radius of curvature R4. Because the actual length of the lasting plate 79 and the corresponding distance of the hooks 27.2, 27.3, 27.5, and 27.6 to pivot point P1 is not drawn 100 percent to scale for a sample size 9 or other size of an article of footwear 22, the actual value of the radius of curvature(s) R1-R5 corresponding to the configuration of hooks 27.2, 27.3, 27.5, and 27.6 will be different than what would be measured using drawing FIG. 167, but their relative amount(s) of curvature will be the same, that is, hook 27.5 which is the closest to pivot point P1 is configured with a radius of curvature R1, followed by hook 27.6 which is configured with a larger radius of curvature R2, followed by hook 27.2 which is configured with an even larger radius of curvature R3, followed by hook 27.3 which is configured with an even larger still radius of curvature R4.

The flexible middle portion 60 of the lasting plate 79 which functions as a living hinge can then be grasped with an individual's thumb and first and second fingers and raised upwards to cause the rearfoot area 68 of the shoe upper 23 and hooks 27.4 and 27.7-8 to withdraw enough to permit hook 27.4 to be inserted with guiding downward force into the corresponding mating female receptacle 103 in the rearfoot area 68 of the sole 32, and then hooks 27.7-8 included on the posterior portion 61 of the lasting plate 79 will be positioned above and proximate to their corresponding female receptacles 103. A point which is shown to be proximate hook 27.4 then serves as a pivot point P2, and hooks 27.7 and 27.8 will then be configured and also follow corresponding arcs which are generally consistent with a corresponding radius of curvature that is defined by their individual distances from pivot point P2. The lasting plate 79 can then be rotated downwards from pivot point P2 and hooks 27.7 and 27.8 can be inserted into their corresponding female receptacles 103 in the sole 32 to removably secure the rearfoot area 68 of the shoe upper 23 to the sole 32. Accordingly, hook 27.7 which is the closest to pivot point P2 is configured with a smaller radius of curvature R6 relative to hook 27.8 which is configured with a larger radius of curvature R5. Because the actual length of the lasting plate 79 and the corresponding distance of the hooks 27.7, and 27.8 to pivot point P2 is not drawn 100 percent to scale for a sample size 9 or other size of an article of footwear 22, the actual radius of curvature values of R5 and R6 corresponding to the configuration of hooks 27.7 and 27.8 will be different than what is represented in drawing FIG. 167, but their relative amount(s) of curvature will be the same, that is, hook 27.7 which is the closest to pivot point P2 is configured with a smaller radius of curvature R6 than hook 27.8 which is configured with a greater radius of curvature R5.

Upon release, the lasting plate 79 can include sufficient resilience and shape memory to be able to spring back into its previous unflexed configuration, or alternatively very nearly so with a small amount of spring tension still being maintained. A fastener 29 such as a push-pin fastener 202 like the one shown in drawing FIGS. 157-158 can then be inserted into the recess 84 and opening 72 in the lasting plate 79 and into a least a partial opening 72 in the sole 32 and be actuated by pushing the pin portion 203 into the expandable body portion 204, thereby removably securing a portion of the shoe upper 23, lasting plate 79 and push-pin fastener 202 to the midfoot area 67 of the sole 32.

It can be seen that hooks 27.1 and 27.4 both include an acute bend which causes a portion of the top surface of these hooks to be disposed nearly parallel to a top or bottom surface of a portion of the lasting plate 79. For the purpose of differentiating the configuration of hooks 27.1 and 27.4 from the other hooks 27.2, 27.3, 27.5. 27.6, 27.7, and 27.8 which are disposed between hooks 27.1 and 27.4, hooks 27.1 and 27.4 are here described as having a J or L shape. Hook 27.1 has a free end 28 which faces the front side 77 of the lasting plate 79, whereas hook 27.4 has a free end 28 which faces the back side 78 of the lasting plate 79. Hooks 27.5 and 27.6 both project from the bottom side 76 of the lasting plate 79 without an acute bend, but rather at an angle and so do hooks 27.2 and 27.3 which also have free ends 28 which face the front side 77 of the lasting plate 79. Hooks 27.7 and 27.8 also project from the bottom side 76 of the lasting plate 79, but these have free ends 28 which instead project rearwards toward the back side 78 of the lasting plate 79.

FIG. 168 is a top view of the alternative lasting plate 79 shown in FIG. 167.

FIG. 169 is a side view of an article of footwear 22 including a shoe upper 23, the lasting plate 79 shown in FIGS. 167 and 168, and a sole 32 which are removably secured together.

FIG. 170 is a top view of an alternative lasting plate 79 including two hooks 27.1 and 27.4 and also a plurality of recesses 84 which include openings 79 for receiving mechanical fasteners 29 such as the push-fastener 202 shown in FIGS. 157-158. In this embodiment, the hooks 27.2, 27.3, 27.5, 27.6, 27.7, and 27.8 which are present on the lasting plate 79 shown in FIG. 131 have essentially been eliminated and instead replaced with mechanical fasteners 29 such as push-fasteners 202.

FIG. 171 is a top view of an alternative sole 32 for possible use with the lasting plate 79 shown in FIG. 170 which includes two female receptacles 103 and also a plurality of recesses 84 including openings 72 for receiving mechanical fasteners 29 such as the push-fastener 202 shown in FIGS. 157-158. The area of the sole proximate the recesses 84 can be reinforced and/or include a recess insert 215 which can serve to help retain a mechanical fastener 29 such as a push-fastener 202 generally similar to the one shown in FIGS. 157-158.

FIG. 172 is a side x-ray and/or parts broken away view of an article of footwear 22 which includes the lasting plate 79 shown in FIG. 170 and sole 32 shown in FIG. 171. The configuration of the mechanical fasteners 29 such as the push-fasteners 202 can be changed and also reduced in size. In this embodiment, the lasting plate 79 can be inserted into the shoe upper 23 and hooks 27.1 and 27.4 then be inserted through registered slits 82 on the inferior side 38 of the shoe upper 23. The hook 27.1 on the anterior portion 59 can then be inserted into a corresponding female receptacle 103 in the forefoot area 58 of the sole 32 and the flexible middle portion 60 of the lasting plate 79 can be manipulated as discussed previously to permit the hook 27.4 on the posterior portion 61 of the lasting plate 79 to be inserted into and coupled with a corresponding female receptacle 103 in the rearfoot area 68 of the sole 32. A plurality of mechanical fasteners 29 generally similar to the push-fasteners 202 shown in FIGS. 157-158 can then be inserted into the provided openings 72 in the lasting plate 79 and sole 32 and actuated by pushing the pin portion 203 into the body portion 204 of the push-fasteners 202, thus removably securing the shoe upper 23, lasting plate 79, and sole.

FIG. 173 is a side x-ray and/or parts broken away view of a mold 205 having a front side 77, back side 78, top side 75, bottom side 76, a bottom mold portion 209 which includes a cavity 210, and a front top mold portion 211, a middle top mold portion 212, and a rear top mold portion 213 which can possibly further include a lift out and/or slide portion 214 for making a sole 32 generally similar to the one shown in FIG. 144. During production, the front top mold portion 211, the middle top mold portion 212, and rear top mold portion 213 which can be hinged to the bottom mold portion 209 can be opened and the inside of the mold 205 can include a non-stick surface and/or a mold release agent can be applied. The mold can possibly then be partially filled with recycled foam material or other matter, but also a foam elastomeric material that will blow and then expand to fill the cavity 210 of the mold 205. In the regard, see the following patents directed to mold-making and/or molding footwear soles and including regrind materials: U.S. Pat. Nos. 9,114,580 and 8,653,151 by Skaja et al.; U.S. Pat. Nos. 5,580,507 and 5,435,959 b Williams et al.; U.S. Pat. No. 9,074,061 by Yu; and, U.S. Pat. No. 11,090,863 by Constantinou et al., all of the recited patents hereby being incorporated by reference herein. Alternatively, a moldable plastic or thermoplastic rubber can be injected under pressure into the cavity 210 of the mold 205.

When the foam material or other material has cured then the hinged front top mold portion 211, middle top mold portion 212, and rear top mold portion 213 can be opened and the sole 32 component will then be pulled from the cavity 210 of the mold 205 and the sole 32 component may then still be affixed or mounted on the hook-like or otherwise configured projections which are present on one or more of the front top mold portion 211, middle top mold portion 212, and rear top mold portion 213. Depending upon the flexibility and resilience of the sole 32, it can be possible to seize and pull the rear or posterior portion 34 of the sole 32 to disengage it from the hook-like projections which are associated with the rearfoot area 68, and then push the sole 32 forwards to then disengage the sole 32 from the hook-like projections which face the opposite direction and are associated with the forefoot area 58 and/or midfoot 67 area. However, if and when the sole 32 is not very flexible and resilient, the middle top mold portion 212 can be moved out of the way so that the lift out and/or slide portion 214 of the rear top mold portion 213 can be manipulated to at least partially withdraw the hook-like structures from their corresponding mating female receptacles 103 which have been formed and/or have been included in the sole 32. This process and method can also be used to mold and remove from a mold 205 footwear soles 32 which are made to include a sole insert 108 having a plurality of female receptacles 103, as shown in connection with FIGS. 120 and 163. In any case, the discussed molding method and process can be automated and then not require substantial time and/or labor.

FIG. 174 is a top view of an alternative lasting plate 79 generally similar to the one shown in FIG. 132, which includes longer and/or wider hooks 27.1-27.8.

FIG. 175 is a side view of an alternative lasting plate 79 generally similar to the one shown in FIG. 174.

FIG. 176 is a side view of an alternative article of footwear 22 including an alternative lasting plate 79 generally similar to the ones shown in FIGS. 174-175.

FIG. 177 is a top view of an alternative sole 32 including a sole insert 108 which includes a plurality of female receptacles 103.

FIG. 178 is a top view of an alternative sole 32 including a plurality of female reinforcements 200 and female receptacles 103.

FIG. 179 is a side view of an alternative lasting plate 79 generally similar to the one shown in FIG. 175, and also showing the inclusion of an insole 31.

FIG. 180 is a side view of an alternative lasting plate 79 generally similar to the one shown in FIG. 179, showing the inclusion of an alternative insole 31 which has greater thickness proximate to hook 27.6. This portion of the insole 31 can be disposed under the forefoot area of a wearer's foot in an article of footwear 22 in order to provide additional cushioning.

FIG. 181 is a top view of an alternative lasting plate 79 which includes two separate components, that is, an anterior portion 206 and a posterior portion 207 generally similar to the one shown in FIG. 160, and which includes longer and/or wider hooks 21.1-21.8.

FIG. 182 is a top view of an alternative lasting plate 79 which includes two separate components generally similar to the one shown in FIG. 181, which includes a different configuration where the anterior portion 206 and posterior portion 207 overlap and can be secured.

FIG. 183 is a top view of an alternative lasting plate 79 which includes two separate components generally similar to the one shown in FIG. 181, but having an anterior portion 206 and a posterior portion 207 which do not overlap, and which can be secured by a plurality of fasteners, e.g., two push-pin fasteners 202.

FIG. 184 is a top view of an alternative lasting plate 79 which includes two separate components generally similar to the one shown in FIG. 181, which includes openings 72 in hooks 27.1 and 27.4 for receiving fasteners, e.g. push-pin fasteners 202.

FIG. 185 is a top view of an alternative lasting plate 79 generally similar to the one shown in FIG. 181, but which has larger and wider hooks 27.1 and 27.4 and instead of having individual hooks 21.7 and 27.8 which can be disposed in the rearfoot area 68 of an article of footwear 22 includes a single hook 27.9, and instead of having individual hooks 27.1 and 27.3 which can be disposed in the midfoot area 67 and/or forefoot area 58 of an article of footwear 22 includes a single hook 27.10, and instead of having individual hooks 27.5 and 27.6 which can be disposed in the forefoot area 58 of an article of footwear 22 includes a single hook 27.11. It can be readily understood that the alternative lasting plate 79 hook structures 27.1, 27.4, 27.9, 27.10, and 27.10 shown in drawing FIG. 185 can be used in partial or complete combination with many other structures and alternative lasting plate embodiments and which are shown in the drawing figures and discussed in the specification of the present application, e.g., in combination with a lasting plate 79 which is formed in a single piece and/or one which has a flexible middle portion as shown in drawing FIG. 174, and/or one which is formed in two separate parts which do not overlap a shown in drawing FIG. 183. Further, it can readily understood that the shoe uppers in related alternative embodiments of articles of footwear can include openings and/or slits which are configured to align and mate with hook structures 27.1, 27.4, 27.9, 27.10, and 27.11, and like the like, and also that the soles of these alternative embodiments of articles of footwear can include female receptacles and other structures for mating or coupling with hooks 27.1, 27.4, 27.9, 27.10, 27.11, and/or at least one fastener for selectively and removably coupling or securing an upper, a lasting plate(s) and a sole together to assemble or disassemble these and also other possible components such an insole, and/or strap, and thereby make, change, or renew a customizable and recyclable article of footwear.

FIG. 186 is a side view of the alternative lasting plate 79 shown in FIG. 185.

FIG. 187 is a top view of an alternative lasting plate 79 generally similar to the one shown in FIG. 181, which has a larger and wider hook 27.4 which spans entirely across a posterior portion 61 of the alternative lasting plate 79.

FIG. 188 is a bottom view of an alternative upper 23 including a plurality of slits 82 for receiving and permitting a plurality of hooks 27.1-27.8 of a lasting plate 79 to pass therethrough.

FIG. 189 is a side view of two alternative articles of footwear 22 which are generally similar to those shown in FIG. 130, which have soles 32 with different configurations.

This patent application is directed to creating footwear structures and methods of making articles of footwear which can enable a paradigm shift in the footwear industry. In the 1970's, many companies like Nike, Inc. went to the Far East in order to reduce labor costs associated with manufacturing footwear. Here in the United States, some companies which did not or could not adapt and make this move then went out of business. In this regard, a conventional athletic shoe upper can include over 30 components many of which are sewn together by hand, and the midsole and/or outsole components are also made and permanently cemented together using a labor-intensive process that is not environmentally green. Articles of footwear that were made in the Far East did not necessarily feature value added product differentiation, but they were cheaper and so enjoyed price differentiation.

The applicant believes that the next paradigm shift will involve the return of footwear manufacturing back to the United States. However, in order to accomplish this objective at least three of the following four footwear design and manufacturing challenges, that is, numbers 1, 2, and 4 need to be solved:

1) Footwear uppers need to be made without substantial use of labor, and this can now be done, e.g., with the use of 2D and 3D knitting machines as disclosed by the applicant in U.S. Pat. No. 9,357,813 B2, and other patents which have been incorporated by reference herein;
2) Footwear uppers need to be removably secured to the midsole and/or outsole and/or sole without using a labor-intensive process, e.g., as has been disclosed in the present application and other patents of the applicant which have been incorporation by reference herein;
3) Ideally, the resulting articles of footwear represent value-added products which provide product differentiation, and price differentiation relative to the competition; and,
4) The articles of footwear need to be delivered quickly to customers and the products can then enjoy what can be called case of purchase and delivery differentiation relative to the competition.

When numbers 1, 2, and 4 can be accomplished, then a footwear company will not no longer have the costs associated with shipping from the Far East, tariffs, and also the need to have a large and fixed inventory. Customers will be able to make their selections and order customized footwear products online, and so the footwear company will be able to sell direct. It can then be possible to reduce or eliminate the expenses associated with doing business with third party accounts, but also owning and operating retail stores. Instead, customers will be able to make selections and receive their purchases by 1-2 day, or other delivery rates via Amazon, USPS, UPS, or FEDEX to their own homes in the United States, or other location. Accordingly, the paradigm shift which has been disclosed can be associated with strategic advantages, economic efficiencies, and cost savings for footwear manufacturers and their customers.

INCORPORATION BY REFERENCE

The Applicant is a named inventor on the following patents relating to footwear and/or wheeled skates, U.S. Pat. Nos. 9,775,404, 9,357,813, 8,959,797, 8,209,883, 7,770,306, 7,752,775, 7,464,944, 7,175,187, 7,107,235, 7,016,867, 6,948,264, 6,939,502, D507,094, U.S. Pat. Nos. 6,601,042, 6,449,878, 6,055,746, 5,987,780, 5,921,004, 5,906,872, 5,843,268, 5,832,636, 5,813,146, 5,786,057, 5,729,912, 5,709,954, 5,632,057, 5,625,964, 5,595,004, D374,341, D370,116, U.S. Pat. Nos. 5,425,184, 5,384,973, D347,315, D347,106, U.S. Pat. Nos. 5,203,793, 5,101,580, 4,674,206, and all of these patents are hereby incorporated by reference herein.

Published patents and patent applications regarding various structures, devices and means for securing various components of an article of footwear in functional relation include, e.g., U.S. Pat. Nos. 997,657, 1,219,507, 2,183,277, 2,200,080, 2,220,534, 2,552,943, 2,588,061, 2,640,283, 2,873,540, 3,012,340, 3,373,510, 3,538,628, 3,818,617, 3,846,919, 3,878,626, 3,906,646, 3,982,336, 4,103,440, 4,107,857, 4,132,016, 4,262,434, 4,267,650, 4,279,083, 4,300,294, 4,317,294, 4,351,120, 4,377,042, 4,420,894, 4,535,554, 4,538,368, 4,606,139, 4,747,220, 4,807,372, 4,825,563, 4,850,122, 4,887,369, 5,042,175, 5,083,385, 5,317,822, 5,339,544, 5,367,791, 5,381,610, 5,410,821, 5,533,280, 5,542,198, 5,615,497, 5,628,129, 5,661,915, 5,644,857, 5,657,558, 5,661,915, 5,678,327, 5,692,319, 5,729,916, 5,799,417, 5,822,888, 5,826,352, 5,896,608, 5,991,950, 6,023,857, 6,023,859, 6,145,221, 6,151,805, 6,247,249 B1, 6,282,814 B1, 6,324,772 B1, 6,332,281 B1, 6,349,486 B1, 6,684,532, 6,915,596, 6,931,766, 7,013,583, 7,076,890, 7,114,269, 7,140,129, U.S. 2005/0268491, U.S. 2006/0101671, U.S. 2006/0213088, U.S. 2006/0283050, and patent applications WO 97/46127, WO 02/13641 A1, U.S. Pat. Nos. 7,406,781, 7,730,637, 8,544,189, 8,567,096, 9,955,748, 10,092,063, 10,531,700, and all of these patents and patent applications are hereby incorporated by reference herein.

Published patents and patent applications regarding the possible use of spring devices in articles of footwear, include e.g., U.S. Pat. Nos. 357,062, 968,020, 1,088,328, 1,107,894, 1,113,266, 1,127,456, 1,352,865, 1,370,212, 1,625,048, 2,444,865, 2,447,603, 2,456,102, 2,508,318, 3,333,353, 4,429,474, 4,492,046, 4,314,413, 4,486,964, 4,492,046, 4,506,460, 4,566,206, 4,638,575, 4,771,554, 4,854,057, 4,878,300, 4,942,677, 5,042,175, 5,052,130, 5,060,401, 5,138,776, 5,159,767, 5,187,883, 5,203,095, 5,224,278, 5,279,051, 5,337,492, 5,343,637, 5,343,639, 5,353,523, 5,367,790, 5,381,608, 5,396,718, 5,437,110, 5,461,800, 5,469,638, 5,511,324, 5,517,769, 5,528,842, 5,544,431, 5,596,819, 5,636,456, 5,647,145, 5,649,374, 5,678,327, 5,701,686, 5,706,589, 5,729,916, 5,761,831, 5,822,886, 5,826,350, 5,832,629, 5,860,226, 5,875,567, 5,896,679, 5,937,544, 5,974,695, 5,940,994, 6,006,449, 6,029,374, 6,195,915, 6,195,916, 6,216,365, 6,247,249 B1, 6,282,814 B1, 6,327,795, 6,330,757, 6,324,772 B1, 6,341,432, 6,393,731 B1, 6,416,610, 6,487,796, 6,457,261, 6,546,648, 6,557,271, 6,568,102, 6,598,320, 6,622,401, 6,665,957, 6,694,642, 6,711,834, 6,722,058, 6,749,187, 6,751,891, 6,763,611, 6,807,753, 6,829,848, 6,842,999, 6,851,204, 6,860,034, 6,865,824, 6,880,267, 6,886,274, 6,898,870, 6,920,705, 6,925,732, 6,928,756, 6,944,972, 6,948,262, 6,964,119, 6,964,120, 6,968,636, 6,983,553, 7,013,581, 7,082,698, 7,100,308, 7,100,309, U.S. D434,548, U.S. D450,437, U.S. D462,830, U.S. D472,696, U.S. D483,936, U.S. D474,332, U.S. 2004/0040180, U.S. 2005/0166422, U.S. 2006/0010715, U.S. 2006/0059713, U.S. 2006/0112592, U.S. 2006/0130365, U.S. 2006/0213082, U.S. 2007/0011920, U.S. Pat. No. 10,143,265, French Patent 472,735, Italian Patent 633,409, European Patent Applications EP 0 890 321 A2, EP 1 048 233 A2, EP 1 033 087 A1, EP 1 025 770 A2, EP 1 240 838 A1, and PCT Patent Application WO 98/07341, and all of these patents and patent applications are hereby incorporated by reference herein.

Published patents and patent applications regarding the conduct of Internet or retail business and/or footwear manufacturing include U.S. Pat. No. 5,897,622 granted to Blinn et al., U.S. Pat. No. 5,930,769 granted to Rose, U.S. Pat. No. 5,983,200 granted to Slotznick, U.S. Pat. No. 5,983,201 granted to Fay, U.S. Pat. No. 6,206,750 B1 granted to Barad et al., U.S. Pat. No. 5,206,804 granted to Theis et al., PCT patent application WO 98/18386 by Rami, U.S. Pat. Nos. 5,123,169, 5,128,880, 5,195,030, 5,216,594, 5,231,723, 5,237,520 and 5,339,252 by White or White et al., U.S. Pat. Nos. 4,267,728, 4,598,376, 4,604,807, 4,736,203, 4,800,657, 4,813,436, 5,063,603, 5,164,793, 5,311,357, 5,351,303, 5,483,601, 5,500,802, 6,879,945, 7,089,152, U.S. 2006/0129416, U.S. patent application Ser. No. 09/716,321 by Christopher Cook entitled "System and Method for Sizing Footwear over a Computer Network," assigned to Nike, Inc. which was made of public record in connection with U.S. patent application Ser. No. 10/675,237 that was published as US 2005/0071242 and entitled "Method and System for Custom-Manufacturing Footwear," by Mark Allen and John Tawney assigned to Nike, Inc., U.S. patent application Ser. No. 10/099,685 published as US 2004/0024645 entitled "Custom Fit Sale of Footwear" by Daniel Potter and Allan Schrock, WO 90/05345, WO 94/20020, U.S. Pat. Nos. 9,939,803, 10,028,552, and all of these patents and patent applications are hereby incorporated by reference herein.

Published patents and patent applications regarding the making of uppers for articles of footwear include U.S. Pat. Nos. 5,595,005, 5,604,997, 5,724,753, 5,729,918, 5,785,909, 5,881,413, 5,885,500, 5,909,719, 6,024,712, 6,154,983, 6,237,251, 6,256,824, 6,295,679, 6,299,962, 6,308,438, 6,533,885, 6,986,269, U.S. D374,553, WO 02/13641 A1, WO 02/23641 A1, U.S. 2005/0193592, U.S. 2006/0048413, U.S. 2006/0059715, U.S. 2006/0130359, U.S. 2006/0276095, U.S. 2007/0022627, U.S. Pat. No. 9,545,132, and all of these patents and patent applications are hereby incorporated by reference herein.

Further, patent applications and issued patents regarding three dimensional and/or circular knitting which could possibly be used for making knitted uppers include U.S. Pat. Nos. 1,741,340, 1,889,716, 2,102,368, 2,144,563, 2,333,373, 2,391,064, 2,687,528, 2,771,691, 2,790,975, 3,085,410, 3,102,271, 3,274,709, 3,796,067, 4,253,317, 4,263,793, 4,341,096, 4,520,635, 4,615,188, 4,651,354, 4,732,015, 4,898,007, 5,230,333, 5,771,495, 5,784,721, 5,829,057, 5,946,731, 6,021,527, 6,122,937, 6,154,983, 6,138,281, 6,139,929, 6,230,525, 6,247,182, 6,256,824, 6,286,151, 6,292,951, 6,306,483, 6,314,584, 6,324,874, 6,334,222, 6,336,227, 6,354,114, 6,393,620, 6,446,267, 6,451,144, 6,457,332, EP 0 593 394 A1, D401,758, D403,149, D461,045, U.S. Pat. Nos. 4,194,249, 4,255,949, 4,277,959, 4,373,361, 5,307,522, 5,335,517, 5,560,226, 5,595,005, 5,603,232, 5,724,753, 5,791,163, 5,881,413, 5,909,719, 6,308,438, WO 96/21366, D374,553, U.S. Pat. Nos. 9,681,704, 9,968,156, 9,986,781, 10,130,142, 10,182,617, 10,231,503, 10,294,592, 10,351,979, 10,364,517, 10,378,130, 10,383,388, 10,435,825, 10,458,052, 10,512,296, 10,512,296, 10,548,364, U.S. 2014257719, U.S. 20140310984, U.S. 20140310986, and all of these patents and patents applications are hereby incorporated by reference herein.

Patents relating to fluid-filled bladders which can contain a gas such as ambient air, nitrogen or a so-called "supergas" are disclosed in U.S. Pat. Nos. 4,183,156, and 4,340,626 by Marion F. Rudy, and these patents are hereby being incorporated by reference herein.

Patents relating to closure systems for use in articles of footwear include U.S. Pat. Nos. 9,364,046, 9,565,899, and 10,149,514 by Adams et al., and all of these patents are hereby incorporated by reference herein.

Patents relating to insoles for use in articles of footwear include U.S. Pat. Nos. 4,869,001, 6,233,847, 6,618,960, 6,976,322, 8,341,856, 9,259,050, 9,635,904, 9,655,404, 10,013,711, 10,136,703, 10,172,414, and 10,463,103 which are assigned to Superfeet Worldwide, Inc., and all of these patents are hereby incorporated by reference herein.

Patents relating to mold making and/or methods and processes of molding footwear components such as soles include U.S. Pat. Nos. 9,114,580 and 8,653,151 by Skaja et al.; U.S. Pat. Nos. 5,580,507 and 5,435,959 b Williams et al.; U.S. Pat. No. 9,074,061 by Yu; and, U.S. Pat. No. 11,090,863 by Constantinou et al., and all of these patents are hereby incorporated by reference herein.

The following Clauses provide exemplary configurations for an article of footwear described above and/or methods of making and/or selling an article of footwear.

Clause 1: An article of footwear comprising: an upper comprising an anterior side, a posterior side, a length between said anterior side and said posterior side, a medial side, a lateral side, a superior side, an inferior side, an exterior surface, an interior space, a lasting margin, and a plurality of slits on said inferior side; a lasting plate comprising a top side, a bottom side, a front side, a back side, an edge disposed near said lasting margin within said interior space and extending substantially between said anterior side and said posterior side of said upper, said lasting plate comprising a first plurality of hooks disposed near said front side and extending from said bottom side each comprising a free end which extends towards said front side of said lasting plate, and a second plurality of hooks disposed near said back side and extending from said bottom side each comprising a free end which extends towards said back side of said lasting plate; a sole comprising a plurality of receptacles; whereby at least a portion of said first plurality of hooks and said second plurality of hook extend through said plurality of slits on said inferior side of said upper, and said first plurality of hooks and said second plurality of hooks are mechanically coupled with said sole comprising said plurality of receptacles configured to removably secure said upper, said lasting plate, and said sole.

Clause 2: The article of footwear according to clause 1, wherein said lasting plate comprises an anterior portion, a posterior portion, and a flexible middle portion disposed between and connecting said anterior portion and said posterior portion.

Clause 3: The article of footwear according to clause 1, wherein at least one of said plurality of hooks comprise a J or L shape.

Clause 4: The article of footwear according to clause 1, wherein at least one of said plurality of hooks comprise a curved shape.

Clause 5: The article of footwear according to clause 1, wherein said lasting plate comprises a plurality of projections which extend downwards from said bottom side and near said edge for manipulating the configuration and width of said upper.

Clause 6: The article of footwear according to clause 5, wherein said plurality of projections each comprise a head portion.

Clause 7: The article of footwear according to clause 5, wherein said upper comprises a second plurality of openings on said inferior side, and said plurality of projections are configured to be removably secured to said upper by engagement with said second plurality of openings.

Clause 8: The article of footwear according to clause 7, wherein said second plurality of openings comprises a plurality of sets of openings, and each set includes at least two openings proximate to one another, and said plurality of projections are configured to be engaged with at least one opening of each set of said plurality of sets, said plurality of sets being disposed on each of said medial side and said lateral side of said upper on said inferior side near said lasting margin, and said plurality of sets are spaced apart and disposed along said length of said upper.

Clause 9: The article of footwear according to clause 1, wherein said upper comprises a knitted textile material.

Clause 10: The article of footwear according to clause 1, wherein said sole further comprises a fluid-filled bladder.

Clause 11: The article of footwear according to clause 1, wherein said upper further comprises a heel counter.

Clause 12: The article of footwear according to clause 1, wherein said upper comprises at least one upper opening on said inferior side, and said lasting plate comprises at least one lasting plate recess comprising at least one lasting plate opening, and said sole comprises at least one sole recess comprising at least one sole opening, and at least one removably attachable fastener being disposed in said at least one lasting plate recess and extending through said at least one lasting plate opening in said lasting plate and said at least one upper opening in said inferior side of said upper and into at least a portion of said at least one sole opening in said sole and being mechanically coupled to said sole, and at least a portion of said plurality of hooks extending through said plurality of slits on said inferior side of said upper being mechanically coupled with said plurality of receptacles configured to removably secure said upper, said lasting plate, and said sole.

Clause 13: The article of footwear according to clause 1, and further comprising an insole disposed on said top side of said lasting plate.

Clause 14: The article of footwear according to clause 1, wherein said lasting plate comprises an insole.

Clause 15: The article of footwear according to clause 1, wherein said upper further comprises a closure mechanism selected from the group of closure mechanisms consisting of: laces, straps, openings, eyelets, lace loops.

Clause 16: The article of footwear according to clause 15, wherein said closure mechanism comprises a strap configured to be removably secured to said lasting plate.

Clause 17: The article of footwear according to clause 1, wherein said sole comprises a toe cap.

Clause 18: The article of footwear according to clause 1, wherein said upper further comprises a channel on said exterior side, wherein at least a portion of said sole is removably secured in said channel.

Clause 19: The article of footwear according to clause 1, wherein said first plurality of hooks comprises at least three hooks, and said second plurality of hooks comprises at least two hooks.

Clause 20: The article of footwear according to clause 19, wherein said first plurality of hooks and said second plurality of hooks each extend generally transversely over half of the distance between said medial and lateral sides.

Clause 21: An article of footwear comprising: an upper comprising an anterior side, a posterior side, a length between said anterior side and said posterior side, a medial side, a lateral side, a superior side, an inferior side, an exterior surface, an interior space, a lasting margin, a plurality of slits on said inferior side, and at least one upper opening on said inferior side; a lasting plate comprising a top side, a bottom side, a front side, a back side, an edge disposed near said lasting margin within said interior space and extending substantially between said anterior side and said posterior side of said upper, said lasting plate comprising a plurality of hooks extending from said bottom side, said plurality of hooks comprising a first plurality of hooks each comprising a free end which extends towards said front side of said lasting plate, and a second plurality of hooks each comprising a free end which extends towards said back side of said lasting plate; said lasting plate comprising a shape in a relaxed state and configured to flex under force and subsequently recover said shape when said force is removed; said lasting plate comprising at least one lasting plate recess comprising at least one lasting plate opening;

a sole comprising a sole insert comprising a plurality of receptacles and also at least one sole recess comprising at least one sole opening; at least one removably attachable fastener disposed in said at least one lasting plate recess in said lasting plate and at least partially extending through said at least one lasting plate opening in said lasting plate and said at least one upper opening on said inferior side of said upper and said at least one sole opening in said sole and coupled to said sole, and at least a portion of said plurality of hooks extending through said plurality of slits on said inferior side of said upper, and said plurality of hooks being mechanically coupled with said plurality of receptacles configured to removably secure said upper, said lasting plate, and said sole; and, an insole configured to be disposed at least partially on said top side of said lasting plate.

Clause 22: An article of footwear comprising: an upper comprising an anterior side, a posterior side, a length between said anterior side and said posterior side, a medial side, a lateral side, a superior side, an inferior side, an exterior surface, an interior space, a lasting margin, a plurality of slits on said inferior side, and at least one upper opening on said inferior side; a two-part lasting plate comprising an anterior portion and a posterior portion; said anterior portion comprising a first plurality of hooks extending from a first bottom side, each of said first plurality of hooks comprising a free end which is configured to extend towards said anterior side of said upper; said posterior portion comprising a second plurality of hooks extending from a second bottom side, each of said second plurality of hooks comprising a free end which is configured to extend toward said posterior side of said upper; said anterior portion and said posterior portion each comprising at least one lasting plate recess comprising at least one lasting plate opening;

a sole comprising a plurality of receptacles and also at least one sole recess comprising at least one sole opening; at least one removably attachable fastener disposed in said at least one lasting plate recess and at least a portion of said fastener extending through said at least one lasting plate opening in said lasting plate and said at least one upper opening on said inferior side of said upper and into a portion of said at least one sole opening in said sole and coupled to said sole, and at least a portion of said plurality of hooks extending through said plurality of slits on said inferior side of said upper, and said plurality of hooks being mechanically coupled with said plurality of receptacles configured to removably secure said upper, said lasting plate, and said sole.

Clause 23: An article of footwear comprising: an upper comprising an anterior side, a posterior side, a length between said anterior side and said posterior side, a medial side, a lateral side, a superior side, an inferior side, an exterior surface, an interior space, a lasting margin, a plurality of slits on said inferior side; a two-part lasting plate comprising an anterior portion and a posterior portion; said anterior portion comprising a first plurality of hooks extending from a first bottom side, each of said first plurality of hooks comprising a free end which is configured to extend towards said anterior side of said upper; said posterior portion comprising a second plurality of hooks extending from a second bottom side, each of said second plurality of hooks comprising a free end which is configured to extend toward said posterior side of said upper; a sole comprising a plurality of receptacles; at least a portion of said plurality of hooks extending through said plurality of slits on said inferior side of said upper, and said plurality of hooks being mechanically coupled with said plurality of receptacles configured to removably secure said upper, said lasting plate, and said sole.

Clause 24: The article of footwear according to clause 23, wherein said upper comprises at least one upper opening on said inferior side, and said lasting plate comprises at least one lasting plate recess comprising at least one lasting plate opening, and said sole comprises at least one sole recess comprising at least one sole opening, and at least one removably attachable fastener being disposed in said at least one lasting plate recess and extending through said at least one lasting plate opening in said lasting plate and said at least one upper opening in said inferior side of said upper and into at least a portion of said at least one sole opening in said sole and being mechanically coupled to said sole, and at least a portion of said plurality of hooks extending through said plurality of slits on said inferior side of said upper being mechanically coupled with said plurality of receptacles configured to removably secure said upper, said lasting plate, and said sole.

Clause 25: A method of making an article of footwear comprising: selecting an upper from a plurality of alternative uppers each comprising an anterior side, a posterior side, a length between said anterior side and said posterior side, a medial side, a lateral side, a superior side, an inferior side, an exterior surface, an interior space, a lasting margin, a plurality of slits on said inferior side, and at least one upper opening on said inferior side; selecting a two-part lasting plate from a plurality of alternative two-part lasting plates each comprising an anterior portion comprising a first plurality of hooks extending from a first bottom side, each of said first plurality of hooks comprising a free end which is configured to extend towards said anterior side of said upper, and each of said plurality of alternative two-part lasting plates comprising a posterior portion comprising a second plurality of hooks extending from a second bottom side, each of said second plurality of hooks comprising a free end which is configured to extend toward said posterior side of said upper said anterior portion and said posterior portion each comprising at least one lasting plate recess comprising at least one lasting plate opening; selecting a sole from a plurality of alternative soles each comprising a plurality of receptacles and also at least one sole recess comprising at least one sole opening; selecting at least one removably attachable fastener; selecting an insole from a plurality of alternative insoles; inserting the selected anterior portion into said interior space of the selected upper and causing said first plurality of hooks to pass through a corresponding number of the plurality of slits in said inferior side of said upper; inserting the selected posterior portion into said interior space of the selected upper and causing said second plurality of hooks to pass through a corresponding number of the plurality of slits in said inferior side of said upper; inserting the first plurality of hooks of the combined selected anterior portion and selected upper into a corresponding number of the plurality of receptacles of the selected sole; inserting the second plurality of hooks of the combined selected posterior portion and selected upper into a corresponding number of the plurality of receptacles of the selected sole causing said first plurality of hooks and said second plurality of hooks to be mechanically coupled with said sole comprising said plurality of receptacles; inserting said at least one removably attachable fastener in said at least one lasting plate recess and through said at least one lasting plate opening and said at least one upper opening on said inferior side of said upper and into a portion of said at least one sole opening in said sole and causing at least one selectively removable fastener to be mechanically coupled to said sole; inserting said selected insole into the interior space of said selected upper; thereby removably securing said insole, said upper, said two-part lasting plate, and said sole.

Clause 26: A method of making an article of footwear comprising: selecting an upper from a plurality of alternative uppers each comprising an anterior side, a posterior side, a length between said anterior side and said posterior side, a medial side, a lateral side, a superior side, an inferior side, an exterior surface, an interior space, a lasting margin, a plurality of slits on said inferior side; selecting a two-part lasting plate from a plurality of alternative two-part lasting plates each comprising an anterior portion comprising a first plurality of hooks extending from a first bottom side, each of said first plurality of hooks comprising a free end which is configured to extend towards said anterior side of said upper, and each of said plurality of alternative two-part lasting plates comprising a posterior portion comprising a second plurality of hooks extending from a second bottom side, each of said second plurality of hooks comprising a free end which is configured to extend toward said posterior side of said upper; selecting a sole from a plurality of alternative soles each comprising a plurality of receptacles; inserting the selected anterior portion into said interior space of the selected upper and causing said first plurality of hooks to pass through a corresponding number of the plurality of slits in said inferior side of said upper; inserting the first plurality of hooks of the combined selected anterior portion and selected upper into a corresponding number of the plurality of receptacles of the selected sole; inserting the selected posterior portion into said interior space of the selected upper and causing said second plurality of hooks to pass through a corresponding number of the plurality of slits in said inferior side of said upper and into a corresponding number of the plurality of receptacles of the selected sole; thereby causing said first plurality of hooks and said second plurality of hooks to be mechanically coupled with said sole and removably securing said upper, said two-part lasting plate, and said sole.

Clause 27: An article of footwear comprising: an upper, an anterior side, a posterior side, a length between said anterior side and said posterior side, a medial side, a lateral side, a superior side, an inferior side, an exterior side, an interior side, a lasting margin, a plurality of slits on said inferior side, and an upper opening on said inferior side; a lasting plate comprising a top side, a bottom side, a front side, a back side, an edge disposed near said lasting margin within said interior side and extending substantially between said anterior side and said posterior side of said upper, said lasting plate comprising a plurality of hooks extending from said bottom side, said plurality of hooks comprising a first hook comprising a free end which extends towards said front side of said lasting plate disposed near said front side and a second hook disposed near said back side comprising a free end which extends towards said back side of said lasting plate; said lasting plate comprising a first pivot point P1 proximate said first hook and a second pivot point P2 proximate said second hook; said lasting plate further comprising a plurality of arcuate hooks each being disposed at different distances from said first pivot point P1 proximate said first hook, and/or said second pivot point P2 proximate said second hook, and each of said plurality of arcuate hooks comprising an arcuate configuration defined by an arc generated from a radius extending from one of said first pivot point P1 or said second pivot point P2 to the position of each arcuate hook on said lasting plate; said lasting plate comprising a shape in a relaxed state and configured to flex under force and subsequently recover said shape when said force is removed; said lasting plate comprising a lasting plate recess comprising a lasting plate opening; a sole comprising a plurality of receptacles and also a sole recess comprising a sole opening; a removably attachable fastener disposed in said lasting plate recess and extends through said lasting plate opening in said lasting plate and said upper opening on said inferior side of said upper and into a portion of said sole opening in said sole and coupled to said sole, and at least a portion of said first hook, said second hook, and said plurality of arcuate hooks extend through said plurality of slits on said inferior side of said upper, whereby said first hook, said second hook, and said plurality of arcuate hooks are mechanically coupled with said plurality of said receptacles in said sole thereby removably securing said upper, said lasting plate, and said sole.

Clause 28: An article of footwear comprising: an upper comprising an inferior side comprising a first substantially smooth surface comprising a low, medium or high surface energy; a sole comprising a superior side comprising a second substantially smooth surface comprising a low, medium or high surface energy; and, a double-sided pressure sensitive adhesive tape disposed between said first substantially smooth surface and said second substantially smooth surface and coupling together said upper and said sole.

While the above disclosure of an article of footwear, a method of making the same, and a method of doing business contains many specificities, these should not be construed as limitations on the scope of the disclosure, but rather as exemplifications of several embodiments thereof. It can be readily understood that the various teachings, alternate embodiments, methods and processes disclosed herein can be used in various combinations and permutations. Accordingly, the scope of the invention should be determined not by the embodiments discussed or illustrated, but by the appended claims and their legal equivalents.

Although the present invention has been described with reference to preferred embodiments, workers skilled in the art will recognize that changes may be made in form and detail without departing from the spirit and scope of the invention.

What is claimed is:

1. An article of footwear comprising:

an upper comprising an anterior side, a posterior side, a length between said anterior side and said posterior side, a medial side, a lateral side, a superior side, an inferior side, an exterior surface, an interior space, a lasting margin, and a plurality of slits on said inferior side;

a two-part lasting plate comprising an anterior portion and a posterior portion;

said anterior portion comprising a first edge disposed near said lasting margin within said interior space and a first plurality of hooks extending from a first bottom side, each of said first plurality of hooks comprising a free end which is configured to extend towards said anterior side of said upper;

said posterior portion comprising a second edge disposed near said lasting margin within said interior space and a second plurality of hooks extending from a second bottom side, each of said second plurality of hooks comprising a free end which is configured to extend toward said posterior side of said upper;

a sole comprising a plurality of receptacles;

said upper further comprising at least one upper opening on said inferior side, and at least one of said anterior portion and said posterior portion of said two-part lasting plate comprises at least one lasting plate recess comprising at least one lasting plate opening, and said sole comprises at least one sole recess, and at least one removably attachable fastener being disposed in said at least one lasting plate recess and extending through said at least one lasting plate opening in said at least one of said anterior portion and said posterior portion of said two-part lasting plate and said at least one upper opening in said inferior side of said upper and into at least a portion of said at least one sole recess in said sole and being mechanically coupled to said sole;

at least a portion of said first plurality of hooks and said second plurality of hooks extending through said plurality of slits on said inferior side of said upper; and, said first plurality of hooks and said second plurality of hooks being mechanically coupled with said sole comprising said plurality of receptacles configured to removably secure said upper, said two-part lasting plate, and said sole.

2. The article of footwear according to claim 1, wherein said two-part lasting plate further comprises a flexible middle portion disposed between and connecting said anterior portion and said posterior portion.

3. The article of footwear according to claim 1, wherein at least one of said plurality of hooks comprises a curved shape.

4. The article of footwear according to claim 1, wherein at least one of said anterior portion and/or said posterior portion of said two-part lasting plate comprises a plurality of projections which extend downwards from said bottom side and near at least one of said first edge and/or said second edge for manipulating the configuration and width of said upper.

5. The article of footwear according to claim 4, wherein said upper comprises a second plurality of openings on said inferior side, and said plurality of projections are configured to be removably secured to said upper by engagement with said second plurality of openings.

6. The article of footwear according to claim 5, wherein said second plurality of openings comprises a plurality of sets of openings, and each set includes at least two openings proximate to one another, and said plurality of projections are configured to be engaged with at least one opening of each set of said plurality of sets, said plurality of sets being disposed on each of said medial side and said lateral side of said upper on said inferior side near said lasting margin, and said plurality of sets are spaced apart and disposed along said length of said upper.

7. The article of footwear according to claim 1, wherein said upper comprises at least one of a knitted textile material, a woven material, a non-woven material, a natural material made of cotton, hemp, wool, or leather, or a synthetic leather material, thermoplastic, or thermoset rubber material.

8. The article of footwear according to claim 1, and further comprising a double-sided adhesive tape disposed between said inferior side of said upper and said sole.

9. The article of footwear according to claim 1, and further comprising a heel counter.

10. The article of footwear according to claim 1, wherein said at least one sole recess comprises a sole opening, whereby a portion of said at least one removably detachable fastener extends through said sole.

11. The article of footwear according to claim 1, and further comprising an insole.

12. The article of footwear according to claim 1, wherein said upper further comprises a closure mechanism selected from the group of closure mechanisms consisting of: laces, straps, openings, eyelets, and lace loops.

13. The article of footwear according to claim 1, wherein said sole comprises a toe cap.

14. The article of footwear according to claim 1, wherein said upper further comprises a channel on said exterior side, wherein at least a portion of said sole is removably secured in said channel.

15. The article of footwear according to claim 1, wherein said first plurality of hooks comprises at least three hooks, and said second plurality of hooks comprises at least two hooks.

16. The article of footwear according to claim 15, wherein said first plurality of hooks and said second plurality of hooks each extend generally transversely over half of the distance between said medial and lateral sides.

17. An article of footwear comprising:

an upper comprising an anterior side, a posterior side, a length between said anterior side and said posterior side, a medial side, a lateral side, a superior side, an inferior side, an exterior surface, an interior space, a lasting margin, a plurality of slits on said inferior side;

a two-part lasting plate comprising an anterior portion and a posterior portion and a flexible middle portion disposed between and connecting said anterior portion and said posterior portion;

said anterior portion comprising a first plurality of hooks extending from a first bottom side, each of said first plurality of hooks comprising a free end which is configured to extend towards said anterior side of said upper;

said posterior portion comprising a second plurality of hooks extending from a second bottom side, each of said second plurality of hooks comprising a free end which is configured to extend toward said posterior side of said upper;

a sole comprising a plurality of receptacles;

said upper further comprising at least one upper opening on said inferior side, and at least one of said anterior portion and said posterior portion of said two-part lasting plate comprises at least one lasting plate recess comprising at least one lasting plate opening, and said sole comprises at least one sole recess, and at least one removably attachable fastener being disposed in said at least one lasting plate recess and extending through said at least one lasting plate opening in said at least one of said anterior portion and said posterior portion of said two-part lasting plate and said at least one upper opening in said inferior side of said upper and into at least a portion of said at least one sole recess in said sole and being mechanically coupled to said sole;

at least a portion of said first plurality of hooks and said second plurality of hooks extending through said plurality of slits on said inferior side of said upper; and, said first plurality of hooks and said second plurality of hooks being mechanically coupled with said plurality of receptacles configured to removably secure said upper, said two-part lasting plate, and said sole.

18. The article of footwear according to claim 17, wherein said at least one sole recess comprises a sole opening, whereby a portion of said at least one removably detachable fastener extends through said sole.

19. A method of making an article of footwear comprising: selecting an upper from a plurality of alternative uppers each comprising an anterior side, a posterior side, a length between said anterior side and said posterior side, a medial side, a lateral side, a superior side, an inferior side, an exterior surface, an interior space, a lasting margin, a plurality of slits and at least one upper opening on said inferior side;

selecting a two-part lasting plate from a plurality of alternative two-part lasting plates each comprising an anterior portion comprising a first lasting plate recess comprising a first lasting plate opening and also a first plurality of hooks extending from a first bottom side, each of said first plurality of hooks comprising a free end which is configured to extend towards said anterior side of said upper, and each of said plurality of alternative two-part lasting plates comprising a posterior portion comprising a second lasting plate recess comprising a second lasting plate opening and also a second plurality of hooks extending from a second bottom side, each of said second plurality of hooks comprising a free end which is configured to extend toward said posterior side of said upper;

selecting a sole from a plurality of alternative soles each comprising at least one sole recess and also a plurality of receptacles;

selecting at least one removably attachable fastener;

selecting an insole from a plurality of alternative insoles;

inserting the selected anterior portion into said interior space of said upper and causing said first plurality of hooks to pass through a corresponding number of the plurality of slits in said inferior side of said upper;

inserting the first plurality of hooks of the combined selected anterior portion and said upper into a corresponding number of the plurality of receptacles of said sole;

inserting said posterior portion into said interior space of said upper and causing said second plurality of hooks to pass through a corresponding number of the plurality of slits in said inferior side of said upper and into a corresponding number of the plurality of receptacles of said sole thereby causing said first plurality of hooks and said second plurality of hooks to be mechanically coupled with said sole;

inserting a portion of said at least one fastener in said first lasting plate recess and said second lasting plate recess and through said first lasting plate opening and said second lasting plate opening and said at least one upper opening in said inferior side of said upper and into at least a portion of said at least one sole recess in said sole and causing said at least one fastener to be mechanically coupled to said sole thereby removably securing said upper, said two-part lasting plate, and said sole; and, inserting said insole into said interior space of said upper.

20. The method of making an article of footwear according to claim 19, wherein said at least one sole recess comprises a sole opening, whereby a portion of said at least one removably detachable fastener extends through said sole.

* * * * *